US009928684B2

(12) United States Patent
Okada et al.

(10) Patent No.: US 9,928,684 B2
(45) **Date of Patent: *Mar. 27, 2018**

(54) GAME INFORMATION INTEGRATION SYSTEM

(71) Applicants: Universal Entertainment Corporation, Koto-ku, Tokyo (JP); Aruze Gaming America, Inc., Las Vegas, NV (US)

(72) Inventors: Kazuo Okada, Tokyo (JP); Kengo Takeda, Tokyo (JP)

(73) Assignees: Universal Entertainment Corporation, Tokyo (JP); Aruze Gaming America, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/201,640

(22) Filed: Jul. 5, 2016

(65) Prior Publication Data

US 2016/0371923 A1 Dec. 22, 2016

Related U.S. Application Data

(62) Division of application No. 13/878,214, filed as application No. PCT/JP2011/072352 on Sep. 29, 2011, now Pat. No. 9,401,067.

(30) Foreign Application Priority Data

Oct. 7, 2010 (JP) ..... 2010-227201
Nov. 11, 2010 (JP) ..... 2010-253094

(51) Int. Cl.
*A63F 9/24* (2006.01)
*G07F 17/32* (2006.01)

(52) U.S. Cl.
CPC ..... *G07F 17/3239* (2013.01); *G07F 17/3211* (2013.01); *G07F 17/3237* (2013.01); *G07F 17/3241* (2013.01); *G07F 17/3244* (2013.01)

(58) Field of Classification Search
CPC ..... G07F 17/3239; G07F 17/3234; G07F 17/3211
See application file for complete search history.

(56) References Cited

U.S. PATENT DOCUMENTS

2004/0127277 A1* 7/2004 Walker ..... G07F 17/32 463/16
2006/0281544 A1* 12/2006 Frattinger ..... G07F 17/32 463/29

(Continued)

*Primary Examiner* — Steve Rowland
(74) *Attorney, Agent, or Firm* — Potomac Law Group, PLLC; Kenneth Fagin

(57) ABSTRACT

The present application provides a game playing information integration system which is capable of objectively performing selection and/or settings according to preference of a player, particularly fixed customers, and thereby capable of effectively introducing a gaming machine to invoke demands of players as users and managers of gaming facilities in a well-balanced manner from a result obtained by logically analyzing the gaming machine. (a) Game playing period at one time of each player in gaming machine unit, (b) change in balance over time of player in a game playing period, (c) operation time of the gaming machine unit, and (d) data relating to profit of a shop side by the gaming machine are generated, the degree of satisfaction of player is computed based on (a) and (b), and the degree of satisfaction of a shop side is computed based on (c) and (d).

2 Claims, 127 Drawing Sheets

(56) References Cited

U.S. PATENT DOCUMENTS

| | | | | |
|---|---|---|---|---|
| 2007/0182818 | A1* | 8/2007 | Buehler | G08B 13/19602 348/143 |
| 2008/0261699 | A1* | 10/2008 | Topham | G07F 17/32 463/42 |
| 2010/0228526 | A1* | 9/2010 | Moore, III | G06Q 30/02 703/1 |
| 2011/0183732 | A1* | 7/2011 | Block | G06Q 30/02 463/1 |
| 2011/0306400 | A1* | 12/2011 | Nguyen | G07F 17/3218 463/20 |
| 2012/0190421 | A1* | 7/2012 | Ruppert | G07F 17/3234 463/17 |

* cited by examiner

FIG. 7

| Type of reception data | Contents of reception data | Reception time | Player identification information | Gaming machine unit identification information | Flag indicating play of game in progress | Playing time |
|---|---|---|---|---|---|---|
| Game initiation | (100000) | 2009/11/12 10:25:00 | P01 | M01 | ○ | — |
| Game initiation | (50000) | 2009/11/12 10:25:05 | P02 | M05 | ○ | — |
| ⋮ | ⋮ | ⋮ | ⋮ | ⋮ | ⋮ | ⋮ |
| Number-of-consumptions data | −30 | 2009/11/12 10:25:30 | P01 | M01 | — | — |
| Number-of-consumptions data | −30 | 2009/11/12 10:25:35 | P02 | M05 | — | — |
| Number of payouts | 100 | 2009/11/12 10:25:38 | P01 | M01 | — | — |
| Number of payouts | 1500 | 2009/11/12 10:25:43 | P02 | M05 | — | — |
| Number-of-consumptions data | −30 | 2009/11/12 10:25:44 | P01 | M01 | — | — |
| Number-of-consumptions data | −30 | 2009/11/12 10:25:45 | P02 | M05 | — | — |
| Number of payouts | 200 | 2009/11/12 10:28:50 | P01 | M01 | — | — |
| Number of payouts | 0 | 2009/11/12 10:29:00 | P02 | M05 | — | — |
| ⋮ | ⋮ | ⋮ | ⋮ | ⋮ | ⋮ | ⋮ |
| Liquidation | (120000) | 2009/11/12 12:15:50 | P01 | M01 | × | 1:50:50 |
| ⋮ | ⋮ | ⋮ | ⋮ | ⋮ | ⋮ | ⋮ |
| Liquidation | (40000) | 2009/11/12 12:30:00 | P02 | M05 | × | 2:04:55 |
| ⋮ | ⋮ | ⋮ | ⋮ | ⋮ | ⋮ | ⋮ |

FIG.8A

| Gaming machine unit identification information | Date | (a) Playing time per player, visit and play | (b) Change with elapse of time in balance of the player (balance after correction) | (c) Operation time of gaming machine | (d) Profit on the shop side by gaming machine |
|---|---|---|---|---|---|
| M01 | 2009/11/12 | 3:10:00 | 60000 | 12:10:00 | 34000 |
| | ⋮ | ⋮ | ⋮ | ⋮ | ⋮ |
| M05 | 2009/11/12 | 1:50:00 | −10000 | 4:30:00 | 15000 |
| | ⋮ | ⋮ | ⋮ | ⋮ | ⋮ |
| ⋮ | ⋮ | ⋮ | ⋮ | ⋮ | ⋮ |

FIG.8B

| Player identification information | (a') Visit frequency | (b') Consumed amount of money per visit |
|---|---|---|
| P01 | One time/3.5 days | 20000 |
| P02 | One time/5.4 days | 15000 |
| ⋮ | ⋮ | ⋮ |

FIG.8C

| Gaming machine unit identification information | (c') Operability | (d') Gross profit |
|---|---|---|
| M01 | 78% | 10000 |
| M05 | 55% | 15000 |
| ⋮ | ⋮ | ⋮ |

FIG.9A

| Gaming machine unit identification information | Date | Degree of satisfaction of player | Degree of satisfaction of gaming facility |
|---|---|---|---|
| M01 | 2009/11/12 | 55 | 60 |
| | ⋮ | ⋮ | ⋮ |
| ⋮ | ⋮ | ⋮ | ⋮ |
| M05 | 2009/11/12 | 52 | 58 |
| | ⋮ | ⋮ | ⋮ |
| ⋮ | ⋮ | ⋮ | ⋮ |

FIG.9B

| Player identification information | Date | Evaluation points of life cycle of player | | Group | Pattern |
|---|---|---|---|---|---|
| | | Visit frequency | Consumed-amount-of money | | |
| P01 | 2009/11/12 | 48 | 55 | C | 2 |
| | ⋮ | ⋮ | ⋮ | ⋮ | ⋮ |
| P02 | 2009/11/12 | 47 | 52 | C | 2 |
| | ⋮ | ⋮ | ⋮ | ⋮ | ⋮ |
| ⋮ | ⋮ | ⋮ | ⋮ | ⋮ | ⋮ |

FIG.9C

| Gaming machine unit identification information | Date | Date Evaluation points of life cycle of gaming machine | | Group | Pattern |
|---|---|---|---|---|---|
| | | Operability | Gross profit | | |
| M01 | 2009/11/12 | 48 | 47 | D | 3 |
| | ⋮ | ⋮ | ⋮ | ⋮ | ⋮ |
| ⋮ | ⋮ | ⋮ | ⋮ | ⋮ | ⋮ |
| M05 | 2009/11/12 | 42 | 45 | D | 3 |
| | ⋮ | ⋮ | ⋮ | ⋮ | ⋮ |
| ⋮ | ⋮ | ⋮ | ⋮ | ⋮ | ⋮ |

FIG. 33

| Type of reception data | Contents of reception data | Reception time | Player identification information | Gaming machine unit identification information | Flag indicating play of game in progress |
|---|---|---|---|---|---|
| Consumed-amount-of-money data | 1,000 Yen | 2009/11/12 10:25:30 | P01 | M01 | ○ |
| Consumed-amount-of-money data | 1,000 Yen | 2009/11/12 10:26:00 | P02 | M05 | ○ |
| Consumed-amount-of-money data | 1,000 Yen | 2009/11/12 10:45:50 | P01 | M01 | — |
| Consumed-amount-of-money data | 1,000 Yen | 2009/11/12 10:46:30 | P02 | M05 | — |
| Consumed-amount-of-money data | 1,000 Yen | 2009/11/12 11:08:50 | P01 | M01 | — |
| Consumed-amount-of-money data | 1,000 Yen | 2009/11/12 11:40:30 | P02 | M05 | — |
| ⋮ | ⋮ | ⋮ | ⋮ | ⋮ | ⋮ |
| Amount-of-sales data | 1,0000 Yen | 2009/11/12 13:15:50 | P01 | M01 | × |
| Amount-of-sales data | 7,500 Yen | 2009/11/12 13:30:00 | P02 | M05 | × |
| ⋮ | ⋮ | ⋮ | ⋮ | ⋮ | ⋮ |

FIG.34A

| Type of reception data | Contents of reception data | reception Time | Player identification information | Gaming machine unit identification information | Flag indicating play of game in progress | Service time flag | Game playing time |
|---|---|---|---|---|---|---|---|
| Number-of-consumptions data | 250 | 2009/11/12 10:25:30 | P01 | M01 | ○ | × | — |
| Number-of-consumptions data | 250 | 2009/11/12 10:26:00 | P02 | M05 | ○ | ○ | — |
| Start | 6 Times per minute | 2009/11/12 10:26:50 | P01 | M01 | — | × | — |
| Start | 6 Times per minute | 2009/11/12 10:27:30 | P02 | M05 | — | ○ | — |
| Start | 6 Times per minute | 2009/11/12 10:27:50 | P01 | M01 | — | × | — |
| Start | 6 Times per minute | 2009/11/12 10:28:30 | P02 | M05 | — | ○ | — |
| Start | 6 Times per minute | 2009/11/12 10:28:50 | P01 | M01 | — | × | — |
| Special prize | In generation | 2009/11/12 10:29:00 | P02 | M05 | — | ○ | — |
| ⋮ | ⋮ | ⋮ | ⋮ | ⋮ | ⋮ | ⋮ | ⋮ |
| Liquidation | (4000) | 2009/11/12 12:15:50 | P01 | M01 | × | × | 1:50:20 |
| ⋮ | ⋮ | ⋮ | ⋮ | ⋮ | ⋮ | ⋮ | ⋮ |
| Liquidation | (3000) | 2009/11/12 12:30:00 | P02 | M05 | × | ○ | 2:14:00 |
| ⋮ | ⋮ | ⋮ | ⋮ | ⋮ | ⋮ | ⋮ | ⋮ |

FIG.34B

| Gaming machine unit identification information | Device type | Model (classification by machine probability) | Model (classification by gadget type) | Model (classification by big hit specification) | Mount identification information | New device type flag | Service time flag |
|---|---|---|---|---|---|---|---|
| M01 | A | Max type | Mixed machine | Small hit incorporation | G01 | X | X |
| M02 | A | Max type | Mixed machine | Small hit incorporation | G01 | X | X |
| M03 | A | Max type | Mixed machine | Small hit incorporation | G01 | X | X |
| M04 | B | Medium type | Ordinary machine | Sudden probability change incorporation | G01 | X | X |
| M05 | B | Medium type | Ordinary machine | Sudden probability change incorporation | G01 | X | X |
| M06 | B | Medium type | Ordinary machine | Sudden probability change incorporation | G01 | X | X |
| M07 | C | Easy big hit digital type | Gadget type | Sudden probability change incorporation | G01 | O | O |
| M08 | C | Easy big hit digital type | Gadget type | Sudden probability change incorporation | G01 | O | O |
| ⋮ | ⋮ | ⋮ | ⋮ | ⋮ | | ⋮ | ⋮ |

FIG. 35

| | Gaming machine unit identification information | Big hit deviation and frequency (average and standard deviation) | Characteristics (wave of winning pachinko balls) | Characteristics (movement of winning pachinko ball slump graph) | Operation time rate per day | Number of game playing customers per day | Average game playing time per player (minute) | Business dividing number (total time) | Business dividing number (service time) | Operability | Stability | Attraction power value of new device type |
|---|---|---|---|---|---|---|---|---|---|---|---|---|
| Type other than new device type | M01 | 6.8 Times ± 3.6 Times per day | Large | • | 86.54 | 4.5 | 150 | 13.5 | 12.2 | 90.43 | 65 | — |
| | M02 | 6.8 Times ± 4.2 Times per day | Large | • | 82.56 | 4.6 | 140 | 13.2 | 12.3 | 87.11 | 55 | — |
| | M03 | 6.8 Times ± 3.8 Times per day | Large | • | 81.67 | 4.9 | 130 | 12.9 | 12.7 | 85.02 | 40 | — |
| | M04 | 7.2 Times ± 2.6 Times per day | Small | • | 14.10 | 1.1 | 100 | 13.0 | 12.4 | 13.96 | 5 | — |
| | M05 | 7.1 Times ± 2.4 Times per day | Small | • | 13.85 | 1.2 | 90 | 12.7 | 12.4 | 13.67 | -10 | — |
| | M06 | 7.3 Times ± 1.9 Times per day | Small | • | 13.46 | 1.5 | 70 | 13.4 | 12.3 | 13.34 | 5 | — |
| | ⋮ | ⋮ | ⋮ | ⋮ | ⋮ | ⋮ | ⋮ | ⋮ | ⋮ | ⋮ | ⋮ | ⋮ |
| New device type | M07 | 6.8 Times ± 2.5 Times per day | Medium | • | 95.90 | 2.2 | 340 | 14.8 | 13.1 | 110.47 | — | Large |
| | M08 | 6.8 Times ± 2.6 Times per day | Medium | • | 92.31 | 2.4 | 300 | 15.2 | 13.2 | 105.60 | — | Large |
| | ⋮ | ⋮ | ⋮ | ⋮ | ⋮ | ⋮ | ⋮ | ⋮ | ⋮ | ⋮ | ⋮ | ⋮ |

FIG. 36

| Device type | Gaming machine unit identification information | Target dividing number | Number of fixed customers | Number-of-fixed-customers alarm flag | Setup rate | Appropriate setup rate | Setup rate alarm flag |
|---|---|---|---|---|---|---|---|
| A | M01 | 13.3 | 80 | × | 10% | 9-13% | × |
| | M02 | | | | | | |
| | M03 | | | | | | |
| B | M04 | 13.2 | 8 | ○ | 8% | 0-2% | ○ |
| | M05 | | | | | | |
| | M06 | | | | | | |
| C | M07 | 16.0 | — | — | 12% | 15-18% | ○ |
| | M08 | | | | | | |
| ⋮ | ⋮ | ⋮ | ⋮ | ⋮ | ⋮ | ⋮ | ⋮ |

FIG. 37

| Player identification information | Customer category data | Member name | Local area | Sex | Age | Occupation | Average use amount of money | Average game playing time (minute) | Average visit frequency | Average amount of money lost |
|---|---|---|---|---|---|---|---|---|---|---|
| P01 | Fixed customer | ○○ | ○○ | ○○ | ○○ | ○○ | 18000 | 200 | 2.2 Days per time | 10000 |
| P02 | Fixed customer | ●● | ●● | ●● | ●● | ●● | 20000 | 210 | 1.3 Days per time | 18000 |
| P03 | Fixed customer | △△ | △△ | △△ | △△ | △△ | 25000 | 240 | 3.2 Days per time | 23000 |
| P04 | Unfixed customer | — | — | — | — | — | 13000 | 120 | 10.9 Days per time | 11000 |
| P05 | Unfixed customer | — | — | — | — | — | 10000 | 100 | 12.1 Days per time | 9000 |
| P06 | Unfixed customer | — | — | — | — | — | 8000 | 60 | 17.2 Days per time | 6000 |
| P07 | Novice | — | — | — | — | — | 2000 | 20 | 31 Days per time | 2000 |
| P08 | Novice | — | — | — | — | — | 3000 | 30 | 24 Days per time | 3000 |
| ⋮ | ⋮ | ⋮ | ⋮ | ⋮ | ⋮ | ⋮ | ⋮ | ⋮ | ⋮ | ⋮ |

FIG. 50

| Gaming machine comparison table | | | | | | | | | | | |
|---|---|---|---|---|---|---|---|---|---|---|---|
| Stability | | Operability | | | | | | | | | |
| | | <30 | <40 | <50 | <60 | <70 | <80 | <90 | <100 | <110 | 110≦ |
| Sales dividing number | <11.0 | -30 | -20 | -10 | -10 | -10 | -10 | -10 | -10 | -10 | -10 |
| | <12.0 | -20 | -10 | -10 | -10 | -10 | -10 | -10 | -10 | -10 | 0 |
| | <13.0 | -10 | -10 | -10 | -10 | -10 | -10 | -10 | -10 | -5 | 5 |
| | <13.5 | 5 | 15 | 25 | 35 | 45 | 50 | 55 | 60 | 65 | 75 |
| | <14.0 | 10 | 20 | 30 | 40 | 50 | 55 | 60 | 65 | 70 | 80 |
| | <15.0 | 0 | 10 | 20 | 30 | 40 | 45 | 50 | 55 | 60 | 70 |
| | <16.0 | -10 | 0 | 10 | 20 | 30 | 35 | 40 | 45 | 50 | 60 |
| | <17.0 | -10 | 0 | 10 | 20 | 30 | 35 | 40 | 45 | 50 | 60 |
| | <18.0 | -20 | -10 | 0 | 10 | 20 | 25 | 30 | 35 | 40 | 50 |
| | 18.0≦ | -30 | -20 | -10 | 0 | 10 | 15 | 20 | 25 | 30 | 40 |

FIG. 51

| Gaming facility comparison table | | | | | | | | | | | |
|---|---|---|---|---|---|---|---|---|---|---|---|
| Stability | | Operability | | | | | | | | | |
| | | 0<30 | 30<40 | 40<50 | 50<60 | 60<70 | 70<80 | 80<90 | 90<100 | 100<110 | 110< |
| Sales dividing number | <11.0 | -70 | -60 | -50 | -40 | -30 | -20 | -10 | -10 | -10 | -10 |
| | 11.0<12.0 | -60 | -50 | -40 | -30 | -20 | -10 | -10 | -10 | -10 | -10 |
| | 12.0<13.0 | -50 | -40 | -30 | -20 | -10 | -10 | -10 | -10 | -10 | -10 |
| | 13.0<13.5 | -40 | -30 | -20 | -10 | 0 | -10 | -10 | -10 | -10 | -10 |
| | 13.5<14.0 | -30 | -20 | -10 | 0 | 10 | 20 | 30 | 40 | 50 | 60 |
| | 14.0<15.0 | -20 | -10 | 0 | 10 | 20 | 30 | 40 | 50 | 60 | 70 |
| | 15.0<16.0 | -20 | -10 | -10 | -10 | -10 | 0 | 10 | 20 | 30 | 40 |
| | 16.0<17.0 | -50 | -40 | -30 | -20 | -10 | -10 | -10 | -10 | -10 | -10 |
| | 17.0<18.0 | -60 | -50 | -40 | -30 | -20 | -10 | -10 | -10 | -10 | -10 |
| | 18.0< | -70 | -60 | -50 | -40 | -30 | -20 | -10 | -10 | -10 | -10 |

FIG. 53

| Elapsed days | Number of shops | Shop average operation | Average operation of device type A | Shop operation deviation rate | Sales by machine | Gross profit by machine | Coin unit price | Gross profit rate |
|---|---|---|---|---|---|---|---|---|
| Day 1 | 110 | 11,588 | 23,212 | 200.3% | 48,222 | 2,303 | 2.08 | 4.8% |
| Day 2 | 132 | 11,114 | 22,447 | 202.0% | 48,871 | 2,187 | 2.18 | 4.5% |
| Day 3 | 119 | 11,929 | 22,412 | 187.9% | 49,529 | 4,488 | 2.21 | 9.1% |
| Day 4 | 95 | 10,435 | 19,890 | 190.6% | 47,756 | 7,583 | 2.40 | 15.9% |
| Day 5 | 62 | 11,317 | 20,397 | 180.2% | 47,264 | 8,490 | 2.32 | 18.0% |
| Day 6 | 48 | 12,641 | 21,741 | 172.0% | 51,753 | 5,290 | 2.38 | 10.2% |
| Day 7 | 43 | 12,134 | 21,231 | 175.0% | 50,919 | 7,814 | 2.40 | 15.3% |
| Day 8 | 34 | 11,174 | 18,042 | 161.5% | 41,958 | 3,615 | 2.33 | 8.6% |
| Day 9 | 23 | 11,603 | 19,898 | 171.5% | 45,962 | 8,276 | 2.31 | 18.0% |
| Day 10 | 14 | 11,312 | 19,609 | 173.3% | 42,491 | 3,000 | 2.17 | 7.1% |
| Day 11 | 11 | 11,759 | 17,501 | 148.8% | 38,479 | 4,854 | 2.20 | 12.6% |
| Day 12 | 3 | 14,335 | 21,780 | 151.9% | 55,118 | 18,842 | 2.53 | 34.2% |
| Day 13 | 1 | 16,637 | 24,838 | 149.3% | 57,500 | 14,300 | 2.32 | 24.9% |

FIG. 54

| Elapsed days | Number of shops | Shop average operation | Average operation of device type A | Shop operation deviation rate | Sales by machine | Gross profit by machine | Coin unit price | Gross profit rate |
|---|---|---|---|---|---|---|---|---|
| Day 1 | 33 | 12,027 | 22,726 | 189.0% | 47,706 | 4,688 | 2.10 | 9.8% |
| Day 2 | 43 | 11,338 | 23,147 | 204.1% | 48,910 | −601 | 2.11 | −1.2% |
| Day 3 | 37 | 12,056 | 22,528 | 186.9% | 49,469 | 3,284 | 2.20 | 6.6% |
| Day 4 | 31 | 10,928 | 21,082 | 192.9% | 48,809 | 10,862 | 2.32 | 22.3% |
| Day 5 | 22 | 11,516 | 20,273 | 176.0% | 46,201 | 6,280 | 2.28 | 13.6% |
| Day 6 | 15 | 12,862 | 21,014 | 163.4% | 48,420 | 2,697 | 2.30 | 5.6% |
| Day 7 | 9 | 12,444 | 19,820 | 159.3% | 55,194 | 17,400 | 2.78 | 31.5% |
| Day 8 | 5 | 10,574 | 15,974 | 151.1% | 39,146 | 2,199 | 2.45 | 5.6% |
| Day 9 | 3 | 9,347 | 18,507 | 198.0% | 45,822 | −3,467 | 2.48 | −7.6% |
| Day 10 | 1 | 12,563 | 22,909 | 182.4% | 42,700 | −20,600 | 1.86 | −48.2% |
| Day 11 | 2 | 11,148 | 17,028 | 152.7% | 46,591 | 23,191 | 2.74 | 49.8% |
| Day 12 | 1 | 21,014 | 27,028 | 128.6% | 61,300 | 10,300 | 2.27 | 16.8% |
| Day 13 | 1 | 16,637 | 24,838 | 149.3% | 57,500 | 14,300 | 2.32 | 24.9% |

FIG. 55

| Name of business office | Hall CD | Hall name | Person in charge | Device type name | Number of setups | Number of exchanges | Date of opening | Elapsed week |
|---|---|---|---|---|---|---|---|---|
| Shikoku | [illegible] | Shop W | [illegible] | Device type A | 10 Machines | 5.0 | December 14, 2009 (Monday) | First week |

| Item | Day 1 | Day 2 | Day 3 | Day 4 | Day 5 | Day 6 | Day 7 | Average per week | Cumulative average |
|---|---|---|---|---|---|---|---|---|---|
| | 12/14 (Monday) | 12/15 (Tuesday) | 12/16 (Wednesday) | 12/17 (Thursday) | 12/18 (Friday) | 12/19 (Saturday) | 12/20 (Sunday) | – | – |
| Business hour | 7.00 | 14.25 | 14.25 | 14.25 | 14.25 | 14.25 | 14.25 | 13.21 | – |
| TOTAL IN | 141,860 | 241,120 | 192,560 | 240,330 | 215,440 | 194,200 | 201,400 | 203,844 | – |
| TOTAL OUT | 162,740 | 230,870 | 206,800 | 238,920 | 210,460 | 198,830 | 195,890 | 206,359 | – |
| Difference pachinko ball | -20,880 | 10,250 | -14,240 | 1,410 | 4,980 | -4,630 | 5,510 | -2,514 | – |
| Winning pachinko ball rate | 114.7% | 95.7% | 107.4% | 99.4% | 97.7% | 102.4% | 97.3% | 101.2% | – |
| Sales | 149,000 | 620,000 | 542,000 | 517,000 | 561,000 | 430,000 | 520,000 | 477,000 | – |
| Prize | 566,600 | 415,000 | 826,800 | 488,800 | 461,400 | 522,600 | 409,800 | 527,286 | – |
| Gross profit | -417,600 | 205,000 | -284,800 | 28,200 | 99,600 | -92,600 | 110,200 | -50,286 | – |
| Business dividing number | 38.03 | 6.69 | 15.25 | 9.45 | 8.22 | 12.15 | 7.88 | 11.05 | – |
| Shop average operability | 11,000 | 13,320 | 12,812 | 12,606 | 11,646 | 14,217 | 13,056 | 12,665 | – |
| IN count by machine | 14,186 | 24,112 | 19,256 | 24,033 | 21,544 | 19,420 | 20,140 | 20,384 | – |
| Shop operation ratio | 129.0% | 181.0% | 150.3% | 190.6% | 185.0% | 136.6% | 154.3% | 160.9% | – |
| OUT count by machine | 16,274 | 23,087 | 20,680 | 23,892 | 21,046 | 19,883 | 19,589 | 20,636 | – |
| Number of difference pachinko balls by machine | -2,088 | 1,025 | -1,424 | 141 | 498 | -463 | 551 | -251 | – |
| Sales by machine | 14,900 | 62,000 | 54,200 | 51,700 | 56,100 | 43,000 | 52,000 | 47,700 | – |
| Gross profit per machine | -41,760 | 20,500 | -28,480 | 2,820 | 9,960 | -9,260 | 11,020 | -5,029 | – |
| IN count per hour | 2,027 | 1,692 | 1,351 | 1,687 | 1,512 | 1,363 | 1,413 | 1,578 | – |
| OUT count per hour | 2,325 | 1,620 | 1,451 | 1,677 | 1,477 | 1,395 | 1,375 | 1,617 | – |
| Sales per hour | 2,129 | 4,351 | 3,804 | 3,628 | 3,937 | 3,018 | 3,649 | 3,502 | – |
| Coin unit price | 1.05 | 2.57 | 2.81 | 2.15 | 2.60 | 2.21 | 2.59 | 2.34 | – |

FIG. 56

| Elapsed days | Number of shops | Shop average operation | Average operation of device type A | Shop operation deviation rate | Sales by machine | Gross profit by machine | Coin unit price | Gross profit rate |
|---|---|---|---|---|---|---|---|---|
| Day 1 | 34 | 11,036 | 24,022 | 217.7% | 48,124 | 1,056 | 2.00 | 2.2% |
| Day 2 | 43 | 10,448 | 21,913 | 209.7% | 50,581 | 4,677 | 2.31 | 9.2% |
| Day 3 | 35 | 11,755 | 22,521 | 191.6% | 49,116 | 753 | 2.18 | 1.5% |
| Day 4 | 29 | 10,149 | 19,550 | 192.6% | 46,340 | 4,297 | 2.37 | 9.3% |
| Day 5 | 19 | 10,979 | 19,706 | 179.5% | 46,678 | 9,236 | 2.37 | 19.8% |
| Day 6 | 15 | 12,822 | 22,659 | 176.7% | 53,407 | 4,519 | 2.36 | 8.5% |
| Day 7 | 18 | 12,216 | 22,373 | 183.1% | 52,623 | 5,799 | 2.35 | 11.0% |
| Day 8 | 14 | 11,419 | 19,115 | 167.4% | 44,132 | 4,924 | 2.31 | 11.2% |
| Day 9 | 8 | 12,888 | 23,574 | 182.9% | 51,718 | 6,146 | 2.19 | 11.9% |
| Day 10 | 9 | 11,112 | 19,506 | 175.5% | 46,929 | 9,237 | 2.41 | 19.7% |
| Day 11 | 6 | 12,682 | 19,078 | 150.4% | 38,577 | 3,766 | 2.02 | 9.8% |

FIG. 57

| Name of business office | Hall CD | Hall name | Person in charge | Device type name | Number of setups | Number of exchanges | Date of opening | Elapsed week |
|---|---|---|---|---|---|---|---|---|
| Okayama | ○○○○○○ | Shop X | ○○ ○○ | Device type A | 7 Machines | 5.0 | December 15, 2008 (Tuesday) | First week |

| Item | Day 1 | Day 2 | Day 3 | Day 4 | Day 5 | Day 6 | Day 7 | Average per week | Cumulative average |
|---|---|---|---|---|---|---|---|---|---|
| | 12/15 (Tuesday) | 12/16 (Wednesday) | 12/17 (Thursday) | 12/18 (Friday) | 12/19 (Saturday) | 12/20 (Sunday) | 12/21 (Monday) | -- | -- |
| Business hour | 7.75 | 13.75 | 13.75 | 13.75 | 13.75 | 13.75 | 13.75 | 12.89 | -- |
| TOTAL IN | 109,900 | 186,200 | 164,500 | 116,200 | 137,900 | 172,200 | 172,600 | 151,500 | -- |
| TOTAL OUT | 117,600 | 186,900 | 157,500 | 116,200 | 137,200 | 162,400 | 172,200 | 150,000 | -- |
| Difference pachinko ball | -7,700 | -700 | 7,000 | 0 | 700 | 9,800 | 1,400 | 1,500 | -- |
| Winning pachinko ball rate | 107.0% | 100.4% | 95.7% | 100.0% | 99.5% | 94.3% | 99.2% | 99.0% | -- |
| Sales | 256,200 | 387,800 | 396,900 | 345,100 | 319,900 | 524,300 | 375,200 | 372,200 | -- |
| Prize | 410,200 | 401,800 | 256,900 | 345,100 | 305,900 | 328,300 | 347,200 | 342,200 | -- |
| Gross profit | -154,000 | -14,000 | 140,000 | 0 | 14,000 | 196,000 | 28,000 | 30,000 | -- |
| Business dividing number | 16.01 | 10.36 | 6.47 | 10.00 | 9.58 | 6.26 | 9.25 | 9.19 | -- |
| Shop average operability | 6,800 | 7,600 | 7,100 | 5,156 | 6,000 | 6,000 | 6,000 | 6,379 | -- |
| IN count by machine | 15,700 | 26,600 | 23,500 | -16,600 | 19,700 | 24,600 | 24,800 | 21,643 | -- |
| Shop operation ratio | 230.9% | 350.0% | 331.0% | 322.0% | 328.3% | 410.0% | 413.3% | 339.3% | -- |
| OUT count by machine | 16,800 | 26,700 | 22,500 | 16,600 | 19,600 | 23,200 | 24,600 | 21,428 | -- |
| Number of difference pachinko balls by machine | -1,100 | -100 | 1,000 | 0 | 100 | 1,400 | 200 | 214 | -- |
| Sales by machine | 36,600 | 55,400 | 56,700 | 49,300 | 45,700 | 74,900 | 53,600 | 53,171 | -- |
| Gross profit per machine | -22,000 | -2,000 | 20,000 | 0 | 2,000 | 28,000 | 4,000 | 4,266 | -- |
| IN count per hour | 2,026 | 1,935 | 1,709 | 1,207 | 1,433 | 1,789 | 1,804 | 1,700 | -- |
| OUT count per hour | 2,168 | 1,942 | 1,636 | 1,207 | 1,425 | 1,687 | 1,789 | 1,694 | -- |
| Sales per hour | 4,723 | 4,029 | 4,124 | 3,585 | 3,324 | 5,447 | 3,898 | 4,161 | -- |
| Coin unit price | 2.33 | 2.08 | 2.41 | 2.97 | 2.32 | 3.04 | 2.16 | 2.46 | -- |

FIG. 58

| Elapsed days | Number of shops | Shop average operation | Average operation of device type A | Shop operation deviation rate | Sales by machine | Gross profit by machine | Coin unit price | Gross profit rate |
|---|---|---|---|---|---|---|---|---|
| Day 1 | 22 | 10,467 | 21,900 | 209. 2% | 50,511 | −262 | 2.31 | −0. 5% |
| Day 2 | 19 | 11,208 | 21,679 | 193. 4% | 48,327 | 4,194 | 2.23 | 8. 7% |
| Day 3 | 21 | 11,113 | 21,586 | 194. 2% | 48,748 | 8,836 | 2.26 | 18. 1% |
| Day 4 | 18 | 8,786 | 17,568 | 200. 0% | 47,916 | 9,549 | 2.73 | 19. 9% |
| Day 5 | 4 | 9,754 | 19,182 | 196. 6% | 46,069 | 3,250 | 2.40 | 7. 1% |
| Day 6 | 5 | 10,518 | 19,537 | 185. 8% | 51,211 | 8,566 | 2.62 | 16. 7% |
| Day 7 | 5 | 10,627 | 19,933 | 187. 6% | 47,437 | 4,928 | 2.38 | 10. 4% |
| Day 8 | 4 | 10,488 | 18,939 | 180. 6% | 37,600 | −11, 103 | 1.99 | −29. 5% |
| Day 9 | 2 | 10,800 | 18,395 | 170. 3% | 47,450 | 17,504 | 2.58 | 36. 9% |
| Day 10 | 1 | 7,200 | 10,900 | 151. 4% | 24,900 | −3, 682 | 2.28 | −14. 8% |
| Day 11 | 1 | 7,400 | 9,300 | 125. 7% | 27,000 | −2, 618 | 2.90 | −9. 7% |

FIG. 59

| Name of business office | Hall CD | Hall name | Person in charge | Device type name | Number of setups | Number of exchanges | Date of opening | Elapsed week |
|---|---|---|---|---|---|---|---|---|
| Nagoya No. 2 | ◎◎◎◎◎ | Shop Y | ○○ ○○ | Device type A | 8 Machines | 5.0 | December 15, 2018 (Tuesday) | First week |

| Item | Day 1 | Day 2 | Day 3 | Day 4 | Day 5 | Day 6 | Day 7 | Average per week | Cumulative average |
|---|---|---|---|---|---|---|---|---|---|
| | 12/15 (Tuesday) | 12/16 (Wednesday) | 12/17 (Thursday) | 12/18 (Friday) | 12/19 (Saturday) | 12/20 (Sunday) | 12/21 (Monday) | -- | -- |
| Business hour | 13.75 | 13.75 | 13.45 | 13.75 | 13.75 | 13.75 | 13.75 | 13.71 | -- |
| TOTAL IN | 165,600 | 167,200 | 112,800 | 124,800 | 139,200 | 111,200 | 108,000 | 132,686 | -- |
| TOTAL OUT | 154,008 | 163,856 | 117,312 | 122,304 | 139,200 | 102,320 | 111,240 | 130,034 | -- |
| Difference pachinko ball | 11,592 | 3,344 | -4,512 | 2,496 | 0 | 8,880 | -3,240 | 2,651 | -- |
| Winning pachinko ball rate | 93.0% | 98.0% | 104.0% | 98.0% | 100.0% | 92.0% | 103.0% | 98.0% | -- |
| Sales | 476,800 | 416,800 | 240,800 | 380,000 | 304,000 | 368,000 | 276,800 | 351,898 | -- |
| Prize | 244,960 | 349,920 | 331,040 | 330,080 | 304,000 | 190,400 | 341,800 | 298,857 | -- |
| Gross profit | 231,840 | 66,880 | -90,240 | 49,920 | 0 | 177,600 | -64,800 | 53,029 | -- |
| Business holding number | 5.14 | 8.40 | 13.75 | 8.89 | 10.00 | 5.17 | 12.34 | 8.48 | -- |
| Shop average operability | 9,100 | 9,300 | 9,300 | 8,100 | 9,300 | 7,600 | 7,400 | 8,586 | -- |
| IN count by machine | 20,700 | 20,900 | 14,100 | 15,600 | 17,400 | 13,900 | 13,500 | 16,586 | -- |
| Shop operation ratio | 227.5% | 224.7% | 151.6% | 192.6% | 187.1% | 182.9% | 182.4% | 193.2% | -- |
| OUT count by machine | 19,251 | 20,482 | 14,664 | 15,288 | 17,400 | 12,790 | 13,905 | 16,254 | -- |
| Number of difference pachinko balls by machine | 1,449 | 418 | -564 | 312 | 0 | 1,110 | -405 | 331 | -- |
| Sales by machine | 59,600 | 52,100 | 30,100 | 47,500 | 38,000 | 46,000 | 34,600 | 43,986 | -- |
| Gross profit per machine | 28,980 | 8,360 | -11,280 | 6,240 | 0 | 22,200 | -8,100 | 6,629 | -- |
| IN count per hour | 1,505 | 1,520 | 1,048 | 1,135 | 1,265 | 1,011 | 982 | 1,210 | -- |
| OUT count per hour | 1,400 | 1,490 | 1,090 | 1,112 | 1,265 | 930 | 1,011 | 1,186 | -- |
| Sales per hour | 4,335 | 3,789 | 2,238 | 3,455 | 2,764 | 3,345 | 2,516 | 3,206 | -- |
| Coin unit price | 2.88 | 2.48 | 2.13 | 3.04 | 2.18 | 3.31 | 2.56 | 2.65 | -- |

FIG. 60

| Elapsed days | Number of shops | Shop average operation | Average operation of device type A | Shop operation deviation rate | Sales by machine | Gross profit by machine | Coin unit price | Gross profit rate |
|---|---|---|---|---|---|---|---|---|
| Day 1 | 21 | 12,869 | 23,786 | 184.8% | 47,376 | 2,911 | 1.99 | 6.1% |
| Day 2 | 27 | 11,979 | 22,834 | 190.6% | 45,957 | 686 | 2.01 | 1.5% |
| Day 3 | 27 | 12,467 | 22,579 | 181.1% | 50,754 | 8,446 | 2.25 | 16.6% |
| Day 4 | 17 | 11,572 | 20,448 | 176.7% | 48,409 | 6,151 | 2.37 | 12.7% |
| Day 5 | 17 | 11,837 | 21,703 | 183.4% | 49,577 | 11,389 | 2.28 | 23.0% |
| Day 6 | 13 | 12,915 | 22,139 | 171.4% | 53,533 | 8,267 | 2.42 | 15.4% |
| Day 7 | 11 | 12,385 | 20,764 | 167.6% | 46,220 | 5,997 | 2.23 | 13.0% |
| Day 8 | 11 | 11,369 | 17,186 | 151.2% | 41,543 | 7,633 | 2.42 | 18.4% |
| Day 9 | 10 | 11,293 | 17,370 | 153.8% | 40,649 | 10,924 | 2.34 | 26.9% |
| Day 10 | 3 | 12,691 | 21,189 | 167.0% | 34,196 | -2,723 | 1.61 | -8.0% |
| Day 11 | 2 | 11,561 | 16,778 | 145.1% | 33,059 | -11,775 | 1.97 | -35.6% |
| Day 12 | 2 | 9,621 | 18,075 | 187.9% | 50,754 | 24,871 | 2.81 | 49.0% |

FIG. 61

| Name of business office | Hall CD | Hall name | Person in charge | Device type name | Number of setups | Number of exchanges | Date of opening | Elapsed week |
|---|---|---|---|---|---|---|---|---|
| Osaka No. 4 | ◇◇◇◇ | Shop 2 | ○○ ○○ | Device type A | 9 Machines | 5.0 | December 15, 2009 (Tuesday) | First week |

| Item | Day 1 | Day 2 | Day 3 | Day 4 | Day 5 | Day 6 | Day 7 | Average per week | Cumulative average |
|---|---|---|---|---|---|---|---|---|---|
| | 12/14 (Monday) | 12/15 (Tuesday) | 12/16 (Wednesday) | 12/17 (Thursday) | 12/18 (Friday) | 12/19 (Saturday) | 12/20 (Sunday) | -- | -- |
| Business hour | 12.75 | 12.75 | 12.75 | 12.75 | 12.75 | 12.75 | 12.75 | 12.75 | -- |
| TOTAL IN | 229,518 | 206,793 | 209,718 | 236,503 | 186,750 | 209,088 | 226,197 | 214,938 | -- |
| TOTAL OUT | 216,081 | 194,022 | 212,535 | 250,947 | 193,491 | 207,432 | 239,940 | 218,350 | -- |
| Difference pachinko ball | 13,437 | 12,771 | -2,817 | -14,445 | -6,741 | 1,656 | -13,743 | -1,412 | -- |
| Winning pachinko ball rate | 94.1% | 93.8% | 101.3% | 106.1% | 103.6% | 99.2% | 106.1% | 100.7% | -- |
| Sales | 588,051 | 595,800 | 415,800 | 302,400 | 396,900 | 540,900 | 282,600 | 446,064 | -- |
| Prize | 319,311 | 340,380 | 472,140 | 591,300 | 531,720 | 507,780 | 557,460 | 474,299 | -- |
| Gross profit | 268,740 | 255,420 | -56,340 | -288,900 | -134,820 | 33,120 | -274,860 | -28,234 | -- |
| Business dividing number | 5.43 | 5.71 | 11.35 | 19.55 | 13.40 | 9.39 | 19.73 | 10.63 | -- |
| Shop average operability | 13,005 | 14,990 | 17,900 | 18,408 | 13,700 | 16,700 | 16,750 | 15,922 | -- |
| IN count by machine | 25,502 | 22,977 | 23,302 | 26,278 | 20,750 | 23,232 | 25,133 | 23,882 | -- |
| Shop operation ratio | 196.1% | 153.3% | 130.2% | 142.8% | 151.5% | 139.1% | 150.0% | 150.0% | -- |
| OUT count by machine | 24,009 | 21,558 | 23,615 | 27,883 | 21,499 | 23,048 | 26,660 | 24,039 | -- |
| Number of otherwise provide balls to receive | 1,493 | 1,419 | -313 | -1,605 | -749 | 184 | -1,527 | -157 | -- |
| Sales by machine | 65,339 | 66,200 | 46,200 | 33,600 | 44,100 | 60,100 | 31,400 | 49,563 | -- |
| Gross profit per machine | 29,860 | 28,380 | -6,260 | -32,100 | -14,980 | 3,680 | -30,540 | -3,137 | -- |
| IN count per hour | 2,000 | 1,802 | 1,828 | 2,061 | 1,627 | 1,822 | 1,971 | 1,873 | -- |
| OUT count per hour | 1,883 | 1,691 | 1,852 | 2,187 | 1,686 | 1,808 | 2,091 | 1,885 | -- |
| Sales per hour | 5,125 | 5,192 | 3,624 | 2,635 | 3,459 | 4,714 | 2,463 | 3,687 | -- |
| Coin unit price | 2.56 | 2.88 | 1.98 | 1.28 | 2.13 | 2.59 | 1.25 | 2.08 | -- |

FIG.63B

Less than 4 : less than 3.5

4 : 3.5 or more and less than 4.5

5 : 4.5 or more and less than 5.5

6 : 5.5 or more and less than 6.5

7 : 6.5 or more and less than 7.5

8 : 7.5 or more and less than 8.5

9 : 8.5 or more and less than 9.5

10 : 9.5 or more and less than 10.5

11 : 10.5 or more and less than 11.5

12 : 11.5 or more and less than 12.5

13 : 12.5 or more and less than 13.5

14 : 13.5 or more and less than 14.5

15 : 14.5 or more and less than 15.5

16 : 15.5 or more and less than 16.5

17 :16.5 or more and less than 17.5

18 : 17.5 or more and less than 18.5

19 : 18.5 or more and less than 19.5

20 : 19.5 or more and less than 20.5

20 or More : 20.5 or more

Device type A Appearance Distribution of Pack

Device type A Appearance Distribution of Pack

Device type A Appearance Distribution of Pack

Device type A Appearance Distribution of Pack

Device type A Appearance Distribution of Pack

Device type A Appearance Distribution of Pack

Device type A Appearance Distribution of Pack

Device type B Appearance Distribution of Pack

Device type C Appearance Distribution of Pack

Device type D Appearance Distribution of Pack

Device type E Appearance Distribution of Pack

Device type F Appearance Distribution of Pack

Slump waveform type

Device type A Distribution by waveform type

FIG. 84

[Number of setups]
PS: 284 Machines, PC: 538 Machines

[Condition of location]
Along Main Trunk Line in Matsuyama City, Ehime Prefecture
(Adjacent to Crossing point)
Main visiting method: automobile (Total)
・Operability by device type: 16,806
・Operability by shop: 12,530 (134.1%)
・Sales by machine: 42,609 Yen (2.54)
・Sales dividing number: 8.90
・Total number of players: 2,948 Players
・Prize exchange rate: 29.1% (859 Players)
・Player winning rate: 22.2% (654 Players)

| Elapsed days | 12/14 (Monday) | 12/15 (Tuesday) | 12/16 (Wednesday) | 12/17 (Thursday) | 12/18 (Friday) | 12/19 (Saturday) | 12/20 (Sunday) |
|---|---|---|---|---|---|---|---|
| Total number of players | 132 Players | 284 Players | 250 Players | 244 Players | 208 Players | 224 Players | 208 Players |
| Prize exchange rate | 48.5%(64 P) | 27.5%(78 P) | 31.6%(79 P) | 29.1%(71 P) | 21.6%(45 P) | 27.2%(61 P) | 36.1%(75 P) |
| Player winning rate | 38.6%(51 P) | 24.6%(70 P) | 20.4%(51 P) | 23.8%(58 P) | 13.9%(29 P) | 19.6%(44 P) | 39.8%(84 P) |
| Business hour | 8.25 | 14.25 | 14.25 | 14.25 | 14.25 | 14.25 | 14.25 |
| Operability by device type | 15,623 | 21,981 | 18,759 | 15,318 | 13,151 | 21,793 | 32,568 |
| Operability by shop | — | 12,533 | 13,224 | 11,222 | 11,200 | 13,200 | 13,469 |
| Sales by machine | 36,734 | 51,047 | 47,781 | 47,718 | 33,698 | 54,937 | 50,918 |
| Sales dividing number | 12.74 | 9.06 | 8.97 | 7.58 | 6.95 | 9.67 | 11.85 |
| Weather | Sunny | Cloudy | Sunny -> rainy | Sunny | Sunny -> cloudy | Sunny -> cloudy | Sunny -> cloudy |
| Temperature | 15.3~6.7 | 11.3~4.4 | 9.6~5.0 | 8.5~3.7 | 7.5~3.3 | 7.1~2.4 | 9.2~4.5 |

| Elapsed days | 12/21 (Monday) | 12/22 (Tuesday) | 12/23 (Wednesday) | 12/24 (Thursday) | 12/25 (Friday) | 12/26 (Saturday) | 12/27 (Sunday) |
|---|---|---|---|---|---|---|---|
| Total number of players | 193 Players | 189 Players | 203 Players | 170 Players | 182 Players | 245 Players | 216 Players |
| Prize exchange rate | 26.4%(51 P) | 34.9%(66 P) | 22.2%(45 P) | 28.2%(48 P) | 24.7%(45 P) | 26.1%(64 P) | 31.0%(67 P) |
| Player winning rate | 19.7%(38 P) | 24.3%(46 P) | 14.8%(30 P) | 24.7%(42 P) | 20.9%(38 P) | 17.1%(42 P) | 23.6%(51 P) |
| Business hour | 14.25 | 14.25 | 14.25 | 14.25 | 14.25 | 14.25 | 14.25 |
| Operability by device type | 14,258 | 15,872 | 17,745 | 11,175 | 11,881 | 17,118 | 17,017 |
| Operability by shop | 11,454 | | 13,500 | 9,500 | 12,900 | 14,000 | 13,500 |
| Sales by machine | 37,172 | | 51,131 | 24,975 | 31,188 | 48,344 | 41,281 |
| Business dividing number | 7.80 | | 5.82 | 11.61 | 8.54 | 8.92 | 7.23 |
| Weather | Sunny -> cloudy | Cloudy -> sunny | Sunny -> cloudy | Sunny / cloudy | Sunny -> rainy | Sunny | Sunny |
| Temperature | 8.8~4.1 | 10.9~1.3 | 15.1~4.4 | 13.8~5.7 | 13.2~3.4 | 10.7~8.8 | 12.5~1.1 |

Average value of number of exchange medals

Rate of number of exchange medals by elapsed days

Distribution of number of exchange (Day 1)

Distribution of number of exchange (Day 14)

Average value of use amount of money

Rate of use amount of money by elapsed days

Distribution of use amount of money (Day 1)

Distribution of use amount of money (Day 14)

FIG. 94

[Number of setups]
PS: 106 Machines, (PS-exclusive shop)
[Condition of location]
Shop in front of Meguro Station, Tokyo
Shopping mall and Tokyo Gakugei University near this location 《Total》
・Operability by device type: 19,105
・Operability by shop: 8,828 (206.14%)
・Sales by machine: 53,760 Yen (2.81)
・Sales dividing number: 7.67

・Total number of players. 152 Players
・Prize exchange rate: 46.1% (70 Players)
・Player winning rate: 31.6% (48 Players)

| Elapsed days | 12/22 (Tuesday) | 12/23 (Wednesday) | 12/24 (Thursday) | 12/25 (Friday) | 12/26 (Saturday) | 12/27 (Sunday) | 12/28 (Monday) |
|---|---|---|---|---|---|---|---|
| Total number of players | | 18 Players | 25 Players | 28 Players | 30 Players | 21 Players | 29 Players |
| Prize exchange rate | | 55.6%(10P) | 48.0%(12P) | 41.4%(12P) | 53.3%(16P) | 33.3%(7P) | 44.0%(13P) |
| Player winning rate | | 38.9%(7P) | 20.0%(5P) | 31.0%(9P) | 40.0%(12P) | 23.8%(5P) | 34.0%(10P) |
| Business hour | | 12.75 | 12.75 | 12.75 | 12.75 | 12.75 | 12.75 |
| Operability by device type | | 23,830 | 18,529 | 14,941 | 18,487 | 23,389 | 15,456 |
| Operability by shop | | 11,500 | | 6,600 | | | 8,383 |
| Sales by machine | | 16,250 | 57,260 | 38,640 | 60,700 | 54,860 | 49,020 |
| Business dividing number | | 8.72 | 8.70 | 10.61 | 5.49 | 4.82 | 6.41 |
| Weather | | Sunny | Sunny | Sunny | Cloudy -> sunny | Cloudy | Cloudy -> sunny |
| Temperature | | 12.3-2.3 | 13.8-4.9 | 12.0-7.3 | 12.9-6.7 | 12.0-7.4 | 14.2-6.7 |

FIG. 95

[Number of setups]
PS: 98 Machines, (exchange of 6.0 pieces),PC:396 Machines
[Condition of location]
Along Trunk Line in Street Shop with Expressway Interchange and 1 Kilometer along Trunk Line from Main Stations 《Total》
・Operability by device type: 25,594
・Operability by shop: 18,583 (137.9%)
・Sales by machine: 44,297 Yen (1.73)
・Sales dividing number: 11.12
・Total number of players: 168 Players
・Prize exchange rate: 47.6% (80 Players)
・Player winning rate: 33.3% (56 Players)

| Elapsed days | 12/21 (Monday) | 12/22 (Tuesday) | 12/23 (Wednesday) | 12/24 (Thursday) | 12/25 (Friday) | 12/26 (Saturday) | 12/27 (Sunday) | 12/28 (Monday) |
|---|---|---|---|---|---|---|---|---|
| Total number of players | 5 Players | 18 Players | 25 Players | 29 Players | 30 Players | 21 Players | 29 Players | 11 Players |
| Prize exchange rate | 80.0%(4 P) | 55.6%(10 P) | 48.0%(12 P) | 41.4%(12 P) | 53.3%(16 P) | 33.3%(7 P) | 44.0%(13 P) | 54.5%(6 P) |
| Player winning rate | 60.0%(3 P) | 38.9%(7 P) | 20.0%(5 P) | 31.0%(9 P) | 40.0%(12 P) | 23.8%(5 P) | 34.0%(10 P) | 45.5%(5 P) |
| Business hour | 11.75 | 12.75 | 12.75 | 12.75 | 12.75 | 12.75 | 12.75 | 12.75 |
| Operability by device type | 22,211 | 25,883 | 25,963 | 25,316 | 25,751 | 26,323 | 27,370 | 25,936 |
| Operability by shop | 19,000 | 18,500 | 20,000 | 18,000 | 18,000 | 19,000 | 18,000 | 18,000 |
| Sales by machine | 16,250 | 49,000 | 33,875 | 82,250 | 52,750 | 29,250 | 43,750 | 47,250 |
| Business dividing number | 46.50 | 6.86 | 12.22 | 4.33 | 7.47 | 16.87 | 13.31 | 12.85 |
| Weather | Sunny | Cloudy -> sunny | Sunny | Sunny | Sunny | Cloudy -> sunny | Sunny -> cloudy | Rainy -> sunny |
| Temperature | 9.8-4.4 | 9.5-0.7 | 12.6-2.3 | 14.3-4.3 | 12.3-6.5 | 12.5-5.9 | 12.6-6.2 | 13.2-6.2 |

FIG. 96

[Number of setups]
PS: 179 Machines, PC:425 Machines
[Condition of location]
5 Minutes by walk from a main station in Tokyo
Multiple floors in building (B1F and 1F)

《Total》
・Operability by device type: 23,319
・Operability by shop: 16,198 (144.0%)
・Sales by machine: 58,457 Yen (2.51)
・Sales dividing number: 6.80
・Total number of players: 178 Players
・Prize exchange rate: 36.0% (64 Players)
・Player winning rate: 18.0% (32 Players)

| Elapsed days | 12/21 (Monday) | 12/22 (Tuesday) | 12/23 (Wednesday) | 12/24 (Thursday) | 12/25 (Friday) | 12/26 (Saturday) | 12/27 (Sunday) |
|---|---|---|---|---|---|---|---|
| Total number of players | 11 Players | 30 Players | 17 Players | 27 Players | 28 Players | 21 Players | 44 Players |
| Prize exchange rate | 63.6%(7P) | 50.0%(15P) | 47.1%(8P) | 48.1%(13P) | 25.0%(7P) | 28.6%(6P) | 18.2%(8P) |
| Player winning rate | 36.4%(4P) | 16.7%(5P) | 23.5%(4P) | 25.9%(7P) | 10.7%(3P) | 9.5%(2P) | 15.9%(7P) |
| Business hour | 5.75 | 13.75 | 13.75 | 13.75 | 13.75 | 13.75 | 13.75 |
| Operability by device type | 11,681 | 25,091 | 24,633 | 24,632 | 25,273 | 26,530 | 25,396 |
| Operability by shop | 12,300 | 15,749 | 17,068 | 13,549 | 15,463 | 18,493 | 20,751 |
| Sales by machine | 24,600 | 70,200 | 50,000 | 54,800 | 69,200 | 63,600 | 76,800 |
| Business dividing number | 11.59 | 6.09 | 9.33 | 9.26 | 4.72 | 6.77 | 4.43 |
| Weather | Sunny | Sunny | Sunny | Sunny | Sunny | Cloudy -> sunny | Cloudy |
| Temperature | 9.0-3.8 | 10.6-2.6 | 12.3-2.3 | 13.8-4.9 | 12.0-7.3 | 12.9-6.7 | 12.0-7.4 |

FIG. 97

[Number of setups]
PS: 93 Machines (exchange of 5.5 pieces), PC: 118
[Condition of location]
Front of Keio line station in Tokyo
Neighboring residential area 《Total》
・Operability by device type: 19,596
・Operability by shop: 11,530 (170.0%)
・Sales by machine: 41,969 Yen (2.14)
・Sales dividing number: 10,78
・Total number of players: 293 Players
・Prize exchange rate: 32.4% (95 Players)
・Player winning rate: 27.6% (81 Players)

| Elapsed days | 12/21 (Monday) | 12/22 (Tuesday) | 12/23 (Wednesday) | 12/24 (Thursday) | 12/25 (Friday) | 12/26 (Saturday) | 12/27 (Sunday) | 12/28 (Monday) |
|---|---|---|---|---|---|---|---|---|
| Total number of players | 37 Players | 43 Players | 53 Players | 29 Players | 39 Players | 38 Players | 27 Players | 27 Players |
| Prize exchange rate | 35.1%(13P) | 39.5%(17P) | 35.8%(19P) | 34.5%(10P) | 20.5%(8P) | 26.3%(10P) | 33.3%(9P) | 33.3%(9P) |
| Player winning rate | 29.7%(11P) | 34.9%(15P) | 34.0%(18P) | 27.6%(8P) | 17.9%(7P) | 21.1%(8P) | 25.9%(7P) | 25.9%(7P) |
| Business hour | 13.75 | 13.75 | 13.75 | 13.75 | 13.75 | 13.75 | 13.75 | 13.75 |
| Operability by device type | 25,396 | 26,046 | 17,958 | 10,712 | 13,723 | 22,664 | 15,912 | 24,359 |
| Operability by shop | 15,146 | 15,537 | 11,395 | 5,048 | 6,117 | 12,578 | 10,462 | 15,960 |
| Sales by machine | 53,500 | 43,250 | 41,125 | 29,125 | 45,125 | 50,000 | 31,500 | 42,125 |
| Business dividing number | 12.68 | 11.24 | 13.28 | 7.79 | 3.25 | 9.56 | 15.00 | 13.87 |
| Weather | Sunny | Sunny | Sunny | Sunny | Sunny | Cloudy -> sunny | Cloudy | Cloudy -> sunny |
| Temperature | 9.0-3.8 | 10.6-2.6 | 12.3-2.3 | 13.8-4.9 | 12.0-7.3 | 12.9-6.7 | 12.0-7.4 | 14.2-6.7 |

Game playing time of Day 1
(continuous 8 Days)

Game playing time of Day 2
(continuous 8 Days)

Game playing time of Day 3
(continuous 8 Days)

Game playing time of Day 4
(continuous 8 Days)

Game playing time of Day 5 (continuous 8 Days)

Game playing time of Day 6 (continuous 8 Days)

Game playing time of Day 7 (continuous 8 Days)

Game playing time of Day 8 (continuous 8 Days)

FIG. 100A
Age of Day 1
(continuous 8 Days)
FIG. 100B
Age of Day 2
(continuous 8 Days)
FIG. 100C
Age of Day 3
(continuous 8 Days)
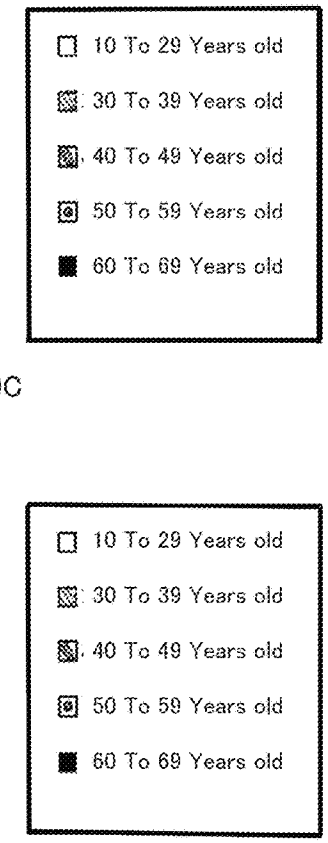
FIG. 100D
Age of Day 4
(continuous 8 Days)
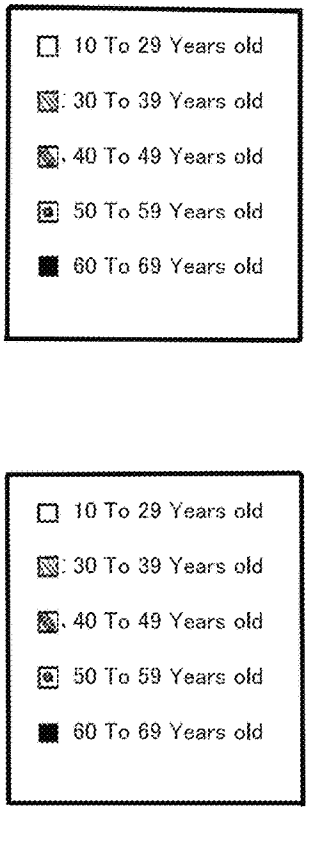

FIG. 101A
Age of Day 5
(continuous 8 Days)
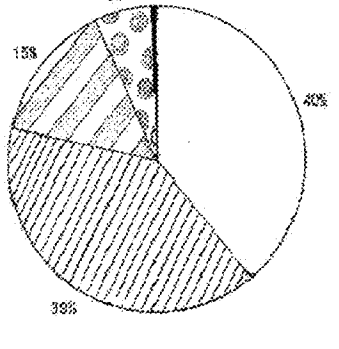
FIG. 101B
Age of Day 6
(continuous 8 Days)
FIG. 101C
Age of Day 7
(continuous 8 Days)
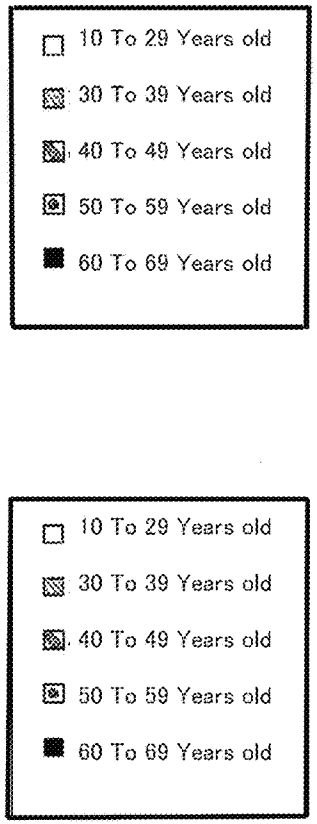
FIG. 101D
Age of Day 8
(continuous 8 Days)
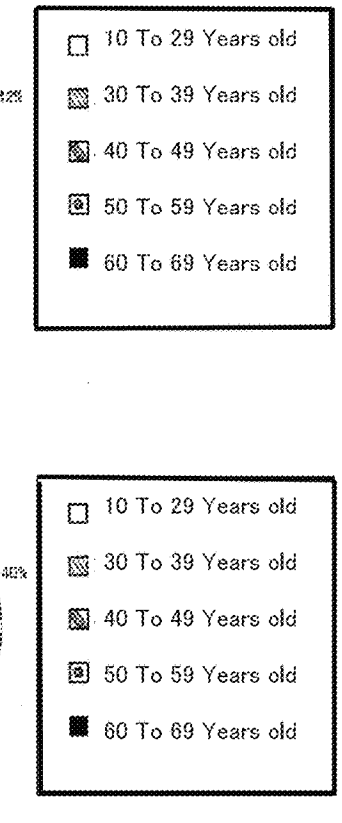

Sex category of Day 1
(continuous 8 Days)

Sex category of Day 2
(continuous 8 Days)

Sex category of Day 3
(continuous 8 Days)

Sex category of Day 4
(continuous 8 Days)

Sex category of Day 5
(continuous 8 Days)

Sex category of Day 6
(continuous 8 Days)

Sex category of Day 7
(continuous 8 Days)

Sex category of Day 8
(continuous 8 Days)

Attribute of Day 1
(continuous 8 Days)

Attribute of Day 2
(continuous 8 Days)

Attribute of Day 3
(continuous 8 Days)

Attribute of Day 4
(continuous 8 Days)

FIG. 105A
Attribute of Day 5
(continuous 8 Days)
FIG. 105B
Attribute of Day 6
(continuous 8 Days)
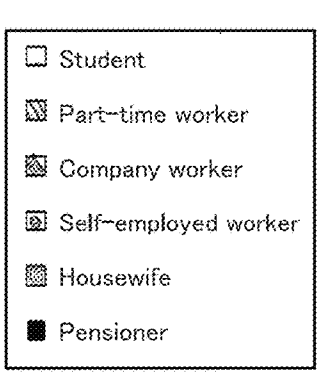
FIG. 105C
Attribute of Day 7
(continuous 8 Days)
FIG. 105D
Attribute of Day 8
(continuous 8 Days)
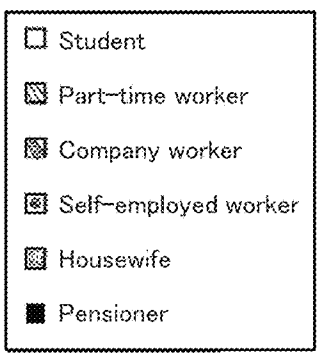

F10

F9

F11

① By device type

② By gaming machine

GAME INFORMATION INTEGRATION SYSTEM

CROSS-REFERENCE TO RELATED APPLICATIONS

This application is a divisional of application Ser. No. 13/878,214 filed Apr. 6, 2013, with a 371(c) completion date of Apr. 17, 2014. That application is the U.S. National Phase entry of PCT/JP2011/072352, which was filed on Sep. 29, 2011. The PCT application was based on and claims priority to Japanese application JP 2010-227201, filed Oct. 7, 2010, and Japanese application JP 2010-253094, filed Nov. 11, 2010. The entire contents of the parent application (U.S. Ser. No. 13/878,214), the PCT application, and the two underlying Japanese applications are incorporated herein by reference.

TECHNICAL FIELD

The present invention relates to a game playing information integration system for acquiring game playing information. In particular, the present invention relates to a game playing information integration system which integrally manages game information including the operation states of a variety of gaming machines installed in a gaming facility, the information of a player playing on a gaming machine and other information, and provides such game information as the information to be reflected on management.

BACKGROUND ART

Conventionally, there have been systems which compute the number of times of big hit and number of games played or the payout quantity of gaming machines with an elapse of time and manages and analyzes the state of each gaming machine. Summing of the data indicating the state of each one of those gaming machines has been performed to analyze the states including sales by the type of the gaming machine, or by gaming facility.

However, as important elements in management of a gaming facility, the timing for replacing old gaming machines by new gaming machines and arrangement and layout of the gaming machines, and further which gaming machines to be replaced by which new gaming machines have been generally determined by the experience of humans based on the results of the analysis mentioned above. Moreover, in order to promote replacement with new gaming machines, manufacturers who conduct changes in designs and sell the gaming machines need to design popular device types. However, designing these popular device types has been also dependent on the rule of thumb and intuitions of the planners of gaming machines.

(1) Difficulties for Manufacturers Who Design, Manufacture, and Sell Gaming Machines in Designing Popular Device Types to Design First, a method of designing the above-mentioned known popular device type is as follows: that is, it has been conventionally a proposition to design gaming machines which sell well for manufacturers to design, manufacture, and sell gaming machines. As approaches for achieving this object, it has been a routine practice to introduce new functions or stage effects to induce a sense of expectation or to promote famous copyrights in contents that are used in gaming machines while paying a large amount of license fees. However, manufacturers themselves have intuitively or experientially determined as to whether or not the device is an excellent gaming machine; and therefore, even if these approaches are employed, the popularity of gaming machines has often superseded the manufacturers' predictions.

(2) Difficulties in Selecting the Type of the Gaming Machine Seen from the Local Area Characteristics of the Gaming Facility and the Player Playing the Game Second, a conventional method regarding the selection of game elements of gaming machines installed in the gaming facility and the determination of the timing to replace gaming machines performed by the manager of the above-mentioned gaming facility is as follows:

That is, for example, there are a variety of players' preferences for gaming machines such as differences in players' preferences depending on geographical conditions such as local area characteristics such as Las Vegas or Macao or whether or not the condition of location is near resort hotels, differences in preferences of customer categories depending on time intervals such as differences in visit time of housewives or businessmen, or differences in preferences of fixed customers (manias), unfixed customers (browsing customers), or novices (beginners), and such preferences are different depending on players. In addition, in respect of the management side of gaming facilities, requests for gaming machines that they desire to install in the gaming facilities are also different depending on the gaming facilities. For example, one gaming facility of the adjacent two gaming facilities desires to install gaming machines of such device type to stimulate gambling mind of players, whereas the other gaming facility desires to install gaming machines of such device type to enjoy the play of game over a long period of time without exerting such gambling mind. Namely, even within a same local area, the requests from the gaming facilities as to gaming machines may be different depending on management policy. Therefore, on the manufacturers' side, it is impossible to satisfy the requests of all players and gaming machines, and it is also unavoidable to design gaming machines while taking the greatest common preferences of all.

In such a present situation, in order for a gaming facility to obtain the maximal profit, the gaming facility itself must continuously install gaming machines of which device type and number is assigned in accordance with the request of that gaming facility and the preferences of players visiting the gaming facility.

However, timing of replacement with gaming machines of new device type has been conventionally determined on the basis of rule of thumb; and therefore, a difference takes place with economic efficiency related to the replacement, depending on persons who determine such replacement, and as a result, there has been apprehension that the gaming facility loses profit.

In addition, while, in a gaming machine, settings which are able to change a winning probability in a predetermined range are provided at a plurality of stages in general, these settings are often adjusted on the basis of rule of thumb; and therefore, a balance between improvement of ability to attract customers by setting a current mode to a high probability mode, the profit of the gaming facility lowers, and as a result, there has been apprehension that the gaming facility loses profit.

Further, there has been a problem that the manager in gaming facility takes preference to only improvement of one's own immediate profit against the manager's thought, highly sets a dividing number, and causes fixed customer to lose interest in shop in a long run.

Furthermore, players visiting a gaming facility vary depending on the time slot in a day, the season, the temperature, the game elements of the gaming machine installed and other factors. A management method for coping with such variation in real time as much as possible is desired.

Meanwhile, there are currently such systems that allows network connection between a gaming machine and an external game program download server, suitably selecting and downloading one game program to download from a plurality of game programs from the external game program download server, and executing a plurality of games on a single machine, not only changes in game programs, but also downloads for modifying their game contents in detail even in the same game program, for example, performing changes in denomination rates and other detailed changes in game elements have been also enabled. It has been also important how to link such a known system for changing software on a gaming machine by downloading with a method for managing gaming machines depending on the varying states mentioned above.

In Patent Document 1, there is disclosure of a management apparatus for gaming facility to sum and manage work data on pachinko gaming machines.

PRIOR ART DOCUMENT

Patent Document

[Patent Document 1] Japanese Patent Publication No. H11-207001

SUMMARY OF THE INVENTION

Problems to be Solved by the Invention

With respect to a game playing information integration system, in the management apparatus for gaming facility, described in Patent Document 1, it is possible to perform summing and management of operability data, and then, based on the data, perform determination of whether or not settings or the like in service time are appropriate; and therefore, it may be possible to normalize the settings or the like in service time. However, it is impossible to perform analysis as to customer category; and therefore, with respect to timing of replacement with gaming machines of new device type or adjustment of settings, it is difficult to continuously perform selections or settings according to the preferences of players, in particular, fixed customers, over a long period of time.

Conventionally, the method for the manager of the gaming facility to grasp the operation states of the gaming machines installed in the gaming facility more precisely, and to provide information to cope with the state of the gaming facility changing every moment based on the grasped information in real time have been provided only in the form of numerical indication established for each gaming facility and manager. Therefore, it has been difficult to determine such information in real time. Moreover, years of experience have been required to grasp the states with such numerical data.

It is an object of the present invention to provide a game playing information integration system for quantitatively obtaining data related to shop management of a gaming facility to be thereby able to objectively perform selection or settings according to the preferences of players, in particular, fixed customers, and to be thereby able to effectively introduce a gaming machine to invoke demands of players as users and managers of gaming facilities in a well-balanced manner from a result obtained by logically analyzing the gaming machine.

Another object of the present invention is to provide a game playing information integration system which is connected with all gaming machines in the gaming facility via a network, and is capable of displaying the operation state of each gaming machine in every predetermined time on a display screen (display screen of a personal computer and a portable terminal) for the manager.

Means for Solving the Problems

First Aspect of the Present Invention

In order to solve the above-described problems, the present invention employed the following features.

(1) A game playing information integration system is provided, the game playing information integration system including:

a plurality of gaming machine units; and a server connected to enable communication with each of the gaming machine units, wherein the gaming machine unit includes:

a player identification information reading means which is capable of reading player identification information, and outputs the read player identification information;

number-of-consumptions data output means for outputting number-of-consumptions data related to a number-of-consumptions of game media; and number-of-payouts data output means for outputting number-of-payouts data related to a number-of-payouts of game media, wherein the gaming machine unit identification information is assigned to each of the gaming machine units, and the server includes:

data storage means for storing each of the number-of-consumptions data output from the number-of-consumptions data output means and the number-of-payouts data output from the number-of-payouts data output means in association with reception time data related to data reception time, player identification information, and gaming machine unit identification information, and analysis processing means for performing analysis of data received from the gaming machine unit and then stored in the data storage means;

the analysis processing means is constituted so as to perform processing operations (A) to (C), the processing (A) is processing of, based on the data stored in the data storage means, generating data related to at least items (a) to (d) that follow:

(a) a game playing period per one time of each player in the gaming machine unit;

(b) a change with an elapse of time of a balance of the player in the game playing period;

(c) operation time of the gaming machine unit; and (d) profit of a shop side by the gaming machine, the processing (B) is processing of, based on at least the data related to the items (a) and (b), computing a degree of satisfaction of a player relative to a gaming machine unit, the degree of satisfaction of the player being a variable following meeting conditions (I) and (II):

(I) the longer the game playing time is, the higher the degree of satisfaction of the player is; and (II) a balance of a player in a latter half of the game playing period has a greater influence relative to the degree of satisfaction of the player than a balance of a player in a first half of the game playing period, and the processing (C) is processing of, based on data related to the items at least items (c) and (d), computing a degree of satisfaction on a shop side relative to a gaming machine unit, the degree of satisfaction on the shop side being a variable meeting following conditions (i) and (ii):

(i) the longer the operation time is, the higher the degree of satisfaction on the shop side is; and (ii) the greater a profit on the shop side is, the higher the degree of satisfaction on the shop is.

In view of only a balance relationship, the greater the player's profit is, the greater the loss on the shop side is, and the greater the player's loss is, the greater the profit on the shop side is. Therefore, simply assuming that the degree of satisfaction is determined by only balance, the higher the degree of player's satisfaction is, the lower the degree of satisfaction on the shop side is, and the lower the degree of the player's satisfaction is, the higher the degree of satisfaction on the shop side is. In other words, the degree of the player's satisfaction and the degree of satisfaction on the shop side have a tradeoff relationship. This is a relationship which is conventionally thought to be present in view of common knowledge.

However, in reality, a relationship between the degree of the player's satisfaction and the degree of satisfaction on the shop side is not a tradeoff relationship, and is influence by another element. For example, some players can play a game over long period of time or some player does not feel dissatisfaction even if a slight loss takes place. Conversely, in a case where a player gains great profit in the first half of the play of game, but loses almost of the profit in the last half of the play of game, even if no loss takes place, the player cannot sometimes obtain a sense of satisfaction. That is, the degree of player's satisfaction is not determined by only balance. In the present invention, elements other than the tradeoff relationship mentioned above are objectively evaluated, and the relationship between the degree of the player's satisfaction and the degree of satisfaction on the shop side is provided in a more realistic manner.

Therefore, in the present invention, a player pays his or her attention to timing of stopping the play of game. That is, timing for a player to stop the play of game corresponds to any one of three patterns of 1. No money to play; 2. Big hit (bonus is won); and 3. Interest in gaming machine is lost. The present invention is characterized in that trends for a player to start to complete the play of game are acquired in all by integrating information, whereby the patterns are objectively and logically analyzed and then the data of analysis is utilized for stabilization of management. This puts the brake for the manager in gaming facility to seek an immediate profit, and provides environment in which a fixed customer can enjoy the play of game over a long period of time while the gaming facility obtains a stable profit in long term. An increase of fixed customers is handled as a very important problem to be solved in the field as opening the way against reduction of game market scale which is questioned in future as well as being useful for long-term stable management of the gaming facility.

In order to solve this problem, according to the present invention, integrative acquisition of information is performed from each device in gaming facility (such as gaming machine unit or a variety of servers, for example); based on these items of information, analysis is performed from three points of view made of "customer" analysis, "machine" analysis, and "sales" analysis; and by integrally employing the results of these analyses, useful information is provided for determination as to whether or not to establish the current sales strategy of the gaming facility and planning of the future sales strategy to increase the number of fixed customers.

Therefore, in the present invention, the degree of the player satisfaction and the degree of satisfaction on the shop side are computed and then the computed degrees of satisfaction are visualized as the result of "customer" analysis, "machine" analysis, and "sales" analysis. In this manner, information is provided for reversing a tradeoff relationship between the degree of the player's satisfaction and the degree of satisfaction on the shop side, which has been conventionally thought to be present in view of common knowledge, and then, improving both of the degree of the player's satisfaction and the degree of satisfaction on the shop side.

It is to be noted that reception time data related to reception time of data is not limited to showing reception time itself of data, and includes receiving time intervals of data, for example. Further, the reception time data related to reception time of data may be the one indicating time itself of transmission from a gaming machine unit or may be the one indicating time intervals of transmission from a gaming machine unit.

The present invention can further employ the following features.

(1-1) A game playing information integration system of (1) is provided, wherein the data storage means further stores model data related to model of gaming machine unit in association with gaming machine unit identification information.

(1-2) The game playing information integration system of (1) is provided, wherein the data storage means further stores device type data related to device type of gaming machine unit in association with gaming machine unit identification information.

(1-3) The game playing information integration system of (1) is provided, wherein the gaming machine unit further includes number-of-games-played data output means for outputting number-of-games-played data related to the number of games played, and the data storage means further stores number-of-games-played data output from the number-of-games-played data output means in association with reception time data related to reception time of data, player identification information, and gaming machine unit identification information.

(1-4) The game playing information integration system of (1) is provided, wherein the gaming machine unit further includes winning prize number data output means for outputting winning prize number data related to the number of times of special prize, and the data storage means further stores the winning prize number data output from the winning prize number data output means in association with reception time data related to reception time of data, player identification information, and gaming machine unit identification information.

The present invention can further employ the following feature.

(2) The game playing information integration system of (1) is provided, wherein the game playing period includes one or a plurality of variation trend continuation periods, the variation trend continuation periods are a series of period in which either one of increase trend and decrease trend of difference number is continuous, and meets a condition in which an absolute value of difference number in an entire period is a predetermined reference value or more, and the condition (II) is that, among the variation trend continuation periods included in the game playing period, the later a balance in a variation trend continuation period takes place, the greater an influence is imparted to a degree of satisfaction of the player.

According to the feature of (2), conventionally, the intuitive and qualitative degree of satisfaction of each player can be numerically (visually) expressed in a more realistic manner.

Conventionally, for example, when players talk with each other about the results of their own play of games, the characteristics of their one play of games are often expressed by the presence or absence of the variation trend continuation period or its related generation timing, such as expression that "no bonus took place for one hour" or "bonus continued for 30 minutes". This is because players understand that the variation trend continuation period is an effective milestone representing characteristics of gaming machines regardless of whether the player takes care or does not take care for the matter, and one's own feeling (satisfaction or dissatisfaction) can be comparatively easily expressed by means of the variation trend continuation period. In particular, a trend of the variation trend continuation period that takes place later (variation trend continuation period that takes place at a time close to completion of the play of game) greatly influences the degree of the player's satisfaction.

For example, among players, there are a quite a few players who determine an upper limit or a lower limit of a balance. In this case, in the latter half of game playing period, a change in balance toward the upper limit or the lower limit takes place, and there is a high possibility that the tread of such change and the changed trend of variation trend continuation period are the same. Therefore, the variation trend of the variation trend continuation period in the latter half of the game playing period indicates that a win or loss that has been determined by a player oneself. Even when a player who does not determine such rule makes determination as to whether or not to stop the play of game, the player often makes such determination on the basis of a result of the play of game at that time (that is, variation trend continuation period that takes place at a time close to completion of the play of game).

According to the feature of (2), the degree of the player's satisfaction is computed by employing the variation trend continuation period, thus making it possible to numerically (visually) express the degree of intuitive and qualitative satisfaction of each player in a more realistic manner.

A series of period may be a period in units of time or may be a period in unit of the number of games played.

The present invention can further employ the following features.

(3) The game playing information integration system of (2) is provided, wherein the condition (II) is that, among the variation trend continuation periods included in the game playing period, the greater the number of continuous occurrences of variation trend continuation period is, the period having the same variation trend as the variation trend continuation period that occur lastly, the greater the influence on the degree of the player's satisfaction is.

In a case where a variation trend continuation period having a same trend is continuous at the last of game playing period, such trend greatly influences the degree of the player's satisfaction. Therefore, according to the feature of (3), the degree of the player's satisfaction can be numerically (visually) expressed in a more realistic manner.

The present invention can further employ the following features.

(4) The game playing information integration system of (2) or (3) is provided, wherein the series of period is a period of normal game playing state in a game played at the gaming machine unit, a period of bonus game, or a period obtained by combining a bonus game and a game playing state which is different from a normal game state subsequent to the bonus game.

According to the feature of (4), a period of normal game playing state, a period of bonus game, or a period obtained by combining a bonus game and a game playing state (state of the play of a game other than normal game after bonus) which is different from a normal game playing state subsequent to the bonus game are handled as a series of period.

These periods are features which are frequently employed when a player evaluates one's own play o game, and thus, these periods are handled as a series of period, thereby making it possible to achieve the degree of the player's satisfaction in a sense which is further closer to players.

The present invention can further employ the following features.

(5) The game playing information integration system of (4) is provided, wherein the routine moves to a normal game playing state after completion of bonus game as the series of period or after completion of a bonus game as the series of period and a game playing state which is different from a normal game playing state subsequent to the bonus game, and in the normal game playing state, in a case where a next bonus game takes place before exceeding a special period or the number of games played, the next bonus game is included in the series of period.

After completion of bonus game or after completion of bonus game and a game playing state which is different from a normal game playing state subsequent to the bonus game, in a case where a next bonus game takes place before exceeding a special period (for example, 5 minutes) or the number of games played (for example, 20 games), a player often recognizes that these periods are a series of period. Therefore, in the feature of (5), these periods are handled as a series of period, thereby making it possible to achieve the degree of the player's satisfaction in a sense which is further closer to players.

The present invention can further employ the following features.

(6) The game playing information integration system of (2) is provided, wherein the series of period is a period in which difference number per predetermined unit period of time continuously increases or decreases over a plurality of unit periods of time.

According to the feature of (6), the predetermined unit period of time includes both of a period based on time and a period based on the number of games played. The unit period of time may be fixed in advance as a game playing information integration system or may be arbitrarily set at gaming facility.

The present invention can further employ the following features.

(7) The game playing information integration system of any one of (1) to (6) is provided, wherein the analysis processing means is constituted so as to perform processing operations (D) and (E), the processing (D) is processing of, based on the data stored in the data storage means, generating data related to at least items (a') and (b'), that is, (a') visit frequency of player; and (b') consumed amount of money per visit of player, the processing (E) is processing of, based on data related to at least the items (a') and (b'), classifying the player into at least any one of groups of new customer, established customer, dissatisfactory customer, and leaving customer, the group of new customer is a group in which visit frequency is high and a consumed amount of money is small, the group of established customer is a group in which visit frequency is high and a consumed amount of money is large, the group of dissatisfactory customer is a group in which visit frequency is low and a consumed amount of money is large, and the group of leaving customer is a group in which visit frequency is low and a consumed amount of money is small.

The Inventor found out that there is a life cycle viewed from the shop side that a player visiting gaming facility first becomes "new customer" of the gaming facility, becomes "established customer" after gradually established, and then, becomes "dissatisfactory customer" for any reason, and finally becomes "leaving customer". Then, the Inventor found out that the player can be grouped according to which stage of that life cycle the player is positioned at, and the grouping can be performed based on (a') visit frequency and (b') consumed amount of money.

According to the feature of (7), it is possible to determine which stage of the life cycle viewed from the shop side the players are positioned, thus making it easy for the gaming facility to plan and establish measures for r increasing the number of established customers.

The present invention can further employ the following features.

(8) The game playing information integration system of (7) is provided, wherein the storage means stores data indicating history of a group to which the player belongs in association with the player identification information and further stores data for customer life cycle determination, and in the data for customer life cycle determination, a pattern of change of a group to which a player belongs and data indicating advice are associated with each other, the analysis processing means is constituted so as to perform processing operations (F) to (H), the processing (F) is processing of analyzing a pattern of change of a group to which a player belongs, based on data indicating history of a group to which the player belongs, the data being stored in the storage means, the processing (G) is processing of extracting data indicating advice corresponding to a pattern of change of a group to which the player belongs, based on the data for customer life cycle determination, and the processing (H) is processing of outputting advice as to the player, based on the data extracted in the processing (G).

The Inventor found out that there are several patterns as to from which stage to which stage of the life cycle a player moves, and the player's mentality relative to game facility is reflected in that patterns.

According to the feature of (8), the player's mentality as to gaming facility is objectively analyzed by determining from which stage to which stage of the life cycle the player moves, making it possible to provide advice which is useful to plan and establish measures for increasing the number of established customers.

The present invention can further employ the following features.

(9) The game playing information integration system of any one of (1) to (8) is provided, wherein the analysis processing means is constituted so as to perform processing operations (I) and (J), the processing (I) is processing of, based on data stored in the data storage means, generating data related to at least items (c') and (d') that follow:

(c') operability of gaming machine; and (d') gross profit by gaming machine, the processing (J) is processing of classifying the player into at least any one of groups of new machine, main device type, less popular, and unpopular, based on data related to at least the items (c') and (d'), the group of new machine is a group in which operability is high and gross profit is less, the group of main device type is a group in which operability is high and gross profit is more, the group of less popular is a group in which operability is low and gross profit is more, and the group of unpopular is operability is low and gross profit is less.

The Inventor found out that there is a life cycle viewed from players, in which gaming machines installed in gaming facility is first introduced as "new machines" in the gaming facility, then become "main device type" of the gaming facility, becomes gradually "less popular", and finally becomes "unpopular". The Inventor further found out that gaming machines can be grouped depending on which stage of the life cycle the gaming machines are positioned, and the grouping can be performed based on the items (c') operability and (d') gross profit.

According to the feature of (9), it is possible to determine which stage of the life cycle viewed from players the gaming machines are positioned, thus making it easy for the gaming facility to plan and establish measures for decreasing the number of gaming machines that fall under "less popular" and "unpopular".

The present invention can further employ the following features.

(10) The game playing information integration system of (9) is provided, wherein the storage means stores data indicating history of a group to which the gaming machine unit belongs in association with the gaming machine unit identification information and further stores data for gaming machine life cycle determination, and in the data for gaming machine life cycle determination, a pattern of change of a group to which a gaming machine belongs and data indicating advice are associated with each other, the analysis processing means is constituted so as to perform processing operations (K) to (M), the processing (K) is processing of analyzing a pattern of change of a group to which a gaming machine belongs, based on data indicating history of a group to which the gaming machine belongs, the data being stored in the storage means, the processing (L) is processing of extracting data indicating advice that corresponds to a pattern of change of the group to which the gaming machine belongs, based on the data for gaming machine life cycle determination, and the processing (M) is processing of outputting advice as to the player, based on data extracted in the processing (L).

The Inventor found out that there are several patterns as to from which stage to which stage of the life cycle a gaming machine moves, and the player's mentality relative to game facility is reflected in that patterns.

According to the feature of (10), the player's mentality as to gaming facility is objectively analyzed by determining from which stage to which stage of the life cycle the player moves, making it possible to provide advice which is useful to plan and establish action for decreasing less popular device type and/or unpopular device type.

Next, the degree of satisfaction, the life cycle of player's interest, and the gaming machine life cycle will be described.

(11) The game playing information integration system of (1) is provided, wherein the data storage means further stores player data associated with player identification information, the player data being related to a player to which player identification information is assigned.

According to the feature of (11), for example, player data such as player's local area, sex, age, or occupation is stored in association with game identification information, thus making it possible analyze the preference of the player in detail. The "customer" analysis can be performed more precisely, thus making it possible to enhance integrative analysis and use efficiency of the "customer" analysis, "machine" analysis, and "sales" analysis.

The present invention can further employ the following feature.

(12) The game playing information integration system of (11) is provided, wherein the data storage means stores player identification information in association with customer category data indicating that a player to which the player identification information is assigned falls under any of the customer categories divided into plurality.

According to the feature of (12), customer category data is associated with player identification information, thus making it possible to classify data by customer and then perform sales according to the customer category. That is, if players who visit a gaming facility are merely handed as one group, it is difficult to perform sales according to the preference or need of each player; and however, according to the feature of (12), it is possible to install a gaming machine according to the preference or need of the player by customer category.

It should be noted that the customer category used herein is a concept different from the life cycle of the player mentioned above.

The present invention can further employ the following feature.

(13) The game playing information integration system of (12) is provided, wherein the customer categories divided into plurality include a fixed customer, and the data storing means stores data associated with customer category data indicating a fixed customer so to be classified from data associated with any other item of customer category data.

According to the feature of (13), data of fixed customer is stored after classified from another item of data, thereby making it possible to reliably keep track of a visit trend and a playing trend of the fixed customer, and perform management according to the preference or need of the fixed customer. In this manner, it is possible to prevent reduction of the number of fixed customers. In particular, among the fixed players, there are a plenty of players having their individual rules (such as a rule of stopping the play of game if five consecutive big hits are realized, for example); and therefore, if that rule can be understood, the related settings can be changed on the game facility side.

The present invention can further employ the following feature.

(14) The game playing information integration system of any one of (1) and (11) to (13) is provided, wherein the gaming machine unit further includes use amount data output means for outputting use amount data related to an amount of money used for lending a gaming medium, and the data storage means further stores the use amount data output from the use amount data output means in association with reception time data related to reception time of data, player identification information, and gaming machine unit identification information.

According to the feature of (14), in addition to number-of-consumptions data, use amount data is employed, thus making it possible to enhance precision of integrative analysis made of "customer" analysis, "machine" analysis, and "sales" analysis.

(15) The game playing information integration system of any one of (1) and (11) to (14) is provided, wherein the server further includes:

a comparison table in which a criteria of stability is set; and stability determination means for determining stability per predetermined reference unit, based on analysis result data indicating a result of analysis of the data and the comparison table.

According to the feature of (15), it is possible to determine the degree of stability in predetermined reference unit (such as gaming machine simplex, area, device type, model, gaming facility, or unit of chain shops made of a plurality of gaming facilities, for example). The degree of stability used here denotes a milestone of sales obtained as a result of integrative analysis made of "customer" analysis, "sales" analysis, and "machine" analysis, and denotes a quantitative milestone defined based on operability and business dividing number, for example.

For gaming facilities, it is preferable that operability be high, whereas it is not always preferable that business dividing number be high. If the business dividing number is too high, it means that a player excessively "loses", and in a long run, it causes customers losing interest in shop. That is, it is indispensable to enhance operability to its possible highest level and to include the business dividing number in an appropriate range in order to secure and increase the number of fixed customers. The stability denotes a milestone that is defied from such a point of view, the higher operability is, the higher stability is, and as long as the business dividing number is in a predetermined range, the stability increases, or alternatively, if the business dividing number is outside the range, the stability decreases.

The present invention can further employ the following feature.

(16) The game playing information integration system of (15) is provided, wherein the data storage means, in association with gaming machine unit identification information, stores a new device type identification flag for determining whether or not a gaming machine unit to which the gaming machine unit identification unit is assigned is of new device type, and the stability determination means determines stability per predetermined reference unit, based on analysis result data, which does not include analysis result data related to a gaming machine unit to which the gaming machine unit identification information is assigned with which a new device type identification flag set to ON is associated, and the comparison table.

According to the feature of (16), integrative analysis made of "customer" analysis, "sales" analysis, and "machine" analysis can be divided according to whether or not the gaming machine is of new device type. Unlike other device types, a gaming machine of new device type may be operated by only an element of a "new gaming machine" regardless of model or property of machine. This is also true for "fixed customer" as well as the customer category classified as "visitor" or "customer aiming to earn money from new machine". Therefore, sales analysis in line with more realistic state and planning of sales strategy can be performed by classifying "customer" analysis, "sales" analysis, and "machine" analysis as to new device type and "customer" analysis, "sales" analysis, and "machine" analysis regarding as to any other device type.

The present invention can further employ the following feature.

(17) The game playing information integration system of (15) or (16) is provided, wherein analysis result data includes dividing number data related to a dividing number and operation data related to operability, in the comparison table, a dividing number and operability and numerally assigned stability are associated with each other, and the stability determination means numerically determines stability per predetermined reference unit, based on the dividing number data and the operation data and the comparison table.

According to the feature of (17), stability can be numerically determined, based on dividing number data and operability data, thus making it possible to obtain an objective analysis result for use in determination as to whether or not to establish a sales strategy.

The present invention can further employ the following feature.

(18) The game playing information integration system of any one of (15) to (17) is provided, wherein the server further includes target dividing number computation means for computing target dividing number per predetermined reference unit, based on analysis result data indicating a result of analysis by the analysis processing means and/or stability determined by the stability determination means.

According to the feature of (18), a target dividing number can be objectively computed based on analysis result data and/or stability; and therefore, by employing the target dividing number, it is possible to eliminate seeking short-term profit and then achieve a long-term and extensive sales strategy while taking a preference to secure and increase the number of fixed customers.

The present invention can further employ the following feature.

(19) The game playing information integration system of (14) is provided, wherein the server further includes:

game playing trend parameter computation means for, based on data stored in the data storage means in association with one item of player identification information, computing a game playing trend parameter indicating a game playing trend per predetermined reference unit as to a player to which the player identification information is assigned; and customer category determination means for determining a customer category of the player to which the player identification information is assigned, based on the game playing trend parameter computed by the game playing trend parameter computation means.

According to the feature of (19), customer category of a player can be determined, thus making it possible to classify data by the customer category and then perform sales according to the customer category.

The present invention can further employ the following feature.

(20) The game playing information integration system of (19) is provided, wherein the game playing trend parameter is a statistical value or a cumulative value of at least one of use amount of money, game playing time, game playing frequency, and amount of money lost.

According to the feature of (20), as a game playing trend, a statistical value or an accumulated value of these items of information is employed, thus making it possible to perform more appropriate analysis of customer category.

The present invention can further employ the following feature.

(21) The game playing information integration system of (19) or (20) is provided, wherein the data storage means, in association with player identification information, further stores player data related to a player to which the player identification information is assigned, and the customer category determination means determines customer category of the player to which the player identification information is assigned, based on the game playing trend parameter computed by the game playing trend parameter computation means and the player data stored in the data storage means.

According to the feature of (21), player data is employed to determine customer category, and thus, for example, in a case where a local area is near universities, even if a consumed amount is small, if a customer frequently visits a shop in the morning and subsequent, such customer is determined as a "fixed customer", or alternatively, in a case where an office has a large area, even if a customer visits a shop only in the evening and subsequent, if a condition is met, such customer is determined as a "fixed customer", thereby making it possible perform more precious analysis of customer category.

The present invention can further employ the following feature.

(22) The game playing information integration system of any one of (19) to (21) is provided, wherein the server further includes, in addition to the analysis processing means, a comparison table in which criteria for stability is set;

stability determination means for determining stability per predetermined reference unit, based on analysis result data indicating a result of analysis of the data and the comparison table;

target dividing number computation means for computing target dividing number per predetermined reference unit, based on analysis result data indicating a result of analysis by the analysis processing means and/or stability determined by the stability determination means; and alarm broadcasting means for performing broadcasting of alarm in a case where the number of fixed customers relative to a predetermined reference unit, which is computed based on customer category data as a result of determination by the customer category determination means, fails to meet a condition defined based on the target dividing number computed by the target dividing number computation means.

According to the feature of (22), in a case where the number of fixed customers fails to meet a condition defined based on the target dividing number, alarm broadcasting is performed, and thus, the manager in gaming facility does not need to daily check a relationship between the number of fixed customers and the target dividing number, and excellent convenience is realized.

The present invention can further employ the following feature.

(23) the game playing information integration system of (22) is provided, wherein the data storage means, in association with gaming machine unit identification information, stores a new device type identification flag for determining whether or not a gaming machine unit to which the gaming machine unit identification information is assigned is of new device type, and the stability determination means determines stability per predetermined reference unit, based on analysis result data, which does not include analysis result data related to a gaming machine unit to which gaming unit identification information is assigned with which a new device type identification flag set to ON is associated, and the comparison table.

According to the feature of (23), new device type data can be excluded from the category of determination of stability. Unlike other device types, a gaming machine of new device type may be operated by only an element of a "new gaming machine" regardless of model or property of machine. This is also true for "fixed customer" as well as the customer category classified as "visitor" or "customer aiming to earn money from new machine". Therefore, data of new device type is excluded from the category of determination of safety, thereby making it possible to perform more realistic sales analysis and planning of sales strategy.

The present invention can further employ the following feature.

(24) The game playing information integration system of any one of (1) and (11) to (14) is provided, wherein the data storage means, in association with gaming machine unit identification information, stores a new device type identification flag for determining whether or not a gaming machine unit to which the gaming machine unit identification information is assigned is of new device type, and the server further includes, in addition to the analysis processing means:

new device type condition determination means for determining whether or not a device type targeted for analysis meets a predetermined new device type condition, based on analysis result data indicating a result of the analysis of the data; and new device type identification flag setting means for setting a new device type identification flag to ON/OFF, based on a result of the determination by the new device type condition determination means.

The present invention can further employ the following feature.

According to the feature of (24), determination whether the gaming machine is of new device type is made by analysis of data, thus making it possible to perform more realistic determination in comparison with a case of performing determination as to whether or not the gaming machine is of new device type based on the number of days having elapsed from date of introduction. When performing "customer" analysis, "sales" analysis, and "machine" analysis, in order to keep track of (or eliminate) an effect of new device type, it is important to keep track of whether or not that device type is actually new.

Unlike other device types, a gaming machine of new type may be operated by only an element of a "new gaming machine" regardless of model or property of machine, and thus, when data is analyzed, it is desirable to eliminate an effect of new device type. However, it is unrealistic after all, if determination is made as to whether or not the gaming machine is of new device type based on the number of days having elapsed from date of introduction, for example, if analysis is performed by excluding device type still having influential power of new device type from the category of new device type or if device type which does not have influential power of new device type any more is included in analysis as new device type. However, according to the feature of (24), realistic determination of new device type is made, thus enabling realistic analysis of data.

It is to be noted that the present invention does not exclude determination as to whether or not the gaming machine is of new device type based on the number of days having elapsed from date of introduction. This is because determination as to whether or not influential power of new device may be difficult depending on device type. New device type which could not be sufficiently supported by players entails significant lowering of influential power due to an increased number of days having elapsed, thus making it possible to perform determination as to whether or not the gaming machine is of new device type comparatively easily by means of analysis of data. However, a gaming machine having acquired support from players is continuously played by such players, thus making it difficult to determine a boundary as to whether or not the gaming machine is of new device type. In such a case, determination is used together as to whether or not the gaming machine is of new device type based on the number of days having elapsed from date of introduction, thereby making it possible to normalize determination as to whether or not the gaming machine is of new device type.

The present invention can further employ the following feature.

(25) The game playing information integration system of (24) is provided, wherein the analysis processing means performs analysis of data associated with the gaming machine unit identification information to which the gaming machine unit identification information is assigned with which a new device type identification flag set to ON is associated, among the data received from the gaming machine unit and then stored in the data storage means, and the new device type identification flag setting means includes new device type identification flag resetting means for resetting to OFF a new device type identification flag to which the gaming machine unit identification information is associated, the identification information being assigned to a gaming machine unit of device type which is determined that a new device type condition is not met by the new device type condition determination means.

According to the feature of (25), a gaming machine for which data of an analysis result fails to meet a condition of new device type is excluded from the category of new device type, thus making it possible to perform more realistic analysis of data.

The present invention can further employ the following feature.

(26) The game playing information integration system of any one of (1) and (11) to (14) is provided, wherein the data storage means, in association with gaming machine unit identification information, stores a new device type identification flag for determining whether or not a gaming machine unit to which the gaming machine unit identification information is assigned, the server further comprises:

new device type analysis processing means for, among data received from the gaming machine unit and stored in the data storage means, analyzing data associated with the gaming machine unit identification information to which the gaming machine unit identification information is assigned with which a new device type identification flag set to ON is associated; and appropriate condition determination means for, based on new device type analysis result data as a result of analysis by the new device type analysis processing means, determining whether or not a setup number of gaming machine units to which the gaming machine unit identification information is assigned with which a new device type identification flag set to ON is associated meets a predetermined appropriate condition.

According to the feature of (26), normalization of a setup number of new device type can be objectively and logically performed. Gaming machines of new device type and their setup number (or setup ratio) are important in sales strategy of gaming facility. This is because, in a case where the setup number of gaming machines of new device type is smaller than the number demanded from players, the setup number of gaming machines of other device types is limited, and similarly, the players loses interest in shop and then moves to another gaming facility. In addition, gaming machines of new type is introduced into market one after another, and it is not rare that a plurality of new types are installed in gaming facility at the same time, so that it has been very difficult to determine the setup number of gaming machines of new device type. On the other hand, according to the feature of (26), appropriate determination of the setup number of gaming machines of new type can be performed from a result of integrative analysis of "customer" analysis, "sales" analysis, and "machine" analysis, and thus, it is useful upon appropriate establishment of sales strategy.

The present invention can further employ the following feature.

(27) The game playing information integration system of (1) is provided, wherein the analysis means includes:

variation trend continuation period extraction means for extracting a variation trend continuation period, based on number-of-consumptions data and number-of-payouts data stored in the data storage means and reception time data associated with the number-of-consumptions data and the number-of-payouts data, the variation trend continuation period being a series of period in which either one of an increase trend and a decrease trend of a difference number is continuous, an absolute value of a difference number in an entire period being a predetermined reference value or more, and the data storage means stores information related to the variation trend continuation period extracted by the variation trend continuation period extraction means in association with at least one of items of player identification information and gaming machine unit identification information.

In Patent Document 1, there is disclosure of summing data of payout and operability in individual gaming machines, and however, these items of data are a mere sales result derived from the characteristics of the respective gaming machines. In addition, there exist gaming machines which are capable of displaying a slump graph as a feature in the individual specific gaming machines, and however, the data is merely provided as the characteristics of the individual gaming machines, and even gaming machines of a same device type have their different characteristics, and therefore, individual slump data itself is further data than to state the characteristics of gaming machines of one type.

That is, it is not currently established yet as to data summing control processing of determining whether or not to have common or similar characteristics between such gaming machines for acquiring actual characteristics that are not theoretical values of a gaming machine, which are of type different from that of the gaming machine, and is called an excellent machine or data summing control processing of determining whether or not to have common or similar characteristics between gaming machines which are large and small in deviation of data.

In the feature of the above item (27), as characteristics of gaming machines, characteristics obtained from a sales result, which are not theoretical values in gaming machines of a same type, are macroscopically summed. Then, summing control processing is performed so that a result obtained by the summing control processing appears more clearly as characteristics for each type of gaming machines.

Summing control processing is realized in such a manner that different characteristics are obtained even in gaming machines of a same type by its setting location for each hall, sex, age, attribute (occupation) and season parameters of many fixed customers.

Further, there is provided a summing control processing method and its related system in which, from results of various data summing operations described above, a range of a plurality of stages in a predetermined difference number is set, and a sample number of number-of-consumptions/number-of-payouts in this set range is cumulatively stored, whereby characteristic values of sales entities for each device type of gaming machine are obtained, it is found out that the characteristic values are similar to each other in gaming machines serving as excellent machines, and using the finding it is determined whether the machine is similar or not to another gaming machine played in the past so as to be thereby useful for determination or the like of a set number of gaming machines.

The characteristics described above are summed by setting location and sex, age, attribute (occupation), and season parameters of many fixed customers, thereby making it possible to output characteristic data as to which type of gaming machines played in the past is similar to the target type of gaming machines in the respective parameters. Further, by checking the characteristic values of each of the plurality of parameters, it is also possible to output characteristic data as to which type of gaming machines played in the past is similar to the target type of gaming machines by comprehensively checking the parameters.

Specifically, according to the feature of (27), analysis of gaming machines, which has been intuitively and which has been intuitively and qualitatively performed by each player, can be quantitatively and objectively performed, and further, its related results can be integrated with each other.

Conventionally, for example, when players talk with each other about the results of their own play of games, the characteristics of their one play of games are often expressed by the presence or absence of the variation trend continuation period or its related generation timing, such as an expression that "no bonus took place for one hour" or "bonus continued for 30 minutes". This is because players understand that the variation trend continuation period is an effective milestone representing characteristics of gaming machines regardless of whether the player takes care or does not take care of the matter. However, conventionally, these items of information stay in the hearts of individual players, and gaming facilities could not actively utilize them.

According to the feature of (27), these items of information can be quantitatively and objectively acquired and summed, thus making it possible to analyzing and evaluate gaming machines in a sense closer to that of players.

It is to be noted that a series of period may be a period in units of time, and may be a period in units of the number of games played.

The present invention can further employ the following feature.

(28) The game playing information integration system of (27) is provided, wherein the data storage means stores sample data indicating a sample pattern to be compared with a variation pattern of a difference number according to an elapse of time or the number of games in association with type data indicating a type of the sample pattern, the analysis means includes:

pattern data generation means for generating variation pattern data indicating a variation pattern of a difference number according to an elapse of time or the number of games, based on number-of-consumptions data and number-of-payouts data stored in the data storage means and reception time data associated with the number-of-consumptions data and the number-of-payouts data;

sample data extraction means for performing comparison between a variation pattern of a difference number indicated by the variation pattern data and a sample pattern indicated by sample data, and extracting sample data indicating a sample pattern which is the most similar to a variation pattern of the difference number; and type output means for performing an output indicating a type, based on type data associated with the sample data extracted by the sample data extraction means.

According to the feature of (28), characteristics of a gaming machine unit can be quantitatively and objectively analyzed by means of analysis of a variation pattern (for example, waveform of slump graph or appearance frequency or difference number of variation trend continuation period).

The present invention can further employ the following feature.

(29) The game playing information integration system of (28) is provided, wherein the analysis means further includes sample data generation means for storing as sample data in the data storage means, variation pattern data generated by the pattern data generation means in association with type data indicating a type which is identical to that of type data associated with sample data extracted by the extraction means.

According to the feature of (29), variation pattern data as an actually measured value can be acquired as sample data, and thus, the sample data is accumulated, thereby making it possible to cumulatively enhance analysis precision.

The present invention can further employ the following feature.

(30) The game playing information integration system of (1) is provided, wherein the player identification information reading means intermittently or continuously reads a face of a player, and outputs obtained face data, the server includes player identity determination means for determining identity of a player who plays a game at the gaming machine unit, based on the face data intermittently or continuously output from the gaming machine unit, and the data storage means stores, while the player identity determination means determines that a game is played by a same player by, the data storage means stores each of number-of-consumptions data output from the number-of-consumptions data output means and number-of-payouts data output from the number-of-payouts data output means in association with a same item of player identification informant, and when the player identity determination means determines a player is changed, the data storage means stores said each data in association with a different item of player identification information.

According to the feature of (30), the start or completion of the play of game by a player who does not desire to provide one's own information (such as membership registration) can be grasped by player identity determination means, thus enabling more precious acquisition of data.

The present invention can further employ the following feature.

(31) A data acquisition control method, including:

a variation trend continuation period extraction step of extracting a variation trend continuation period, based on incoming and outgoing number data related to incoming and outgoing of gaming media in one gaming machine unit and time data indicating time or a time interval of incoming and outgoing of gaming media, the variation trend continuation period being a series of period during which an increase trend or a decrease trend of difference number is continuous, and an absolute value of difference number in an entire period is equal to or greater than a predetermined reference value; and a storage step of storing information related to the variation trend continuation period extracted by the variation trend continuation period extraction step in association with at least one item of player identification information and gaming machine identification information.

The present invention can further employ the following feature.

(32) A data acquisition control method, including:

a pattern data generation step of generating a variation pattern data indicating a variation pattern of difference number according to an elapse of time or the number of game played, based on outgoing and incoming number data related to outgoing and incoming of gaming media in one gaming machine unit and time data indicating time or a time interval of incoming and outgoing of gaming media;

a sample data extraction step of performing comparison between a variation pattern of difference number indicated by the variation pattern data and a sample pattern indicated by sample data, and extracting sample data indicating a sample pattern which is the most similar to the variation pattern of the difference number, the sample data indicating a sample pattern compared with the variation pattern, associated with type data indicating a type of the sample pattern; and a type step of performing an output indicating a type, based on type data associated with the sample data extracted by the sample data extraction means.

The present invention can further employ the following feature.

(33) A data acquisition method, including:

a face reading step of intermittently or continuously reading a face of a player and then generating face data;

a player identity determination step of, based on the face data, determining identity of a player who plays game at a gaming machine unit;

a player continuation step of, while it is determined that a game is played by a same player by player identity determination means, storing in storage means each item of number-of-consumptions data output from the number-of-consumptions data output means and number-of-payouts data output from the number-of-payouts data output means in association with a same item of player identification information; and a player change step of when it is determined that a player is changed by the player identity determination means, storing such item of the data in associated with a different item of player identification information.

(Game Playing Information)

Hereinafter, terms related to game playing information will be described.

An "operability" (%) is computed by means of "(OUT number/(Absolute Out number per hour×business time))×100". The absolute Out number in pachinko gaming machine is 83, for example, the absolute Out number in pachinko/slot gaming machine is 33, for example.

A "safe" is referred to as game pachinko ball or coin paid out by a gaming machine. A "safe" pachinko ball is referred as game pachinko ball paid out by a gaming machine.

A "good pachinko ball" is computed by means of "number of Outs-number of Safes". In addition, "difference number" is also computed by means of "Number of outs-Number of safes", and is employed regardless of type of gaming medium.

A "winning pachinko ball rate" (%) is computed by means of "(number of safes"/number of outs)×100".

A "prize dividing number" is computed by means of "prize money (Yen)/amount of sales (Yen)".

A "machine dividing number" is computed by means of "(sales amount (Yen)−amount of money for good pachinko ball (Yen))/amount of sales (Yen) or "(sales pachinko ball-good pachinko ball)/sales pachinko ball".

An "incorrect difference pachinko ball" or "prize error" is computed by means of "(sales pachinko ball-good pachinko ball)−prize pachinko ball".

A "pachinko ball unit prize" is computed by means of "machine sales/number of outs".

A "pachinko ball gross profit" is computed by means of "machine gross profit/number of outs".

A "total amount of sales" is computed by means of "machine operability×number of machines×number of days×pachinko ball unit prize".

A "machine sales" is computed by means of "number of outs"×pachinko ball unit price" or "total amount of sales/number of machines".

A "gross profit" is computed by means of "amount of sales-purchase amount of prize" or "amount of sales−(prize money×cost)".

A "gross profit by machine" is computed by means of "machine sales×profitability".

A "total gross profit" is computed by means of "machine operability×number of machines×number of days×gross profit by pachinko ball".

A "cost rate" is computed by means of "number of pachinko balls lent (per 100 pachinko balls)×number of pachinko balls exchanged (per 100 Yen)".

A "balance dividing number" is computed by means of "number of pachinko balls exchanged (per 100 Yen)/number of pachinko balls exchanged (per 100 Yen)" or "1/cost rate".

A "profitability" is computed by means of "gross profit/amount of sales" or "(balance dividing number-dividing number)/balance dividing number)×100".

A "Base (B)" is computed by means of "(number of safes in normal game/number of outs in normal game)×100".

A "B %" is computed by means of "100−base".

A "BY" is computed by means of "base-start×start number-of-payouts" A "customer stay rate" is computed by "(cumulative B-service time/amount of sales"×100%.

A "TS" is computed by means of "cumulative start number/special prize number".

A "BO" (minutes) is computed by means of "TS/start number (one minute), BO (real number)/100".

A "TO" has a relationship of "TO(real number)/100=special prize time (minutes).

A "T10" has a relationship of "T10(total)/100=minutes (TO).

A "TY" is computed by means of "number of safes in special prize-number of outs in special prize".

A "T1Y" is computed by means of "number of safes in big hit-number of outs in big hit(T10)".

A "BA" is computed by means of "number of safes in changed probability/number of outs in changed probability".

A "BOA" is computed by means of "TSA/start A".

In the present invention, game playing information is not limited to the above described matters. Data which is obtained by primarily or secondarily enhancing data output from a gaming machine unit falls under game playing information. The game playing information integration system according to the present invention is capable of generating and outputting the above-described game playing information.

In addition, the present invention may employ the following feature.

(a) A plurality of gaming machines, a gaming medium lending device provided for each of the gaming machines, and a respective one of individual counting devices provided for each of the gaming machines are connected to each other via a communication interface. Then, winning-pachinko ball data, consumption (to-be-consumed) gaming media (shooting pachinko balls or lending pachinko balls) data is received to be added from each device to gaming machine identification information, the data is stored in a storage means in such a manner as to determine what time the data is receive while in operation, based on time data obtained from a clock device included therein.

According to the feature of (a), a dividing number relative to actual operation time and operation time and nonoperation time while in business time, thereby making it easy to obtain dividing number or big hit frequency relative to actual operation time in the whole gaming facility and then numerically obtain safety in shop management.

In the feature of (a), the following feature can be further employed.

(a-1) In a case where a dividing number is obtained and then from the dividing number then stability is obtained, obtaining a dividing number actually operation for each gaming machine and obtaining non-operation time are executed. Long operation time and a greater dividing number denote that even if a dividing number is same, it is evaluated that a player loses significantly. Conversely, evaluation may be performed from operation time. In a case where predetermined stability is obtained, alarming is output and then review of settings or the like is requested.

(a-2) Further, an ID card slot for identifying a player is provided at any of the above-described devices, and the data obtained from each of the above-described devices is stored in association with player identification data. Stability of (a) is obtained only for data of fixed customer.

(a-3) Device type data is stored in association with data to be received and then stability for each device type is obtained from a relationship in settings between cumulative non-operation time and device. In this manner, popularity information for each device type can be obtained.

(a-4) Even if a dividing number is small (even if a rate of cashing back to a player is small), it may be presumed that new device type is popular due to an element other than the dividing number. Therefore, there is a need to compute time during which customer attraction by means of performance of gaming machine itself is made. In a case where stability in whole gaming facility is obtained, data of new device type is not initially considered, and however, move data at a time point at which it is determined that newness is lost is controlled so as to be employed for computation of stability. A reason for initial exclusion from data for computation of stability is that popularity in the case of new device type is not significantly influenced by a dividing number. In the case of new device type, although extended game playing tie is initially predicted from its newness, a change in operation time as the game playing time (rate of operability in whole business time or change in average unit game playing time) is compared with comparison source data, and when a predetermined change is obtained, it is determined that customer attraction due to its newness change to popularity of gaming machine itself.

In addition, as characteristic analysis of the new gaming machine, the data is compared with data of gaming machines of the past device type (for example, data obtained by computing appearance frequency of big hit, and further, difference number range margin of replacement pachinko balls and IN/OUT count pachinko balls per unit time counted by means of individual counting device). Then, a similar gaming machine name in the past is output and displayed, thereby predicting whether or not it will be a popular gaming machine. Then, from this item of information, it is artificially determined whether or not a new/old rate of setup number in shop is appropriate.

Parameters for determination in the feature of (a) include: (i) popularity information by customer hierarchy (%) (This item of data is mainly intended for fixed customer, which is based on computation of average use amount of money, average game playing time, average visit frequency, and average loss, and popularity information by device type is computed.), operation trend of machine/device type by customer category, and analysis of model and characteristics of machine (such as big hit deviation or big hit frequency, for example); and (ii) business dividing number and shop profit.

The present invention may employ the following feature. (b) It is made of: a plurality of gaming machines (which may not be connected to the gaming machines themselves or may only be connected to a lending device or an individual counting device); an IC card reading slot which is connected to each of the gaming machines or which is adjacently disposed; a storage device for storing time intervals from an IC card being inserted into the slot to the card being removed, in association with identification data of the IC card; a determination device for determining whether or not the identification data corresponds to a specific group (fixed customer or not); a device for computing a cumulative value or average value of any one or more of use amount of money, game playing time, number of visits, and amount of loss from game playing data from a gaming machine determined that it is the specific group; and a display device for externally displaying an alarm in a case where a computation result exceeds a predetermined threshold value.

(b') Facial recognition may be performed instead of identifying fixed customer by means of IC card.

(b-1) In a sense of thinking harmony and/or balance, an instruction display to change a dividing number of gaming machine may be output at a previous stage of generating alarming. Namely, in a case where a probability adjustment function for big hit probability or the like is added to a gaming machine, the setting is changed and a dividing number is changed to an optimal one by gaming machine or by gaming machine mount.

(b-2) In case of machine withdrawal, a case in which gaming machines of same device type are withdrawn in all is also predicted. Therefore, in a case where a withdrawal target is determined for each device type, the data stored in the storage device needs to be stored in association with device type identification data as well as card identification information.

Second Aspect of the Present Invention

As mentioned above, gaming machine-based analysis systems have been present conventionally. However, No conventional system which analyzes the life cycle of the gaming machine the life cycle of the player has been present. In order to achieve the objects mentioned above, the present invention employs, as a main structure thereof, a constitution for comparing and analyzing the life cycle of the gaming machine and the life cycle of the player, and outputting advice (alert and indication of state change, etc.) to keep the balance of the two.

Accordingly, employing the present invention allows adjustment of installation of the gaming machines in the gaming facility depending on characteristics of visiting players in consideration of characteristics of a variety of gaming machines.

For example, when there are many high rollers, the rate of installation of high-denomination gaming machines is increased in the gaming facility. When the life cycle of the high rollers is becoming to have the tendency of "dissatisfied customers", the rate of installation of high-denomination gaming machines is increased in the gaming facility as mentioned above.

On the contrary, when there are few high rollers and many players who likes low-denomination gaming machines, the number of low-denomination gaming machines for high rollers is increased the rate of installation of high-denomination gaming machines in the gaming facility is lowered. When the life cycle not the high rollers who like high-denomination gaming machines but the players who like low-denomination gaming machines is becoming to have the tendency of "dissatisfied customers", the rate of installation of the low-denomination gaming machines in the gaming facility is increased as mentioned above.

More specifically, the present invention employs the following constitution to achieve the objects mentioned above.

(34) A game playing information integration system comprising:

a plurality of gaming machine units; and a server connected to enable communication with each of the gaming machine units, wherein the gaming machine unit includes: the gaming machine unit game initiation or completion data output means which outputs a game initiation or completion data for cumulatively monitoring the number of times of games executed by the server for each game by the execution of the game, the server includes:

data storage means which stores the game initiation or completion data outputted by the game initiation or completion data output means and reception time data indicating a reception time of the data in association with each other, and, stores, in advance, map layout indication image data of the gaming facility, location information of said each gaming machine unit indicated in the map layout indication image, and when data is received from the gaming machine unit, and lookup data with identification information for each gaming machine unit included in the data, analysis processing means for performing analysis of data received from the gaming machine unit and then stored in the data storage means;

an output means produces image data depending on the results analyzed by this analysis means and outputs the data to an external portion, wherein the analysis processing means produces a cumulative value of game initiation or completion data for each gaming machine unit based on data stored in the data storage means, and the output means executes a processing of outputting an image of the location information of each gaming machine unit in the outputted map layout indication image as an image data changed depending on the cumulative value.

(35) Further to the constitution of the above (34), the analysis means grasps the number of all players from player identification information transmitted from each gaming machine unit, produces an average rate of game execution of players by time unit, and produces a rate of operation of all game units by time unit, the output means produces graph image data from the rate of game execution and operability and outputs the graph image data to an external portion.

(36) A game playing information integration system including:

a plurality of gaming machine units; and a server connected to enable communication with each of the gaming machine units, wherein the gaming machine unit includes:

a player identification information reading means which is capable of reading player identification information, and outputs the read player identification information;

the gaming machine unit includes game execution data output means which outputs to the server outputting predetermined data by the execution of the game (the game execution data output means is the data generated by executing the game, and for example, any of a game initiation or completion data output means which outputs game initiation or completion data for cumulatively monitoring the times of game executed for every execution of the game, a number-of-consumptions data related to the number of consumptions of gaming media, and a number-of-payouts data output means for outputting number-of-payouts data related to the number of payouts of game playing media are included in the concept of the game execution data output means), wherein the gaming machine unit identification information is individually assigned to each of the gaming machine units, the server includes:

data storage means which stores the player identification information, the predetermined data outputted by the game execution data output means, and reception time data indicating reception time of the predetermined data (not the time range of receipt, but, for example, log indicating the time of receipt) in association with each other;

analysis processing means for performing analysis of data received from the gaming machine unit and then stored in the data storage means; and output means which produces image data depending on the results analyzed by this analysis means and outputs the data to an external portion, the analysis processing means executes, based on data stored in the data storage means, a processing which produces data relating to at least (x) to (y), (x) a value of the predetermined data of each player at the gaming machine unit (for example, game initiation or completion data), (y) a cumulative value of cumulative number of visitors by the type of players classified into player identification information of each player at the gaming machine unit, and further the output means executes:

by the analysis means, based on the two cumulative value produced by the processings (x) and (y), a processing of editing a map layout indication image showing a state that the gaming machine units are disposed in the gaming facility to change based on a cumulative value of the predetermined data, outputting the edited map layout information to indicate, and a processing of generating and outputting a graph image based on the cumulative value of the number of visitors by the type of players classified in the player identification information in advance.

(38) Further to the constitution of (34), a processing of producing and outputting a graph image based on the cumulative value obtained in the (x) by the analysis means is executed.

The analysis means is constituted as to produce the two cumulative values, but when the performance of the gaming machines is generally evaluated, it may be evaluated based on the game information mentioned above.

As mentioned above, the present invention includes the first aspect and the second aspect, but the first aspect and second aspect of the present invention are not distinct inventions. The game playing information integration system according to the first aspect of the present invention may include the constitution the game playing information integration system according to the second aspect of the present invention, and may be equivalent to the game playing information integration system according to the second aspect of the present invention. On the contrary, the game playing information integration system according to the second aspect of the present invention may include the game playing information integration system according to the first aspect of the present invention, and may be equivalent to the game playing information integration system according to the first aspect of the present invention. That is, the game playing information integration system of the present invention may include the constitutions of both the first and second aspects of the present invention.

The "game initiation or completion data" may be "number-of-consumptions data" and "number of payouts", and may include "number-of-consumptions data" and "number of payouts". The "game initiation or completion data an output means" may be "number-of-consumptions data output means" and "number-of-payouts output means", and may include "number-of-consumptions data output means" and "number-of-payouts output means". The "cumulative value of the game initiation or completion data" is not limited to a mere cumulative value of the game initiation or completion data, but may include data computed directly or indirectly from a plurality of game initiation or completion data. Examples of such data include degree of satisfaction, (a) a game playing period per one time of each player in the gaming machine unit; (b) a change with an elapse of time of a balance of the player in the game playing period; (c) operation time of the gaming machine unit; and (d) profit of a shop side by the gaming machine. That is, in the invention according to the first aspect of the present invention, the data produced based on the number-of-consumptions data and number of payouts outputted with an elapse of time from the gaming machine unit (for example, degree of satisfaction) may be equivalent to the cumulative value of the game initiation or completion data.

Effects of the Invention

According to a game playing information integration system of the first aspect of the present invention, it is possible to objectively perform selection and settings according to the preferences of players, in particular, fixed customers, and it is also possible to efficiently introduce gaming machines which are capable of invoking a demand for players as users and managers in gaming facilities in a well-balanced manner from a result obtained by local analysis. According to the game playing information integration system of the second aspect of the present invention, the operational state of the gaming facility can be visually grasped in real time even by a manager or an operator with little experience. Therefore, it is not necessary to analyze the management state from numerical values as in a conventional method, and measures to take after grasping the state can be quickly taken.

BRIEF DESCRIPTION OF THE DRAWINGS

FIG. 7 is an explanatory view depicting one example of the game playing status database stored in the hall conserver shown in FIG. 1.

FIGS. 8A, 8B, and 8C are tables depicting one example of a correlation database stored in the hall conserver shown in FIG. 1.

FIGS. 9A, 9B, and 9C are tables depicting one example of a determination result database stored in the hall conserver shown in FIG. 1.

FIG. 33 is an explanatory view showing an example of the sales-related database stored in the IC card server shown in FIG. 21.

FIGS. 34A and 34B are each an explanatory view depicting an example of the game playing status database stored in the hall conserver shown in FIG. 21.

FIG. 35 is an explanatory view depicting an example of the correlation database stored in the hall conserver shown in FIG. 21.

FIG. 36 is an explanatory view depicting an example of the determination result database stored in the hall conserver shown in FIG. 21.

FIG. 37 is an explanatory view showing one example of a member management database stored in the member management server shown in FIG. 21.

FIG. 50 is a view showing one example of a gaming machine comparison table for determining stability.

FIG. 51 is a view showing one example of a gaming facility comparison table for determining stability.

FIG. 53 is a table showing an introduction shop operation state (whole) by local area.

FIG. 54 is a table showing an introduction shop operation state (residential street) by local area.

FIG. 55 is a table showing one example of operation result by shop in residential street.

FIG. 56 is a table showing an introduction shop operation state (road side) by local area.

FIG. 57 is a table showing one example of operation result by shop in road side.

FIG. 58 is a table showing an introduction shop operation state (front of station) by local area.

FIG. 59 is a table showing one example of operation result by shop in front of station.

FIG. 60 is a table showing an introduction shop operation state (busy street) by local area.

FIG. 61 is a table showing one example of operation result by shop in busy street.

FIG. 84 is a table showing data related to the number of players and winning rates or the like in shop α.

FIG. 94 is a table showing data related to the number of players and winning rate or the like in shop β.

FIG. 95 is a table showing data related to the number of players and winning rate or the like in shop γ.

FIG. 96 is a table showing data related to the number of players and winning rate or the like in shop δ.

FIG. 97 is a table showing data related to the number of players and winning rate or the like in shop ϵ.

FIGS. 99A, 99B, 98C, and 99D are pie graphs showing game playing time per player by day (fifth to eighth days), respectively.

FIGS. 100A, 100B, 100C, and 100D are pie graphs showing ages of players by day (first to fourth days), respectively.

FIGS. 101A, 101B, 101C, and 101D are pie graphs showing ages of players by day (fifth to eighth days), respectively.

FIGS. 105A, 105B, 105C, and 105D are pie graphs showing attributes of players by day (fifth to eighth days), respectively.

FIG. 118 While FIG. 117 shows the screen indicated when the "degree of satisfaction of visiting customers" is selected, this

FIG. 120 is a view depicting a display image indicated by specifying the site of "Device type E Device type A" of an alert display portion of F13 in FIG. 119 with a pointer.

Figure 1:
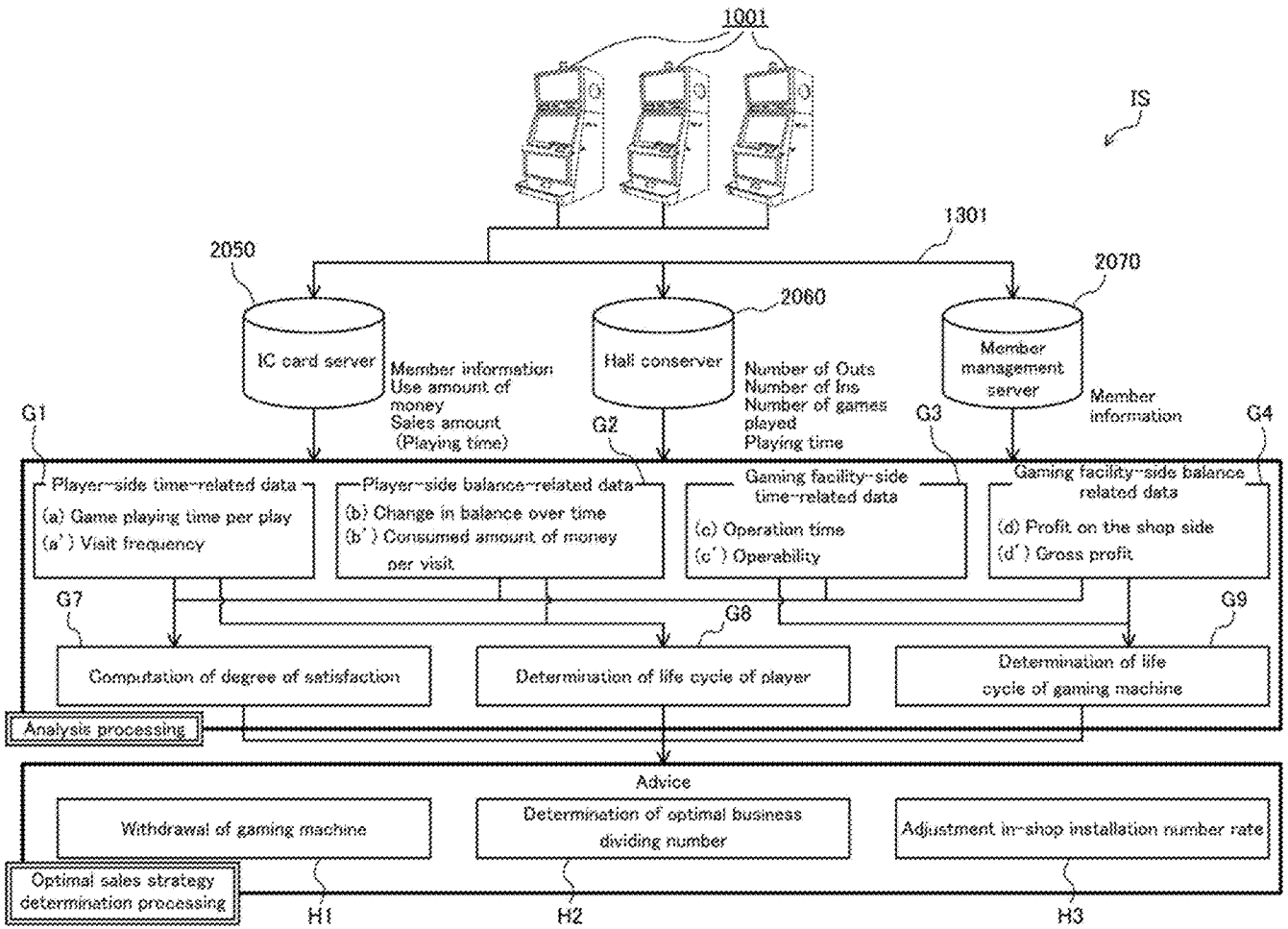
FIG. 1 is a functional flowchart depicting an outline of a game playing information integration system.
Figure 121:
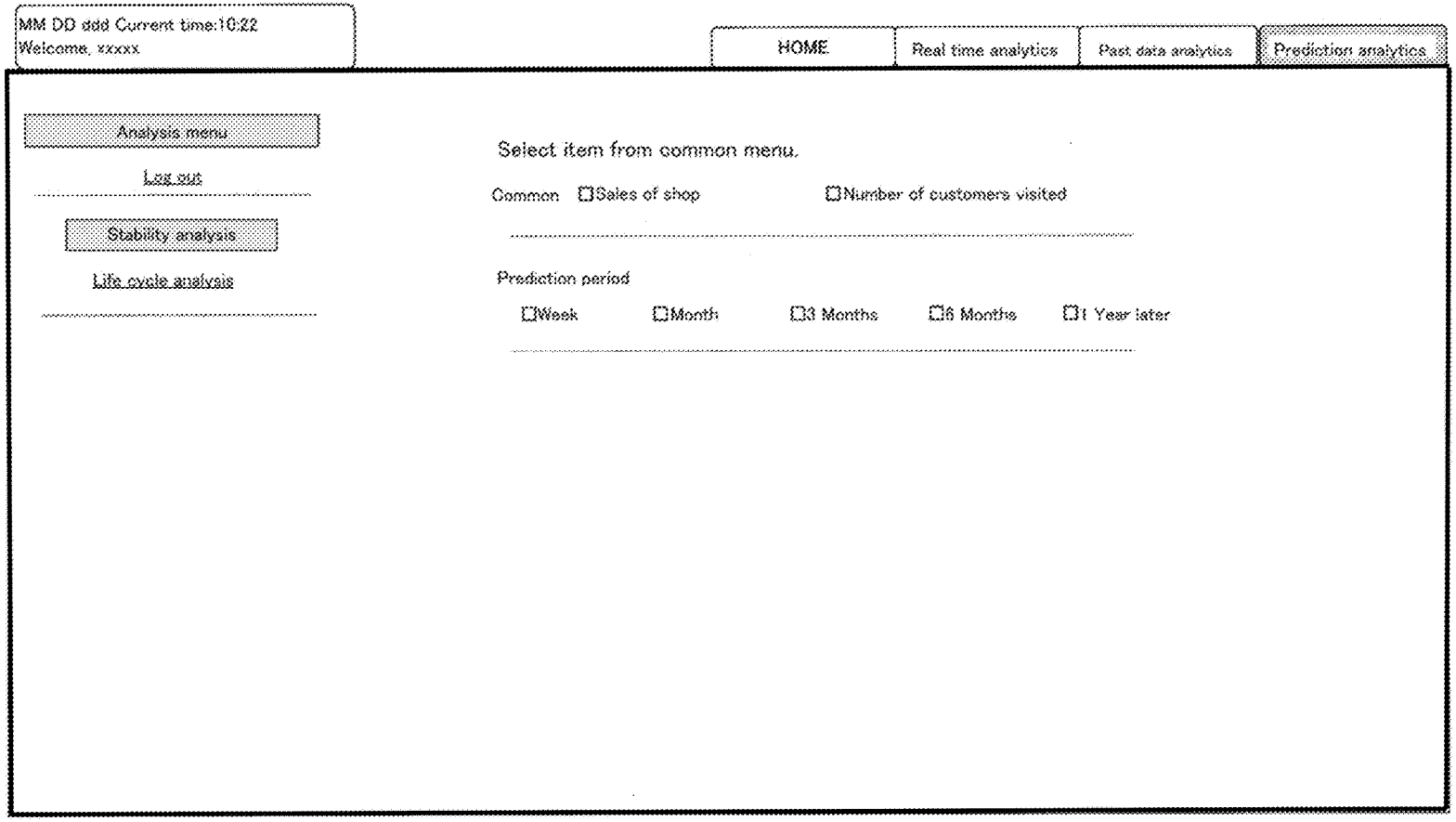

FIG. 121 is an explanatory view indicated on display screens of personal computers which produce display screen data based on the data obtained from the analysis processing as the analysis processing means of FIG. 1 and are installed in the gaming facility (not shown) and of cellular phones connected via the internet and the like. This explanatory view is a view indicated when "prediction analytics" is selected among "home", "real time analytics", "past analytics", and "prediction analytics" indicated on the display screen.

MODE FOR CARRYING OUT THE INVENTION

FIG. 1 is a functional flowchart showing an outline of a game playing information system in a casino.

A game playing information integration system IS includes: a plurality of gaming machine units 1001; an IC card server 2050; a hall conserver 2060; and a member management server 2070. The gaming machine 1001 corresponds to the gaming machine unit of the present invention. The IC card server 2050, the hall conserver 2060, and the member management server 2070 are equivalent to "servers" in the present invention. The servers in the present invention may be made of a plurality of devices, or alternatively, may be made of a single device. Therefore, the servers of the invention may be constituted by the hall conserver 2060 only in the present invention.

Data read from the gaming machine 1001 or the data inputted into the gaming machine 1001 are transmitted to any one of the IC card server 2050, hall conserver 2060 and member management server 2070. Examples of data transmitted include consumed-amount-of money data or sales amount data, reception time data, player identification information, the gaming machine unit identification information, number-of-consumptions data, number of payouts, number of games played data, number-of-prize-winning-time data, among others.

In the hall conserver 2060 based on data transmitted to the IC card server 2050, the hall conserver 2060 or the member management server 2070, (a) the game playing time per play in the gaming machine 1001, and (a') the visit frequency are computed (G1).

Moreover, in the hall conserver 2060 based on the data transmitted to the IC card server 2050, the hall conserver 2060 or the member management server 2070, (b) change in balance over time and (b') consumed amount of money per visit are calculated (G2).

Moreover, in the hall conserver 2060 based on data transmitted to the IC card server 2050, the hall conserver 2060 or the member management server 2070, (c) the operation time of the gaming machine 1001, and (c') the operability of the gaming machine 1001 are calculated (G3).

Furthermore, in the hall conserver 2060 based on data transmitted to the IC card server 2050, the hall conserver 2060 or the member management server 2070, (d) the profit of a shop side by the gaming machine 1001, and (d') the gross profit of the gaming machine 1001 are calculated (G4).

In the hall conserver 2060 based on (a) the game playing time per play, and (b) the change in balance over time, the degree of satisfaction of player for the gaming machine 1001 is computed, and (c) the operation time of the gaming machine 1001, and (d) based on the profit of a shop side by the gaming machine 1001, the degree of satisfaction of a shop side for the gaming machine 1001 is computed (G7). The computation of the degree of satisfaction will be described later.

In the hall conserver 2060, based on (a') visit frequency and (b') consumed amount of money per visit, the life cycle of the player is determined (G8). The determination of the life cycle of the player will be described later.

In the hall conserver 2060 based on (c') the operability of the gaming machine 1001, (d') the gross profit of the gaming machine 1001, the life cycle of the gaming machine 1001 is determined (G9). The life cycle of the gaming machine 1001 determination will be described later. The processings of G1 to G9 corresponds to the analysis processing.

The hall conserver 2060 performs, based on the degree of satisfaction for the gaming machine 1001 of the gaming facility and of the player, and the life cycle of the player, the life cycle of the gaming machine, a processing to indicate advice (H1 to H3). Examples of the processing to indicate advice include the withdrawal of machine (H1), the determination of optimal business dividing number (H2), and the adjustment of the in-shop installation number rate (H3).

Figure 2:
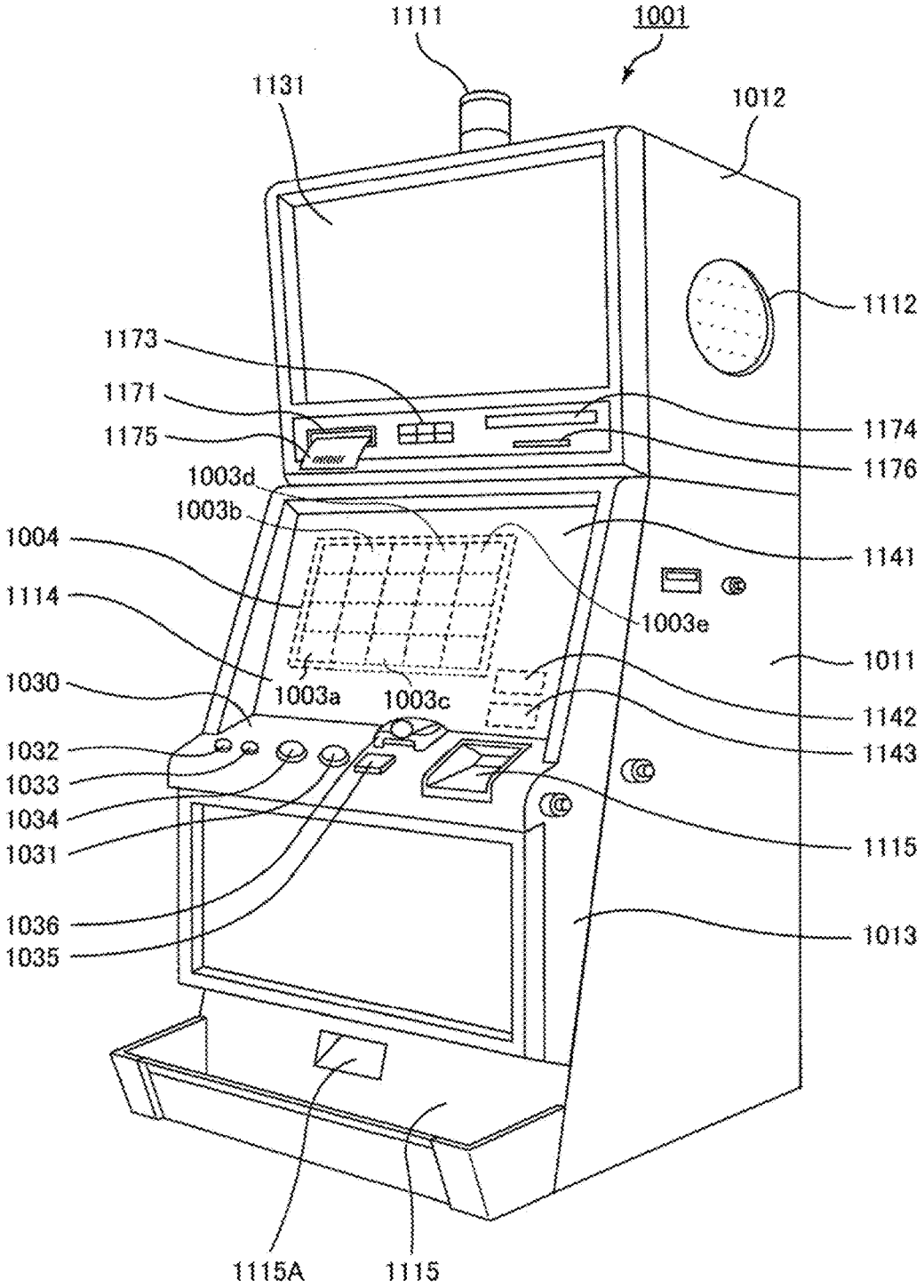
FIG. 2 is a network configuration view depicting one example of a game playing information integration system according to the embodiment.

FIG. 2 is a perspective view schematically showing an example of the slot machine shown in FIG. 1.

In the gaming machine 1001, as the game medium, coins, bills or electronic valuable information equivalent to these are used. Moreover, in this embodiment, tickets with bar codes described later are also used. It should be noted that It is to be noted that the gaming media are not limited to these, and may be medals, tokens, or electronic moneys, for example.

The gaming machine 1001 includes a cabinet 1011, a top box 1012 placed on top of the cabinet 1011, and a main door 1013 provided on the front face of the cabinet 1011.

In the center of the main door 1013, a lower image display panel 1141 is provided. The lower image display panel 1141 is composed of a liquid crystal panel, constituting a display. The lower image display panel 1141 has a symbol display area 1004. In the symbol display area 1004, 1005 video reels 1003 (1003*a*, 1003*b*, 1003*c*, 1003*d*, 1003*e*) are indicated.

In this embodiment, the term "video reel" used here designates the representation of the operations of the rotation and stopping of a mechanical reel having the plurality of symbols drawn on its periphery by means of images. A symbol line including a plurality of (in this embodiment, 22) symbols determined in advance is assigned to each one of the video reels 1003.

In the symbol display area 1004, the symbol line assigned to each one of the video reels 1003 is scrolled respectively, and stops after a predetermined time has elapsed. As a result, a portion (in this embodiment, continuous 4 symbols) of each symbol line is indicated to the player.

In the symbol display area 1004, one symbol is indicated in each of four areas: upper row, central upper row, central lower row and lower row with correspondence to each one of the video reels 1003. That is, in the symbol display area 1004, 5 rows×4=20 symbols are indicated.

In this embodiment, any one of the above four areas is selected with correspondence to each one of the video reels 1003, and the lines formed by connecting the areas are used as paylines.

It should be noted that specific modes of the paylines can be optionally employed, and for example, straight lines, V-shaped, curved lines or the like formed by connecting the areas of the central upper row with correspondence to each one of the video reels 1003 can be employed. Moreover, the number of paylines employed can be also optional, for example, 30.

Moreover, the lower image display panel 1141 has a number-of-credits display area 1142 and a number-of-payouts display area 1143. In the number-of-credits display area 1142 the number of coins which are owned by the player and deposited within the gaming machine 1001 (hereinafter referred to as the number of credits) is indicated. Moreover, in the number-of-payouts display area 1143, the number of coins paid out to the player when an award is achieved (hereinafter referred to as number of payouts) is indicated.

Moreover, in the lower image display panel 1141 a touch panel 1114 is built in. The player can input various instructions by touching the lower image display panel 1141.

Below the lower image display panel 1141, various devices which are the targets of operations performed by the player, are disposed, including various buttons disposed on a control panel 1030.

A spin button 1031 is used in initiating scrolling of the symbol line of each of the video reels 1003. A change button 1032 is used for requesting exchange to an attendant of the gaming facility. A CASH OUT button 1033 is used to pay out coins deposited within the gaming machine 1001 onto a coin tray 1015.

A 1-BET button 1034 and a maximum BET button 1035 is to determine the number of coins used for the game from coins deposited within the gaming machine 1001 (hereinafter referred to as BET number). The 1-BET button 1034 is used in determining the above BET number by the unit of 1. The maximum BET button 1035 is used in setting the above BET number to a specified upper limit number.

A coin slot 1036 is provided to receive coins. A bill identifier 1115 is provided to receive bills. The bill identifier 1115 selects whether a bill is valid, and receives valid bills into the cabinet 1011. It should be noted that the bill identifier 1115 may be constituted to allow reading of a ticket 1175 with a bar code described later.

On the front face of the top box 1012, an upper image display panel 1131 is provided. The upper image display panel 1131 is composed of a liquid crystal panel, constituting a display. images concerning stage effects, images showing introduction of the contents of the game and descriptions of rules are indicated on the upper image display panel 1131. Moreover, on the top box 1012, a speaker 1112 and a lamp 1111 are provided. In the gaming machine 1001, stage effects are performed by means of indication of images, output of sounds and output of light.

Below the upper image display panel 1131, a ticket printer 1171, a card slot 1176, a data display device 1174, and a key pad 1173 are provided.

The ticket printer 1171 prints a bar code encoding the number of credits, date, the identification number of the gaming machine 1001 and other data on a ticket, and outputs the ticket as the ticket 1175 with a bar code. The player has the gaming machine read the ticket 1175 with a bar code to perform the game, and can exchange the ticket 1175 with a bar code to bills at a predetermined place in the gaming facility (for example, a cashier in a casino).

The card slot 1176 is for inserting a card in which predetermined data are stored. For example, data for identifying the player (player identification information) and data relating to the history of the game played by the player are stored on the card.

Data are read from and written in the card inserted into the card slot 1176 by a card reader 1172 described later. It should be noted that data equivalent to coins, bills or credits may be stored on the card.

The data display device 1174 includes a fluorescent display, light-emitting diode and the like, and is for indicating, for example, the data read by the card reader 1172 and the data inputted by the player via the key pad 1173. The key pad 1173 is for inputting instructions and data relating to issuing tickets and the like.

Figure 3:
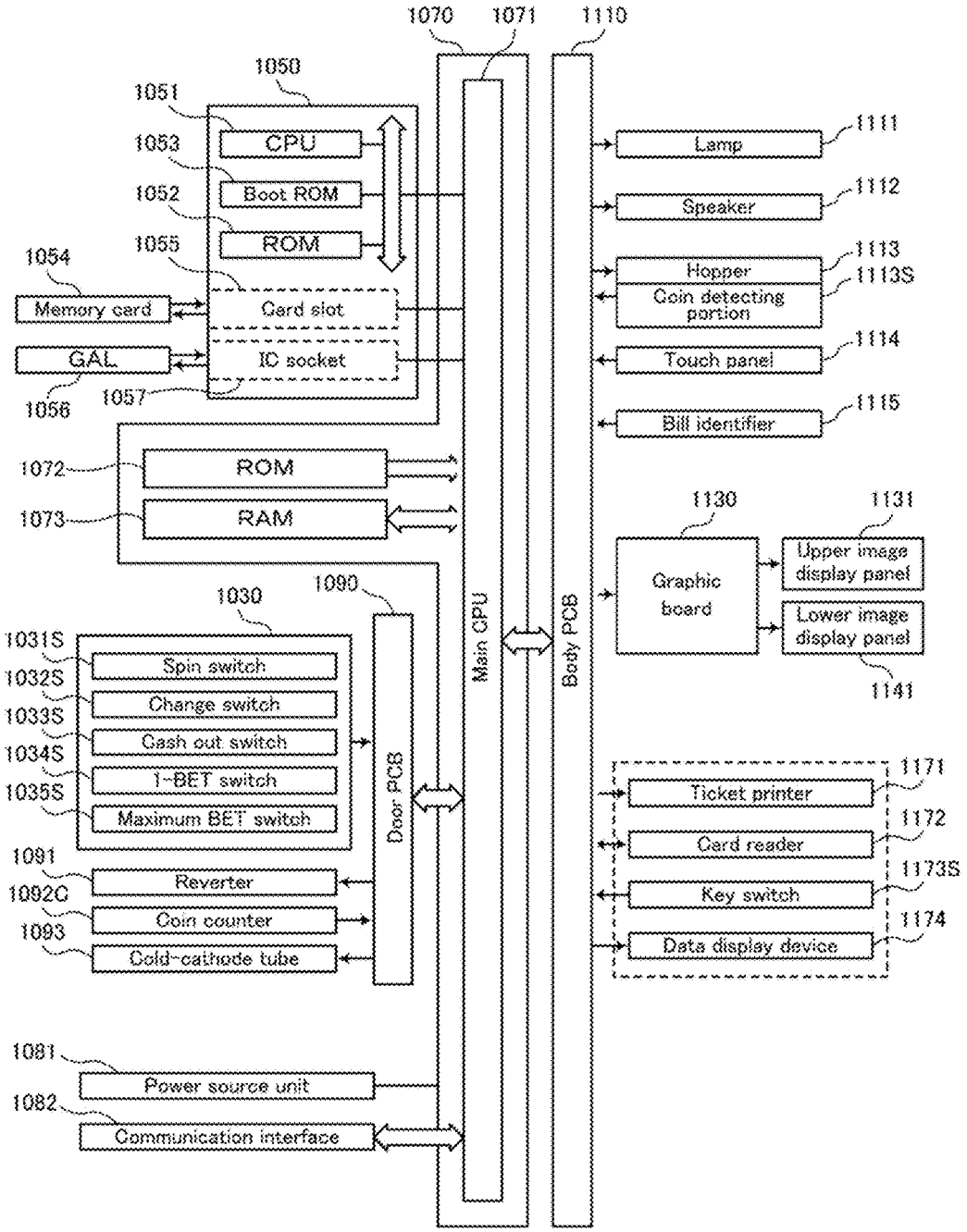
FIG. 3 is a block diagram depicting an internal structure of a slot machine shown in FIG. 1.

FIG. 3 is a block diagram depicting an internal structure of a slot machine shown in FIG. 1.

Next, with reference to FIG. 3, the constitution of circuits provided in the gaming machine 1 will be described.

FIG. 3 is a block diagram depicting an internal structure of a gaming machine according to an embodiment of the present invention.

A gaming board 1050 is provided with the CPU 1051, the ROM 1052 and the boot ROM 1053 connected to each other via the internal bus, a card slot 1055 corresponding to a memory card 1054, and an IC socket 1057 corresponding to a (Generic Array Logic) 1056.

The memory card 1054 includes a non-volatile memory, and stores game programs and game system programs. The game programs contain the lottery program, and programs for performing stage effects produced by means of images and sound programs relating to the progress of the game. Moreover, the above game programs contain the data for defining the constitution of a symbol line assigned to each of the video reels 1003.

The lottery program is a program to determine a stop planning symbol of each of the video reels 1003 by a lottery. The stop planning symbol is the data to determine four symbols indicated by the symbol display area 1004 in the twenty two symbols constituting the symbol line. The gaming machine 1001 of this embodiment the symbol indicated in a predetermined area (for example, upper row area) in four areas corresponding to each of the video reels 1003 of the symbol display area 1004 is determined as the stop planning symbol.

Symbol determination data is contained in the above the lottery program. The symbol determination data is the data for defining random number values so that each of the twenty two symbols (code number "00" to "21") constituting the symbol line is determined depending on each video reel 1003 with an equal probability (i.e., 1/22).

The probability that each of the twenty two symbols is determined is basically equal. However, the numbers of various symbols contained in the twenty two symbols are different, and therefore the probabilities that various symbols are determined respectively are different (i.e., weights occur). For example, one piece of the symbol "JACKPOT7" is contained in the symbol line of a first video reel **1003*a***, while seven pieces of the symbol "ORANGE" is contained therein. therefore, the former is determined with the probability of "1/22", while the latter is determined with the probability of "7/22".

It should be noted that in this embodiment data is defined so that the numbers of symbols constituting the symbol lines of the video reels 1003 are the same, but the numbers of symbols constituting the symbol lines may be different, depending on the video reels 1003. For example, the symbol line of the first video reel **1003*a* may be constituted by twenty two symbols, while the symbol line of a second video reel 1003*b* may be constituted by thirty symbols. Accordingly, the degree of freedom in setting the probabilities that various symbols are determined depending on each of the video reels 1003** is increased.

Moreover, the card slot 1055 is constituted in such a manner that the memory card 1054 can be inserted and removed, and is connected to the motherboard 1070 by an IDE bus.

A GAL 1056 is a type of a PLD (Programmable Logic Device) having an OR fixed array structure. The GAL 1056 has input ports and output ports. When an input port receives a predetermined input, corresponding data is outputted through an output port. The GAL 1056 has input ports and output ports. When an input port receives a predetermined input, corresponding data is outputted through an output port.

Further, the IC socket 1057 is structured to allow insertion/removal of the GAL 1056. The IC socket 1057 is connected to the motherboard 1070 through a PCI bus. The content of a game to be run at the gaming machine 1001 can be changed by replacing a memory card 1054 with another one with another program written thereon, or replacing the program written onto the memory card 1054 with another program.

A CPU 1051, a ROM 1052 and a boot ROM 1053 connected each other to via an internal bus are connected to a motherboard 1070 via a PCI bus. The PCI bus performs signal transfer between the motherboard 1070 and the gaming board 1050, and supplies power from the motherboard 1070 to the gaming board 1050.

An authentication program is stored in the ROM 1052. An auxiliary program, a program (boot code) for the CPU 1051 to start the auxiliary program and the like are stored in the boot ROM 1053.

The authentication program is a program for authenticating game programs and game system programs (alteration check program). The auxiliary authentication program is a program for authenticating the above authentication program. The authentication program and auxiliary authentication program are described according to a procedure for performing authentication that target programs are not altered (authentication procedure).

The motherboard 1070 is provided with a main CPU 1071, a ROM 1072, a RAM 1073, and a communication interface 1082.

The ROM 1072 includes memory devices of flash memory and the like, BIOS and the like executed by the main CPU 1071 programs and permanent data are stored. When BIOS is executed by the main CPU 1071, the initialization processing of predetermined peripheral units is performed. Moreover, an inclusion processing of the game program and game system program stored in the memory card 1054 via the gaming board 1050 is initiated. The gaming machine unit identification information assigned individually for each gaming machine 1001 is stored in the ROM 1072.

The RAM 1073 stores data and programs utilized when the main CPU 1071 operates. For example, when the capturing processing of the game program, the game system program, and the authentication program mentioned above is performed, these can be stored in the RAM 1073. Further, the RAM 1073 is provided with an operation region for executing the above programs. Examples of the operation region is a region for storing number-of-games-played, bet number, credit number, and a region for storing a symbol determined by a lottery (code number).

The main CPU 1071 performs data communication through the communication interface 1082 with the IC card server 2050, hall conserver 2060, and member management server 2070. the main CPU 1071 outputs the player identification information read by the card reader 1172. The main CPU 1071 and the card reader 1172 function as player identification information reading means of the present invention. Moreover, the main CPU 1071 function as number-of-consumptions data output means and number-of-payouts output means. Furthermore, the main CPU 1071 outputs the gaming machine unit identification information to the IC card server 2050, the hall conserver 2060 and the member management server 2070 in performing data communication with the IC card server 2050, the hall conserver 2060 and the member management server 2070. Moreover, the motherboard 1070 is connected to a later-described door PCB (Printed Circuit Board) 1090 and a main body PCB 1110 via USBs. Further, the motherboard 1070 is connected to a power supply unit 1081.

When power is supplied from the power supply unit 1081 to the motherboard 1070, the main CPU 1071 of the motherboard 1070 is booted, and power is supplied to the gaming board 1050 via the PCI bus and the CPU 1051 is booted.

The door PCB 1090 and the main body PCB 1110 are connected to an input device such as a switch and a sensor, and peripheral devices whose operations are controlled by the main CPU 1071.

The door PCB 1090 is connected to the control panel 1030, a reverter 1091, a coin counter 1092C and a cold cathode tube 1093.

The control panel 1030 is provided with a spin switch 10315, a change switch 1032S, a CASHOUT switch 1033S, a 1-bet switch 1034S, and a maximum bet switch 1035S, respectively corresponding to the buttons described above. Each switch detects that it is pushed by a player, and outputs a signal to the main CPU 1071.

The coin counter 1092C sorts whether a coin inserted into the coin slot 1036 is valid in terms of materials, shapes and other factors, and when it detects a valid coin, outputs a signal to the main CPU 1071. Moreover, an invalid coin is discharged from a coin payout exit 1015A.

The reverter 1091 operates based on a control signal outputted from the main CPU 1071, and distributes valid coins determined by the coin counter 1092C into a hopper 1113 or a not-shown cash box. When the hopper 1113 is not full of coins, a valid coin is distributed there. On the other hand, when the hopper 1113 is filled with coins, a valid coin is distributed into the cash box.

The cold cathode tube 1093 functions as a backlight provided at a back of an upper image display panel 1131 and a lower image display panel 1141. The cold cathode tube 1093 lights based on a control signal from the main CPU 1071.

The main body PCB1110 is connected to the lamp 1111, the speaker 1112, hopper 1113, a coin detecting portion 1113S, the touch panel 1114, the bill identifier 1115, a graphic board 1130, the ticket printer 1171, the card reader 1172, a key switch 1173S and the data display device 1174.

A lamp 1111 lights up based on a control signal outputted from a main CPU 1071. The speaker 1112 outputs a sound such as BGM based on the control signal outputted from the main CPU 1071.

The hopper 1113 operates based on a control signal outputted from the main CPU 1071, and pays out the number of coins determined to be paid out to a coin tray 1015 through the coin payout exit 1015A. The coin detection unit 1113S detects a coin to be paid out from the hopper 1113, and outputs a signal to the main CPU 1071.

The touch panel 1114 detects a position touched on the lower image display panel by a player with a finger, and outputs a signal corresponding to the position detected to the main CPU 1071. the bill identifier 1115 outputs, when it accepts a valise bill, a signal depending to the main CPU 1071 on the amount of the bill.

The graphic board 1130 controls display of an image to be displayed on the upper image display panel 1131, and the lower image display panel 1141, based on a control signal outputted from the main CPU 1071. Five pieces of the video reels 1003 are indicated in the symbol display area 1004 of the lower image display panel 1141, the operations of scroll of the symbol line on each of the video reels 1003 and the stopping of the same are indicated. The graphic board 1130 has a VDP which generates image data, a video RAM which stores the image data generated by the VDP, and the like. The number of credits stored in the RAM 1073 is indicated in the number-of-credits display area 1142 of the lower image display panel 1141. The number of coins paid out is indicated in the number-of-payouts display area 1143 of the lower image display panel 1141.

Moreover, the graphic board 1130 has a VDP (Video Display Processor) which generates image data, a video RAM which stores the image data generated by the VDP, and the like. Note that the image data utilized when image data is generated by the VDP is included in a game program read out from the memory card 1054 and stored in the RAM 1073.

The ticket printer 1171 prints on a ticket a bar code representative of coded data such as credit number, date, identification number of the gaming machine 1001, etc., based on a control signal outputted from the main CPU 1071, and outputs it as a bar coded ticket 1175.

The card reader 1172 reads data stored in a card inserted into the card slot 1176 and transmits the data to the main CPU 1071, and writes data based on a control signal from the main CPU 1071. Player identification information is contained in the data stored in the card.

The key switch 1173S is provided on the key pad 1173. When the key pad 1173 is operated by the player, the key switch 1173S outputs a predetermined signal to the main CPU 1071.

The data display device 1174 the data read by the card reader 1172 and indicates the data inputted by the player via the key pad 1173, based on a control signal outputted from the main CPU 1071.

Figure 4:
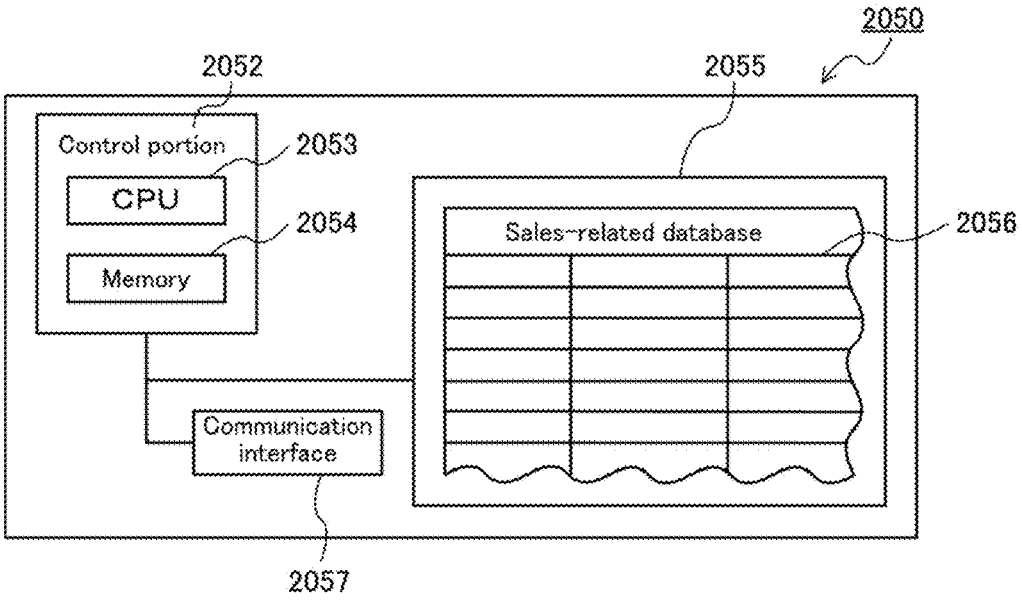
FIG. 4 is a block diagram depicting an internal structure of the IC card server shown in FIG. 1.

FIG. 4 is a block diagram depicting an internal structure of the IC card server shown in FIG. 1.

The IC card server 2050 is provided with a control portion 2052, a hard disk 2055, a communication interface 2057, and the control portion 2052 is provided with a CPU 2053 and a memory 2054. The hard disk 2055 stores various programs and data, while the control portion 2052 reads and executes these programs, and performs various processings. The hard disk 2055 stores a sales-related database 2056.

In the sales-related database 2056, for example, consumed-amount-of money data or sales amount data, reception time data, player identification information, gaming machine unit identification information, flag indicating play of game in progress and the like are contained in association with each other. Further in the hard disk 2055 of the IC card server 2050, data relating to credits to the casino or data relating to member point may be stored in association with player identification information.

Data storage means further stores use amount data outputted from use-amount-of-money data output means in association with reception time data relating to the time of receipt of data, player identification information, and gaming machine unit identification information.

Figure 5:
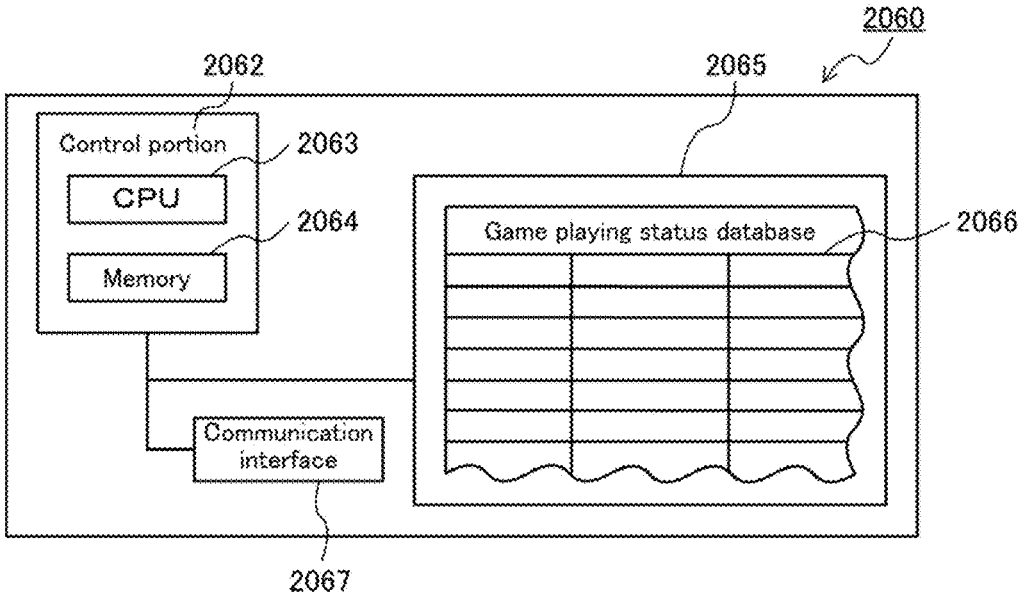
FIG. 5 is a block diagram depicting an internal structure of the hall conserver shown in FIG. 1.

FIG. 5 is a block diagram depicting an internal structure of the hall conserver shown in FIG. 1.

The hall conserver 2060 is provided with a control portion 2062, a hard disk 2065, and a communication interface 2067, and the control portion 2062 is provided with a CPU 2063 and a memory 2064. The hard disk 2065 stores various programs and data. The control portion 2062 reads and executes these programs, and performs various processings.

The hard disk 2065 stores the game playing status database 2066. In the game playing status database 2066 for example, number-of-consumptions data, number of payouts, number of games played data, number-of-prize-winning-time data, game information data and other data outputted from the gaming machine 1001 or data produced by processing the data, reception time data, player identification information, gaming machine unit identification information, flag indicating play of game in progress and event flag are contained in association with each other. Furthermore, in the game playing status database in association with the gaming machine unit identification information, for example, device type data, model data, mount identification information, new device type flag, event flag and the like are contained.

Furthermore, the hard disk 2065 stores data for determination of degree of satisfaction, data for determination of customer life cycle, data for determination of life cycle of gaming machine.

Data storage means stores each of the number-of-consumptions data outputted from number-of-consumptions data output means and the number of payouts outputted from number-of-payouts output means in association with reception time data relating to the time of receipt of data, player identification information, and the gaming machine unit identification information.

Moreover, the hard disk 2065 stores a correlation database. In the correlation database, as player-side time-related data, (a) game playing time on the gaming machine per play (per player), and (a') visit frequency of player are stored; and as player-side balance-related data, (b) change in balance over time, and (b') consumed amount of money per visit are store; as gaming facility-side time-related data, (c) operation time of gaming machine; and (c') operability of gaming machine are store; as gaming facility-side balance related data, (d) profit on the shop side by gaming machine, (d') gross profit by gaming machine are stored. These data are stored in association with the gaming machine unit identification information.

Further, the hard disk 2065 stores a determination result database. In the determination result database, data indicating the degree of satisfaction of the player and of gaming facility relative to the gaming machine, data relating to the life cycle of player, data relating to the life cycle of the gaming machine are stored. These data are stored in association with the gaming machine unit identification information.

Moreover, by the optimal sales strategy determination processing described later, for example, when advice such as withdrawal of machine, determination of optimal business dividing number, adjustment of in-shop installation number rate is indicated, data relating to the advice are stored. The data is also stored in association with the gaming machine unit identification information. The hard disk 2065 functions as data storage means. The control portion 2062 functions as analysis processing means.

Figure 6:
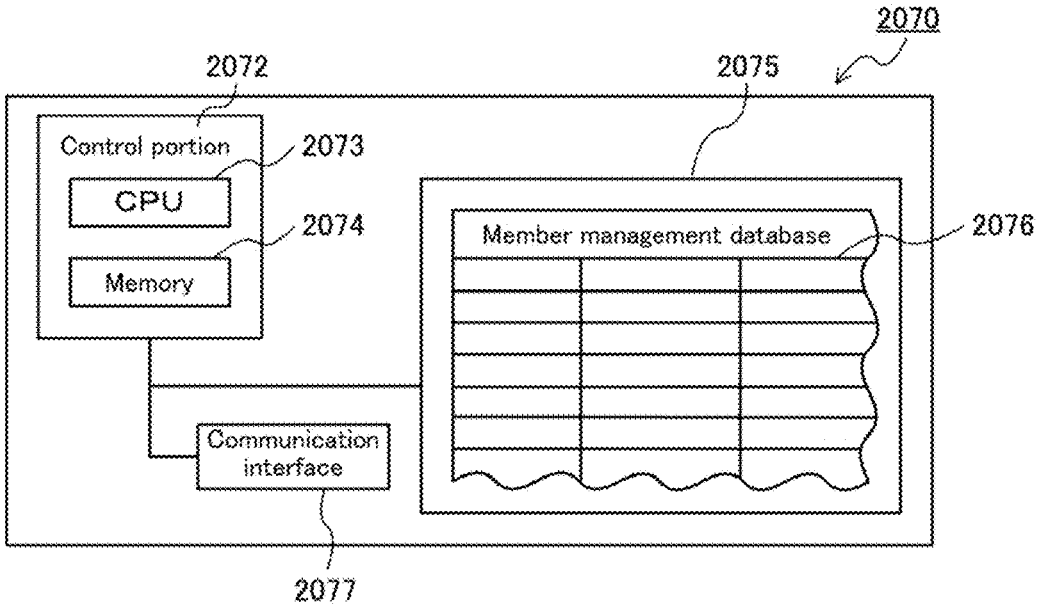
FIG. 6 is a block diagram depicting an internal structure of a member management server shown in FIG. 1.

FIG. 6 is a block diagram depicting an internal structure of the member management server shown in FIG. 1.

The member management server 2070 is provided with a control portion 2072, a hard disk 2075, and a communication interface 2077, and the control portion 2072 is provided with a CPU 2073 and a memory 2074. The hard disk 2075 stores various programs and data, the control portion 2072 reads and executes these programs, and performs various processings.

The hard disk 2075 stores a member management database 2076. In the member management database 2076, for example, player identification information, customer category data, member name, local area, sex, age, occupation and other data of the player are stored in association with each other. Moreover, the member management database 2076, in association with player identification information, stores average use time, average game playing time, average visit frequency, and average amount of money lost or the like to which the player identification information is assigned.

Data storage means, further, in association with player identification information, stores player data related to a player to which the player identification information is assigned. In addition, the data storage means stores customer category data indicating which one of the customer categories classified in plurality the player to which the player identification information is assigned falls under, in association with player identification information.

FIG. 7 is an explanatory view depicting one example of a game playing status database stored in the hall conserver shown in FIG. 1.

In the game playing status database for example, number-of-consumptions data, number of payouts, game initiation data, liquidation data, reception time data, player identification information, the gaming machine unit identification information, flag indicating play of game in progress, game playing time data and the like are contained in association with each other. Various data transmitted from the gaming machine 1001 to the hall conserver 2060 are stored in the game playing status database.

FIGS. 8A, 8B, and 8C are tables depicting one example of a correlation database stored in the hall conserver shown in FIG. 1.

The data produced by processing data contained in the game playing status database is stored in the correlation database. The game playing status database contains a database for computation of the degree of satisfaction, a database for evaluation of the life cycle of player, and a database for evaluation of the life cycle of gaming machine.

FIG. 8A is a database for computation of the degree of satisfaction. The database for computation of the degree of satisfaction stores, in association with the gaming machine unit identification information, by date, (a) a game playing period per one time of visit of each player; (b) a change with an elapse of time of a balance of the player per visit; (c) operation time of the gaming machine; and (d) profit of a shop side by the gaming machine. That is, based on the data stored in the game playing status database shown in FIG. 7, the control portion 2062 generates data related to items (a) to (d), and stored in the database for computation of the degree of satisfaction. This processing corresponds to the processing (A).

FIG. 8B is a database for evaluation of the life cycle of player. The database for evaluation of the life cycle of player stores, in association with the player identification information, (a') visit frequency, and (b') consumed amount of money per visit. That is, based on the data stored in the game playing status database shown in FIG. 7, the control portion 2062 generates data relating to (a') and (b'), and stores the data in the database for evaluation of the life cycle of player. This processing corresponds to the processing (D).

FIG. 8C is a database for evaluation of the life cycle of gaming machine. The database for evaluation of the life cycle of gaming machine stores in association with the gaming machine unit identification information, (c') operability, and (d') gross profit. That is, based on the data stored in the game playing status database shown in FIG. 7, the control portion 2062 generates data relating to (c') and (d'), and stores in the database for evaluation of the life cycle of gaming machine. This process corresponds to the processing (I).

FIGS. 9A, 9B, and 9C are tables depicting an example of the determination result database stored in the hall conserver shown in FIG. 1.

Data produced by processing data contained in the correlation database is stored in the determination result database. The determination result database contains a database relating to the degree of satisfaction, a database relating to evaluation dots of the life cycle of player, and a database relating to evaluation dots of the life cycle of gaming machine.

FIG. 9A is a database relating to the degree of satisfaction. A database relating to the degree of satisfaction stores in association with the gaming machine unit identification information, by date, the degree of satisfaction of player and degree of satisfaction of gaming facility.

FIG. 9B is a database relating to evaluation dots of the life cycle of player. The database relating to evaluation dots of the life cycle of player stores in association with the player identification information, by date, visit frequency and consumed-amount-of money data, which serve as coordinates of the evaluation dots of life cycle of player.

FIG. 9B is a database relating to evaluation dots of the life cycle of gaming machine. The database relating to evaluation dots of the life cycle of gaming machine stores in association with the gaming machine unit identification information, by date, the operability and gross profit, which serve as coordinates of evaluation dots of life cycle of gaming machine.

Next, the degree of satisfaction, life cycle of player, and the life cycle of the gaming machine will be described.

Figure 10:
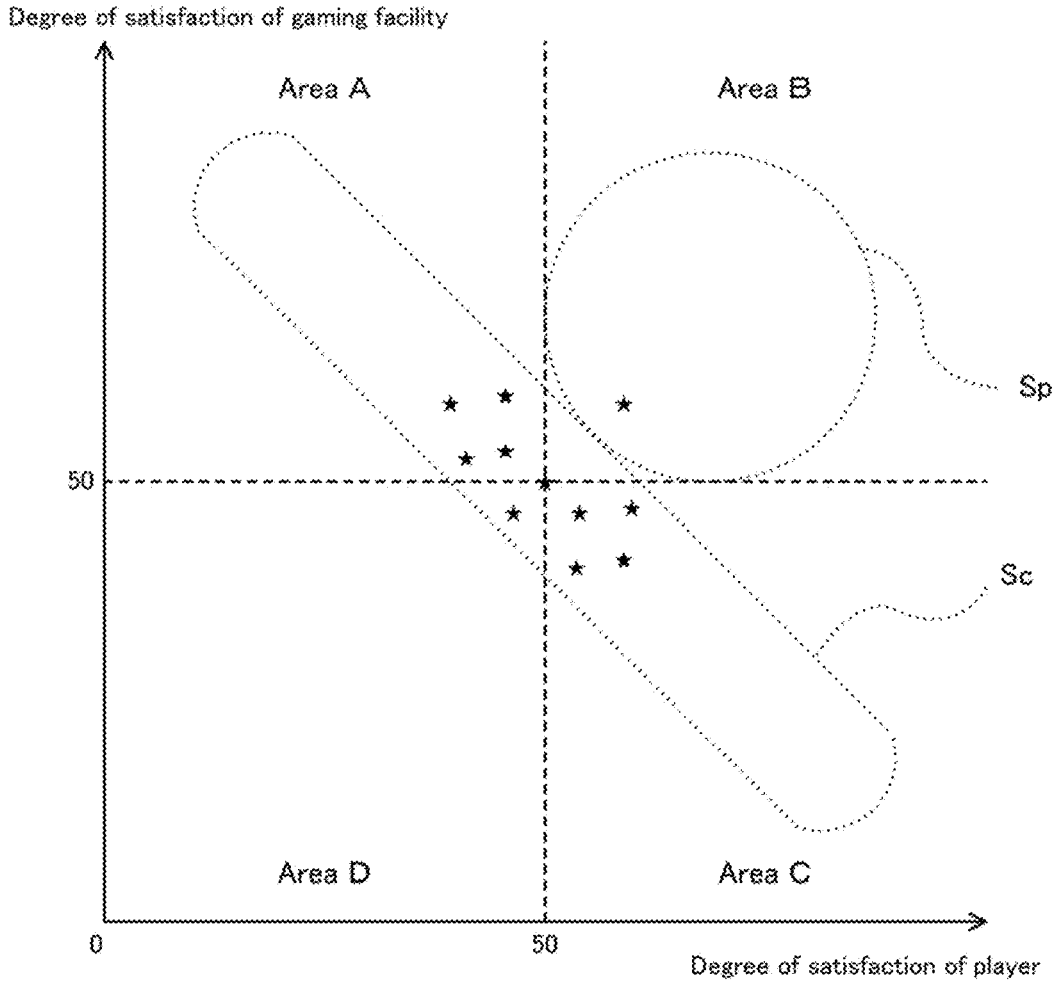
FIG. 10 is a view for explaining a relationship between a degree of satisfaction of a player and a degree of satisfaction of gaming facility.

FIG. 10 is a view depicting a relationship between a degree of satisfaction of a player and a degree of satisfaction of gaming facility.

In the figure, the vertical axis indicates the degree of satisfaction of gaming facility, and the horizontal axis indicates the degree of satisfaction of player. In FIG. 10, the degree of the player's satisfaction and the degree of satisfaction of gaming machine are expressed by means of deviation values. An average value of the degrees of satisfaction of player and gaming machines is 50.

In this plane, dots are plotted on a coordinate system defining the degrees of satisfaction of gaming facility and player relative to the gaming machine (hereinafter, evaluation dots of the degrees of satisfaction). A star mark indicates the evaluation dots of degrees of satisfaction as to one gaming machine.

Therefore, in FIG. 10, the evaluation dots of degrees of satisfaction as to 11 gaming machines are plotted.

The plane shown in FIG. 10 is classified into four areas while the average value is defined as a reference.

Area A is an area in which the degree of satisfaction of gaming machine is high and the degree of player's satisfaction is low.

Area B is an area in which the degree of satisfaction of gaming machine is high and the degree of player's satisfaction is also high.

Area C is an area in which the degree of satisfaction of gaming machine is low and the degree of player's satisfaction is high.

Area D is an area in which the degree of satisfaction of gaming machine is low and the degree of player's satisfaction is low.

As described above, according to a relationship between the degree of player's satisfaction and the degree of satisfaction on the shop side, which conventionally has been thought to be present in common knowledge, the degrees of satisfaction of player and gaming machine are determined depending on balance, and a tradeoff relationship is established.

On the other hand, in the present invention, more realistic analysis is performed as the degrees of satisfaction of player and gaming machine. The elements employed for analysis of the degrees of satisfaction in the present invention are at least four elements that follow:

(a) game playing period of time per one time of each player in gaming machine unit;

(b) change with an elapse of time as to balance of the player in game playing period of time;

(c) operation time of game machine unit; and (d) profit on the shop side by gaming machine unit The items (a) and (b) are employed for analysis of the degree of the player's satisfaction. The items (c) and (d) are employed for analysis of the degree of satisfaction of gaming machine.

(a) Game Playing Period at One Time of Each Player in Gaming Machine Unit

In a case where the game playing time at the gaming machine unit is long, there is a high possibility that a player enjoys the play of game at that gaming machine. This is because, if the player does not have interest therein, there is a high possibility that game will be played at another gaming machine. Namely, even if a slight loss takes place with a player, the player does not move to another gaming machine, and thus, it is thought that the player satisfies a current gaming machine. Therefore, in the present invention, the data related to the item (a) is employed for computation of the degree of the player's satisfaction.

(b) Change with Elapse of Time in Balance of the Player in Game Playing Period of Time The amount of balance itself influences the degree of the player's satisfaction, as indicated by the abovementioned tradeoff relationship. It is to be noted that in the present invention, weighting is performed for the amount of balances so that the balance in the latter half of game playing period has greater influence relative to the degree of the player's satisfaction than that in the first half of gaming machine period, and then, computation of the degree of the player satisfaction is performed.

The present invention focuses on timing with which a player stops the play of game. That is, the timing for the player to stop the play of game corresponds to any one of three patterns of 1. No money to play, 2. Big hit (Bonus is won), and 3. Interest in gaming machine is lost.

1. No money to play means that there is a high possibility that a loss takes place at least in the latter half of game playing period, and there is also a possibility that the player is not satisfied with the gaming machine. Of course, if the game playing time is long, even if no money to play arises, there is also a possibility that the player is satisfied with the gaming machine. Therefore, in the present invention, computation of the degree of the player's satisfaction is performed by employing the item (a) as well as the item (b).

2. Big hit means that there is a high possibility that profit takes place at least in the latter half of game playing period, and there is a possibility that the player is satisfied with the gaming machine.

3. Losing interest in gaming machine means that there is a high possibility that profit does not occur in the latter half of game playing machine, and there is a possibility that the player does not satisfied with the gaming machine.

The weighting method mentioned above is not limited in particular, and for example, the following methods can be employed.

(Weighting Method 1)

Among the variation trend continuation periods included in the game playing period, the later a balance in a variation trend continuation period takes place, the greater an influence is imparted to a degree of satisfaction of the player.

In general, even if an absolute value between the balance of the last variable trend continuation period in game playing period and the balance of the second last variation trend continuation period is the same, a player is prone to feel a loss in balance if the balance of the second last variation trend continuation period is positive and the balance of the last variation trend continuation period is negative. Conversely, a player is prone to feel a profit (no loss) if the balance of the second last variation trend continuation period is negative and the balance of the last variation trend continuation period is positive.

Therefore, it is defined that, among the variation trend continuation periods included in the game playing period, the later a balance in a variation trend continuation period takes place, the greater an influence is imparted to a degree of satisfaction of the player, and data weighting is performed to be thereby able to compute the degree of the player's satisfaction in a more realistic manner.

(Weighting Method 2)

The greater the number of continuous occurrences of variation trend continuation period is, the period having the same variation trend as the variation trend continuation period that occur lastly, the greater the influence on the degree of the player's satisfaction is.

If the balance of variation trend continuation period is positive or negative at a probability of ½, the probability at which the variation trend continuation period of which balance is positive or negative continuously takes place N times is obtained as $(1/2)^N$. The occurrence of the variation trend continuation period having the same variation trend is rare. Therefore, the greater the number of continuous occurrences is, the greater the mental impact is imparted to a player.

Therefore, it is defined that the greater the number of continuous occurrences in variation trend continuation period is, the period having the same variation trend as the variation trend continuation period that takes place lastly, the greater the influence is imparted to the degree of the player's satisfaction, and data weighting is performed to be thereby able to compute the degree of the player's satisfaction in a more realistic manner.

(Weighting Method 3)

The greater the absolute value of balance of the last variation trend continuation period in game playing period is, the greater the influence is imparted to the degree of the player's satisfaction.

A player occasionally stops the play of game intentionally. That is, there is a high possibility that the last variation trend continuation period renders the player make a decision to stop the play of game, and the balance of the last variation trend continuation period has great impact on the player's mentality.

Therefore, it is defined that the greater the absolute value of balance of the last variation trend continuation period in game playing period is, the greater the influence is imparted to the degree of the player's satisfaction, and data weighting is performed to be thereby able to compute the degree of the player's satisfaction in a more realistic manner. In a case where the balance is positive, a positive influence is imparted to the degree of the player's satisfaction. If a case where the balance is negative, a negative influence is imparted to the degree of the player's satisfaction.

(c) Operation Time of Gaming Machine Unit

In a case where the operation time of gaming machine unit is long, there is a high possibility that the gaming machine unit contributes to attracting players' interest irrespective of whether or not profit is large or small. Therefore, the data related to the item (c) is employed for computation of the degree of satisfaction of gaming facility.

(d) Profit on the Shop Side by Gaming Machine Unit

The profit on the shop side itself has influence on the degree of satisfaction of gaming facility as shown in the abovementioned tradeoff relationship, and therefore, in the present invention, the data related to the item (d) is employed for computation of the degree of satisfaction of gaming facility.

FIG. 10 shows one example of a result obtained by computing degrees of satisfaction between player and gaming facility by employing the data related to the items (a) to (d). Many evaluations of the degrees of satisfaction sparsely exist in area A and area C. Area Sc is a region in which the evaluation dots of the degree of satisfaction of gaming machine unit are easily positioned which follow the abovementioned tradeoff relationship. However, the evaluation dots of degree of satisfaction of one gaming machine unit are not positioned in area Sc, but are positioned in area Sp. Area Sp is a region in which the degrees of satisfaction between player and gaming machine are high.

In this manner, according to the present invention, computation of the degrees of satisfaction between player and gaming facility is performed based on the data related to the items (a) to (d), whereby the abovementioned tradeoff relationship is eliminated so as to be able to extract a gaming machine unit with its high degrees of satisfaction between player and gaming facility.

According to the present invention, for example, in a manner described below, it is possible to improve a setup balance of the gaming machine units in the gaming facility.

Figure 11A:
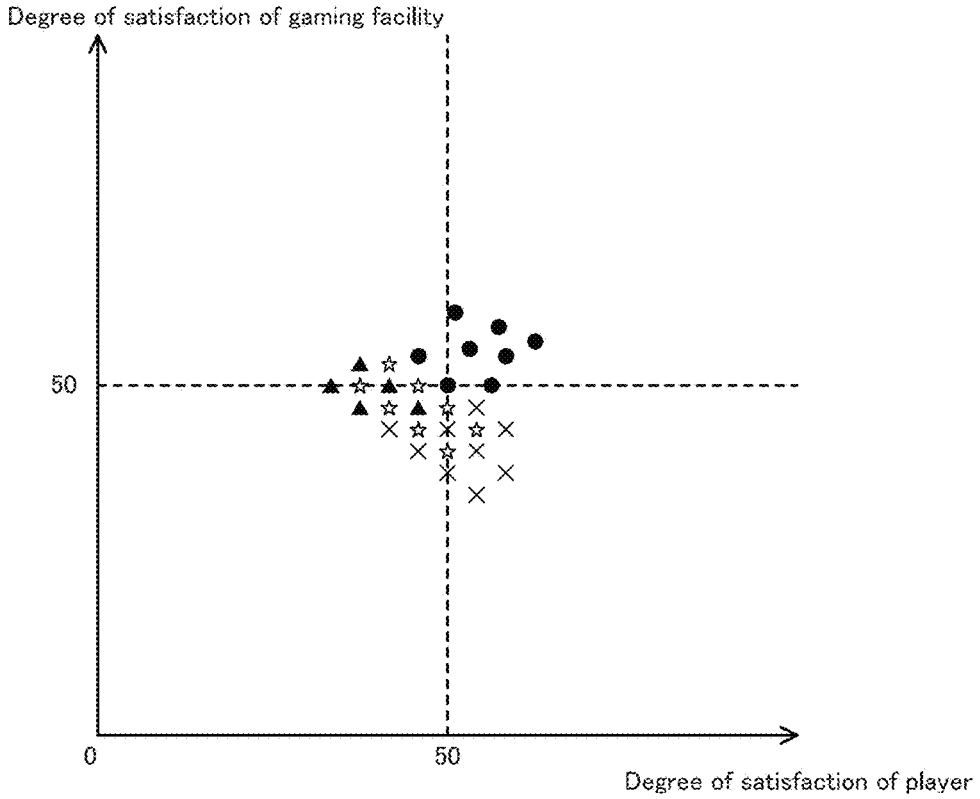
FIGS. 11A and 11B are views depicting a relationship between a degree of satisfaction of a player and a degree of satisfaction of gaming facility.

FIG. 11A shows distribution of evaluation dots of the degrees of satisfaction before improvement in gaming machine.

The black circle mark, the x-mark, the black triangle mark, and the star mark indicate device types of gaming machine units, respectively. According to FIG. 11A, the gaming machine unit with the black circle mark is relatively high in degrees of satisfaction of player and gaming machine. The gaming machine unit with the x-mark is low in degree of satisfaction of gaming facility. The gaming machine with the black triangle mark is low in degree of player's satisfaction.

Since there is a room for improvement as to the gaming machines with the x-mark and black triangle mark, these units were withdrawn from the gaming facility. In place of these gaming machine units, the gaming machine units with the white square mark and black square mark were introduced.

Figure 11B:
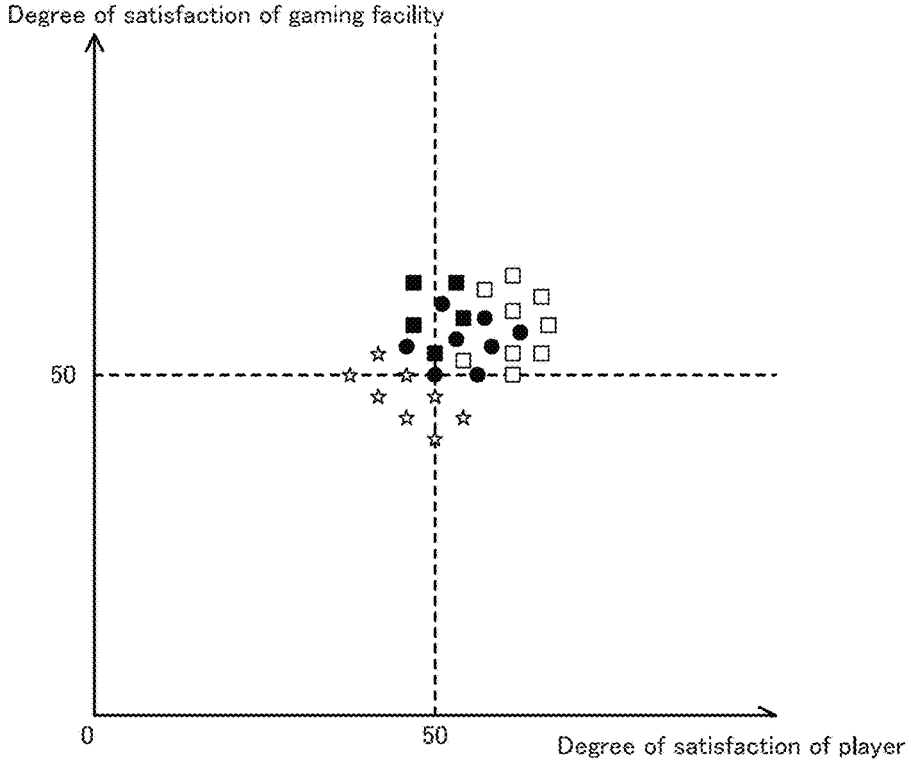

FIG. 11B shows evaluation dots of degrees of satisfaction after improvement in gaming facility.

The degrees of satisfaction of player and gaming facility as to the gaming machine units with the white and black square marks, which were new introduced, are higher than that of the gaming machine units that were installed previously. Entirely, the evaluation dots of degrees of satisfaction in FIG. 11B are positioned more upper right than those in FIG. 11A.

In this manner, in the present invention, for example, the number of gaming machine units with high degrees of satisfaction of player and gaming machine can be increased in the entire shop by replacing the gaming machine units of device type with low degrees of satisfaction with those of other device type. An action for improvement is not limited to this example. Another action for improvement can include change of dividing number or settings and change of the number of setups by device type or the like, for example.

Figure 12:
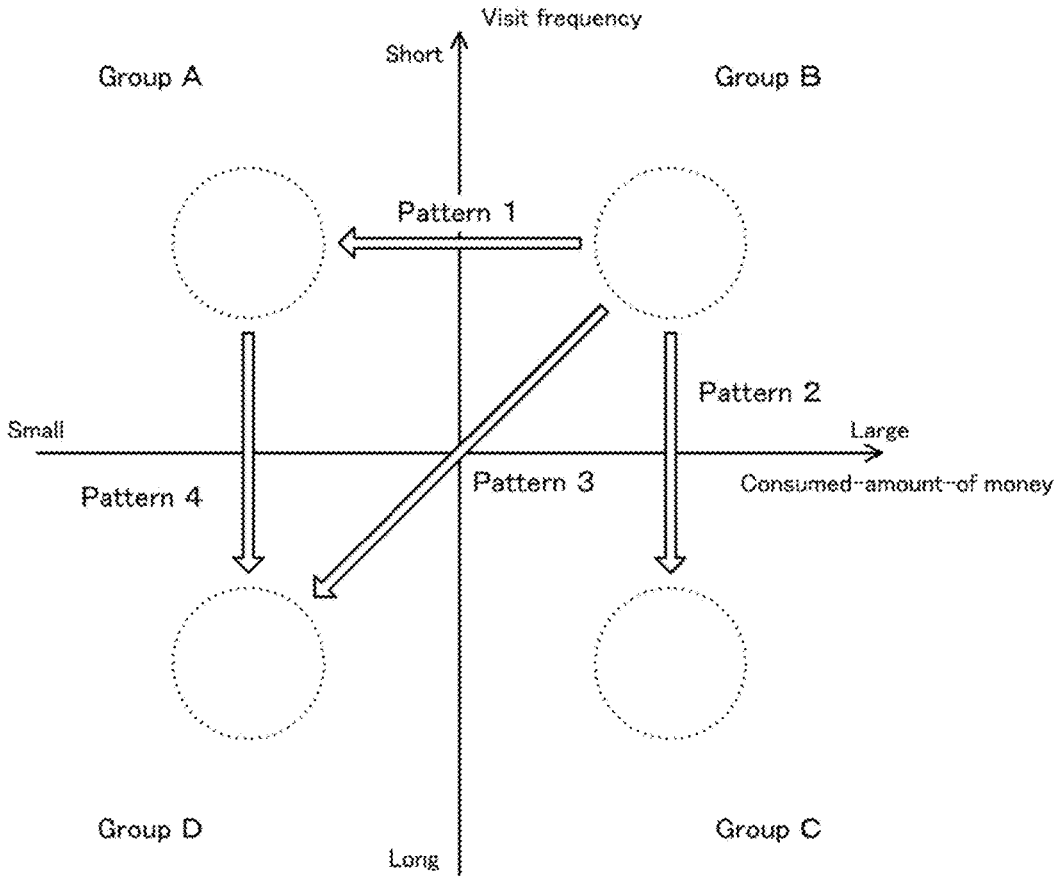
FIG. 12 is a view for explaining a life cycle of a player and its related pattern.

FIG. 12 is a view showing the life cycle of player's interest and its related pattern.

In the figure, the vertical axis indicates the visit frequency of player, and the horizontal axis indicates the consumed amount of money per visit by a player. In FIG. 12, the visit frequency of player and the consumed amount of money per visit of player are expressed by means of deviation values. The average value of the visit frequency of player and the consumed amount of money per visit of player is 50.

In this plane, dots are plotted on a coordinate system defining the degrees of satisfaction of gaming facility and player relative to the gaming machine (hereinafter, evaluation dots of the degrees of satisfaction).

The plane shown in FIG. 12 is classified into four group while the average value is defined as a reference.

Group A indicates a group of new customers. In general, a new customer is prone to be high in visit frequency and small in consumed amount of money.

Group B indicates a group of fixed customers. In general, a fixed customer is prone to be high in visit frequency and large in consumed amount of money.

Group C indicates a group of dissatisfactory customers. In general, a dissatisfactory customer is prone to be low in visit frequency and large in consumed amount of money.

Group D indicates a group of leaving customers. In general, a leaving customer is prone to be low in visit frequency and low in consumed amount of money.

In the embodiment, evaluation dots of life cycle of player are plotted based on data related to (a') visit frequency and (b') consumed amount of money per visit by player, thereby determining a group to which a player belongs. Further, in the embodiment, evaluation dots of life cycle of payer are plotted with an elapse of time, thereby indicating trajectory of evaluation dots of life cycle of player. In this manner, change of a group to which a player belongs is determined.

Patterns of change of group to which player belongs include patterns 1 to 4 shown in FIG. 12 as follows, for example.

Pattern 1 is a pattern in which the visit frequency is high, but the consumed amount of money gradually lowers. In the case of pattern 1, lowered attraction power of device type of gaming machine unit is presupposed as customer's mentality.

Patent 2 is a pattern in which the consumed amount of money is large, but the visit frequency lowers. In the case of pattern 2, the outflow to another gaming machine is presupposed as customer's mentality.

Patent 3 is a pattern in which both of the consumed amount of money and the visit frequency lower. In the case of pattern 3, lowered reliability of gaming facility is presupposed as customer's mentality.

Patent 4 is a pattern in which the consumed amount of money is small, and the visit frequency lowers. In the case of pattern 4, lowered attractive power of gaming facility is presupposed as customer's mentality.

In the present embodiment, data indicating advice is associated with each pattern. A pattern of change of a group to which a player belongs is determined; the advice associate with that pattern is extracted; and based on the extracted data, an image indicating the advice is displayed.

The above advices are exemplified as follows, for instance.

The advice associated with pattern 1 includes replacement of gaming machine unit or change of the number of dispositions for improving the attraction force of device type of gaming machine units.

The advice associated with pattern 2 includes holding of event for strengthening customer's interest in gaming facility or the like.

The advice associated with pattern 3 includes setting change of dividing number for recovering reliability of gaming facility.

The advice associated with pattern 4 includes replacement of gaming machine unit or change of the number of dispositions for enhancing the attraction power of gaming facility and setting change of dividing number or the like.

Figure 13A:
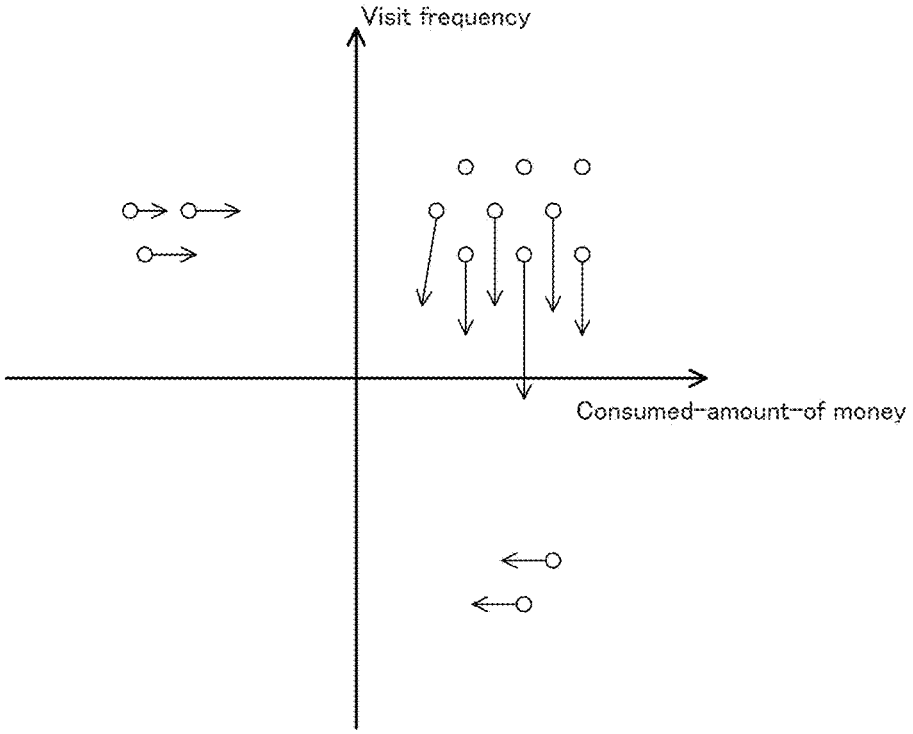
FIGS. 13A and 13B are views depicting transition of the life cycle of the player.
Figure 13B:
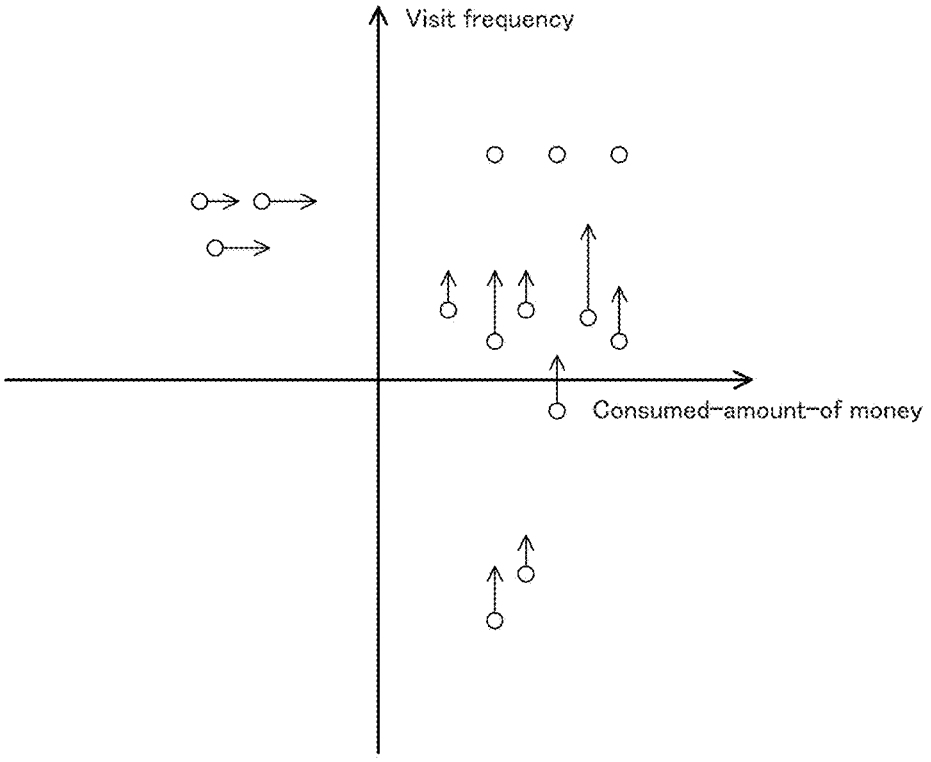

FIGS. 13A and 13B are views showing transition of life cycle of player. In the figure, the arrow mark with white circle indicates transition history of evaluation dots of life cycle of player.

In FIG. 13A, three players belonging to group A move to group B; nine players belonging to group B move to group C; and two players belonging to group C moves to group D. Movement of nine players falls into pattern 2. Therefore, in the embodiment, holding an event for strengthening customer's interest in gaming facility is displayed as the advice.

FIG. 13B shows transition of life cycle of player after action based on the above advice has been taken. In FIG. 13B, all players move to group B. In view of the fact, it is found that the action based on the advice is successful.

Figure 14:
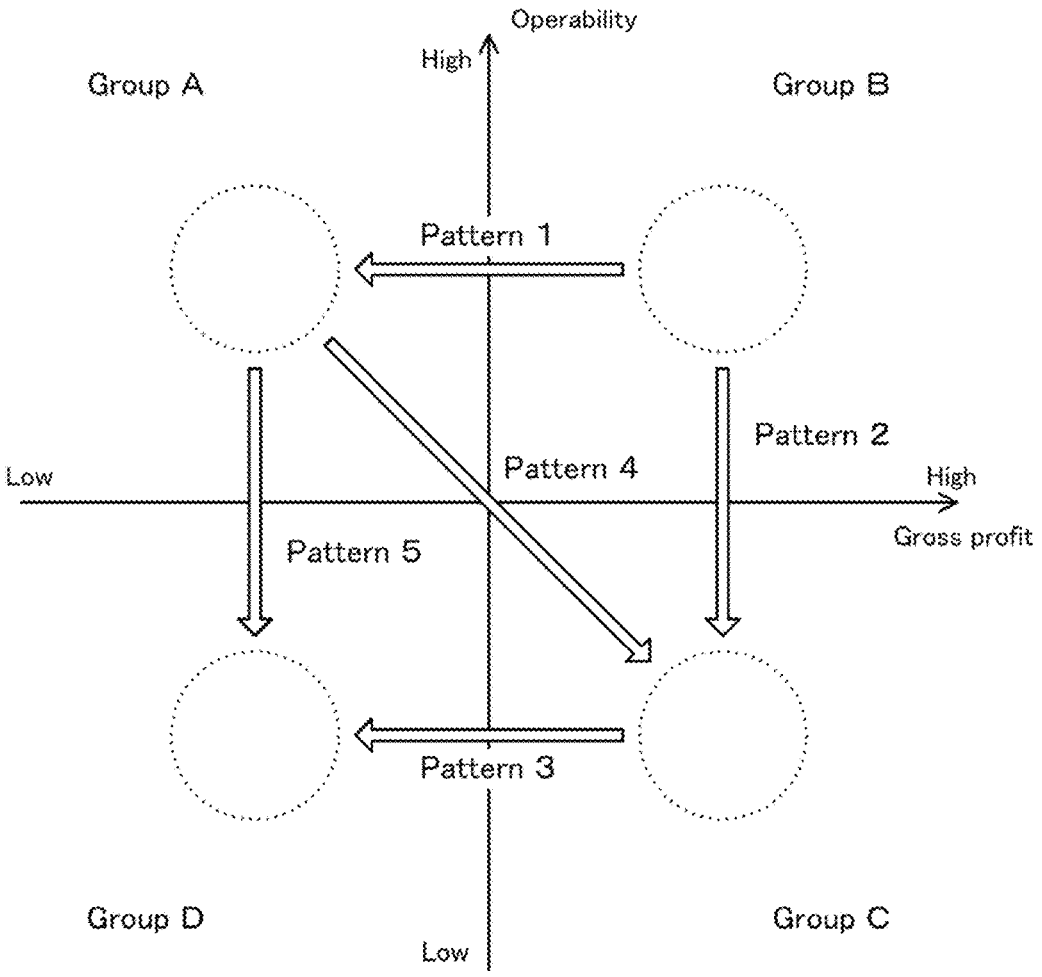
FIG. 14 is a view for explaining a life cycle of gaming machine and its related pattern.

FIG. 14 is a view showing a life cycle of gaming machine and its related pattern.

In the figure, the vertical axis indicates operability of gaming machine, and the horizontal axis indicates gross profit by gaming machine. In FIG. 14, the operability of gaming machine and the gross profit by gaming machine, are expressed by means of deviation values. The average value of the operability of gaming machine and the gross profit by gaming machine is 50.

In this plane, dots (evaluation dots of life cycle of gaming machine) are plotted on a coordinate system between operability and gross profit of gaming machine.

The plane shown in FIG. 14 is classified into four groups as follows while the average value is defined as reference.

Group A indicates a group of new machines. In general, a new machine is probe to be high in operability and low in gross profit.

Group B indicates of group of main device types. In general, a main device type is prone to high in operability and high in gross profit.

Group C indicates of group of less popular device types. In general, a less popular device type is prone to low in operability and high in gross profit.

Group D indicates of group of unpopular device types. In general, an unpopular device type is prone to low in operability and low in gross profit.

In the embodiment, evaluation dots of life cycle of gaming machine are plotted based on data related to (c') operability and (d') gross profit by gaming machine, thereby determining a group to which a gaming machine belongs. For example, in the embodiment, the evaluation dots of life cycle of gaming machine are plotted with an elapsed of time, indicating trajectory of evaluation dots of life cycle of gaming machine. In this manner, change of group to which gaming machine belongs is determined.

The patterns of change of group to which gaming machine belongs include patterns 1 to 5 shown in FIG. 14 as follows, for example.

Pattern 1 is a pattern in which operability is maintained to be high, but gross profit lowers.

Pattern 2 is a pattern in which gross profit is maintained, but operability lowers.

Pattern 3 is a pattern in which operability changes to be low, but gross profit lowers.

Pattern 4 is a pattern in which operability lowers and gross profit rises.

Pattern 5 is a pattern in which gross profit changes to be low, and operability lowers.

In the present embodiment, data indicating advice is associated with each pattern. A pattern of change of a group to which a player belongs is determined; the advice associate with that pattern is extracted; and based on the extracted data, an image indicating the advice is displayed.

The above advices, for instance, include the following examples.

The advice associated with pattern 1 includes revisal of dividing number or the like.

The advice associated with pattern 2 includes revisal of dividing number or the like.

The advice associated with pattern 3 includes discussion of withdrawal of machine.

The advice associated with pattern 4 includes revisal of dividing number or the like.

The advice associated with pattern 5 includes discussion of withdrawal of machine.

Figure 15A:
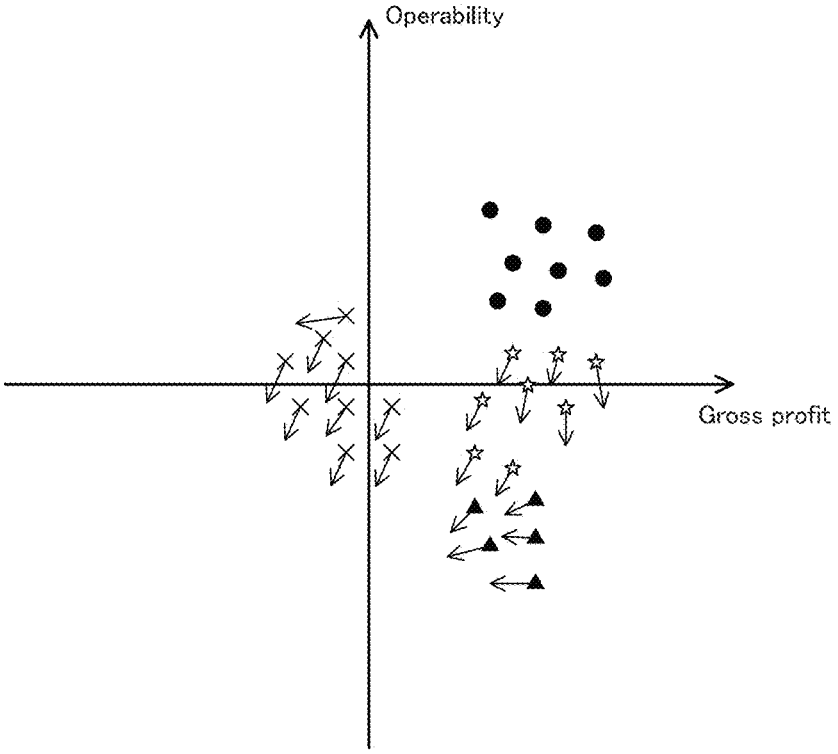
FIGS. 15A and 15B are views depicting transition of the life cycle of the gaming machine.
Figure 15B:
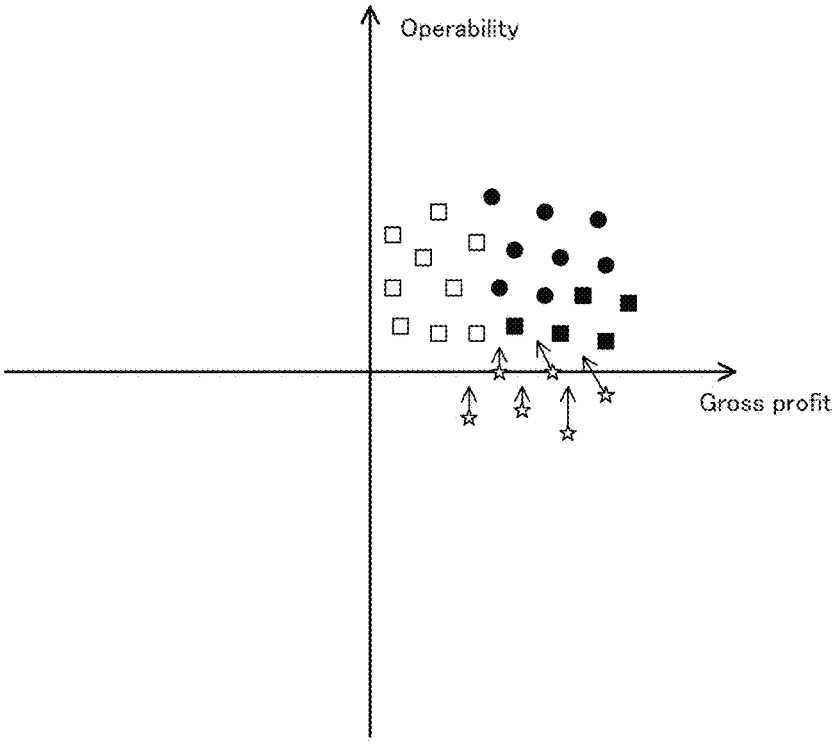

FIGS. 15A and 15B are views showing transition of life cycle of gaming machine. In the figure, the arrow provided with mark indicates transition history of evaluation dots of life cycle of gaming machine. Types of mark correspond to device types of gaming machine units.

In FIG. 15A, eight evaluation dots of life cycle of gaming machine with black circle mark belong to group B; nine evaluation dots of life cycle of gaming machine with x-mark move from group B to group D; eight evaluation dots of life cycle of gaming machine with star mark move from group B to group C; and five evaluation dots of life cycle of gaming machine with black triangle mark move from group C to group D.

Movement of evaluation dots of life cycle of gaming machine with star mark falls under pattern 2. Movement of evaluation dots of life cycle of gaming machine with black triangle mark falls under pattern 3. Therefore, in the embodiment, revisal of dividing number and discussion of withdrawal of machine are displayed as the advice.

FIG. 15B shows transition of life cycle of player after the action based on the advice has taken. Withdrawal of gaming machine units with black triangle mark and x-mark is performed, and gaming machine units of white and black square marks are newly introduced. The gaming machine units of white and black square marks are positioned in group B, and the gaming machine with start mark moves to group B. In this manner, it is found that the action based on advice is successful.

Figure 16:
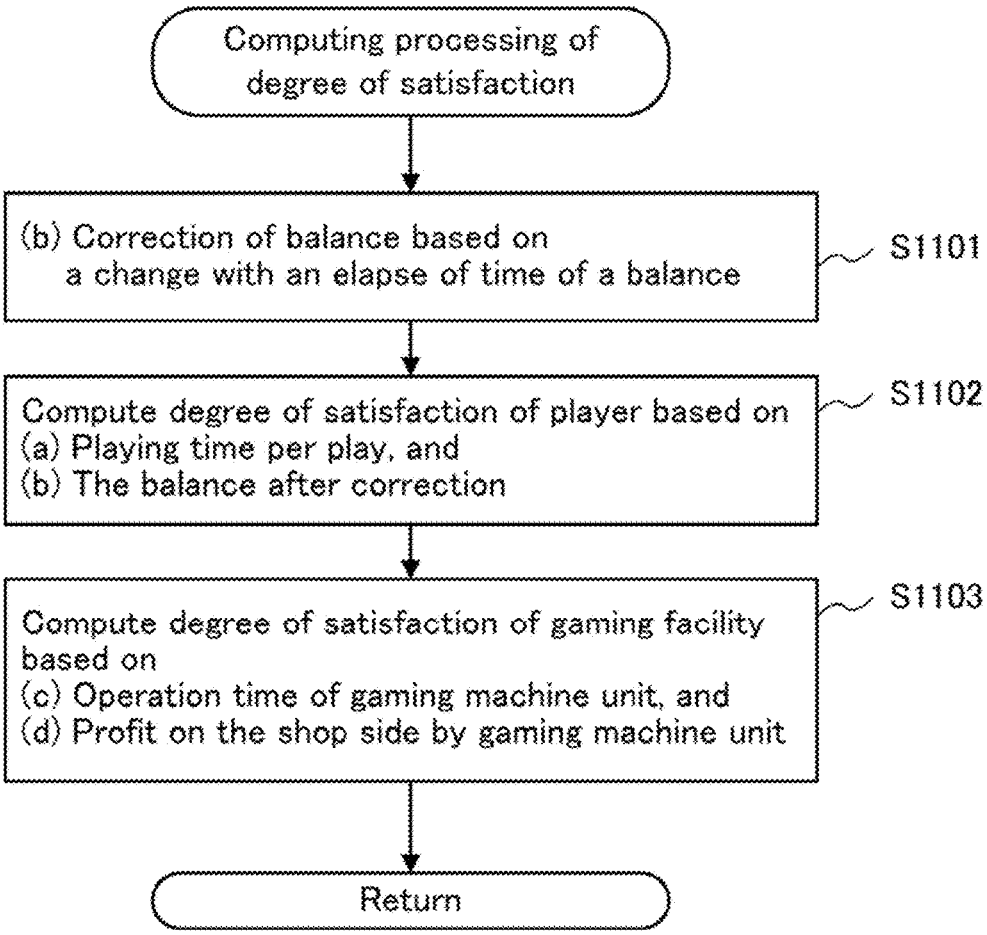
FIG. 16 is an explanatory view depicting one example of a determination result database stored in the hall conserver shown in FIG. 1.

FIG. 16 is an explanatory view depicting one example of a determination result database stored in the hall conserver shown in FIG. 1.

The control portion 2062 of the hall converser 2060 corrects the balance based on a change with elapse of time using the data stored in the game playing status database 2066 stored in the hard disk 2065 (step S1101).

The correction of the balance will be described now.

Figure 17:
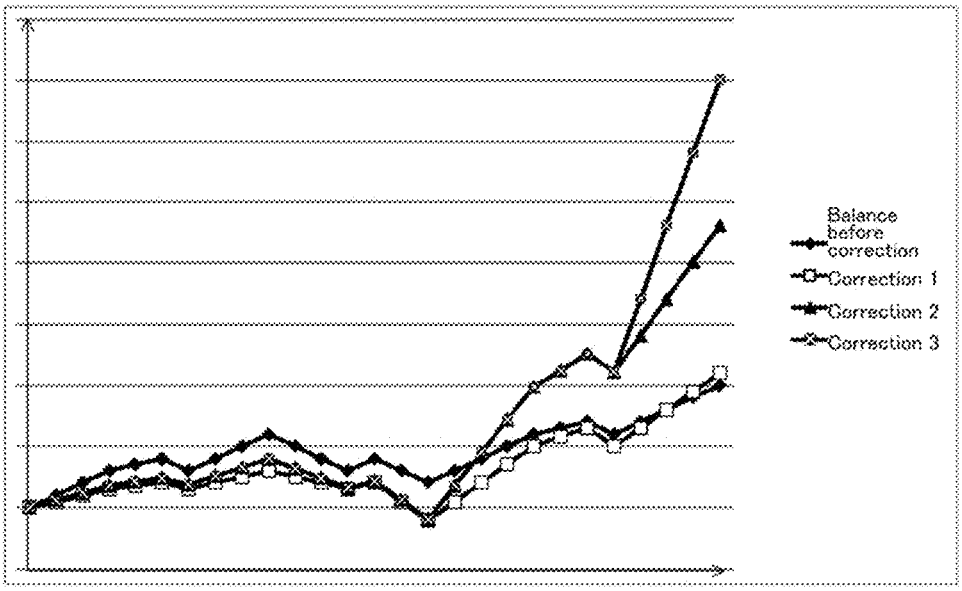
FIG. 17 is a graph depicting weighting in the computing processing of degree of satisfaction.

FIG. 17 is a graph depicting weighting in the computing processing of degree of satisfaction.

The balance before correction shown in FIG. 17 indicates the same trend as in the slump graph SG in FIG. 65 (*b*). The variation trend continuation periods $CP_1$ to $CP_5$ included in the slump graph SG of FIG. 65 (*b*) are also contained in FIG. 17. The variation trend continuation period $CP_1$ to $CP_5$ are positive, positive, negative, positive, and positive, respectively.

5

In this embodiment, three type of correction (correction 1 to correction 3) shown in FIG. 17 are performed on the balance before correction.

Correction 1 the weighting to impart a greater influence to relative to the degree of satisfaction of the balance of a latter half in the game playing period than a balance in a first half in the game playing period. In this embodiment. Correction of the following equation (1) is performed on the balance in the first half, and correction of the following equation (2) is performed on the balance in the latter half.

$$(\text{Balance in first half})\times(1-\alpha) \quad (1)$$

$$(\text{Balance in latter half})\times(1+\alpha) \quad (2)$$

With the proviso that $\alpha$ is a positive number less than 1.

As a result, the balance becomes as correction 1 shown in FIG. 17 (in the figure, white square marks).

Correction 2 is the weighting to allow, in the variation trend continuation periods contained in the game playing period, the balance occurring later in the variation trend continuation period to have greater influence on the degree of satisfaction of player. In this embodiment, the following equation (3) is performed on the balance of each variation trend continuation period of correction.

$$(\text{Balance of the } nth \text{ variation trend continuation period})\times<1+(n/N)> \quad (3)$$

With the proviso that N is the total number of the variation trend continuation periods included in the game playing period, and n is a natural number equal to or lower than N.

As a result, the balance becomes as correction 2 shown in FIG. 17 (in the figure, black triangle mark).

Correction 3 is weighting to allow such correction that the higher the number of continuous number of occurrence of the variation trend continuation period having the same variation trend the variation trend continuation period which occurs finally, the greater the influence on the degree of satisfaction of player. In this embodiment, among the variation trend continuation periods having the same variation trend the last variation trend continuation period, the correction of the following equation (4) is performed on the balance of the variation trend continuation period occurring continuously with the last variation trend continuation period.

$$(\text{Balance of the } m\text{-}th \text{ variation trend continuation period})\times m \quad (4)$$

With the proviso that m is a natural number.

As a result, the balance becomes as correction 3 shown in FIG. 17 (in the figure, x-marks).

In such a manner, according to this embodiment, as shown in FIG. 17, performing correction 1 to 3 increases the proportion of the balance of the latter half in the overall balance.

Next, the control portion 2062 of the hall conserver 2060 computes the degree of satisfaction of player based on (a) the game playing period at one time, and (b) the balance after correction (step S1102). The method of computing the degree of satisfaction of player is as described above. The control portion 2062 stores the computed degree of satisfaction of player in the hard disk 2065. Step S1102 corresponds to the processing (B).

Next, the control portion 2062 of the hall conserver 2060 (c) computes the degree of satisfaction of gaming facility based on (a) the operation time of the gaming machine 1001, and (d) the profit of a shop side by the gaming machine 1001 (step S1103). The method of computing of the degree of satisfaction of gaming facility is as described above. The control portion 2062 stores the computed degree of satisfaction of gaming facility in the hard disk 2065, and completes this subroutine. Step S1103 corresponds to the processing (C).

Figure 18:
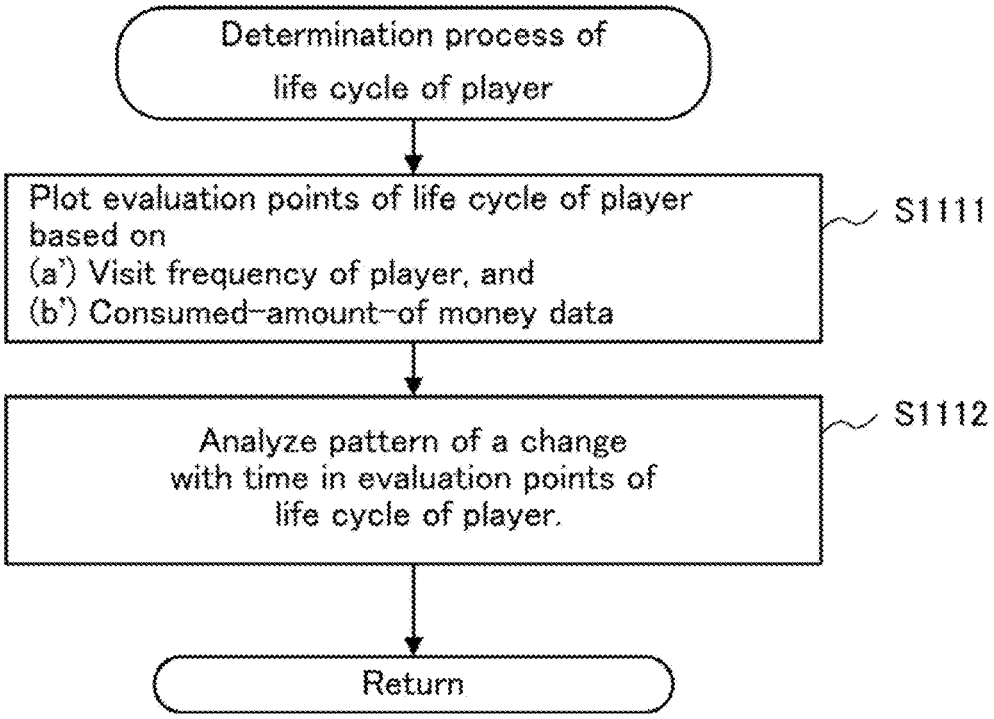
FIG. 18 is a flowchart depicting the player life cycle determination processing executed in the hall conserver shown in FIG. 1.

FIG. 18 is a flowchart showing the player life cycle determination processing executed in the hall conserver shown in FIG. 1.

The control portion 2062 of the hall conserver 2060 plots evaluation dots of life cycle of player based on data related to (a') visit frequency and (b') consumed amount of money per visit by player (step S1111). Accordingly, a group to which a player belongs is determined. In other words, the player is classified into any of the groups: new customers, fixed customers: dissatisfied customers and leaving customers. Step S1111 corresponds to the processing (E). Next, the control portion 2062 analyzes the pattern of change of evaluation dots of life cycle of player (step S1112), and completes this subroutine. Step S1112 corresponds to the processing (F). Evaluation dots of life cycle of player, the group to which the player belongs and its pattern of change are stored in the determination result database (refer to FIG. 9 (*b*)).

Figure 19:
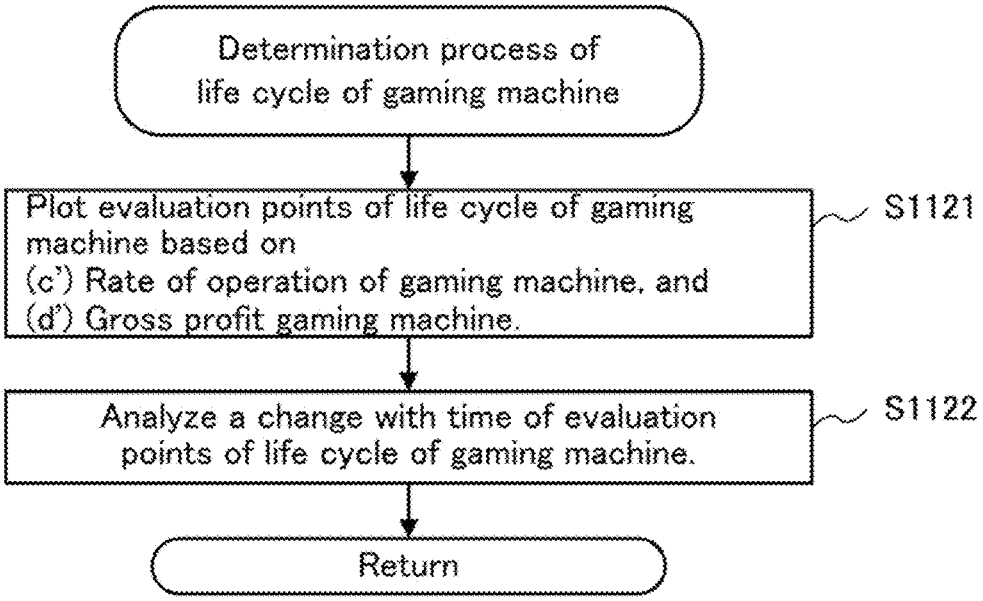
FIG. 19 is a flowchart depicting the gaming machine life cycle determination processing executed in the hall conserver shown in FIG. 1.

FIG. 19 is a flowchart depicting the gaming machine life cycle determination processing executed in the hall conserver shown in FIG. 1.

The control portion 2062 of the hall conserver 2060 plots evaluation dots of life cycle of gaming machine based on (c') the operability of the gaming machine 1001, and (d') the gross profit by the gaming machine 1001 (step S1121). Accordingly, the group to which the gaming machine belongs (refer to FIG. 14) is specified. In other words, gaming machines are classified into any one of groups of new machine, main device type, less popular, and unpopular. Step S1121 corresponds to the processing (J).

Next, the control portion 2062 analyzes the pattern of change of evaluation dots of life cycle of gaming machine (step S1122), and completes this subroutine. Step S1122 corresponds to the processing (K). Evaluation dots of life cycle of gaming machine, the group to which the gaming machine belongs and its pattern of change are stored in the determination result database (refer to FIG. 9 (*c*)).

Figure 20:
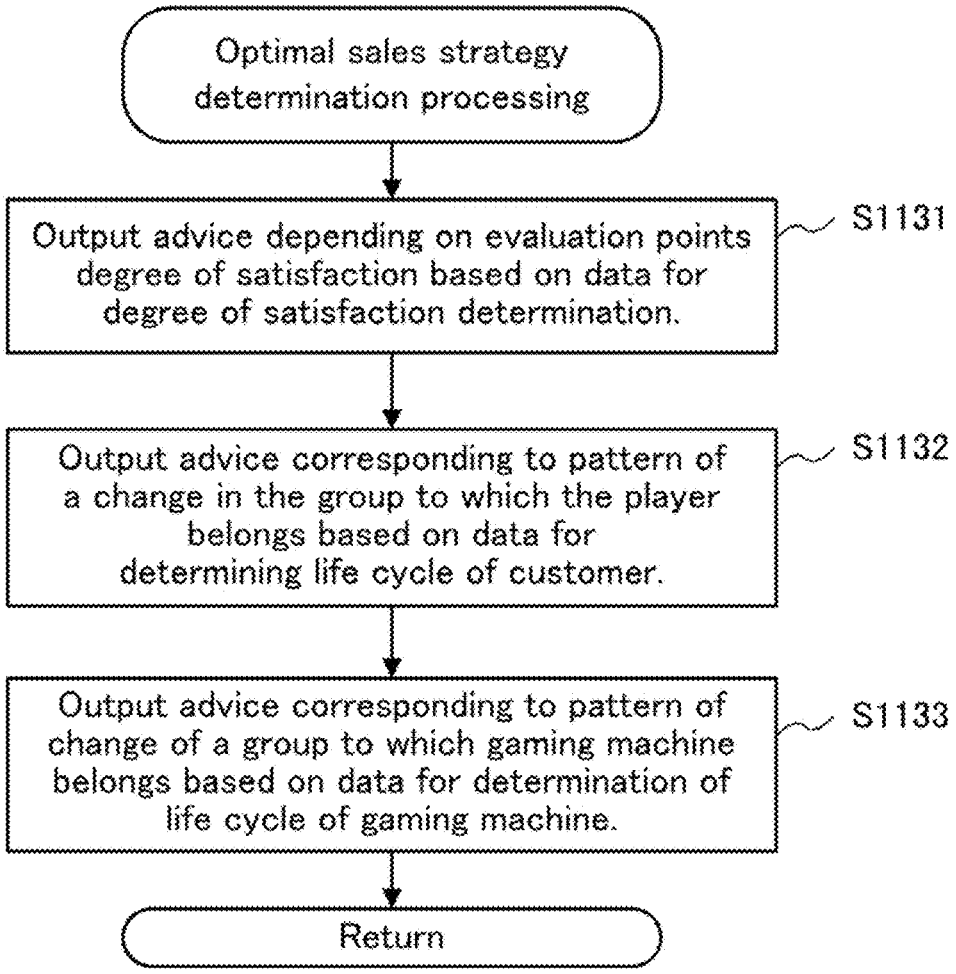
FIG. 20 is a flowchart depicting the optimal sales strategy determination processing executed in the hall conserver shown in FIG. 1.
Figure 21A:
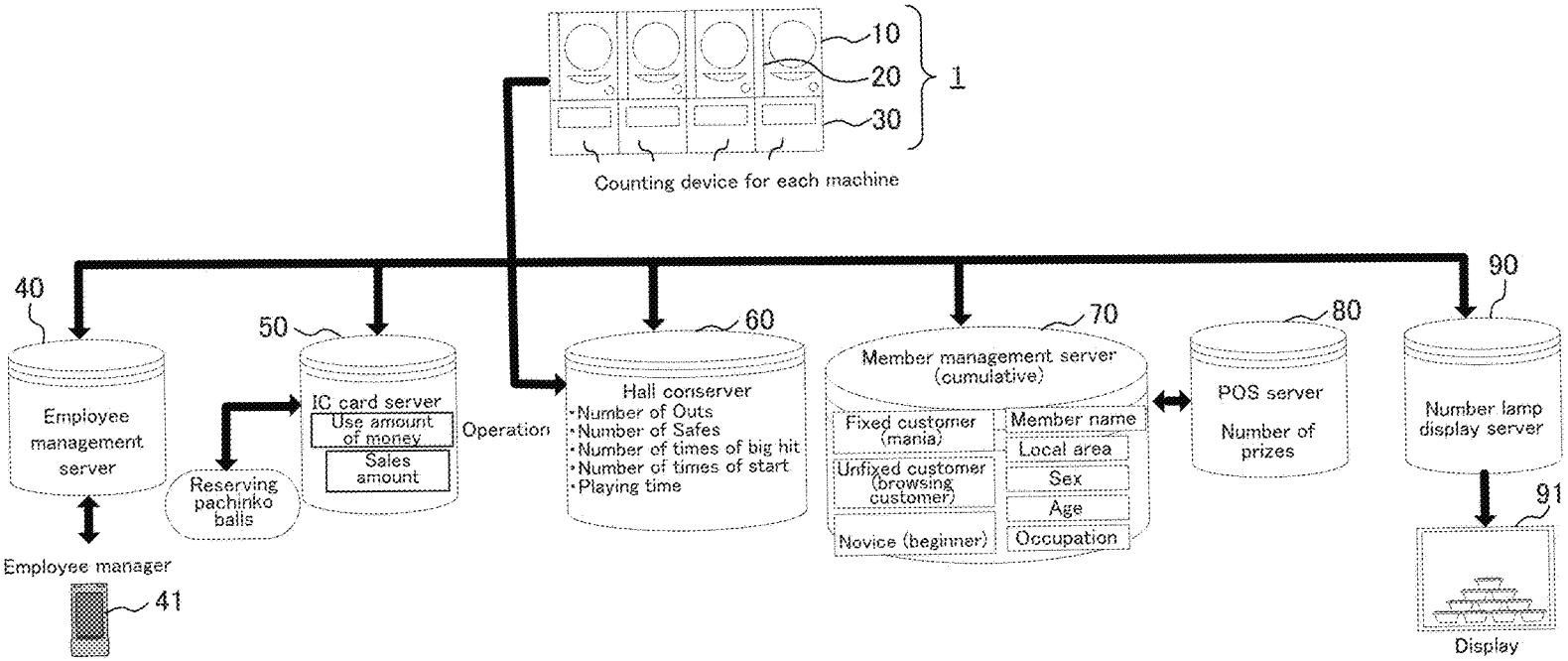
FIGS. 21A, 21B, 21C, and 21D illustrate a functional flowchart depicting the outline of the game playing information integration system in the gaming facility.
Figure 21B:
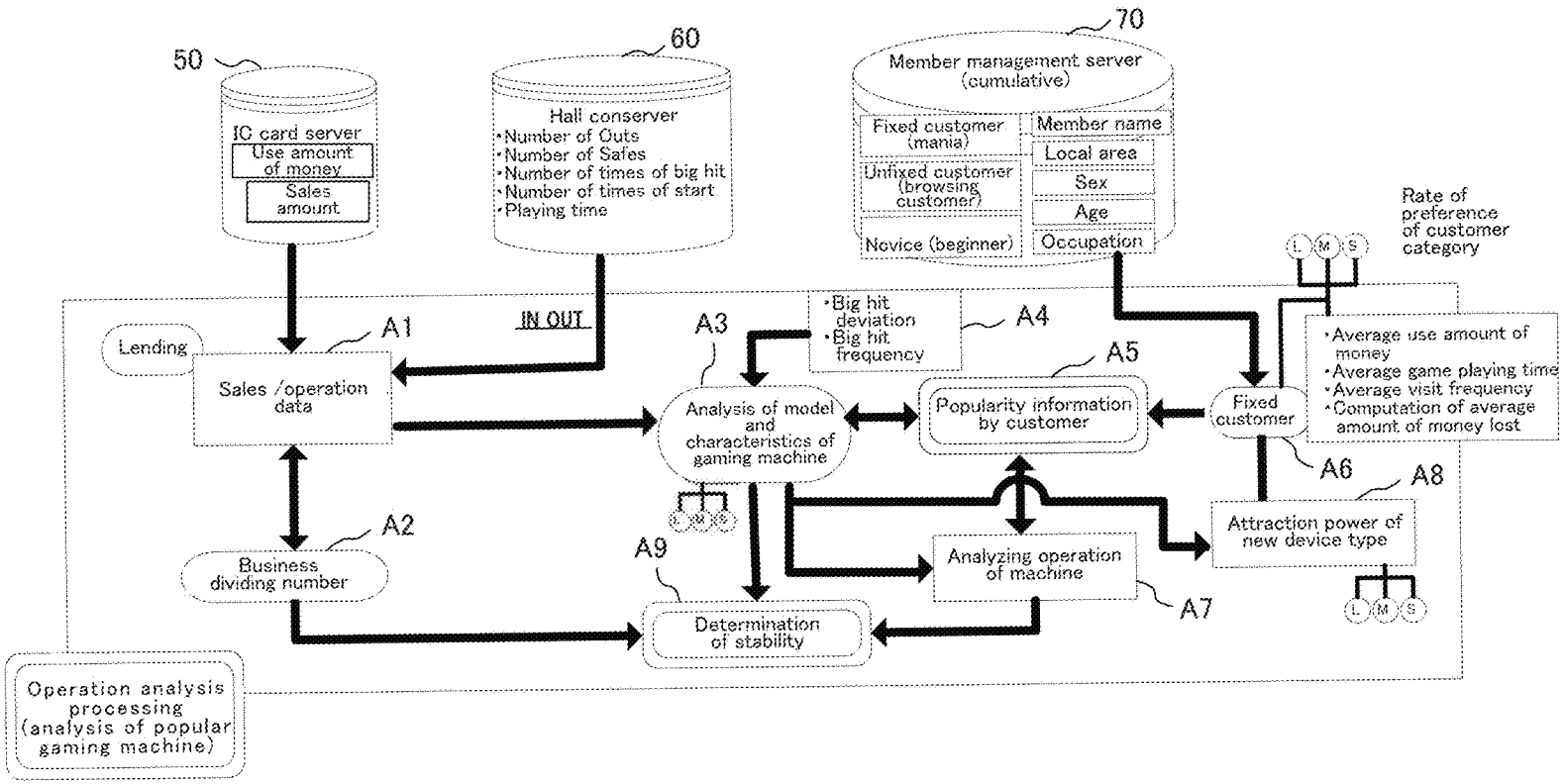
Figure 21C:
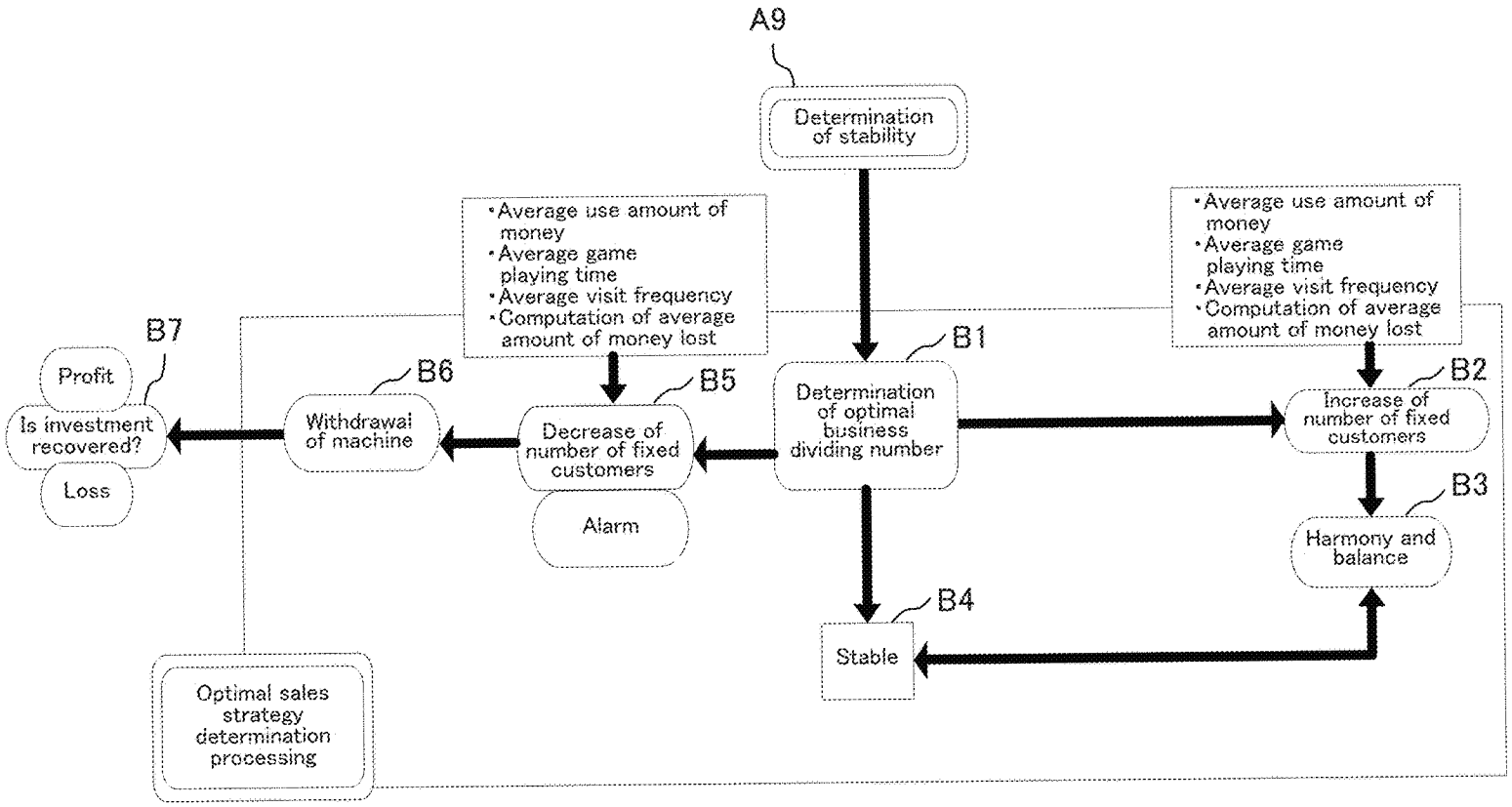
Figure 21D:
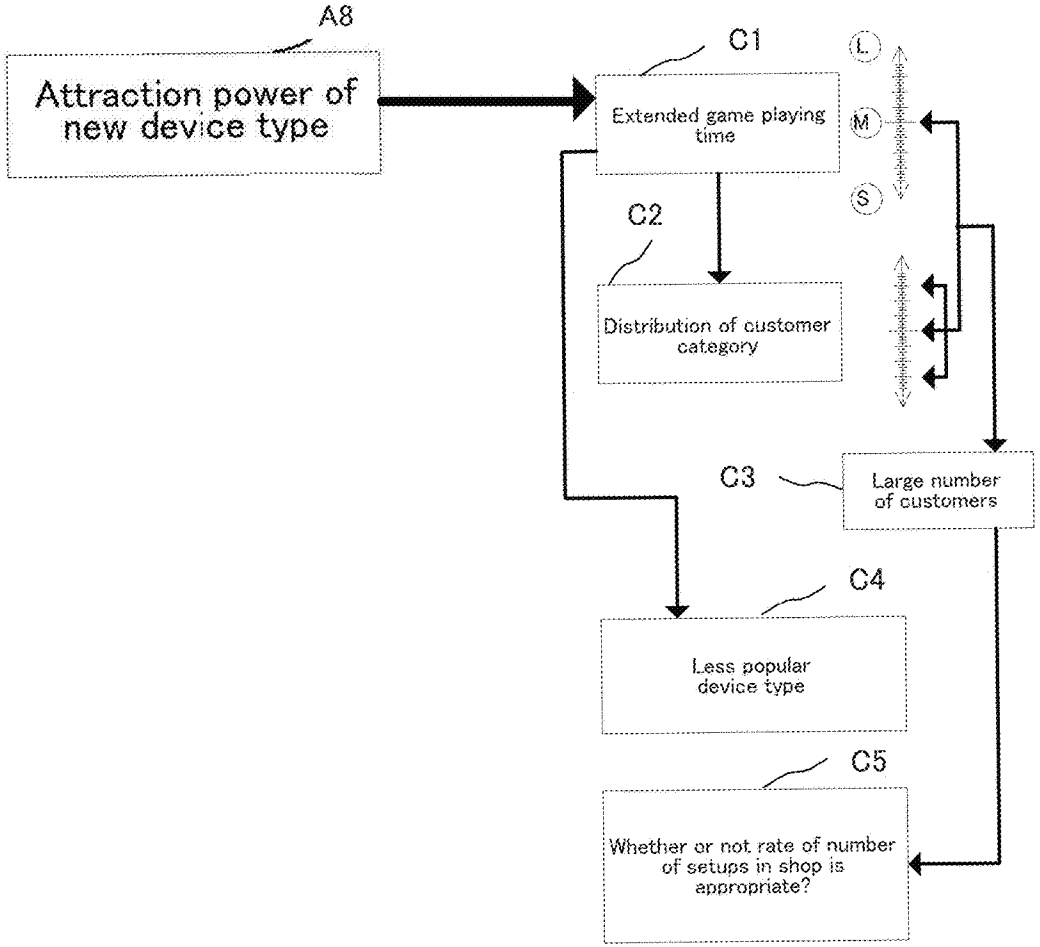

FIG. 20 is a flowchart depicting the optimal sales strategy determination processing executed in the hall conserver shown in FIG. 1.

The control portion 2062 of the hall conserver 2060 outputs advice depending on the degree of satisfaction evaluation dots based on the data for degree of satisfaction determination stored in the hard disk 2065 (step S1131).

In the data for determination of degree of satisfaction, data indicating advice is associated with the combination of a numerical range of the degree of satisfaction of player the number of value range (for example, 0 or higher but less than 10, 10 or higher but less than 20, etc.) and the numeral range of the degree of satisfaction of gaming facility (for example, 0 or higher but less than 10, 10 or higher but less than 20, etc.). Examples of the contents of advice include withdrawal of machine, changing value settings, changing the number of units installed, and others. It should be noted that the advice may be qualitative contents, or contents including specific numerical values.

Next, the control portion 2062 outputs advice depending on the pattern of change of the group to which the player belongs, based on data for determination of customer life cycle (step S1132).

In the data for determination of customer life cycle the pattern of change of the group to which the player belongs and the data indicating advice are associated with each other. It should be noted Since the description of the advice has been already provided, it will be omitted here. Step S1132 corresponds to the processing (G) and process (H).

Next, the control portion 2062 outputs advice corresponding to the pattern of change of a group to which gaming machine belongs based on the data for determination of life cycle of gaming machine (step S1133), and completes this subroutine. Step S1133 corresponds to the processing (L) and process (M).

In the data for determination of life cycle of gaming machine the pattern of change of a group to which gaming machine belongs and the data indicating advice are associated with each other. Since the description of the advice has been already provided, it will be omitted here.

In the embodiment mentioned above the case where standard deviation (deviation value) is used to evaluate the degree of satisfaction, life cycle of player and life cycle of gaming machine has been described, but the present invention is not limited to this example. Moreover, the degree of satisfaction, life cycle of player and life cycle of gaming machine mentioned above can be also applied to the embodiments shown below.

(Game Playing Information Integration System)

FIGS. 21A, 21B, 21C, and 21D illustrate a functional flowchart showing the outline of a game playing information integration system IS.

The game playing information integration system IS includes a plurality of gaming machine units 1, an employee management server 40, an IC card server 50, a hall conserver 60, a member management server 70, a POS server 80, a number lamp display server 90, and a plurality of game playing information display device 91 for each gaming machine.

A plurality of gaming machine units 1 each include a pachinko gaming machine 10, a gaming medium lending devices 20, and an individual counting devices 30. In other words, the gaming medium lending device 20 is installed for each of the pachinko gaming machines 10 (gaming machines), and the individual counting device 10 is installed for each of the pachinko gaming machines 10 (gaming machines).

Data output from the gaming machine unit 1 includes data indicating the number of out pachinko balls, data indicating the number of safe pachinko balls, data indicating an occurrence of a special prize, data indicating start or the like, for example. In the game playing information integration system IS, data indicating the number of pachinko balls lent, which is output from the gaming medium lending device 20, is employed as the data indicating the number of out pachinko balls, and data indicating a count value, which is output from the individual counting device 30, is employed as the data indicating the number of safe pachinko balls. The data indicating an occurrence of a special prize and the data indicating start are output from the pachinko gaming machine 10. The gaming medium lending device 20 is capable of reading player identification information from an IC card (not shown) owned by a player.

It is to be noted that in the present invention the gaming machine unit 1 is not limited to this example as long as the unit includes at least a gaming machine. The gaming machine is not limited thereto in particular, and includes a pachinko gaming machine, a pachinko/slot gaming machine, a slot machine, a gaming machine or the like, for example.

Reading of player identification information in the gaming medium lending device 20 does not always need to be performed via an IC card. A medium to store player identification information is not limited in particular. In addition, player identification information does not always need to be recognized by a player. For example, in a case where a new IC card is provided from a gaming medium lending device to a player, the IC card stores identification information of the IC card itself, and the identification information of the IC card itself is not recognized by a player. However, the game playing information integration system IS recognizes a player by employing identification information itself of a medium. In such a case the identification information of the medium functions as player identification information.

Player identification information is not limited to identification information of a medium. The gaming machine unit 1 may be constituted so that a password is input from a player. In this case, the password functions as player identification information. In addition, a face authentication system can also be employed. The face authentication system is superior to any other item of player identification information in that it is capable of identifying a player without need to cooperate the player. In this case, data obtained by acquiring a player's face as an image or data obtained by processing that data functions as player identification information.

An employee management server 40 is a server to manage an employee manager, and is capable of making wireless communication with a portable terminal device 41 owned by the employee manager. The portable terminal device 41 is not limited in particular, and includes a portable terminal device provided with a touch panel, for example (such as iPhone (registered trademark), for example). A wireless communication system is not limited in particular, and includes Wi-Fi or the like, for example. Data or the like of an analysis result, which is obtained by the game playing information integration system IS, is distributed from the employee management server 40 to each of the portable terminal devices 41, whereas the employee management server 41 is capable of setting an information access privilege by employee manager or by manager, and setting a priority level for each item of distribution information. For example, a higher access privilege may be set to a respective one to owner in order, head office staff, shop manager, manager, and chief so that the higher information security is not transmitted to a portable terminal device 41 to which an access privilege less than the corresponding higher level is set.

An IC card server 50 stores data related to a use amount of money and data related to an amount of sales in association with reception time data, player identification information, and gaming machine unit identification information. The data related to a use amount of money and data related to an amount of sales are generated based on data indicating the number of out pachinko balls and data indicating the number of save pachinko balls, which are outputted from the gaming machine unit 1. In addition, the IC card server, in association with player identification information, stores data indicating the number of saved pachinko balls (or saved medals) to which the player identification information is assigned.

A hall conserver 60 stores data indicating the number of out pachinko balls, data indicating the number of safe pachinko balls, data indicating the number of times of special prize, and data indicating the number of times of start in association with reception time data, player identification information, and gaming machine unit identification information. In addition, the hall conserver 60 stores data indicating game playing time in associated with player identification information and gaming machine unit identification information.

Game playing time is generated from time when data reception from the gaming machine unit 1 is started and time when data reception from the gaming machine unit 1 completes, for example, based on data transmitted from the gaming machine unit 1. In this manner, in the game playing information system IS, information such as the number of out pachinko balls related to operation, i.e., game playing by customer at gaming machine is output from the gaming machine unit 1 to the hall conserver 60.

A member management server (cumulative) 70 stores data related to players such as member' name, local area, sex, age, occupation or the like of each player in association with player identification information. In addition, in the member management server 70, customer category data is stored for each item of player identification information. As the customer category, for example, fixed customer (mania), unfixed customer (browsing customer), and novice (beginner) or the like are set. Player identification information and player data to which customer category data indicating fixed customer is stored after classified from player identification information and player data with which another item of customer category data is associated.

A POS server 80 is connected to enable communication with the member management server 70, and stores data related to the number of prizes in association with player identification information. The data related to the number of prizes is not limited to data automatically or manually input in a gaming facility, and may be data automatically or manually input out of the gaming machine.

A number lamp display server 90 performs display and control of a device 91 for displaying game playing information by gaming machine, which functions as a number lamp display. The device 91 for displaying game playing information by gaming machine is installed upward of a gaming machine unit 1, a cashbox image is displayed, and game playing information related to another gaming machine unit 1 is displayed with predetermined timing (such as timing with which an instruction for requesting display of game playing information is input, for example). Among items of data generated by means of the game playing information integration system IS, for example, predetermined game playing information (such as game playing information which may be disclosed to a player, for example) may be displayed on the device 91 for displaying game playing information by gaming machine.

Next, processing operation executed in the game playing information integration system IS will be continuously described with reference to FIG. 1. Herein, a case in which the hall conserver 60 executes the above processing will be described. It is to be noted that in the present invention, entity of executing each processing operation is not limited to the hall conserver 60, and may be performed by any one of other devices (such as employee management server 40, IC card server 50, member management server 70, POS server 80, or number lamp display server 90, for example). In addition, the above processing operation may be performed by any two or more devices from among the employee management server 40, the IC card server 50, the hall conserver 60, the member management server 70, the POS server 80, and the number lamp display server 90 in a cooperative or sharing manner.

The processing operations in the game playing information integration system include: operation analysis processing operations (popular machine analysis) A1 to A9; optimal sales strategy determination processing operations B1 to B7; and processing operations C1 to C5 related to normalization of new device type installation state as well as processing operations (data storage/analysis processing) of storing data from the gaming machine unit 1 described above or data obtained by analyzing the data in each of the servers 40 to 90. In data storage/analysis processing, data storage into each of the servers 40 to 90 and analysis processing for obtaining data employed in operation analysis processing and optimal sales strategy determination processing on the downstream side are performed. In operation analysis processing, "customer" analysis, "machine" analysis, and "sales" analysis are performed, and further, analysis of correlation of three elements of "customer", "machine", and "sales" is performed. In optimal sales strategy determination processing determination is made as to current sales strategy, and according to a result of the determination, establishment and planning of optimal (target) sales strategy is possible. In this manner, in the game playing information integration system IS, analysis of data, analysis of correlation of three elements, and determination of analysis result are performed in order.

In the game playing information integration system IS, except a case in which it is limited in the present specification in particular, analysis of data can be performed on the basis of any of predetermined reference units (such as gaming machine, device type of gaming machine, model of gaming machine, area of gaming facility, gaming facility, or casino, for example). Of course, the present invention is not limited to this example. As to unit time as a base for data analysis as well, except in a case in which it is limited in the present specification in particular, such analysis can be performed on the basis of any unit. In addition, while processing operations each are designated by reference numerals, such reference numerals are merely assigned for the sake of convenience, and it is to be noted that the order of reference numeral represents the order of these processing operations.

In A1, sales and operation data in predetermined reference units (such as gaming machine, device type of gaming machine, model of gaming machine, area of gaming facility, gaming facility, or casino, for example) is generated, and is stored in the hall conserver 60 in a system which is capable of recognizing the reference unit, based on: data related to a use amount of money and data related to an amount of sales, which are stored in the IC card server 50; data related to the number of out pachinko balls, data related to the number of safe pachinko balls, data related to the number of times of special prize, data related to the number of times of start, and data related to game playing time, which are stored in the hall conserver 60.

In the game playing information integration system IS, sales and operation data (mainly sales data) is generated based on information from the gaming medium lending device 20. In the figure, the term "lending" denotes a main information transmission source. It is to be noted that the present invention is not limited to this example, and for example, sales data may be input from an individual counting device 30 to the IC card server 50.

In A2, a business dividing number is computed based on the sales and operation data generated in A1. In A2, it is possible to compute a business dividing number per predetermined unit time as to a predetermined reference unit (such as one day, one week, or one month, for example). The business dividing number may be computed while service time or event and the like and normal game playing are classified from each other, or alternatively, may be computed while new device type and another device type are classified from each other. The sales and operation data generated in A1 and the business dividing number computed in A2 each are equivalent to a result of "sales" analysis in gaming facility.

In A3, analysis of model and characteristics of machine is performed based on: the sales and operation data generated in A1; big hit deviation (for example, standard deviation) and big hit frequency (for example, average value), which is computed in A4 (to be described later); and popularity information by customer, which is generated in A5 (to be described later). The term "model" denotes elements as to mechanical specification, and includes: elements classified by winning probability of special prize in machine; elements classified by gadget type; elements classified by big hit specification or the like, for example. Elements classified by winning probability of special prize in machine include max type, medium type, and easy big hit digital type or the like, for example. Elements classified by gadget type include mixed machine, ordinary machine, and wing-type or the like, for example. Elements classified by big hit specification are small hit incorporation, and sudden probability change incorporation or the like, for example. The term "characteristics" denotes elements different from "model", and includes whether wave of winning pachinko balls is wild or gentle, and appearance frequency of movement of winning pachinko ball slump graph (for example, whether or not wave of slump graph is wild or how appearance frequency of variation trend continuation period (pack) is) or the like. It is to be noted that the characteristics in the present invention is not a result of qualitative evaluation, but a result of quantitative evaluation, and are expressed as character data by means of stepwise evaluation (such as large, medium, or small, for example) data or numeric evaluation data obtained by performing computation employing a predetermined computation formula (such as a function, for example) or performing processing such as referring to table data, with the use of sales and operation data, big hit deviation and big hit frequency, and popularity information by customer. The stepwise or numeric evaluation used here is performed by employing standards which are different depending on model.

In A4, big hit deviation and big hit frequency are computed based on data related to the number of times of special prize, which is stored in the hall conserver 60, and reception time data associated with the data related to the number of times of special prize.

In A5, popularity information is generated based on: the characteristic data generated in A3; data related to fixed customer, which is created in A6 (to be described later); and an analysis result of machine operation in A7 (to be described later). Unlike other device types, new device type may be operated by only an element of a "new machine", regardless of machine model or characteristics. Therefore, in the game playing information integration system IS, the element of new device type is excluded when popularity information by customer is generated. Specifically, data related to gaming machine units of new device type is not employed to generate popularity information by customer. Of course, the present invention is not limited to this example.

In A6, determination of customer category (such as fixed customer, unfixed customer, or beginner, for example) is performed based on data stored in the member management server 70 (and data stored in the hall conserver 60). In particular, determination of fixed customer is performed. Specifically, computation of average use amount of money, average game playing time, average visit frequency, average amount of money lost or the like) is performed for each player (player identification information. It is to be noted that determination of customer category (in particular, fixed customer) may be performed by employing a rate of preference by customer category. The rate of preference by customer category may be stepwise evaluation such as large, medium, or small, for example. Customer category analysis (fixed customer analysis) in A6 is equivalent to "customer" analysis in gaming facility.

In A7, operation of machine is analyzed based on the characteristic data generated in A3 and the popularity information by customer, which is generated in A5. The operation of machine includes data or the like indicating operability, for example. In addition, it may be expressed as graph or function and the like indicating a change with an elapse of time of predetermined parameters. The parameters are not limited in particular, and include the number of consumptions, the number of payouts, the number of times of start, the number of big hits (number of times of special prize), use amount of money, game playing time, the number of players, and average amount of money lost or the like. A span of change with an elapse of time is not limited in particular, for example, and analysis of one month, one week, and one day or the like during a period from a time point of machine introduction to a current time point is possible.

Analysis of model and characteristics of machine in A3 and analysis of operation of machine in A7 are equivalent to "machine" analysis in gaming facility.

In A8, attraction power (degree of attraction power) of new device type is determined based on a result of analysis of model and characteristics of machine in A3 and a result of analysis of fixed customer in A6. This determination is performed only for new device type.

For example, table data with which an analysis result of fixed customer and degree of attraction power of new device type are associated is stored for each class of machine classified based on the model and characteristics of machine. Then, a table according to the results of analysis of the model and characteristics of machine I A3 is selected, and referring to the selected table, the degree of attraction power of new device type associated with the analysis result of fixed customer is extracted. The degree of attraction power of new device type is stored as data indicating stepwise evaluation (such as large, medium, and small, for example). Evaluation of attraction power of new device type and evaluation result in the present invention is not limited to this example.

In design of a gaming machine such as pachinko gaming machine 10 or the like, there may be performed selection of so called character, requiring a large amount of license fee relative to copyright. The animation character of new device type has strong element as new device type in particular, game playing trend of player is also different depending on animation character type or the like, and thus, it is desirable to employ the presence or absence of animation character for determination of degree of attraction power of new device type as well.

In A9, determination of stability is performed.

As described above, in A1 to A7, "customer" analysis, "machine" analysis, and "sales" analysis are performed. In its process, for example, a result of "sales" analysis performed in A1 is employed for "machine" analysis in A3, and in other words, an analysis result of each element is employed for analysis of another element. Then, in A9, analysis of stability is performed based on the business dividing number analyzed in A2, the characteristic data generated in A3, and the analysis result of operation of machine in A7. In the game playing information integration system IS, the term "stability" numerically indicates stability of management as to predetermined reference unit, and is a milestone of sales obtained as a result of integrative analysis of "customer" analysis, "sales" analysis, and "machine" analysis. The higher operability is the higher stability is, and as long as the business dividing number is within a predetermined range, the stability rises, whereas as long as the business dividing number is outside of the range, the stability lowers.

In B1, determination of optimal business dividing number is performed based on stability data generated in A9. The optimal business dividing number is a target business dividing number, and the stability is maximized in a case where an actual business dividing number becomes an optimal business dividing number (target business dividing number).

In B2, an increase of fixed customers before and after performing setting of machine based on the optimal business dividing number determined in B1 is determined based on average use time of player, average game playing time, average visit time, and average amount of money lost or the like, and it is determined whether or not the number of fixed customers increases. In this manner, a harmony and balance between fixed customer and profit is obtained (step B3) by using a combination of determination of optimal business dividing number (step B1) and increase of fixed customer (B2), stabilization of management in predetermined reference unit is realized (step B4).

In B5, a decrease of fixed customer before and after performing setting of machine based on the optimal business dividing number determined in B1 is determined based on average use time of player, average game playing time, average visit time, and average amount of money lost or the like, and it is determined whether or not the number of fixed customers decreases. For example, broadcasting of alarm is performed for a portable terminal device 41.

Setting of machine is changed as triggered by broadcasting of alarm in B5, and in a case where an increase of fixed customer is realized (step B2), a harmony and balance between fixed customer and profit is obtained (step B3), and stabilization of management in predetermined reference unit can be realized (step B4); and however, in a case where decreasing of fixed customers continues or if the number of fixed customers does not increase even if setting of machine is changed, withdrawal of machine is performed (step B6), introduction of new device type or the like is performed, and it is determined whether or not investment is recovered, that is, whether profit is gained or whether a loss takes place (step B7).

In respect of C1 to C5, based on the degree of attraction power of new device type (and average use amount of money, average game playing time, average visit (game playing) frequency), and average amount of money lost in A6) which are generated in A8, determination is made as to extended game playing time (step C1), determination is made as to distribution of customer category (step C2), and it is determined whether or not popularity of that device type decreases (step C3). For example, in a case where average use amount of money, average game playing time, average game playing frequency, and average amount of money lost lower and the distribution of customer category changes (for example, in a case where the number of fixed customers playing game decreases), it is determined that popularity of device type decreases (step C4). On the other hand, in a case where the number of customers is large (step C3), it is determined whether or not an in-shop installation number rate is appropriate (step C5).

Embodiments

Game Playing Information Integration System

Figure 22:
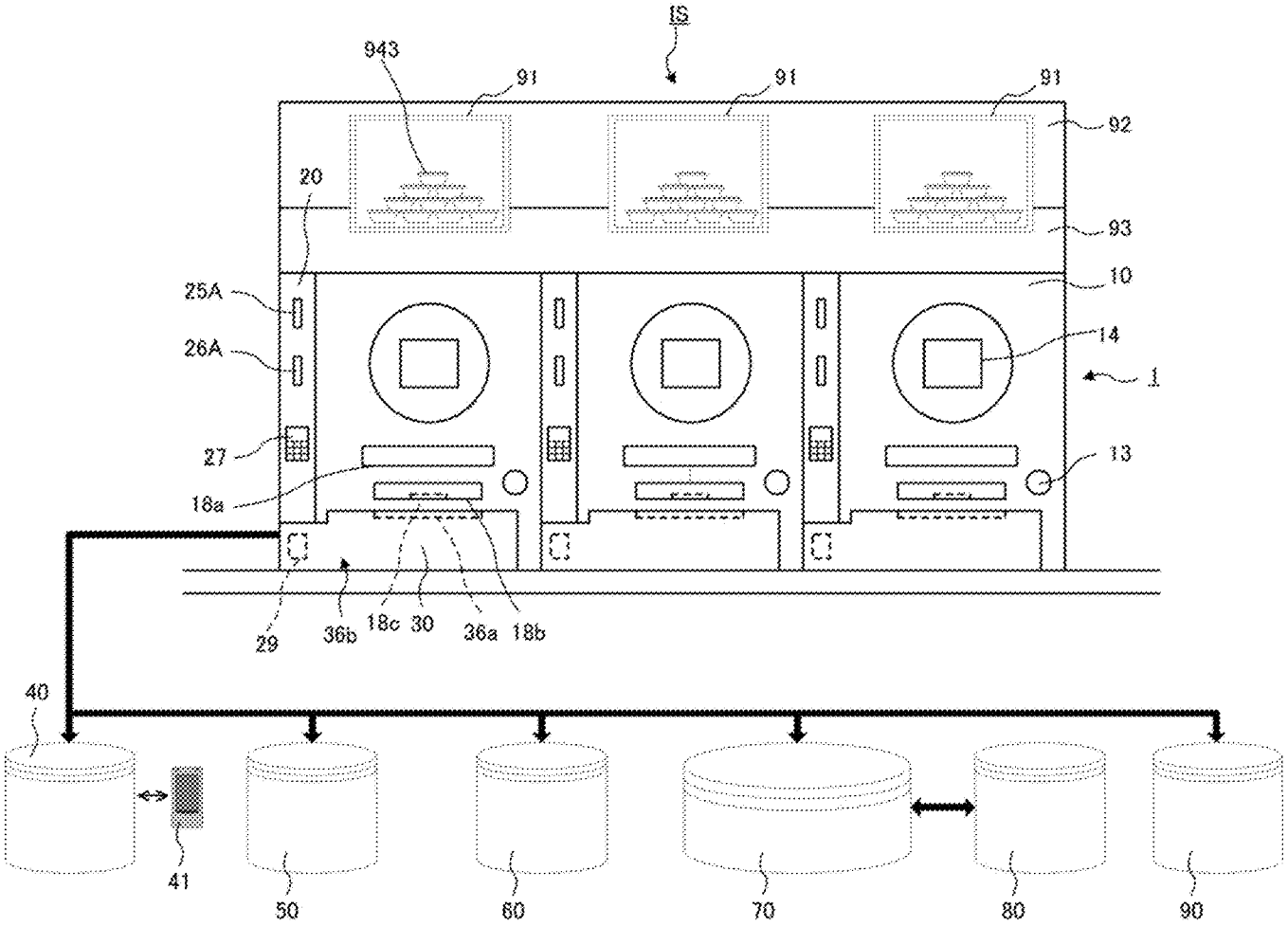
FIG. 22 is a network configuration view depicting an example of the game playing information integration system according to this embodiment.

FIG. 22 is a network configuration view showing one example of a game playing information integration system IS according to the embodiment.

The game playing information integration system IS includes a plurality of gaming machine units 1, an employee management server 40, an IC card server 50, a hall conserver 60, a member management server 70, a POS server 80, and a number lamp display server 90, and the gaming machine unit 1 transmits a signal (data) to each of the servers 40 to 90. In addition, the servers 40 to 90 can communicate with each other.

A plurality of gaming machine units 1, although not shown, are disposed in a back-to-back facing manner in pair, and these plurality of paired gaming machine units 1 are disposed side by side, thereby constituting a gaming machine bank (a so called "bank"). Upward of the gaming machine units 1 that are disposed side by side, a work door 92 is provided in an openable/closable manner across a predetermined number of gaming machine units 1 (three machines in the figure). A device 91 for displaying game playing information by gaming machine is a 15-inch liquid crystal display device; is supported at a site other than the work door 92, that is, on a front face side of a plate member 93 installed between the work door 92 and a pachinko gaming machine 10; and is positioned on a front face of the work door 92 when the work door 92 is closed or is installed so as to be able to be retracted up to a position which does not interfere with the work door 92 when the work door 92 is opened. A cashbox image 943 is displayed on the device 91 for displaying game playing information by gaming machine. It is to be noted that a display area of the device 91 for display game playing information by gaming machine is equal to or greater than a display area of a display device 14 of the pachinko gaming machine 10. The plate member 93 is equivalent to a gaming machine bank constituent element in the present invention. The gaming machine bank constituent element is not limited in particular, and for example, may be the work door 92.

A plurality of gaming machine units 1 each are include a pachinko gaming machine 10, a gaming medium lending device 20, and an individual counting device 30. Specifically, the gaming medium lending devices 20 are provided at the packing gaming machines 10, respectively, and the individual counting device 30 is mounted on each of the gaming medium lending devices 20. The gaming medium lending devices 20 each are installed corresponding to the adjacent pachinko gaming machines 10, and are connected to enable communication with the corresponding pachinko gaming machines 10. The gaming medium lending devices 20 each are connected to enable communication with the servers 40 to 90 that performs system management or sales management of the gaming medium lending device 20 in the entire hall.

The pachinko gaming machine 10 includes an 8-inch display device 14 at a front center thereof, and a game playing pachinko ball wins a gadget (start chucker) in the play of game, a start signal is output from an external end. The start signal is equivalent to number-of-games-played data related to the number of games played. The pachinko gaming playing device 10 includes number-of-games-played data output means for outputting number-of-games-played data related to the number of games played.

In addition, if a special prize is won by lottery as triggered by a winning prize, the pachinko gaming device 10 outputs a signal for special prize generation from an external end. The signal for special prize generation is equivalent to number-of-times-of-special-prize data related to the number of times of special prize. The pachinko gaming machine 10 included number-of-times-of-special-prize data related to the number of times of special prize.

At each of the gaming medium lending device 20, there is provided: a card insertion slot 26A which is capable of accepting an IC card issued by means of a card airplane (not shown) in hall, for example, a bill entry slot 25A which is capable of bill entry, and a Ten-numeric key operation unit 27 or the like. An IC card stores medium identification information of the IC card itself, and the medium identification information is employed as player identification information in the game playing information integration system IS.

A player can receive lending of game playing pachinko balls as gaming media required for the play of game by entering an information card or a predetermined amount of bills into a card insertion slot 26A or a bill entry 25A. In this case, the gaming medium lending device 20 supplies an instruction for paying out the number of game playing pachinko balls according to the entered amount of money or a specified number of game playing pachinko balls to a pachinko gaming machine 10 which is provided together via the information card, whereby in the pachinko gaming machine 10, the game playing pachinko balls of which number is assigned in accordance with the entered amount of money is paid out onto the corresponding top plate 18*a*. In this manner, the player can play a game by employing the game playing pachinko balls paid out. In addition, in the gaming medium lending device 20, an IC card is stored separately, and in a case where a player receives lending of game playing pachinko balls by entering a bill without inserting an IC card, the gaming medium lending device 20 provides the stored IC card to the player by ejecting it to the outside of the gaming machine. At this time, the gaming medium lending device 20 may read or may not read player identification information from the IC card. It is to be noted that in a case where medium identification information is stored in a medium such as an IC card is employed as player identification information, the medium identification information read in the game playing information integration system IS before that medium is provided is employed to identify a player after the medium has been provided to the player, and thus, corresponds to player identification information.

At each of the gaming medium lending devices 20, a removable mount portion 29 which is capable of removably mounting an individual counting device 30 is provided so as to be able to mount the individual counting device 30. When the individual counting device 30 is mounted at a removable mount portion 28 of the gaming medium lending device 20, the individual counting device 30 and the gaming medium lending device 20 are connected to enable communication with each other. Each of the individual counting devices 30 is provided downward of a bottom plate 18*b* of the pachinko gaming device 10 that corresponds to the gaming medium lending device 20.

The individual counting device 30 is entirely constituted in a substantially rectangular parallelepiped shape, and at a top face part thereof, an introduction opening portion 36*a* is provided for introducing game playing pachinko balls (player-owned pachinko balls) ejected via an opening portion 18*c* at which an opening and closing shutter provided at a bottom face part of the bottom plate 18*b* is provided.

The individual counting device 30 counts the number of owned pachinko balls introduced via the introduction opening portion 36*a*. Upon a counting result from the individual counting device 30, the gaming medium lending device 20 stores the number of owned pachinko balls in the IC card inserted at that time, as the number of player-owned pachinko balls. In this manner, the number of player-owned pachinko balls ejected from the bottom plate 18*b* of the pachinko gaming machine 10 is stored as information in the IC card. The owned pachinko balls when counting completes are ejected from an ejection portion 36*b* of the individual counting device 30 and then are discharged into so called a groove for re-collection from the gaming medium lending device 20. Accordingly, the player-owned pachinko balls are stored as information in the IC card without being stacked in a conventionally-used ball-box.

When an instruction for employing the counted own pachinko balls for the play of game again is input to the individual counting device 30, the instruction is transmitted from the individual counting device 30 to the gaming medium lending device 20. In the gaming medium lending device 20 having received this operation result, an instruction for paying out own pachinko balls of which number is stored in an IC card that is inserted into the gaming medium lending device 20 is transmitted to the pachinko gaming machine 10. In the gaming medium lending device 20, game playing pachinko balls are lent in predetermined unit of amount of money (such as in units of 1,000 Yen, for example), thus supplying an instruction of payout to the pachinko gaming machine 10 in lending number units according to the amount of money. Thus, in a case where the number of own pachinko balls that are stored in an IC card includes a fraction which cannot be divided into unit number for supplying the instruction for payout from the gaming medium lending device 20 to the pachinko gaming machine 10, that fraction component is made to be paid out as redundant pachinko balls in the individual counting device 30. In this manner, such fraction component is made to be paid out after distributed into the pachinko gaming machine 10 (top plate 18*a*) and the individual counting device 30, in accordance with data of the number of the player's own pachinko balls that are stored in the IC card.

The employee management server 40 is a server for managing an employee manager, and is capable of making wireless communication with the portable terminal device 41 that is owned by the employee manager.

The IC card server 50 stores data related to a use amount of money and data related to an amount of sales in association with reception time data, player identification information, and gaming machine unit identification information.

The hall conserver 60 stores: data indicating the number of out pachinko balls; data indicating the number of safe pachinko balls; data indicating the number of times of special prize; and data indicating the number of times of start, in association with reception time data, player identification information, and gaming machine unit identification information. In addition, the hall conserver 60 stores data indicating game playing time in association with player identification information and gaming machine unit identification information.

The member management server 70 stores data related to players such as member name, local area, sex, age, and occupation of each player in association with player identification information. In the member management server 70, customer category data is stored for each item of player identification information. As the customer category, for example, fixed customer (mania), unfixed customer (browsing customer), and novice (beginner) or the like are set. Player identification information and player data with which customer category data indicating fixed customer is associated is stored after classified from player identification information and player data with which another item of customer category is associated.

The POS server 80 is connected to enable communication with the member management server 70, and stores data related to the number of prizes in association with player identification information.

The number lamp display server 90 performs display and control of the device 91 for displaying game playing information by gaming machine, which functions as a number lamp display.

It is to be noted that the gaming media in the present invention are not limited to tangibles such as game playing pachinko balls, metals, coins, or tokens, for example. The gaming media may be tangibles or intangibles such as data as long as they are media of value unit in the play of game. For example, so called credits for amusement equipment such as gaming machine also fall under the gaming media in the present invention.

(Pachinko Gaming Machine)

Figure 23:
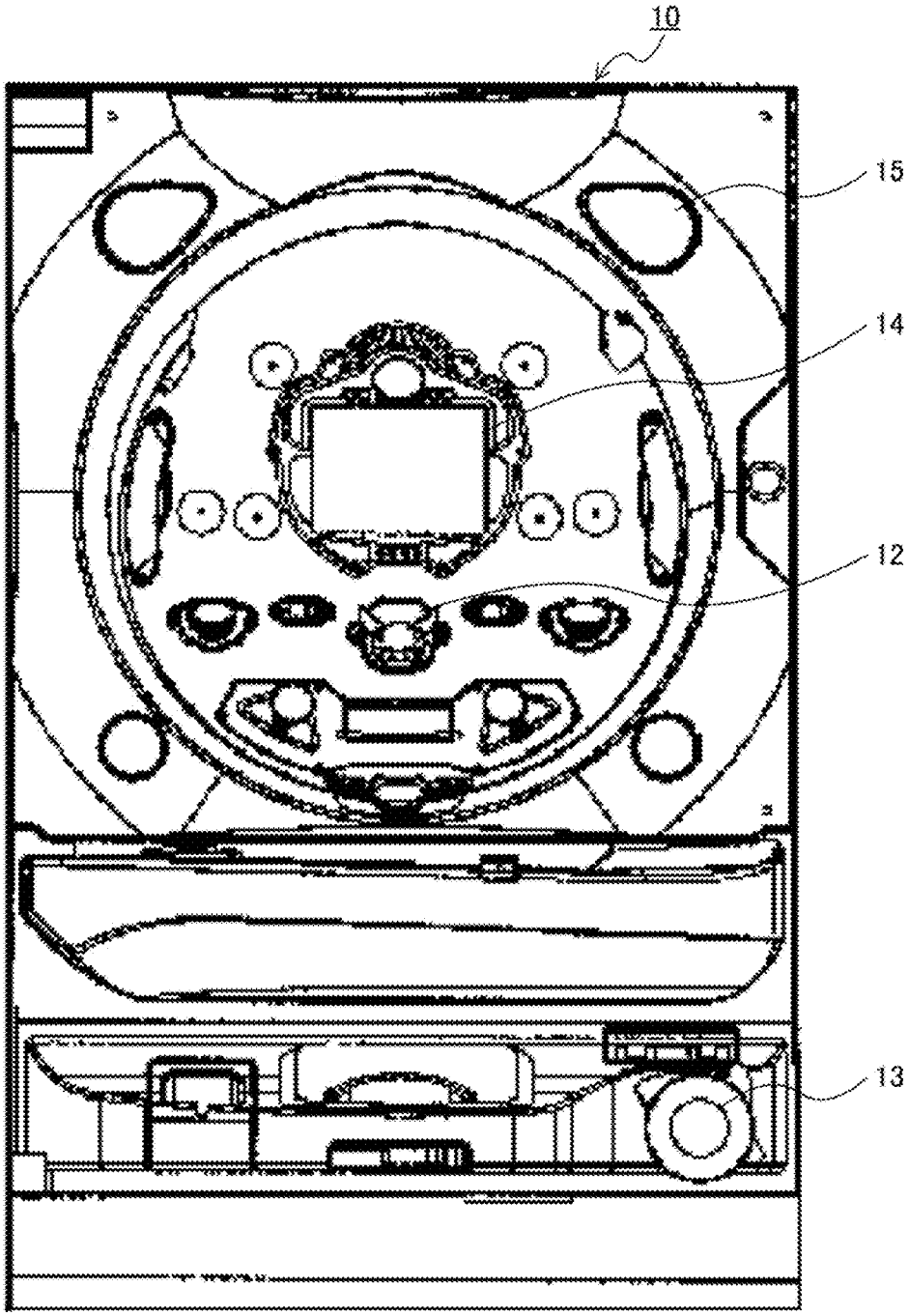
FIG. 23 is a perspective view schematically depicting an example of the pachinko gaming machine shown in FIG. 21.

FIG. 23 is a perspective view schematically showing one example of a pachinko gaming machine shown in FIG. 21.

A gadget device 12 including a start detection sensor 12S (not shown) is provided on a gaming board of a front face of a pachinko gaming machine 10, and a display device 14 is installed at a center portion of the gaming board. The display device 14 of the pachinko gaming machine 10 is equivalent to a symbol display device which is capable of variably displaying symbols. A shooting handle 13 is provided at a lower right of the front face of the pachinko gaming device 10, and speakers 15 are provided on an upper left and an upper right of the front face of the pachinko gaming device 10.

Figure 24:
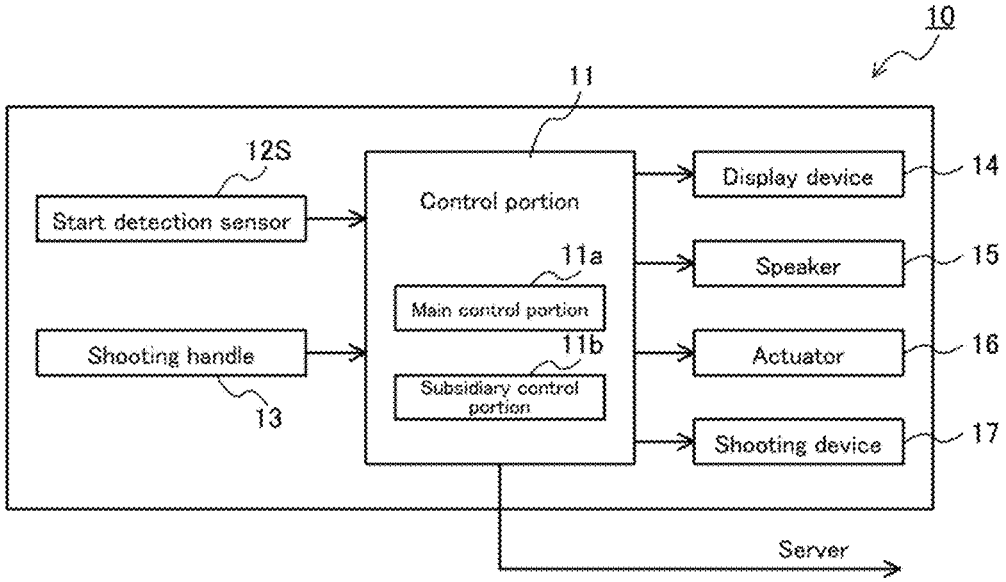
FIG. 24 is a block diagram depicting an internal structure of the pachinko gaming machine shown in FIG. 21.

FIG. 24 is a block diagram depicting an outline of an internal structure of the pachinko gaming machine shown in FIG. 1.

The shooting handle 13 is connected to a control portion 11, an angle signal indicating a turning angle of the shooting handle 13 is converted to a predetermined signal, and then, the converted signal is input to the control portion 11. A start detection sensor 12S is also connected to the control portion 11, and when a gaming pachinko ball passes through the gadget device 12, the start detection sensor 12S outputs a detection signal.

The control portion 11 includes a main control portion 11*a* (so called main board) and a subsidiary control portion 11*b* (so called subsidiary board). The main control portion 11*a* performs big hit determination, and supplies a command to the control portion 11*b* or the like, and the subsidiary control portion 11*b* mainly performs control of stage effect. The main control portion 11*a* includes a CPU, a ROM, and a RAM or the like, and the ROM stores a control program for controlling flow of the entire play of game in a pachinko gaming machine. The RAM stores values of flags or variables for use in the program described above. The subsidiary control portion 11*b* includes a CPU, a ROM, and a RAM or the like, and the ROM stores image data displayed on the display device 14 or sound data or the out output from the speakers 15.

The display device 14, the speakers 15, an actuator 16, and a shooting device 17 are connected to the control portion 11, and a drive signal or drive power is supplied to control each of the devices described above, in accordance with a result of computation processing in the control portion 11. In addition, the control portion 11 transmits a start signal and a special prize generation signal to the hall conserver 60.

(Gaming Medium Lending Device)

Figure 25:
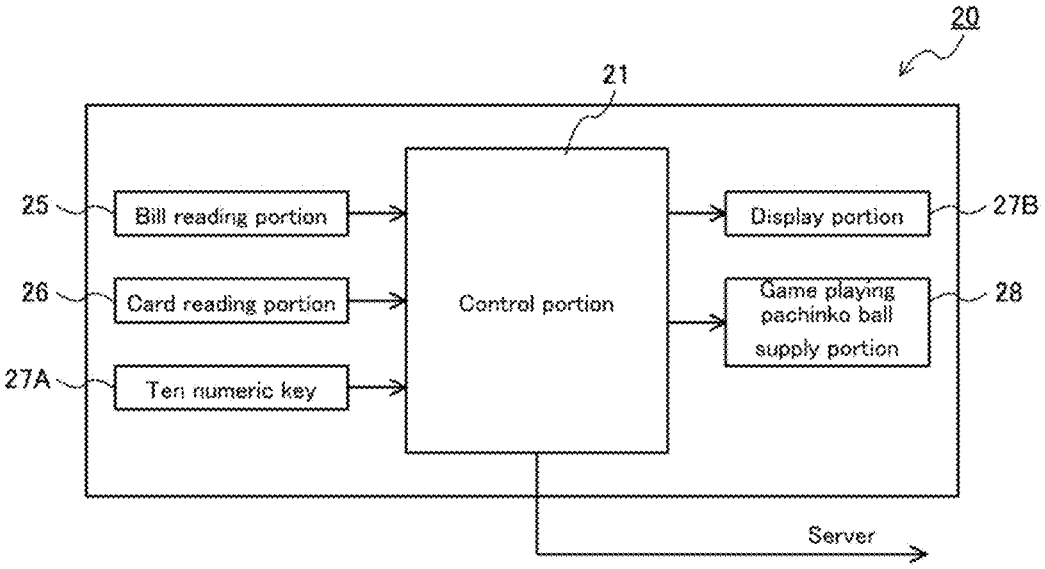
FIG. 25 is a block diagram depicting an internal structure the gaming medium lending device shown in FIG. 21.

FIG. 25 is a block diagram depicting an internal structure of the gaming medium lending device 20 shown in FIG. 21.

A bill reading portion 25, a card reading portion 26, and Ten numeric keys 27A are connected to a control portion 21. The bill reading portion 25 reads a bill entered into a bill entry slot 25A. The card reading portion 26 reads player identification information that is stored in an IC card inserted into the card reading portion 26. In addition, the card reading portion 26 may perform data writing into an IC card in addition to reading of the data stored in the IC card. Ten numeric keys 27A are operated by a player enables input of an instruction related to lending game playing pachinko balls. The card reading portion 26 is capable of reading of player identification information, and functions as a player identification information reading means for outputting the read player identification information.

A display portion 27B and a game playing pachinko ball supply portion 28 are connected to the control portion 21. The display portion 27 displays data such as use amount of money or number of pachinko balls lent, for example. The game playing pachinko ball supply portion 28 is controlled by means of the control portion 21, and supplies game playing pachinko balls of which number is assigned in accordance with the use amount of money. The control portion 21 includes a CPU, a ROM, and a RAM or the like, and controls each of the devices connected to the control portion 21. The control portion 21 outputs data related to use amount of money and data related to the number of pachinko balls lent to the IC card server 50. The data related to the number of pachinko balls lent is employed as number-of consumptions data in the game playing information integration system IS. The control portion 21 of the gaming medium lending device 20 functions as a number-of-consumptions data related to the number of consumptions of gaming media. In addition, the control portion 21 of the gaming medium lending device 20 functions as a use-amount-of-money data output means for outputting use-amount-of-money data related to the amount of money used to lend gaming media.

(Individual Counting Device)

Figure 26:
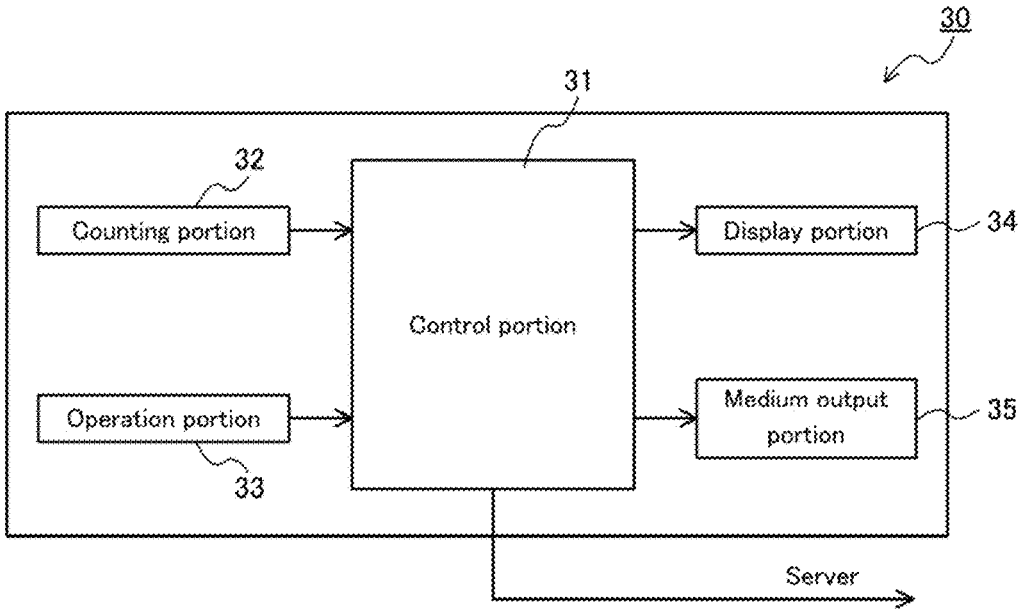
FIG. 26 is a block diagram depicting an internal 31 structure of the individual counting device shown in FIG. 21.

FIG. 26 is a block diagram depicting an internal structure of the individual counting device 30 shown in FIG. 21.

A counting portion 32 and an operation portion 33 are connected to a control portion 31. The counting portion 32 counts the number of game playing pachinko balls when the game playing pachinko balls flow into the counting portion. The operation portion 33 is capable of inputting an instruction such as an instruction related to liquidation or an instruction related to reuse of the counted game playing pachinko balls.

A display portion 34 and a medium output portion 35 are connected to the control portion 31. The display portion 34 displays the number of game playing pachinko balls read or the like, for example. The medium output portion 35 outputs media (such as receipt, for example) for displaying the number of gaming media acquired by a player, based on a result obtained by performing liquidation by means of an instruction related to liquidation. The control portion 31 outputs a count value as number-of-payouts data to the hall conserver 60. The control portion 31 of the individual counting device 30 functions as a number-of-payouts data output means for outputting number-of-payouts data related to the number of payouts of game playing media.

In the gaming machine unit 1, the gaming machine unit identification information is individually assigned to each of the gaming machine units 1, and the pachinko gaming machine 10, the gaming medium lending device 20, and individual counting device 30, which constitute the same gaming machine unit 1, employ at least the same the gaming machine unit identification information when making communication with the servers 40 to 90.

(Server)

The employee management server 40, the IC card server 50, the hall conserver 60, the member management server 70, the POS server 80, and the number lamp display server 90 are equivalent to "servers" in the present invention. It is to be noted that the servers in the present invention may be made of a plurality of nodes, or alternatively, may be made of a single node.

Hard disks 45, 55, 65, 75, 85, and 95 function as "data storage means" in the present invention.

Figure 27:
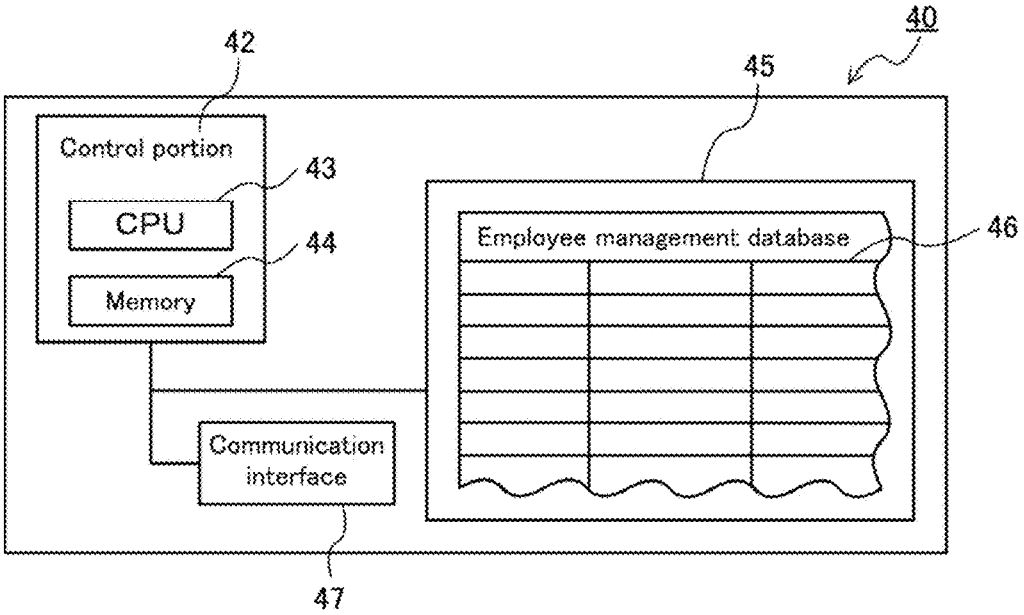
FIG. 27 is a block diagram depicting an internal structure of the employee management server shown in FIG. 21.

FIG. 27 is a block diagram depicting an internal structure of the employee management server 40 shown in FIG. 21.

The employee management server 40 includes a control portion 42, a hard disk 45, and a communication interface 47, and the control portion 42 includes a CPU 43 and a memory 44. The hard disk 45 stores a variety of programs or data, and the control portion 42 reads out and execute these programs, and performs a variety of processing operations. The hard disk 45 stores an employee management database 46. In the employee management database 46, information of employees including employee managers is stored in association with a communication address of a portable terminal device 41. In addition, employee information includes data of executive managers (such as owner, head office staff, shop manager, manager, and/or chief, for example), and different information access privileges are set for each executive manager. The employee management server 40 transmits data indicating a result of analysis or determination in the game playing information integration system IS to the portable terminal device 41. The employee management server 40 determines security of information, based on type (item) of data indicating the analysis or determination in the game playing information integration system IS and then transmits data indicating the result of the analysis or determination to a communication address of an employee manager to which an information access privilege exceeding security of information is set, in a relationship between security of information and information access privilege.

Figure 28:
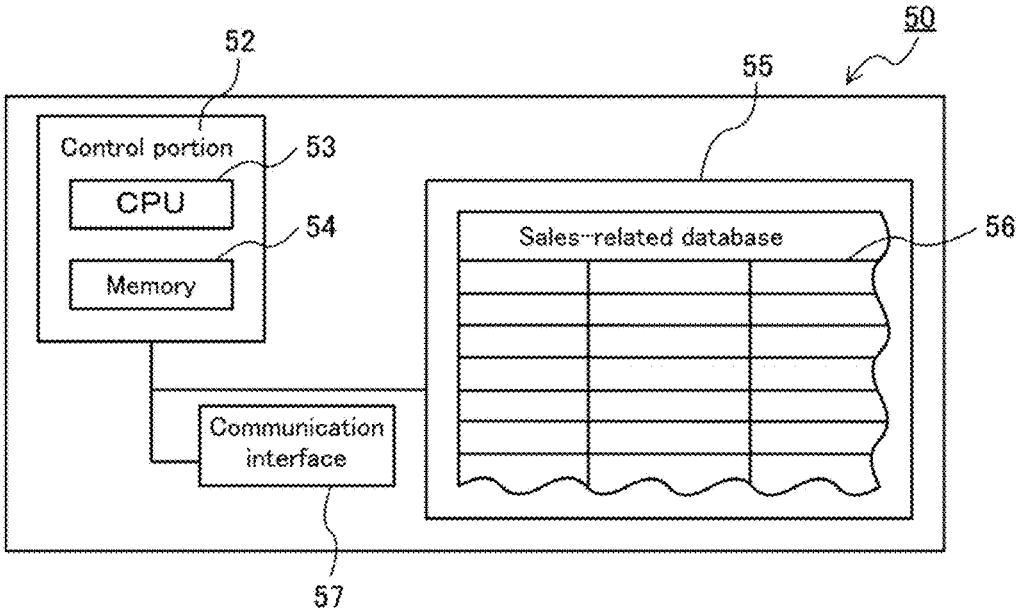
FIG. 28 is a block diagram depicting an internal structure of the IC card server shown in FIG. 21.

FIG. 28 is a block diagram depicting an internal structure of the IC card server 50 shown in FIG. 21.

The IC card server 50 includes a control portion 52, a hard disk 55, and a communication interface 57, and the control portion 52 includes a CPU 53 and a memory 54. The hard disk 55 stores a variety of programs or data, and the control portion 52 reads out and execute these programs, and performs a variety of processing operations. The hard disk 55 stores a sales-related database 56. In the sales-related database 56, for example, consumed-amount-of money data or sales-amount data, reception time data, player identification information, gaming machine unit identification information, and a flag indicating the play of game in progress or the like are stored in association with each other. In the hard disk 55 of the IC card server 50, further, data related to the number of saved pachinko balls or data related to member points may be stored in association with player identification information.

Further, the data storage means stores use-amount-of-money data output from the use-amount-of-money data output means, in association with reception time data related to reception time of data, player identification information, and gaming machine unit identification information.

Figure 29:
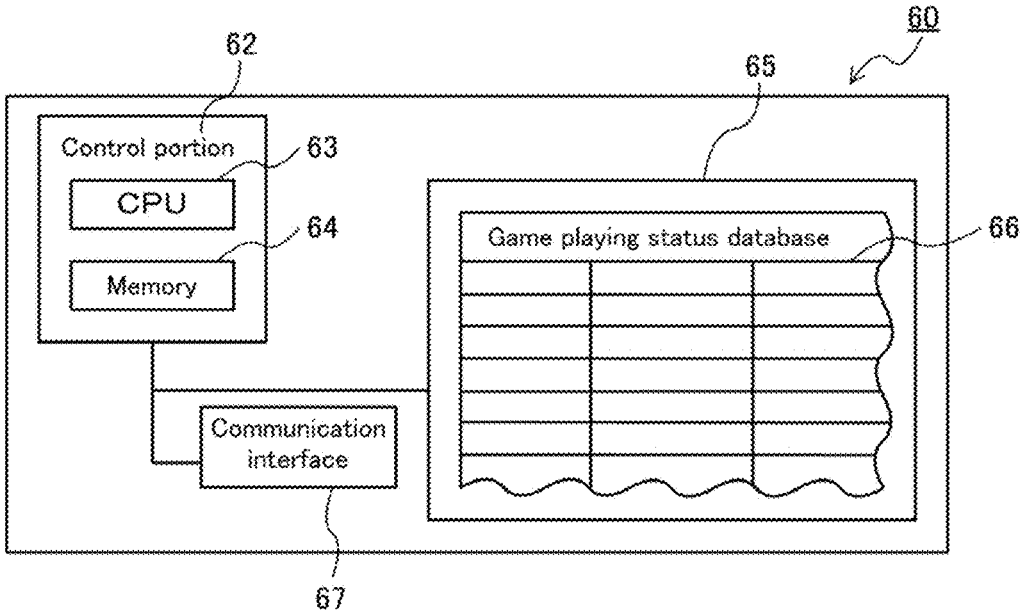
FIG. 29 is a block diagram depicting an internal structure of the hall conserver shown in FIG. 21.

FIG. 29 is a block diagram depicting an internal structure of the hall conserver 60 shown in FIG. 21.

The hall conserver 60 includes a control portion 62, a hard disk 65, and a communication interface 67, and the control portion 62 includes a CPU 63 and a memory 64. The hard disk 65 stores a variety of programs or data, and the control portion 62 reads out and execute these programs, and performs a variety of processing operations.

The hard disk 65 stores the game playing status database 66. In the game playing status database 66, for example, number-of-consumptions data, number-of-payouts data, number-of-times-of-start data, number-of-times-of-prize data, and game playing information data or the like, data output from a gaming machine unit 1 or data obtained when the data is processed, reception time data, player identification information, gaming machine unit identification information, a flag indicating the play of game in progress, and a service type flag are stored in association with each other. Further, device type data, model data, gaming machine mount identification information, a new device type flag, and a service time flag or the like are stored therein.

Data storage means stores each item of number-of-consumptions data output from number-of-consumptions data output means and number-of payouts data output from number-of-payouts data output means in association with reception time data related to reception time of data, player identification information, and gaming machine unit identification information.

In addition, the hard disk 65 stores a correlation database. In the correlation database, for example, gaming machine identification information, big hit deviation and frequency, characteristics, an operation time rate per predetermined unit time, the number of game playing customer per predetermined unit time, average game playing time per player, business time, operability, stability, and values of attraction power of new device type or the like are stored in association with each other.

Further, the hard disk 65 stores a determination result database. In the determination result database, device type, gaming machine unit identification information, target dividing number, the number of fixed customers, an alarm flag indicating the number of fixed customers, setup rate, appropriate setup rate, and setup rate alarm flag or the like are stored in association with each other.

Figure 30:
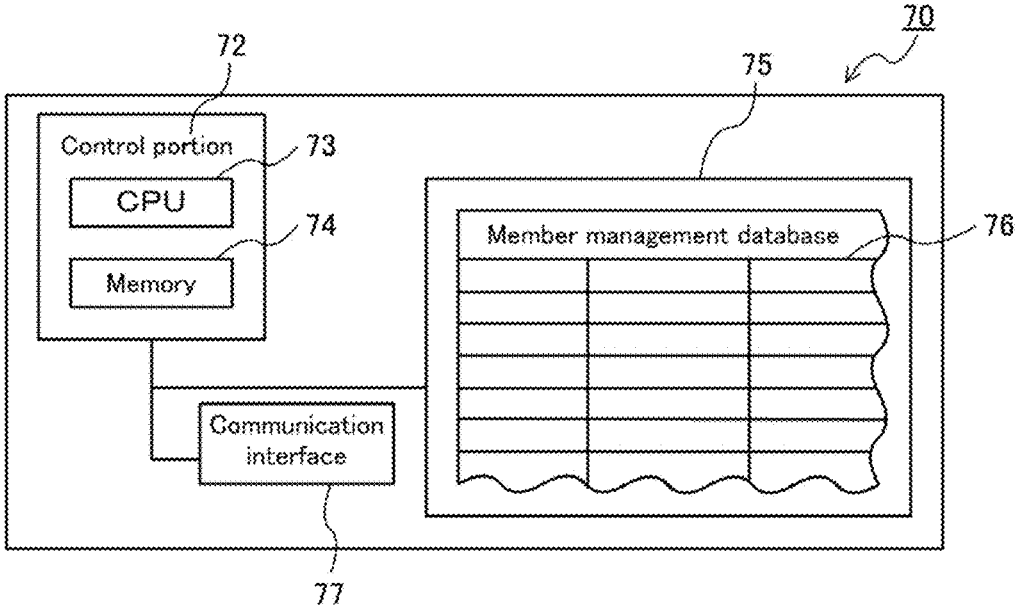
FIG. 30 is a block diagram depicting an internal structure of the member management server shown in FIG. 21.

FIG. 30 is a block diagram depicting an internal structure of the member management server 70 shown in FIG. 21.

The member management server 70 includes a control portion 72, a hard disk 75, and a communication interface 77, and the control portion 72 includes a CPU 73 and a memory 74. The hard disk 75 stores a variety of programs or data, and the control portion 72 reads out and executes these programs, and performs a variety of processing operations.

The hard disk 75 stores the member management database 76. In the member management database 76, for example, player data such as player identification information, customer category data, member's name, local area, sex, age, and occupation is stored in association with each other. In addition, the member management database 76, in association with player identification information, stores average use time, average game playing time, average visit frequency, and average amount of money lost or the like to which the player identification information is assigned.

Data storage means, further, in association with player identification information, stores player data related to a player to which the player identification information is assigned. In addition, the data storage means stores customer category data indicating which one of the customer categories classified in plurality the player to which the player identification information is assigned falls under, in association with player identification information.

Figure 31:
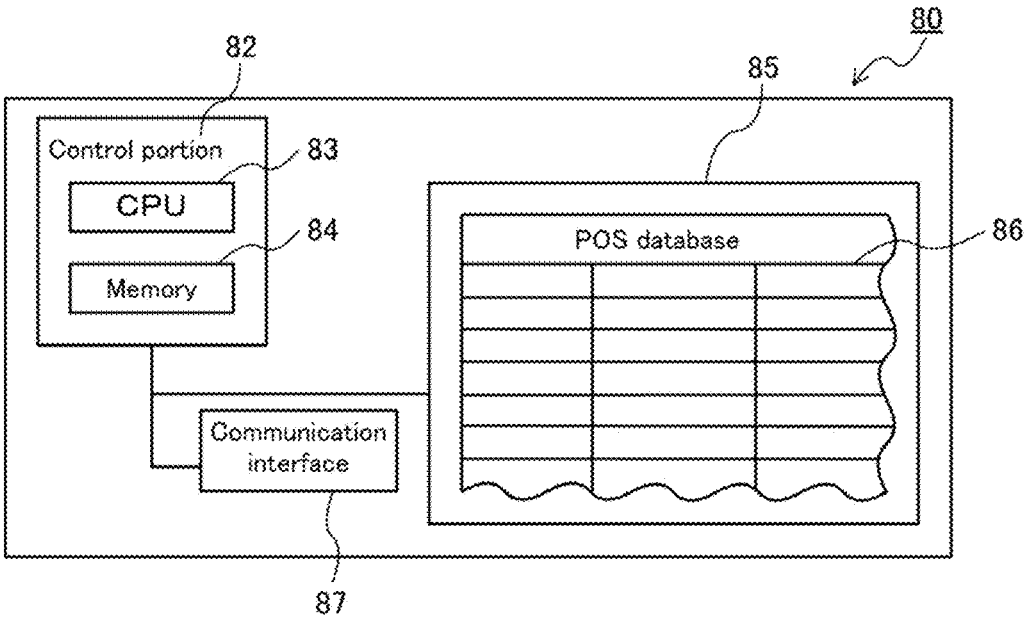
FIG. 31 is a block diagram depicting an internal structure of the POS server shown in FIG. 21.

FIG. 31 is a block diagram depicting an internal structure of the POS server 80 shown in FIG. 21.

The POS server 80 includes a control portion 82, a hard disk 85, and a communication interface 87, and the control portion 82 includes a CPU 83 and a memory 84. The hard disk 85 stores a variety of programs or data, and the control portion 82 reads out and executes these programs, and performs a variety of processing operations. The hard disk 85 stores the POS database 85. The POS database 86 stores data related to prizes in association with player identification information.

Figure 32:
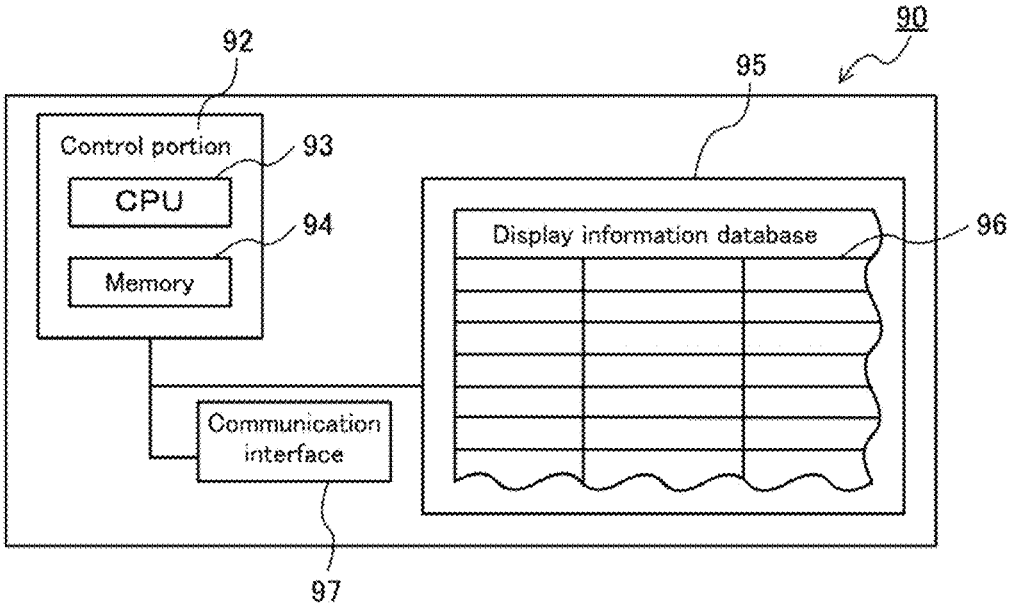
FIG. 32 is a block diagram depicting an internal structure of the number lamp display server shown in FIG. 21.

FIG. 32 is a block diagram depicting an internal structure of the number lamp display server 90 shown in FIG. 21.

The number lamp display server 90 includes a control portion 92, a hard disk 95, and a communication interface 97, and the control portion 92 includes a CPU 93 and a memory 94. The hard disk 95 stores a variety of programs or data, and the control portion 92 reads out and executes these programs, and performs a variety of processing operations. The hard disk 95 stores a display information database 96. The display information database 96 stores information displayed on a device 91 for displaying game playing information by gaming machine.

(Database)

FIG. 33 is an explanatory view showing one example of sales-related database 56 stored in the IC card server 50 shown in FIG. 21.

In the sales-related database 56, every time the IC card server 50 receives consumed-amount-of-money data or amount-of-sales data from a gaming machine unit 1, the consumed-amount-of-money data or the amount-of-sales data is stored in association with reception time data indicating reception time, player identification information, and gaming machine unit identification information. In addition, when the play of game is started in a gaming machine unit 1 of which flag indicating the play of game in progress is set to OFF (x), the flag indicating the play of game in progress is set to ON (o), whereas when no data is transmitted over a predetermined period of time from the gaming machine unit 1 of which flag indicating the play of game in progress is set to ON (o), the flag indicating the play of game in progress is set to OFF (x). It is to be noted that timing with which the IC card server 50 receives data from the gaming machine unit 1 is not limited in particular, and for example, the timing may be serially received every time consumption of money or sales occur or may be received in all every predetermined time.

FIGS. 34A and 34B are tables showing one example of the game playing status database stored in the hall conserver 60 shown in FIG. 21.

In the game playing status database 66, for example, every time data from a gaming machine unit 1, such as number-of-consumptions data, number-of-payouts data, number-of-times-start data, number-of-times-special-prize data, or game playing information data, is received, the received data is stored in association with reception time data indicating reception time, player identification information, and gaming machine unit identification information. In addition, when the play of game is started in a gaming machine unit 1 of which flag indicating the play of game in progress is set to OFF (x), the flag indicating the play of game in progress is set to ON (o), whereas when no data is transmitted over a predetermined period of time from the gaming machine unit 1 of which flag indicating the play of game in progress is set to ON (o), the flag indicating the play of game in progress is set to OFF (x). When the flag indicating the play of game in progress is set to OFF (x), game playing time is computed and then the computed time is stored in association with another item of data. In addition, in a case where data is received from a gaming machine unit 1 in service time (or event), a service time flag is set to ON (o), or alternatively, in a case where data is transmitted to a gaming machine unit 1 in service time (or event), the service time flag is set to OFF (x). Further, in the game playing status database 66, for example, device type data, model data, gaming machine mount identification information, new device type flag, and service time flag or the like are stored in association with gaming machine unit identification information. In addition, although not shown, in the game playing status database 66, data of date of entry into market is stored in association with device type data.

In addition, in the game playing status database 66, further, based on game playing time, for example, there may be stored cumulative operation time of gaming machine unit 1, cumulative nonoperation time, and rate between cumulative operation time and cumulative nonoperation time or the like. Further, rate of dividing number of gaming machine unit 1 relative to cumulative operation time, cumulative nonoperation time or rate between cumulative operation time and cumulative nonoperation time is computed. In this manner, dividing number relative to nonoperation time can be computed.

FIG. 35 is an explanatory view showing a correlation database stored in the hall conserver 60 shown in FIG. 21.

In the correlation database, for example, gaming machine identification information, big hit deviation and frequency, characteristics, operation time rate per predetermined unit time, the number of game playing customer per predetermined unit time, average game playing time per player, business time, operability, stability, and values of attraction power of new device type or the like are stored in association with each other. The big hit deviation and frequency indicates average value and standard deviation of the number of times of big hit per day. As the characteristics, function data is stored indicating stepwise evaluation data of wave of winning pachinko balls and movement of winning pachinko ball slump graph. The operation time rate per day indicates a rate of operation time with respect to business time. Stability and degree of attraction power of new device type will be described later.

FIG. 36 is an explanatory view showing one example of a determination result database stored in the hall conserver 60 shown in FIG. 21.

In the determination result database, device type data, gaming machine unit identification information, target dividing number, the number of fixed customers, number-of-fixed-customers alarm flag, setup rate, appropriate setup rate, setup rate alarm flag are stored in association with each other. The number of fixed customers and the number-of-fixed-customers alarm flag are not set for new device type. The setup rate, appropriate setup rate, and installation alarm flag are set for all device types. In the present invention, the setup rate, appropriate setup rate, and installation alarm flag may be set only for new device type.

FIG. 37 is an explanatory view showing one example of a member management database stored in the member management server 70 shown in FIG. 21.

In the member management database 76, player data such as player identification information, customer category data, member's name, local area, sex, age, and occupation or the like is stored in association with each other; the stored data is further associated with player identification information; and average use time, average game playing time, average visit frequency, and average amount of money lost or the like, to which the player identification information is assigned, is stored. The customer categories classified in plurality include fixed customer, and data associated with the customer category data indicating fixed customer is stored after classified from data associated with another item of customer category data.

Figure 38:
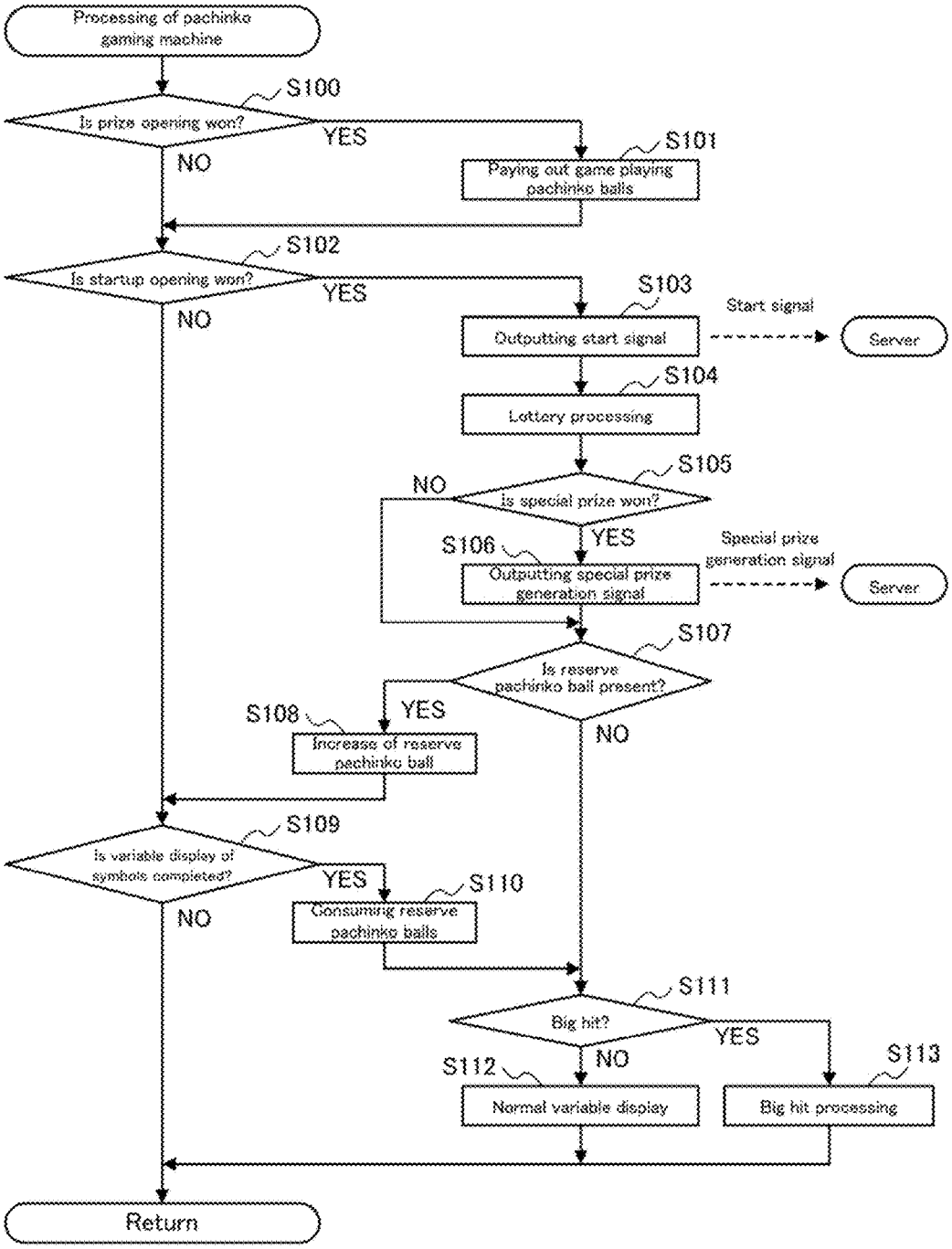
FIG. 38 is a flowchart showing one example of processing executed in the pachinko gaming machine shown in FIG. 21.

FIG. 38 is a flowchart showing one example of execution executed in the pachinko gaming machine 10 shown in FIG. 21.

First, a control portion 11 determines whether or not a game playing pachinko ball wins a prize opening (step S100). In a case where a gaming machine determines that the pachinko ball wins a prize opening, payout of game playing pachinko balls is performed (step S101).

In a case where the game playing pachinko ball does not win the prize opening in step S100 or in the case where the processing of step S101 is executed, the control portion 11 determines that the game playing pachinko ball wins a startup opening (step S102). Specifically, it is determined whether or not a detection signal output when a start detection sensor 12S provided at a gadget device 12 is received. In a case where it is determined that the game playing pachinko ball is detected, the control portion 11 outputs a start signal to the hall conserver 60 (step S103). Next, the control portion 11 performs lottery processing for determine whether or not the result is a big hit (step S104), and determines whether or not a special prize (big hit) takes place (step S105). In a case where it is determined that the special prize takes place, the control portion 11 outputs a special prize generation signal to the hall conserver 60 (step S106).

In a case where it is determined that no special prize takes place in step S105 or in a case where the processing of step S106 is execute, the control portion 11 determines whether or not a reserve pachinko ball is present (step S107). The reserve pachinko ball is data indicating a lottery result when a prize for startup opening takes place when symbols are variably displayed on a display device 14, and is stored in memory of the control portion 11. In a case where no reserve pachinko ball is present in step S107, the control portion 11 stores the reserve pachinko ball in memory, thereby increase the number of reserve pachinko balls (step S108).

In a case where it is determined that no prize for startup opening is present in step S102 or in a case where the processing of step S108 is executed, it is determined whether or not variable display of symbols in the display device 14 completes (step S109). In a case where variable display of symbols does not complete, this subroutine is completed, or alternatively, in a case where it is determined that variable display of symbols completes, the reserve pachinko balls stored in memory of the control portion 11 is consumed (step S110), the routine advances to step S111.

In a case where it is determined that the game playing pachinko ball is present in step S107 or in a case where the processing of step S110 is executed, it is whether or not the prize is a big hit (special prize) (step S111), in a case where it is not a big hit, normal variable display of symbols is performed (step S112), or alternatively, in a case where it is a big hit, big hit processing is performed (step S113). After the processing of step S112 or step S113 has been executed, this subroutine is completed.

It is to be noted that a special prize generation signal is transmitted to the hall conserver 60 at a time point when a special prize is won in the figure, the special prize generation signal may be transmitted to the hall conserver 60 at a time when the occurrence of big hit is displayed on the display device 14 in big hit processing.

In addition, data may be transmitted from a pachinko gaming machine 1 to the hall conserver 60 in all every predetermined time.

Figure 39:
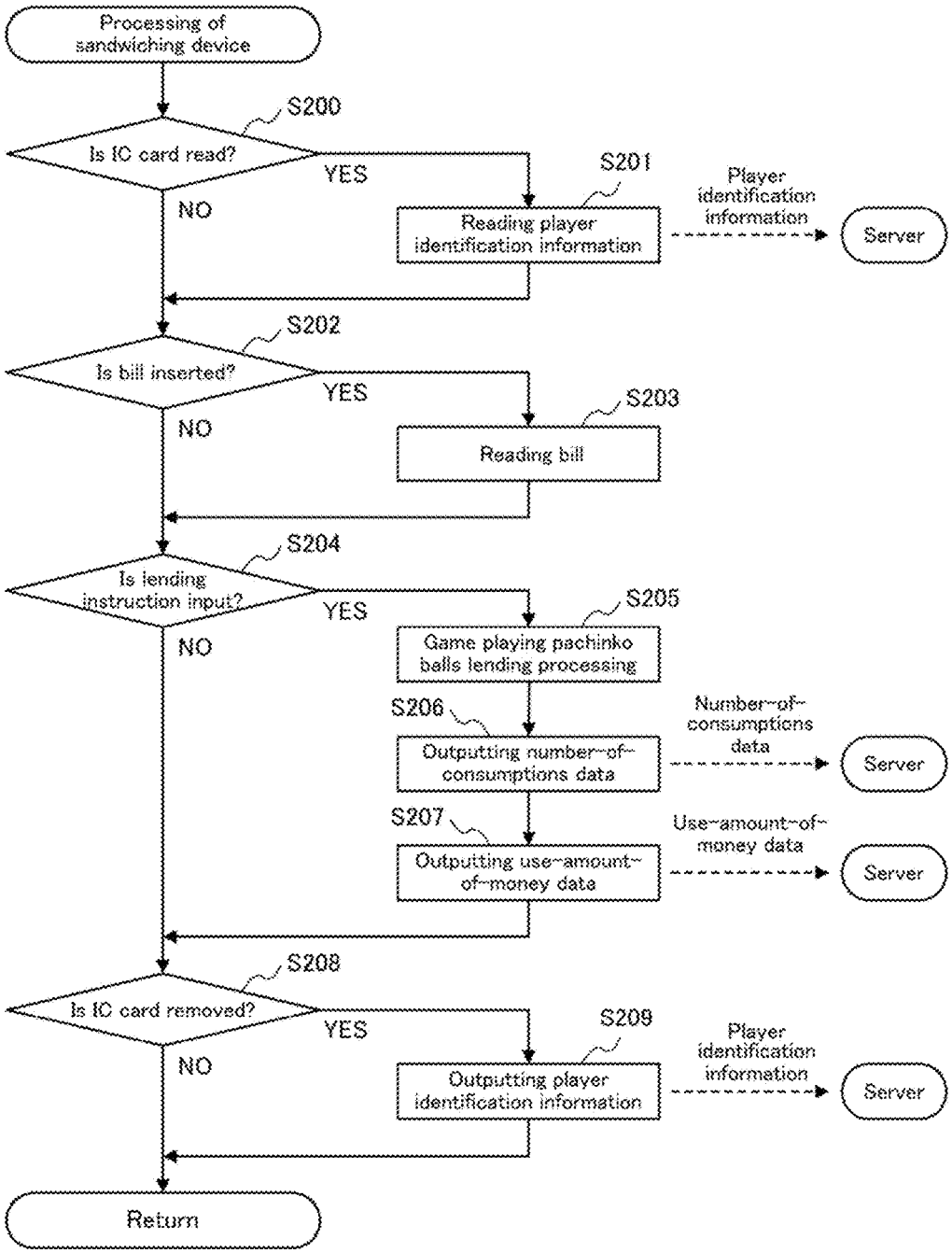
FIG. 39 is a flowchart showing one example of processing executed in the gaming medium lending device shown in FIG. 21

FIG. 39 is a flowchart showing one example of processing executed in the gaming medium lending device 20 shown in FIG. 21.

First, the control portion 21 determines whether or not to read an IC card (step S200). Specifically, when an IN card inserted into a card insertion slot 26A is detected, the control portion 21 determines that the IC card is read. In a case where it is determined that the IC card is read, a card reading portion 26 reads player identification information (step S201). The control portion transmits the read player identification information to an IC card server 50.

In a case where it is determined that the IC card is not read in step S200 or in a case where the processing of step S201 is executed, the control portion 21 determines whether or not a bill is inserted into a bill entry slot 25 (step S202). In a case where it is determined that the bill is inserted, the control portion 21 reads the bill by means of a bill reading portion, and stores amount-of-money data in memory of the control portion 21 on condition that it is a legitimate bill.

In a case where no bill is inserted in step S202 or in a case where it is determined that the processing of step S203 is performed, the control portion 21 determines whether or not an instruction for lending game playing pachinko balls is input via Ten numeric keys 27A (step S204). In a case where the instruction for lending game playing pachinko balls is input, the control portion 21 performs lending processing of game playing pachinko balls of which number is equivalent to the amount of money input via the Ten numeric keys 27A by means of the game playing pachinko ball supply portion 28 (step S205). Next, the control portion 21 outputs data indicating the number of game playing pachinko balls lent to the IC card server 50 (step S206). The data indicating the number of game playing pachinko balls lent is handled as number-of-consumptions data in the game playing information integration system IS. Subsequently, the control portion 21 outputs use-amount data to the IC card server 50 (step S207).

In a case where no lending instruction is input in step S204 or in a case where the processing of step S207 is execute, the control portion 21 determines whether or not an instruction for removing an IC card is input via the Ten numeric key 27A (step S208). In a case where the instruction for removal is input, player identification information is transmitted to the IC card server 50 (step S209), the IC card is ejected, and this subroutine is completed. In step S208, even in a case where the instruction for removing the IC card is input, this subroutine is completed.

Figure 40:
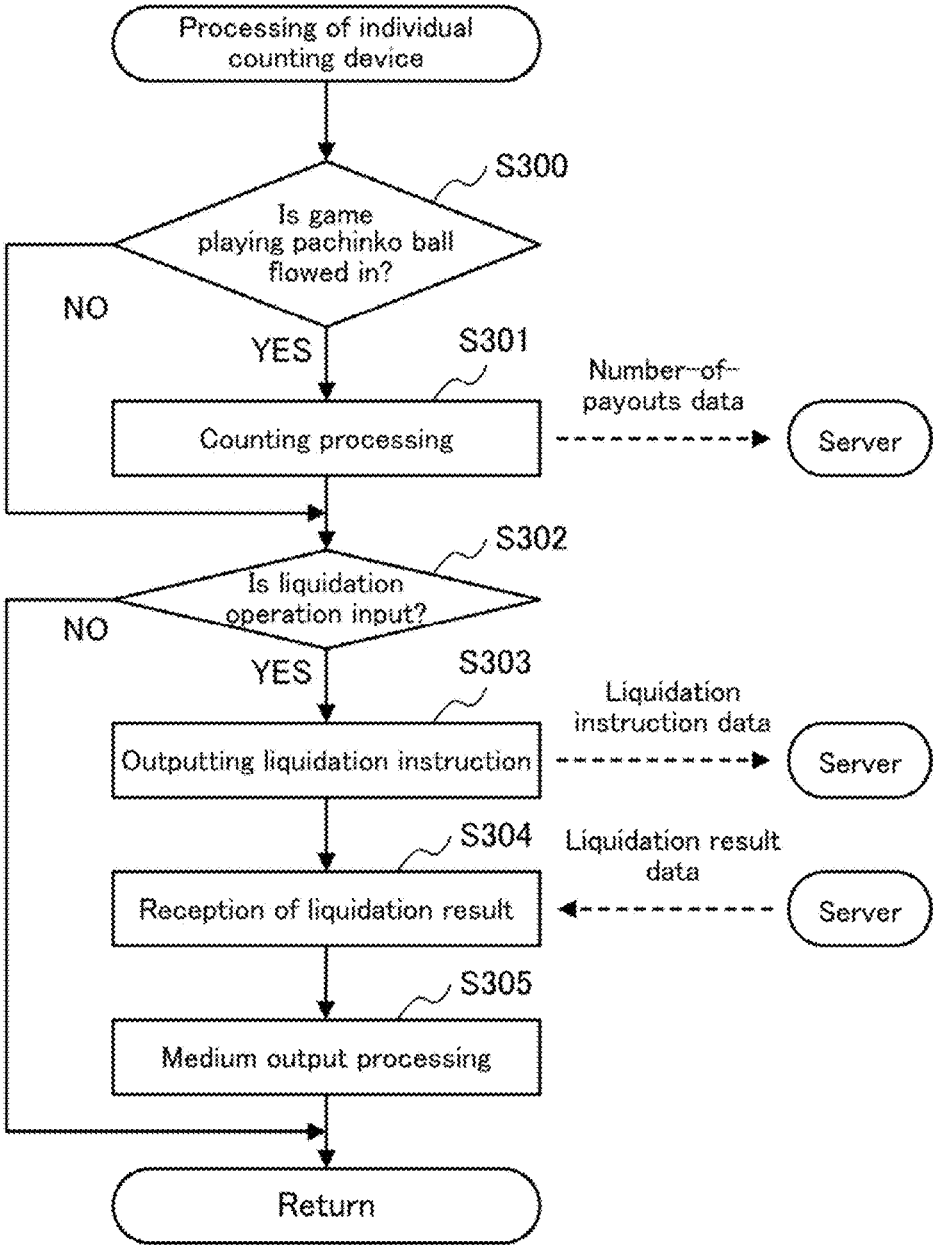
FIG. 40 is a flowchart showing one example of processing executed in the individual counting device shown in FIG. 21.

FIG. 40 is a flowchart showing one example of processing executed in the individual counting device 30 shown in FIG. 21.

First, the control portion 31 determines whether or not a game playing pachinko ball flows into a counting portion 32 (step S300), and in a case where it is determined that the game playing pachinko ball flows into the counting portion, counting processing of game playing pachinko balls is performed (step S301). At this time, the control portion transmits a count value together with the gaming machine unit identification information to the hall conserver 60. The count value is handled as number-of-payouts data in the game playing information integration system IS.

Next, the control portion 31 determines whether or not operation of liquidation is input via the Ten numeric keys 27A (step S302). In a case where operation of liquidation is input, the control portion 31 outputs an instruction for liquidation to the IC card server 50.

Upon receipt of liquidation instruction data, the IC card server 50 performs liquidation processing according to the contents of liquidation instruction data, and outputs liquidation result data to the individual counting device 30. When the control portion 31 receives the liquidation result data (step S304), media of which liquidated number of game playing pachinko balls is displayed is output by means of a medium output portion 35 (step S305).

(Base Processing)

Figure 41:
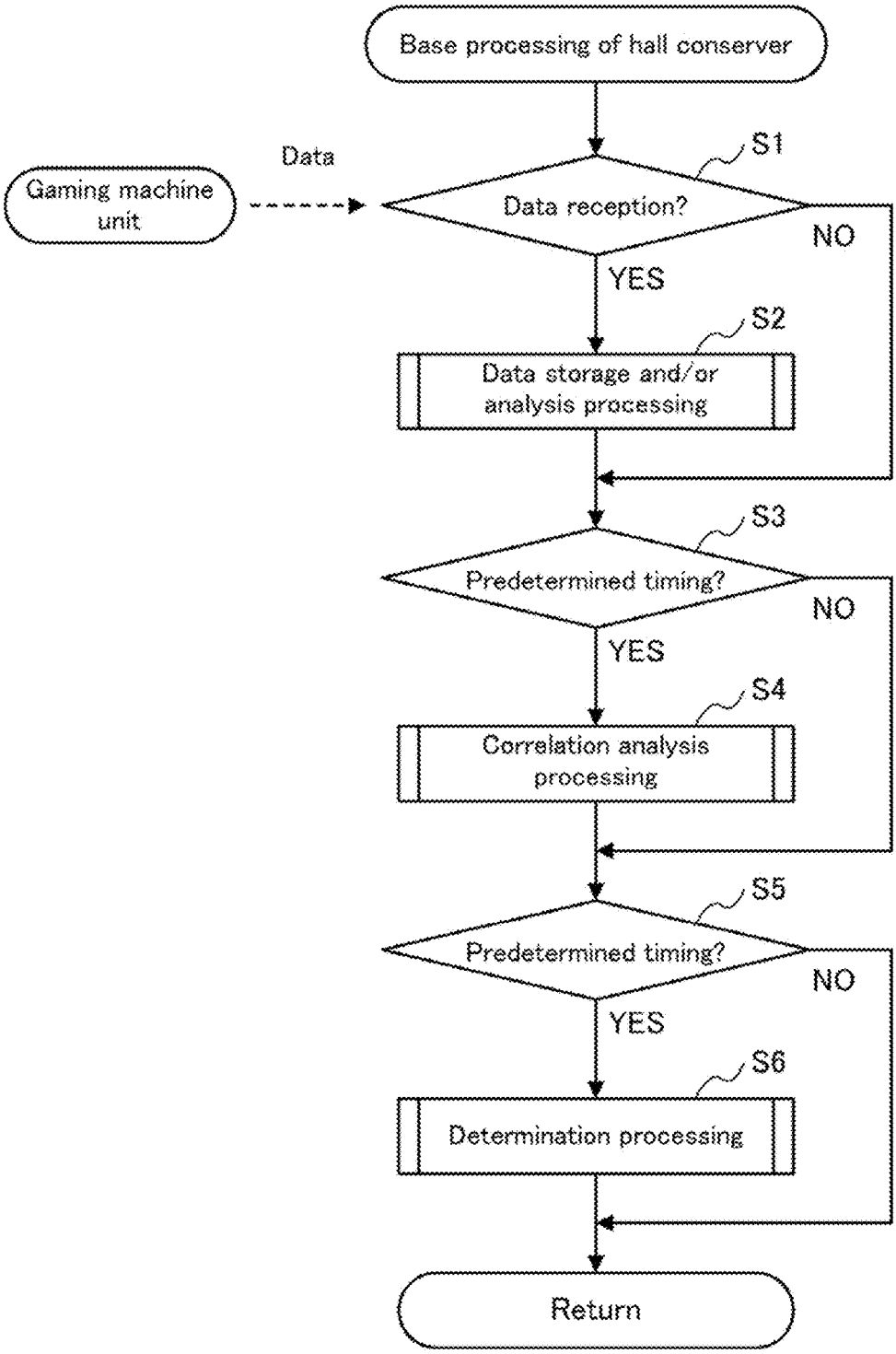
FIG. 41 is a flowchart showing a routine of base processing executed in the hall conserver shown in FIG. 1.

FIG. 41 is a flowchart sowing a routine of base processing executed in the hall conserver 60 shown in FIG. 21. First, a control portion 62 of the hall conserver 60 determines whether or not data is received from a gaming machine unit 1 (step S1). In a case whether it is determined that data is received, the control portion 62 performs data storage and/or analysis processing (step S2). The data storage and/or analysis processing will be described later.

In a case where it is determined that no data is received in step S1 or in a case where the processing of step S2 is executed, the control portion 62 determines whether or not a predetermined timing is reached (step S3). The predetermined timing includes timing when an instruction for executing analysis of data is input to the hall conserver 60 or timing when a predetermined period of time elapses or the like, for example. In a case where it is determined to be the predetermined timing, the control portion 62 performs correlation analysis processing (step S4). The correlation analysis processing will be described later.

In a case where it is determined not to be the predetermined timing in step S3 or in a case where the processing of step S4 is executed, the control portion 62 determines whether or not predetermined timing is reached (step S5). The predetermined timing includes timing when an instruction for determination as to data to the hall conserver 60 or timing when a predetermined period elapsed or the like, for example. In a case where it is determined to be the predetermined timing, the control portion 62 performs determination processing (step S6). The determination processing will be described later. In a case where it is determined not to be the predetermined timing in step 5 or in a case where the processing of step S6 is executed, this subroutine is completed.

Figure 42:
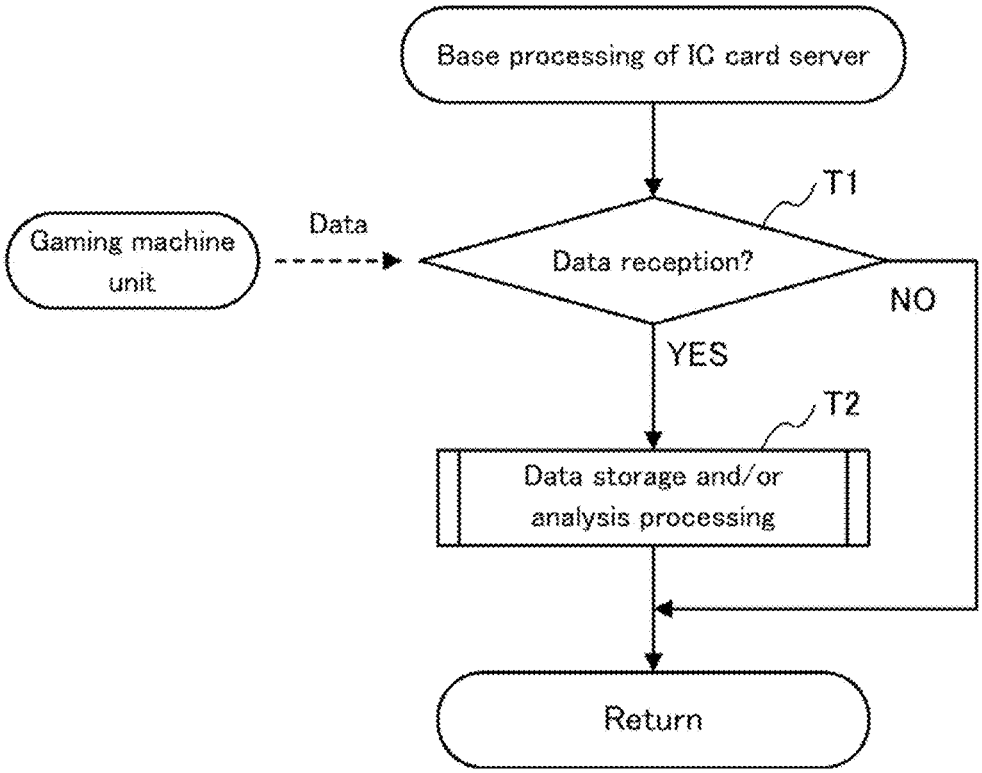
FIG. 42 is a flowchart showing a routine of a base processing executed in the IC card server shown in FIG. 21.

FIG. 42 is a flowchart showing a routine of base processing executed in the IC card server 50 shown in FIG. 21.

First, a control portion 52 of the IC card server 50 determines whether or not data is received from a gaming machine unit 1 (step T1). In a case where it is determined that data is received, the control portion 52 performs data storage and/or analysis processing (step T2). The data storage and/or analysis processing will be described later. In a case where it is determined that no data is received in step T1 or in a case where processing of step T2 is executed, this subroutine is completed.

(Data Storage and/or Analysis Processing)

Figure 43:
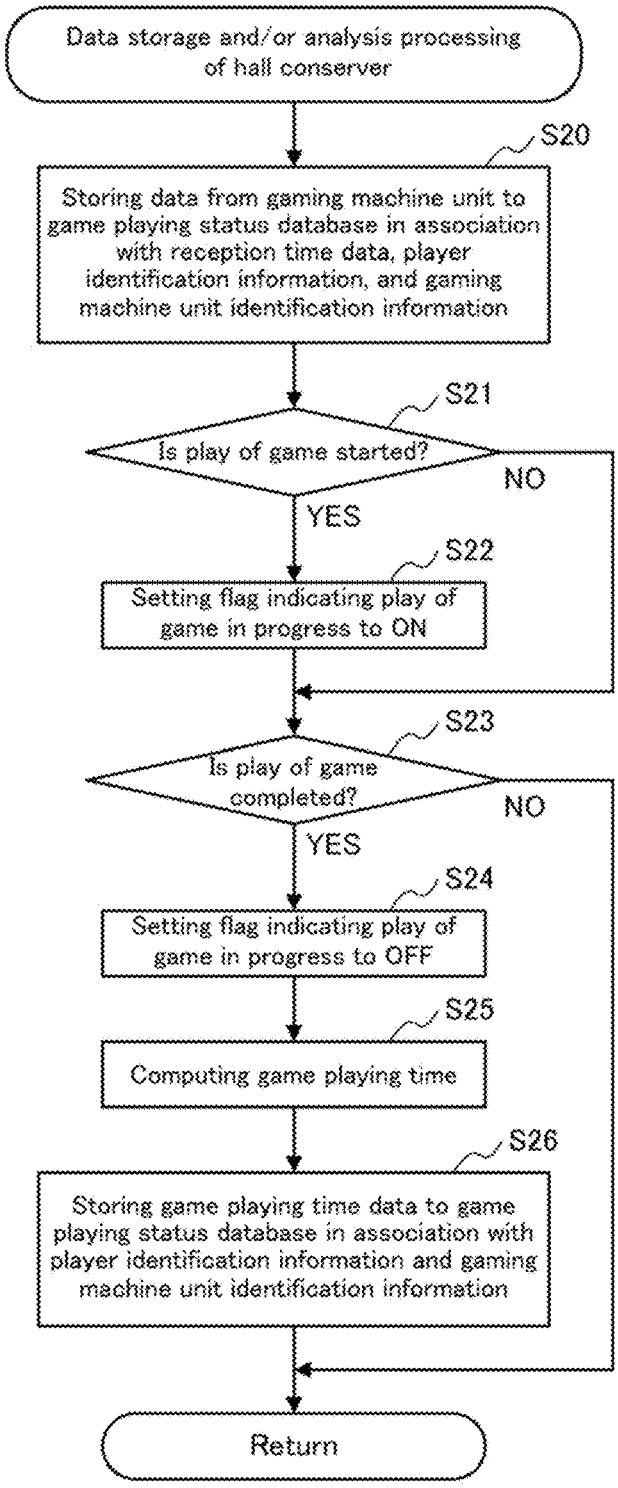
FIG. 43 is a flowchart showing a subroutine of data storage and/or analysis processing executed in step S2 of base processing in the hall conserver shown in FIG. 41.

FIG. 43 is a flowchart showing a subroutine of data storage and/or analysis processing executed in step S2 of base processing in the hall conserver 60 shown in FIG. 41.

First, a control portion 62 of the hall conserver 60 stores data from a gaming machine unit 1 in the game playing status database 66 (refer to FIG. 14 (*b*) in association with reception time data, player identification information, and game playing unit identification information (step S20).

Next, the control portion 62 determines whether or not the play of game is started in the gaming machine unit 1 (step S21). Specifically, in a case where player identification information read from an IC card inserted into a gaming medium lending device 20 is received from the gaming medium lending device 20, the control portion 62 determines that the play of game is started. It is to be noted that determination of start of the play of game in the present invention is not limited to this example, for example, and in a case where data is received from a gaming machine unit 1 to which the gaming machine unit identification information of which flag indicating the play of game in progress is set to OFF (x) is assigned, it may be determined that the play of game is started.

In a case where it is determined that the play of game is started in step S21, the control portion 62 performs processing of setting the flag indicating the play of game in progress to ON (○) (step S22).

In a case where it is determined that the play of game is not started in step S21 or in a case where the processing of step S22 is executed, the control portion 62 determines whether or not the play of game is completed in the gaming machine unit 1 (step S23). Specifically, in a case where player identification information output from the gaming medium lending device 20 is received when an IC card is ejected, the control portion 62 is determined that the play of game completes. It is to be noted that in a case where data is not received for predetermined time intervals or more from a gaming machine unit 1 to which the gaming machine unit identification information 1 of which flag indicating the play of game in process is set to ON (○), it may be determined that the play of game completes.

In a case where the play of game completes in step S23, the control portion 62 performs processing of setting the flag indicating the play of game in progress is set to OFF (x) (step S24). Next, the control portion 62 computes game playing time, based on time when the flag indicating the play of game in progress is set to ON (○) and time when the flag indicating the play of game is set to OFF (x) (step S25). Subsequently, the control portion 62 stores game playing time data in the game playing status database 66 in association with player identification information and the gaming machine unit identification information (step S26). In a case where it is not determined to be completion of the play of game in step S23 or in a case where the processing of step S26 is executed, this subroutine is completed.

When data storage and/or analysis processing shown in FIG. 43 is executed, the control portion 62 of the hall conserver 60 functions an analysis processing means for analyzing data received from the gaming machine unit 1 and stored in a hard disk 65 (data storage means).

Figure 44:
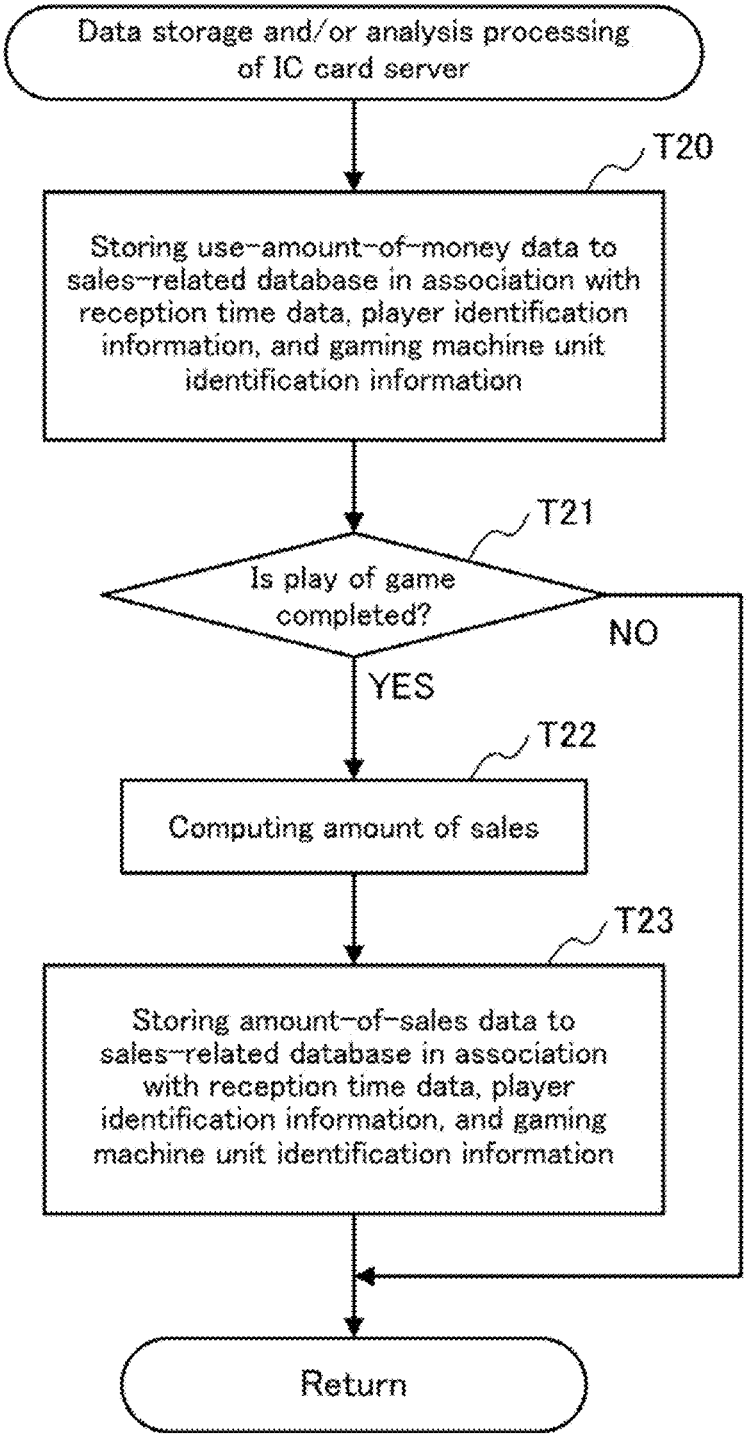
FIG. 44 is a flowchart showing a subroutine of data storage and/or analysis processing executed in step T2 of base processing in the IC card server shown in FIG. 22.

FIG. 44 is a flowchart showing a subroutine of data storage and/or analysis processing executed in step T2 of base processing in the IC card server 50 shown in FIG. 42.

First, the control portion 52 of the IC card server 50 stores use-amount-of-money data received from the gaming medium lending device 20 of the gaming machine unit 1 in a sales-related database 56 in association with reception time data, player identification information, and the gaming machine unit identification information (step T20).

Next, the control portion 52 determines whether or not the play of game completes (step T21). Determination of completion of the play of game may be made in the same manner as that of the processing (step S23) in the hall conserver 60, or alternatively, a result of the processing in the hall conserver 60 may be referred to. In a case where it is determined that the play of game does not complete this subroutine is completed. On the other hand, in a case where it is determined that the play of game completes the control portion 52 performs processing of computing an amount of sales (step S22). Specifically, the control portion 52 computes the amount of sales, based on use-amount-of-money data stored in the sales management database 56 and number-of-consumptions data and number-of-payouts data in the game playing status database 66 of the hall conserver 60 (step S22). Next, the control portion 52 stores the sales-amount data indicating the compute amount of sales in the sales-related database 56 in association with reception time data, player identification information, and the gaming machine unit identification information (step T23), and this subroutine is completed.

When the data storage and/or analysis processing shown in FIG. 44 is executed, the control portion 52 of the IC card server 50 functions as an analysis processing means for analyzing data received from a gaming machine unit 1 and stored in a hard disk 55 (data storage means).

(Correlation Analysis Processing)

Figure 45:
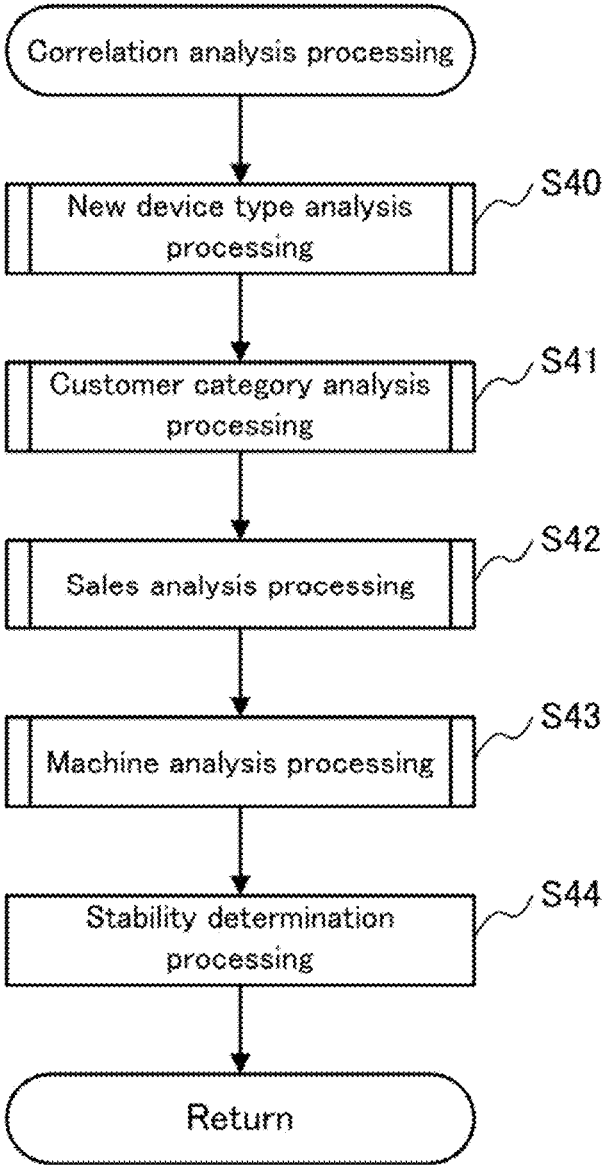
FIG. 45 is a flowchart showing a subroutine of correlation analysis processing executed in step S4 of base processing in the hall conserver shown in FIG. 41.

FIG. 45 is a flowchart showing a subroutine of correlation analysis processing executed in step 4 of base processing in the hall conserver 60 shown in FIG. 41.

It is to be noted that sequential orders are assigned to the processing operations of steps S40 to S43 for clarity, whereas in the present invention, the processing operations of steps S40 to S43 can be executed irrespective of the sequential orders anytime.

First, the control portion 62 of the hall conserver 60 performs processing of analyzing new device type (step S40).

Figure 46:
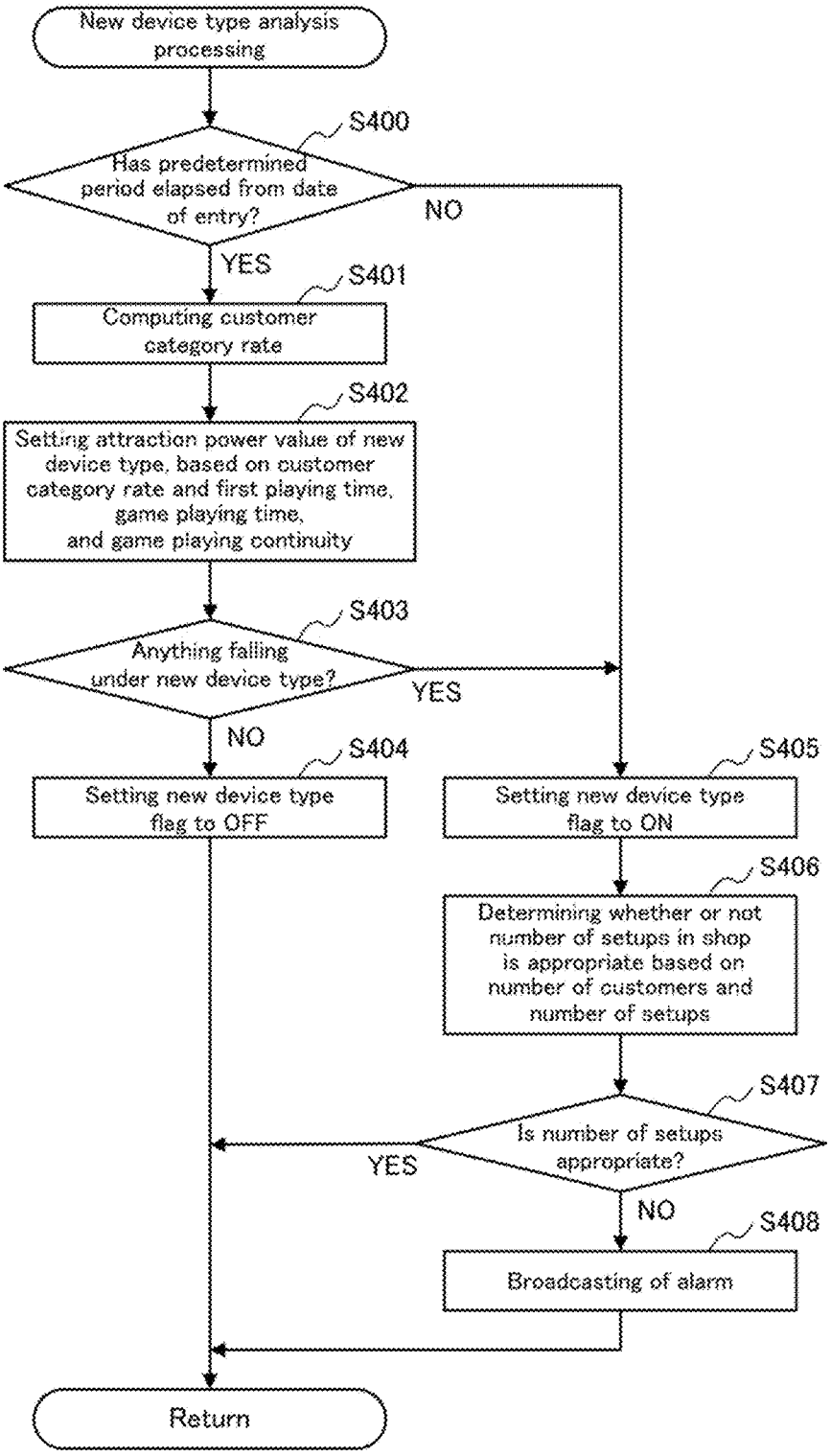
FIG. 46 is a flowchart showing a subroutine of new device type analysis processing invoked and executed in step S40 in the correlation analysis processing shown in FIG. 25.

FIG. 46 is a flowchart showing a subroutine of processing of analyzing new device type, which is invoke and executed in step S40 in the correlation analysis processing shown in FIG. 45.

The control portion 62 of the hall conserver 60 determines whether or not a predetermined period of time elapses from date of entry into market of the new device type as to each gaming machine unit 1, based on the game playing status database 66 (step S400). In the game playing information integration system IS, it is determined to be the new device type until the predetermined period of time elapses. However, this period of time is set to be very short, and determination of whether or not all of them fall under new device type is made as to the gaming machine unit 1 of which predetermined period of time elapses from the date of entry into market. It is to be noted that the present invention is not limited to this example, and for example in determination of new device type, a condition may not be set as to the elapsed period of time from the date of entry into market.

Next, the control portion 62 determines a customer category rate of the device type (step S401). Specifically, the control portion 62 computes the customer category rate as to a player who has played game from a predetermined time point (such as 1 day before, 1 week before, date of introduction to gaming facility, or date of entry into market, for example) up to now in the gaming machine unit 1 of the device type, based on the customer category data stored in a member management database 76 of a member management server 70. The customer category rate includes rate of fixed customer in all, rate of unfixed customer in all, rate of beginner in all, and rate between fixed customer and unfixed customer or the like.

Next, the control portion 62 sets a value of attraction power of new device type, based on customer category rate and first game playing time and game playing time and game playing continuity (step S402).

With respect to customer category rate, for example, if browsing customers and beginners are large in number, the degree of attraction power of new device type is regarded to be high, and the degree of attraction power of new device type can be set by means of stepwise or numerical evaluation. Of course, evaluation criteria or evaluation method of the value of attraction power of new device type, based on customer category rate, is not limited to this example.

The first playing period is a period of time from date of entry into market or date of introduction to gaming facility, for example, up to date when a player first plays game at the pachinko gaming machine 10, and can be computed from the data stored in the game playing status database 66. With respect to the first playing period, for example, the shorter the first game playing time is, the higher the degree of attraction power of new device type is, and the degree of attraction power of new device type can be set by means of stepwise or numerical evaluation.

As the game playing time, for example, game playing time at one time is employed. A player, in general, has newness or a sense of freshness for new device type, it takes time to understand rule, and thus, game playing time at one time can be extended. If the game playing time is short in spite of the fact, there is a high possibility that the player determines that it is not interesting. Therefore, with respect to the game playing time, the longer the game playing time is, the higher the degree of attraction power of new device type is, and the degree of attraction power of new device type can be set by means of stepwise or numerical evaluation.

As the game playing continuity, for example, frequency (average value) of playing game in the device type is employed, and it is evaluated that the higher the frequency is, the higher the continuity is. Evaluation of continuity is evaluation of presence of repeater, and the presence of repeater becomes a milestone indicating that new device type has attraction power. Therefore, with respect to game playing continuity, for example, the higher the continuity is, the higher the degree of attraction power of new device type is, the degree of attraction power of new device type can be set by means of stepwise or numeric evaluation.

With respect to stepwise or numeric evaluation as to the abovementioned customer category rate and first game playing time and game playing time and game playing continuity, for example, the degree of attraction power of new device type can be set by cumulatively or statistically performing analysis and performing stepwise or numeric evaluation.

In step S402, the control portion 62 functions as a means for analysis processing of new device type, for analyzing data associated with the gaming machine unit identification information to which gaming machine unit identification is assigned with which a new device type identification flag set to ON is associated, among the data received from a gaming machine unit 1 and stored in the data storage means.

Next, based on the degree of attraction power of new device type, obtained in step S402, the control portion 62 determines whether or not the device type meets a condition for new device type (step S403).

In a case where the degree of attraction power of new device type is a predetermined rank or a predetermined value or more, the control portion 62 determines that it falls under new device type, or alternatively, in a case where the degree is less than the predetermined rank or predetermined value, the attraction power of new device type is already lost, and thus, the control portion determines that it does not fall under new device type. In step S403, the control portion 62 functions as a new device type condition determination means for determining whether or not device type targeted for analysis meets a predetermined condition for new device type.

In a case where it is determined that it does not fall under new device type, the control portion 62 sets a new device type flag of the device type to OFF (step S404), and this subroutine is completed. On the other hand, in a case where it is determined that a predetermined period of time does not elapse from date of entry into market in step S400 or in a case where it is determined that it falls under new device type in step S403, the control portion 62 sets a new device type flag of the device type to ON (step S405). In step S405, the control portion 62 functions as a new device type identification flag setting means for setting a new device type identification flag to ON/OFF, based on a result of determination the new device type condition determination means.

Next, the control portion 62 determines whether or not the number of setups in shop is appropriate, based on the number of customers relative to a gaming machine unit 1 of the device type and the number of setups in gaming facility (step S406). In a case where the number of customers is large relative to the number of setups, it is presupposed that there is a time interval at which a customer playing rate reaches 100%, and potential players are lost. On the other hand, in a case where the number of customers is smaller relative to the number of setups, it is presupposed that excessive number of setups of new device type is pressing the number of setups of other device types. Therefore, in step S406, a range of appropriate number of setups is computed based on rate of the number of customers relative to the number of setups (customer playing rate), and it is determined whether or not the number of setups is included in the range of appropriate number of setups. For example, in a case where a total number of gaming machines in gaming facility is 400, and the number of customers of new device type is 20, the range of rate of appropriate number of setups, computed from rate of the number of customers relative to the number of setups (customer playing rate) is obtained as 5.3% to 10%. It is determined whether or not the setup rate is included in that range.

At this time, the control portion 62 functions as an appropriate condition determination means for determining whether or not the number of setups of gaming machine units to which game machine unit identification information is assigned with which a new device type identification flag set to ON is associated meets a predetermined appropriate condition, based on new device type analysis result data as a result of analysis by new device type analysis processing means. That is, the appropriate condition in the embodiment is based on whether or not setup rate of a gaming machine unit to which the gaming machine unit identification information is assigned with which a new device type identification flag set to ON is associated, whereas the appropriate condition in the present invention is not limited to this example.

In a case where the number of setups is appropriate (step S407, YES), this subroutine is completed. On the other hand, in a case where it is determined that the number of setups is not appropriate (step S407, NO), a setup rate alarm flag is set to ON (○), whereby broadcasting of alarm is performed (step S408), and this subroutine is completed. When the alarm flag is set, the employee management server 40 transmits data indicating that the setup rate is not appropriate, to a portable terminal device 41.

In the embodiment, the following processing operations of steps S41 to S44 are performed while data with which a new device type flag is associated is excluded.

Subsequent to step S40, the control portion 62 performs customer category analysis processing (step S41).

Figure 47:
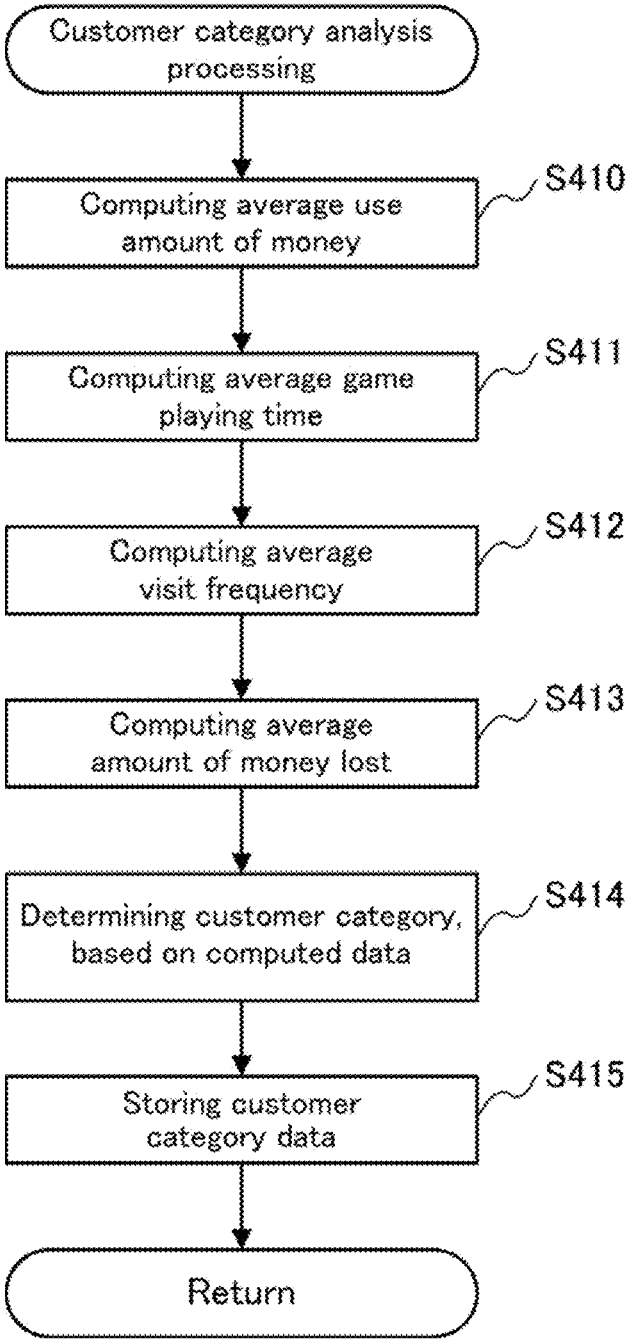
FIG. 47 is a flowchart showing a subroutine of customer category analysis processing invoked and executed in step S41 in the correlation analysis processing shown in FIG. 45.

FIG. 47 is a flowchart showing a subroutine of the customer category analysis processing invoked and executed in step S41 in the correlation analysis processing shown in FIG. 45.

First, the control portion 62 of the hall conserver 60 computes average use amount of money, based on the use-amount-of-money data stored in the sales management database 56 of the IC card server 50 (step S410). Next, the control portion 62 computes average game playing time, based on the game playing time data store in the game playing status database 66 (step S411). Next, the control portion 62 computes average visit frequency, based on the game playing time data stored in the game playing status database 66 (step S412). The average visit frequency is handled as average game playing frequency in a case where a predetermined reference unit is a gaming machine or device type. Next, the control portion 62 computes average amount of money lost, based on the amount-of-sales data stored in the sales management database 56 of the IC card server 50 (step S413).

The data computed in steps S410 to S413 is stored in the member management database 76 of the member management server 70.

The average use amount of money, average game playing time, average game playing frequency, and average amount of money lost each are equivalent to a game trend parameter in the present invention. In the present invention, the game playing trend parameter is not limited to this example, and includes at least one statistical value or cumulative value or the like of use amount of money, game playing time, game playing frequency, and amount of money lost.

In steps S410 to S413, the control portion 62 functions as a game playing trend parameter computation means for computing a game playing trend parameter indicating a game playing trend per predetermined reference unit as to a player to which the game identification information is assigned, based on the data stored in the data storage means in association with ne item of player identification information.

Next, the control portion 62 performs determination of customer category, based on the computed data (step S414). In the game playing information integration system IS, three customer categories of fixed customer, unfixed customer and novice are set. The three customer categories are different from each other in game playing trend. Fixed customer is high in average game playing time and average visit frequency, for example. Unfixed customer has deviation in average use amount of money, average game playing time, and average visit frequency, and is low in average visit frequency, for example. Novice is low in average use amount of money, has deviation in average game playing time, is short in average game playing time and low in average visit time, bus has deviation in average amount of money lost, for example. As to the data computed in steps S410 to S413, numeric or stepwise evaluation based on such trend is performed, and determination of customer category is performed. It is to be noted that in the present invention, it may be determined to be fixed customer with the fact that a customer is member-registered (recording of player data is present). In addition, fixed customer may be changed to unfixed customer with the fact that no visit is made over a predetermined period of time.

In step S414, the control portion 62 functions a customer category determination means for determining customer category of a player to which the player identification information is assigned, based on the game playing trend parameter.

Criteria which are different depending on player data may be employed as criteria for performing numeric or stepwise evaluation. For example, criteria for numeric or stepwise evaluation may be employed depending on whether a player is male or female. At this time, customer category of a player with which player identification information is assigned is determined based on the game playing trend parameter and player data.

The control portion 62 stores the obtained customer category data in a member management database 76 of the member management server 70 (step S415). Afterwards, this subroutine is completed.

Subsequent to step S41 (customer category analysis processing shown in FIG. 47), the control portion 62 performs sales analysis processing (step S42).

Figure 48:
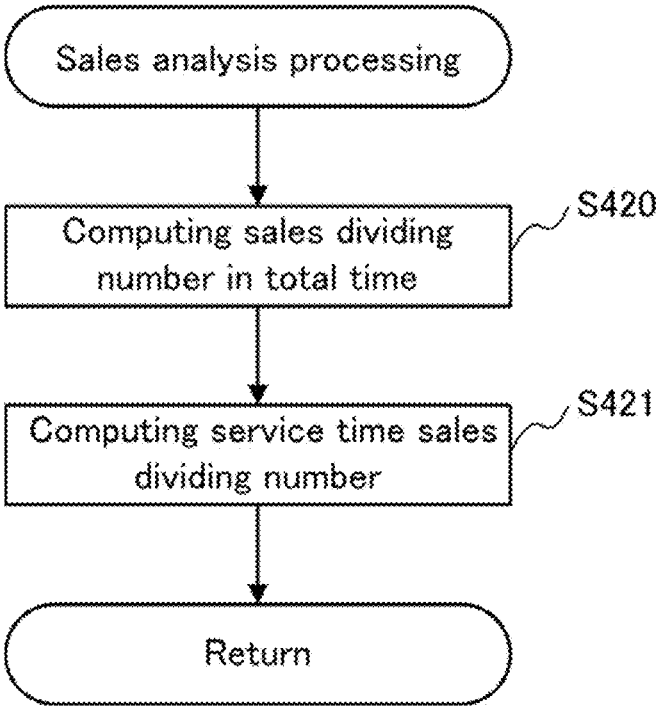
FIG. 48 is a flowchart showing a subroutine of sales analysis processing invoked and executed in step S42 in the correlation analysis processing shown in FIG. 45.

FIG. 48 is a flowchart showing a subroutine of sales analysis processing invoked and executed in step S42 in the correlation analysis processing shown in FIG. 45.

Next, the control portion 62 computes business dividing number in total time intervals (step S420). In the game playing information integration system IS according to the embodiment, the number of game playing pachinko balls lent in the gaming medium lending device 20 is handled as the number of outs (number of consumptions). Therefore, the business dividing number is computed by means of ((number of pachinko balls lent−(number of outs-number of safes))/number of pachinko balls lent)×10=number of payouts/number of consumptions)×10.

The control portion 62 then computes business dividing number in service time (step S421). Afterwards, this subroutine is completed.

Subsequent to step S42 (customer category analysis processing shown in FIG. 48), the control portion 62 performs machine analysis processing (step S43).

Figure 49:
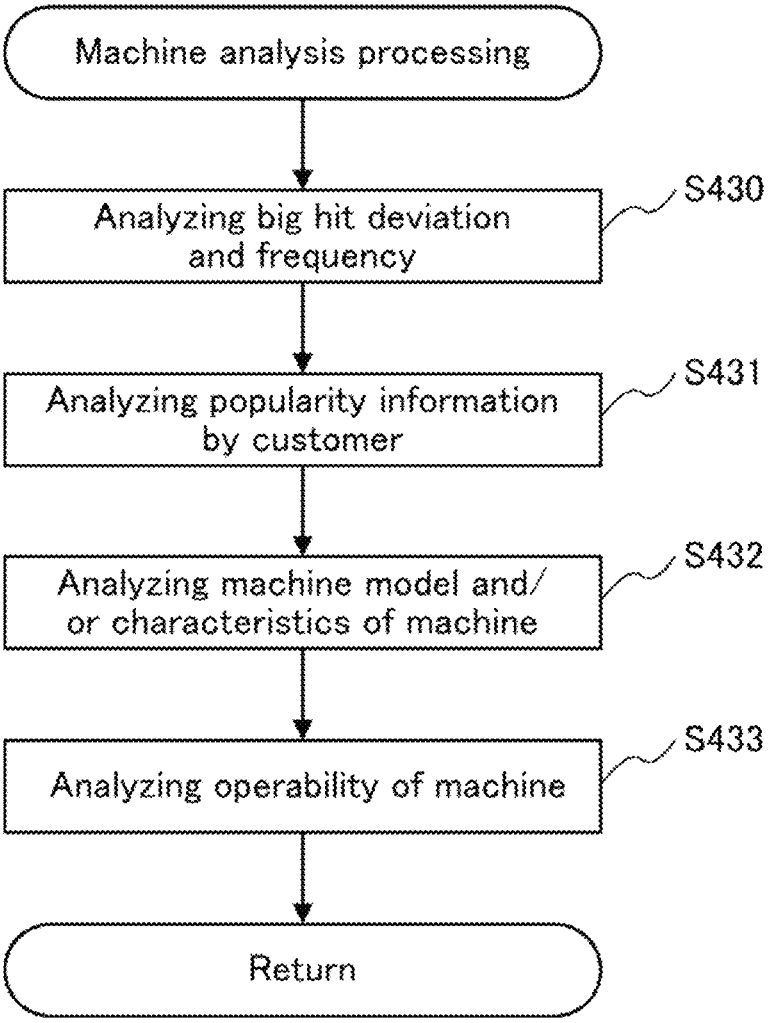
FIG. 49 is a flowchart showing a subroutine of machine analysis processing invoked and executed in step S43 in the correlation analysis processing shown in FIG. 45.

FIG. 49 is a flowchart showing a subroutine of machine analysis processing invoked and executed in step S43 in the correlation analysis processing shown in FIG. 45.

The control portion 62 of the hall conserver 60 performs analysis of big hit deviation (standard deviation) and frequency (average value), based on a special prize generation signal and its related reception time data (step S430). Next, the control portion 62 performs analysis of popularity information by customer (step S431). Then, popularity information by customer is generated. Unlike other device types, new device type may be operative by only an element of a "new machine" regardless of model or characteristics of machine. Therefore, in the game playing information integration system IS, this element of new device type is excluded when popularity information by customer is generated. Specifically, data related to gaming machine unit of new device type is not employed for generation of popularity information by customer. That is, with respect to popularity information by customer, for example, computation of parameters such as average use amount of money, average game playing time, average game playing frequency, and average amount of profit from the shop side is performed by gaming machine (gaming machine identification information). Popularity information by customer is set by means of stepwise or numeric evaluation of these parameters.

Next, the control portion 62 performs analysis of model and characteristics of machine, based on data related to sales and operation stored in the sales management database 56 of the IC card server 50, data related to big hit deviation and frequency computed in step S430, and popularity information by customer (step S432). Subsequently, analysis of operability of machine is performed (step S433). In the game playing information integration system IS, operability (%) is computed by means of (number of consumptions/Absolute number of outs per hour×business time))×100. Afterwards, this subroutine is completed.

When the processing operations of steps S40 to S43 are executed, the control portion 62 of the hall conserver 60 functions as an analysis processing means for analyzing data received from a gaming machine unit 1 and stored in a hard disk 65 (data storage means).

Subsequent to step S43 (machine analysis processing shown in FIG. 49), the control portion 62 performs stability determination processing (step S44).

In the game playing information integration system IS according to the embodiment, determination of stability is performed by employing a comparison table in which at least stability and business dividing number and numeric stability are associated with each other. In the hard disk 65 of the hall conserver 60, for example, a plurality of comparison tables are stored according to device type, model, and gaming facility or the like, and in determination of stability, a comparison table according to a determination target is employed. In addition, in determination of stability, input of balance dividing number may be accepted in advance from the gaming facility side.

FIG. 50 is a view showing one example of gaming machine comparison table for determining stability.

In the gaming machine comparison tables shown in FIG. 50 and FIG. 51, balance dividing number of gaming facility is set to 13.5.

In the gaming machine comparison table, stability is set in association with operability and business dividing number. For example, if operability is less than 30% and business dividing number is 11 or less, the customer game playing rate is low, and no profit is obtained, and thus, evaluation of stability is obtained as minus (−30). In addition, if operability is less than 30% and business dividing number is 18 or more, it is presupposed that too much profit is obtained, and customers losing interest in play takes place, and thus, evaluation of stability is obtained as minus (−30).

On the other hand, in a case where operability is 110% and business dividing number is 11 or less, customer playing rate is good, but profit is not obtained, and thus, stability is obtained minus (−10). If operability is 110% or more and business dividing number is 18 or more, customer playing rate is good, and profit is obtained, and thus evaluation of stability is plus (40). However, such state does not last long, and thus, continuous monitoring is required. It is to be noted that in a case where both of operability and business dividing number are high, stability may be set so as to be minus.

FIG. 51 is a view showing one example of gaming facility comparison table for determining stability.

The comparison table of FIG. 51 is employed for evaluation of stability of gaming facility, and thus, irrespective of operability, business dividing number which lowers balance dividing number is not permitted. Therefore, in a case where business dividing number is less than 13.5, evaluation of stability is obtained as minus. In addition, in the entire gaming facility, business in dividing number which much exceeds balance dividing number is not preferable from the viewpoint of increasing and securing fixed customer. Therefore, in a case where business dividing number is 16 or more, evaluation of stability is obtained as minus.

In a case where business dividing number is 13.5 or more and less than 16, business dividing number itself is stable, and however, if operability is low, management is not stable, and thus, stability is obtained as minus.

As shown in FIG. 50 and FIG. 51, evaluation of stability is different depending on target. Therefore, for example, determination of stability of the entire gaming facility is performed, and in a case where an evaluation result of stability is obtained as minus, determination of stability by gaming machine, device type, or model is performed, and investigation of cause of which the stability of the entire gaming facility is obtained as minus is performed, thereby making it possible to use evaluation of stability of gaming facility and pachinko gaming machine 10.

In the comparison tables shown in FIG. 50 and FIG. 51, criteria for stability are set. In step S44, the control portion 62 of the hall conserver 60 functions as a stability determination means for determining stability per predetermined reference unit, based on analysis result data indicating a result of analysis of data and the comparison tables.

In the embodiment, the stability determination means determines stability per predetermined reference unit, based on analysis result data, which does not include analysis result data related to a gaming machine unit to which the gaming machine unit identification information is assigned with which a new device type identification flag set to ON is associated, and the comparison tables. It is to be noted that the present invention is not limited to this example, and may include data related to new device type.

In addition, analysis result data includes dividing number data related to dividing number and operation data related to operability. In the comparison table, dividing number and operability and numeric stability are associated with each other. Further, in step S44, the stability determination means numerically determines stability per predetermined reference unit based on the dividing number data and operation data and the comparison table.

(Determination Processing)

Figure 52:
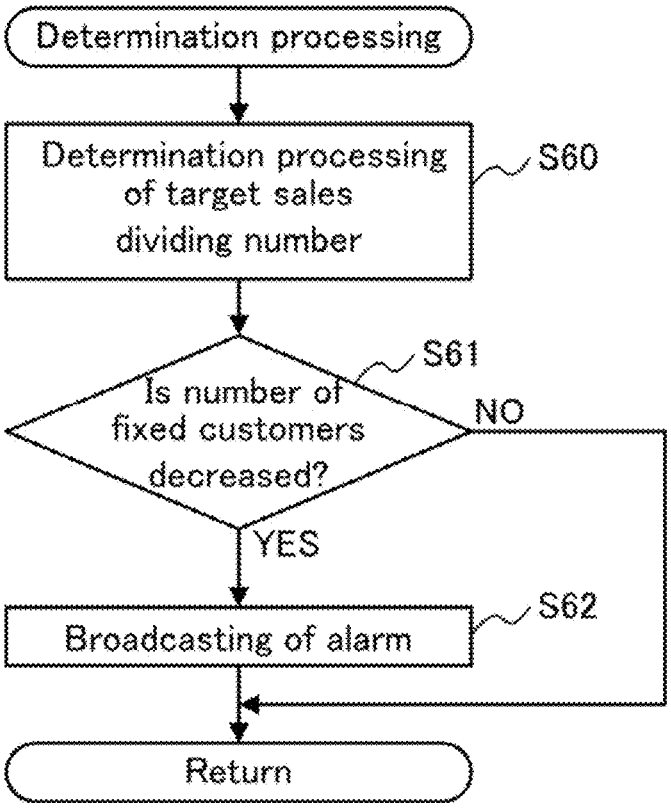
FIG. 52 is a flowchart showing a subroutine of determination processing invoked and executed in step S6 of base processing in the hall conserver shown in FIG. 21.

FIG. 52 is a flowchart showing a subroutine of determination processing invoked and executed in step 6 of base processing in the hall conserver 60 shown in FIG. 41.

In the determination processing, the control portion 62 first performs target business dividing number determination processing (step S60). The processing of step S60 is performed for gaming facility or a variety of device types or models of pachinko gaming machines 10 (or each pachinko gaming machine 10). The target business dividing number is determined, thereby making it possible an objective milestone for setting change. For example, the pachinko gaming machine 10 of device type or model I which operability is high and business dividing number is low may be able to enhance the business dividing number by means of strict setting in order to enhance stability. In addition, the pachinko gaming machine 10 of device type or model in which operability is low and business dividing number is high may be able to enhance operability by means of gentle setting in order to enhance stability.

At this time, the control portion 62 functions as a target dividing number computation means for computing target dividing number per predetermined reference unit, based on analysis result data indicating a result of analysis and/or stability determined by the stability determination means.

Next, the control portion 62 determines whether or not the number of fixed customers decreases (step S61). Determination of customer category is performed in customer category analysis processing (refer to FIG. 47), and in step S61, it is determined whether or not the number of fixed customers decreases as a result of customer category analysis processing. In a case where the number of fixed customers does not decrease, this subroutine is completed, or alternatively, in a case where the number of fixed customers decreases, a number-of-fixed-customers alarm flag is set to ON (○) in the determination result database (refer to FIG. 36), whereby alarm broadcasting is performed (step S62) and then this subroutine is completed.

It should be noted that the hall conserver 60 functions as an analysis processing means, and is capable of performing the processings (A) to (C), processings (D), (E), processings (F) to (H), processings (I), (J), and processing (K) to (M). As for the processings (A) to (M), explanation thereof will be omitted here as they have been already described with reference to FIGS. 1 to 20.

(Acquisition Data)

Next, data actually acquired by means of the abovementioned game playing information integration system IS will be described with reference to FIG. 53 to FIG. 61.

The game playing information integration system employed when data is actually acquired is a system installed over a plurality of gaming facilities, and the game playing information integration system IS in each gaming facility is connected via a network.

Hereinafter, network connection of the game playing information integration systems IS in a plurality of gaming facilities is referred to as a game playing information integration network system INS.

In the game playing information integration network system INS, the servers 40 to 90 of any one of the respective game playing information systems IS (such as hall conserver 60, for example) may perform summing and/or processing or the like of data of each game playing information integration system IS, or alternatively, may be a separately installed server other than the servers 40 to 90 of each game playing information integration system IS.

In the game playing information integration system IS in each gaming facility, identification information of gaming facility is stored in association with acquired data, enabling identification of a source of data acquisition. In addition, in the game playing information integration network system INS, with respect to each gaming machine, item data indicating address or local area attribute is stored, and based on each item data, data extraction and rearrangement (sorting) can be performed. Data indicating address can include data indicating name of prefecture and name of city, town, or village or the like, for example. Data indicating local area attribute can include data indicating residential street, road side, front of station, and busy street or the like, for example.

Data acquisition was performed for 14 days after date of introduction of gaming machines of device type A. That is, device type A is a so called new device type. Tables shown in FIG. 53 to FIG. 61 do not include data if operation time is less than 10 hours due to reduction of business hour and data of shop if the number of operations in shop is 5,000.

FIG. 53 is a table showing an introduction shop operation status (entire) by local area.

Data shown in FIG. 53 include data acquired in the game playing information network system INS.

In order from the left column of the table, there are shown: elapsed number of days; number of shops; shop average operation; average operation of device type A; operation deviation rate by shop; sales by machine; gloss profit by machine; coin unit price; and gloss profit rate.

Average operation by shop is average value of average machine operation of all device types in each shop (number of consumptions of gaming media per gaming machine).

Average operation of device type A is average value of average machine operation of device type A in each shop.

Operation deviation rate by shop indicates rate of average machine operation of device type A relative to average machine operation of all device types. In the table shown in FIG. 53, deviation rate of device type A exceeds 100%, and thus, it is found that device type A is popular in comparison with gaming machines of other device types. On the other hand, deviation rate of device type A is prone to gradually lower, and thus, it is also found that its popularity gradually lower after installation.

Sales by machine are sales per gaming machine.

Gross profit by machine is gross profit per gaming machine.

Coin unit price is unit price of gaming medium.

Gross profit rate (%) is (gross profit by machine/sales by machine)×100.

FIG. 54 is a table showing an introduction shop operation state (residential street) by local area. FIG. 55 is a table showing one example of operation result by shop in residential street.

The data shown in FIG. 54 is data of the game playing information integration system IS in gaming facility in which "residential street" is set as a local area attribute, among the data acquired in the game playing information integration network system INS. The data shown in FIG. 55 is data acquired in the game playing information integration system IS in shop W in which "residential street" is set as a local area attribute. The data shown in FIG. 54 is a summation of data in each shop as shown in FIG. 55.

FIG. 56 is a table showing an introduction shop operation state (read side) by local area. FIG. 57 is a tale showing one example of operation result by shop on road side.

The data shown in FIG. 56 is data of the game playing information integration system in gaming facility in which "road side" is set as a local area attribute. The data shown in FIG. 57 is data acquired in the game playing information integration system IS in shop X in which "road side" is set as a local area attribute. The data shown in FIG. 56 is a summation of data in each shop as shown in FIG. 57.

FIG. 58 is a table showing an introduction shop operation states by local area (front of station). FIG. 59 is a table showing one example of operation result by shop in front of station.

The data shown in FIG. 58 is data of the game playing information integration system IS in gaming facility in which "front of station" is set as a local area attribute, among the data acquired in the game playing information integration network system INS. The data shown in FIG. 59 is data acquired by the game playing information integration system IS in shop Y in which "front of station" is set as a local area attribute. The data shown in FIG. 58 is a summation of data in each shop as shown in FIG. 59.

FIG. 60 is a table showing an introduction shop operation states by local area (busy street). FIG. 61 is a table showing one example of operation result by shop in busy street.

The data shown in FIG. 60 is data of the game playing information integration system IS in gaming facility in which "busy street" is set as a local area attribute, among the data acquired in the game playing information integration network system INS. The data shown in FIG. 59 is data acquired by the game playing information integration system IS in shop Z in which "busy station" is set as a local area attribute. The data shown in FIG. 60 is a summation of data in each shop as shown in FIG. 61.

A manager in gaming facility can understand in a qualitative sense that, for example, the shop average operation in shop (FIG. 58) in front of station is lower than shop in another local area attribute or that shop average operation of new device type (device type A) in busy street (FIG. 60) is high. However, only the qualitative sense of the manager in gaming facility lacks quantitative information, and thus, it is difficult to determine a management policy of gaming facility, and in management based on the sense of the manager in gaming facility, there is a risk that management does not work well.

However, according to the data shown in FIG. 54, FIG. 56, FIG. 58, and FIG. 60, for example, it is possible to quantitatively evaluate how the shop average operation in shop in front of station is lower than that in shops in another local area attribute or how the shop average operation of new device type in busy street is higher than that therein. In addition, these items of data are not based on a theoretical value, and are actually measured values, and thus, are high in reliability.

Figure 62:
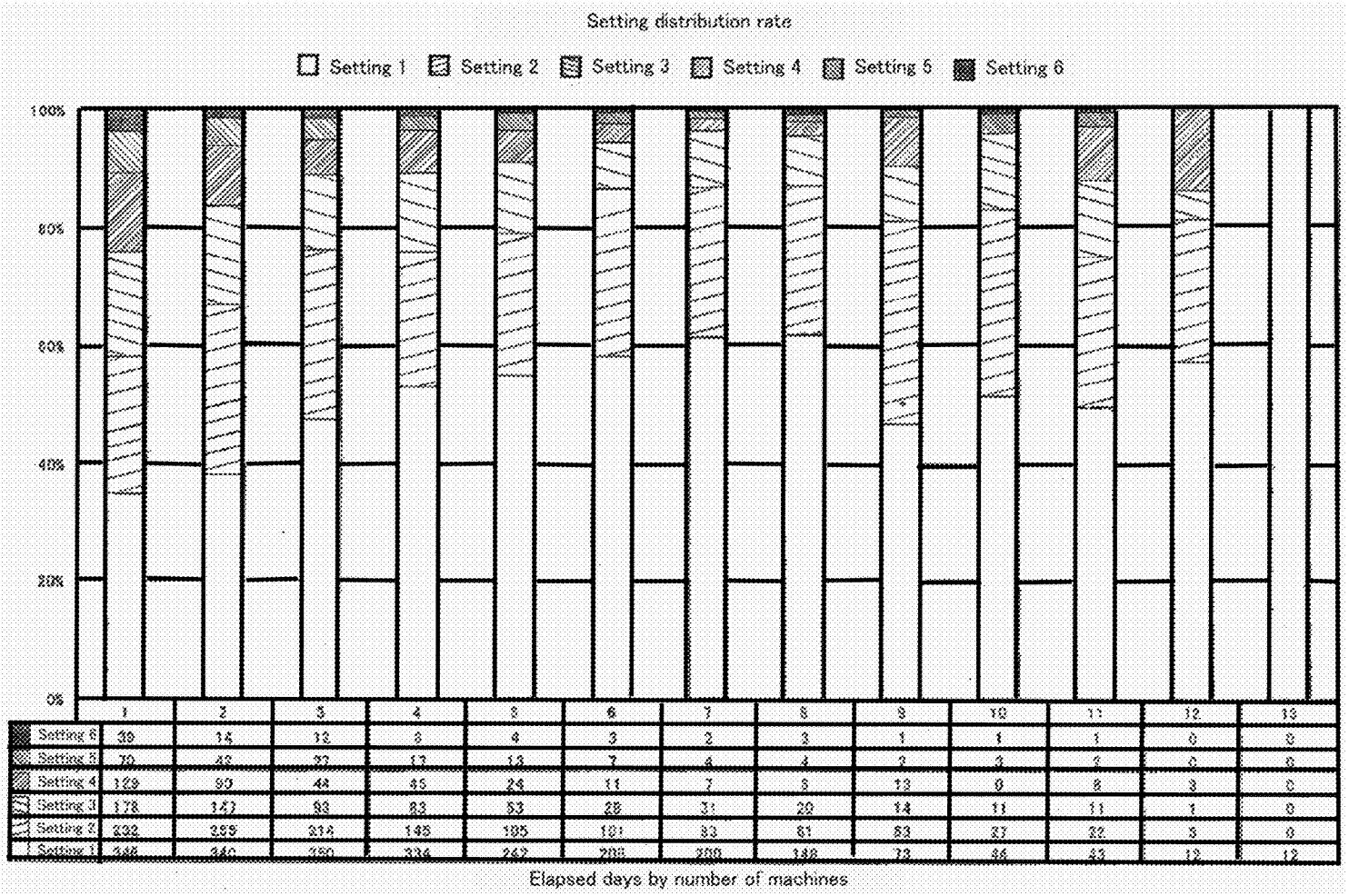
FIG. 62 is a graph depicting a dividing rate of settings of gaming machines.

FIG. 62 is a graph depicting distribution rate of settings of gaming machine, and FIG. 63 is a graph depicting distribution of business dividing number in gaming facility.

Figure 63A:
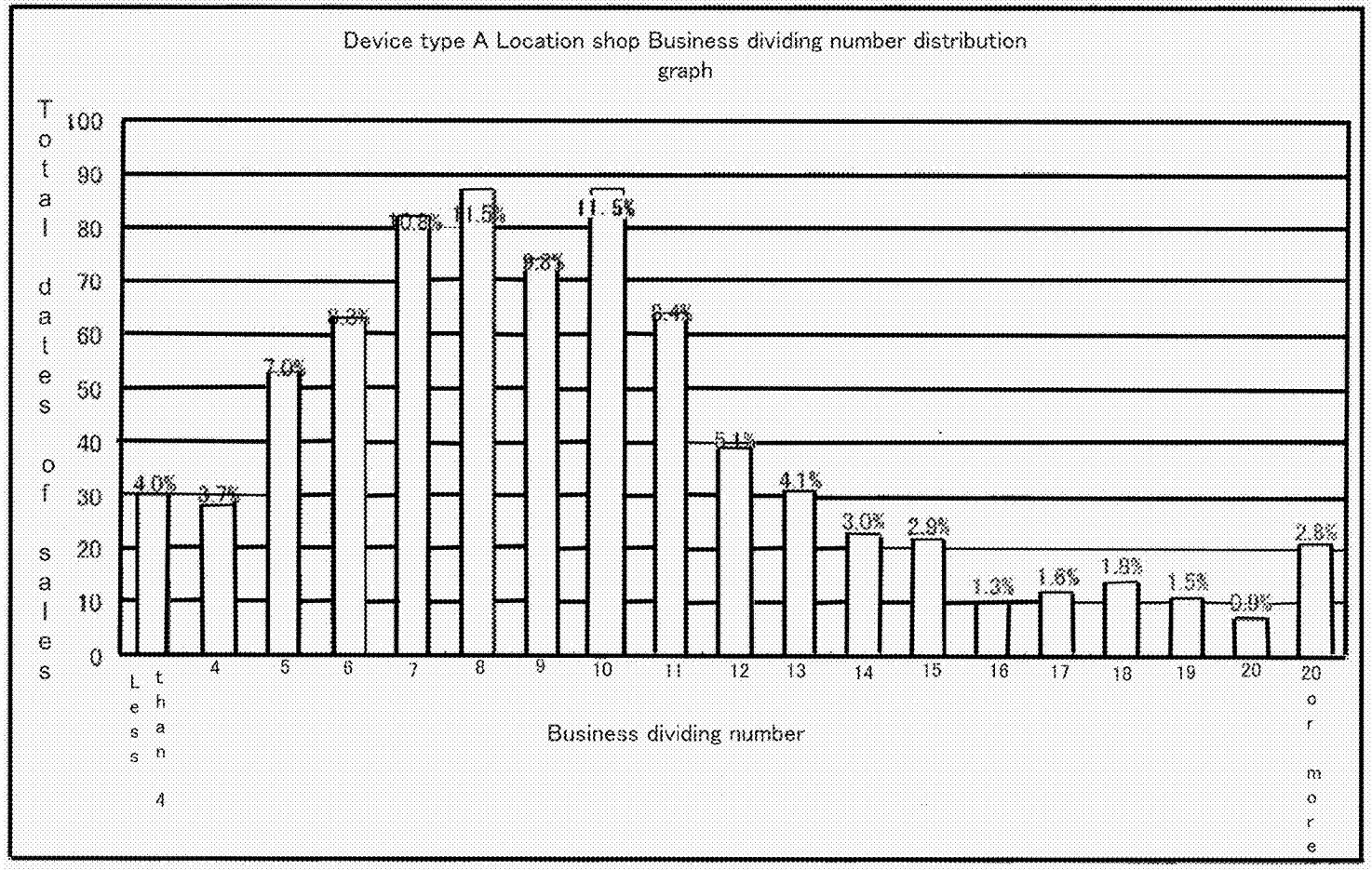
FIG. 63A is a graph depicting distribution of business dividing numbers of gaming machines, with FIG. 63B listing the labels for the horizontal axis.

The settings of gaming machine is a value defined stepwise by means of probability at which a bonus game takes place (probability at which a big hit is won), and in general, the higher the settings are, the higher the probability of occurrence of a bonus game is. The settings are also important elements depending on the characteristics of gaming machine. In the game playing information integration system IS, the data indicating the settings I stored in association with game machine unit identification information. The graph shown in FIG. 62 is a summation of data indicating the settings. The graph shown in FIGS. 63A and 63B is a graph depicting distribution of business dividing number as to device type A. In the game playing information integration system IS, it is possible to compute business dividing number in each gaming machine unit 1, and the data indicating business dividing number in each gaming machine unit can be stored in association with gaming machine identification information.

(Analysis of Variation Trend Continuation Period)

A variation trend continuation period is a series of period in which either one of increase trend and decrease trend of difference number is continuous, and an absolute value of difference number in the whole period is a predetermined reference value or more.

Variation trends of difference number (increase trend or decrease trend) are referred to as variation trends per predetermined period, and the period used here includes a period based on time and a period based on game. For example, in a case where a variation tend is determined by 10 games, even if the difference number of the first 4 games is plus and the difference number of the remaining 6 games is minus, it is determined that the variation trend is plus as long as the difference number of the whole 10 games is plus.

A phenomenon that either one of the increase trend and the decrease trend is continuous is referred to the one that a state in which the difference number is plus or a state in which the difference number is minus continues. Therefore, for example, in a case where the difference number of the first 10 games is plus 50, the difference number of the next 10 games is plus 30, and the difference number of the second next 10 games is plus 70, the degree of increase trend varies, whereas the increase trend itself in these 30 games is continuous.

With respect to a series of period, for example, after completion of a bonus game or after completion of a subsequent game playing state which is different from a normal game playing state, the routine shifts to the normal game playing state, and in that normal game playing state, in a case where a next bonus game takes place before exceeding a special period or the number of games played, the next bonus game may be included in a series of period. That is, in a case where two periods of increase trend are adjacent to each other via a special period or an increase trend of the number of games played, the two periods of increase trend and one period of decrease tend may be handled as a series of period. In addition, the two periods of increase tend may be handled as a series of period, excluding such one period of decrease trend.

The whole period indicated by absolute value of difference number in the whole period designates a series of the whole period. In addition, a predetermined reference value is not limited in particular, and can be individually set in gaming facility, and for example, 500 medals or the like can be exemplified as to a pachinko/slot gaming machine.

The variation trend continuation period defined as described above is a period in which strong impression is imparted to a player. This fact can be understood because when players talks with other persons about a result of the play of game, they often talk about variation trend continuation period such as "no bonus game can be played over 1 hour or more" or "bonus game lasts for long period of time", for example. In other words, players perform analysis and/or evaluation of gaming machine by employing the variable trend continuation period irrespective of whether or not to take care of the matter. However, this analysis is a mere analysis and/or evaluation of individual players, and conventionally, it has been difficult to keep track of such analysis and/or evaluation on the gaming facility side. The present invention is characterized by quantitatively and qualitatively obtaining result of intuitive analysis of the individual players and then performing analysis and/or evaluation of gaming machine in a sense which is closer to players.

Next, processing executed in the game playing information integration system IS will be described.

Figure 64:
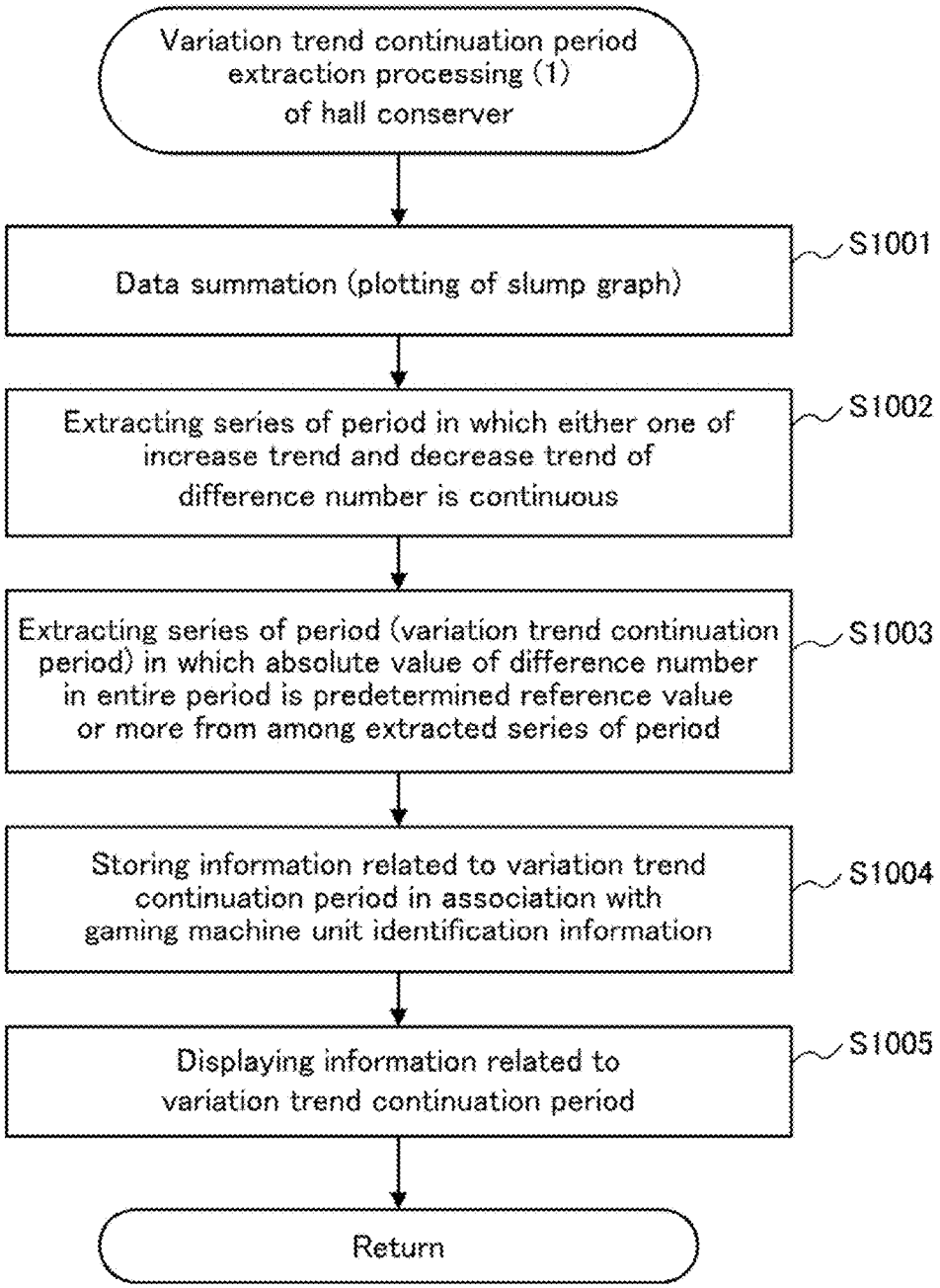
FIG. 64 is a flowchart showing variation trend continuation period extraction processing (1) executed in the hall conserver shown in FIG. 21.

FIG. 64 is a flowchart showing variable trend continuation period extraction processing (1) executed in the hall conserver shown in FIG. 21. This processing is executed when an instruction related to extraction of variable trend continuation period is input by a manager or the like in gaming facility.

Figure 65A:
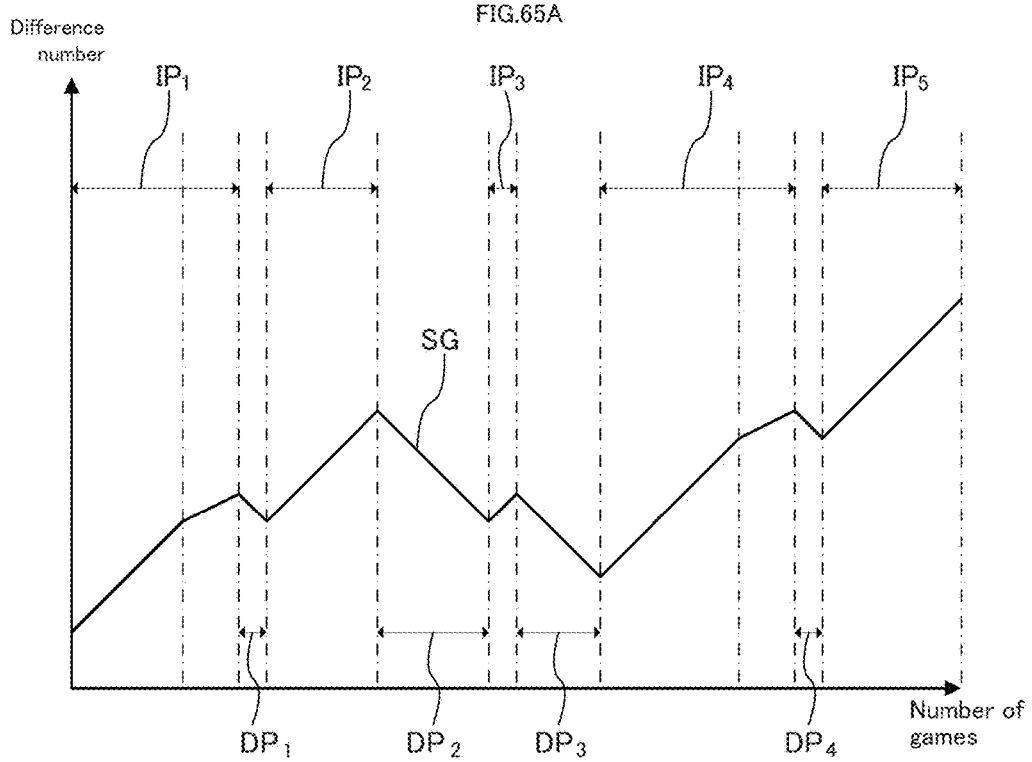
FIG. 65A is a slump graph when extracting a series of period in which an increase trend or decrease trend of dividing number is continuous.
Figure 65B:
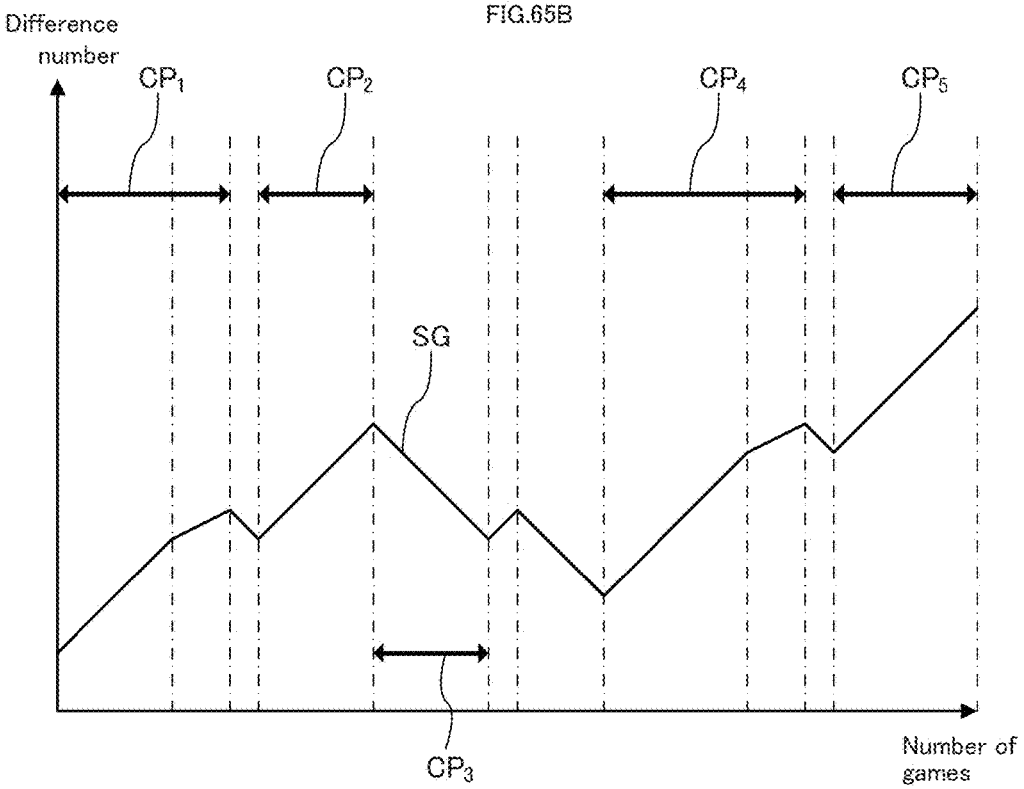
FIG. 65B is a slump graph when a variation trend continuation period is extracted from the slump graph shown in FIG. 65A.

FIG. 65A is a slump graph when extracting a series of period in which either one of increase trend and decrease trend of difference number is continuous; and FIG. 65B is a slump graph when a variation trend continuation period is extracted from the slump graph shown in FIG. 65A. When the processing shown in FIG. 64 is executed, the control portion 62 functions as an analysis means.

First, the control portion 62 of the hall conserver 60 sums data as to one gaming machine unit 1, based on data stored in the game playing status database 66 (refer to FIG. 34*b*) (step S1001). The summation of data is equivalent to plotting of slump graph, and however, such slump graph does not always need to be plotted on display. For example, performing processing of computing difference number every predetermined period and then based on a relationship between period and difference number computing a plurality of X-Y coordinate (X-coordinate: time or number of games and Y-coordinate: difference number) is processing equivalent to summation of data in step S1001. The processing of step S1001 is performed, whereby data capable of plotting a slump graph SG shown in FIG. 65 (*a*) is generated.

Next, the control portion 62 of the hall conserver 60 extracts a series of period in which either one of increase trend and decrease tend of difference number is continuous, from the slump graph SG (step S1002). For example, with the slum graph SG shown in FIG. 65 (*a*), IP1 to IP5 are a series of period in which increase trend of dividing number is continuous, and DP1 to DP4 are a series of period in which decrease trend of dividing number is continuous. In this manner, a series of period IP or DP is included in the slump graph SG virtually obtained by means of the processing of step S1001, and in step S1002, extraction of the series of period IP or DP is performed.

Next, the control portion 62 of the hall conserver 60 extracts a series of period (variation trend continuation period CP) in which an absolute value of difference number in the whole period is a predetermined reference value or more, from among the series of period IP or DP extracted in step S1002 (step S1003). For example, a period in which the absolute value of difference number is a predetermined reference value (for example, 500 medals) is extracted from among the series of period IP1 to IP5 or DP1 to DP4 shown in FIG. 65 (*a*), and the extracted period is defined as variation trend continuation period $CP_1$ to $CP_5$. When the processing operations of steps S1001 to S1003 are executed, the control portion 62 functions as a variation trend continuation period extraction means.

Subsequently, the control portion 62 of the hall conserver 60 stores the information related to the variation trend continuation period that is extracted by step S1003 in a hard disk 65 in association with the gaming machine unit identification information (step S1004). The information related to variation tend continuation period is not limited in particular, and can include length of variation tend continuation period (time and/or number of games), difference number in variation trend continuation period, and generation time and completion time of variation trend continuation period or the like.

Next, the control portion 62 of the hall conserver 60 performs display of information related to variation trend continuation period, based on the information related to variation trend continuation period, stored in the hand disk 65 (step S1005). The display of the information related to variation trend continuation period may be performed on a display (not shown) which is connected to the hall conserver 60, and its related display target is not limited in particular. Afterwards, this routine is completed.

The extraction processing of variation trend continuation period in the present invention is not limited to the processing operations described with reference to FIG. 64 and FIG. 65, and for example, may be processing operations described with reference to FIG. 66 and FIG. 67.

Figure 66:
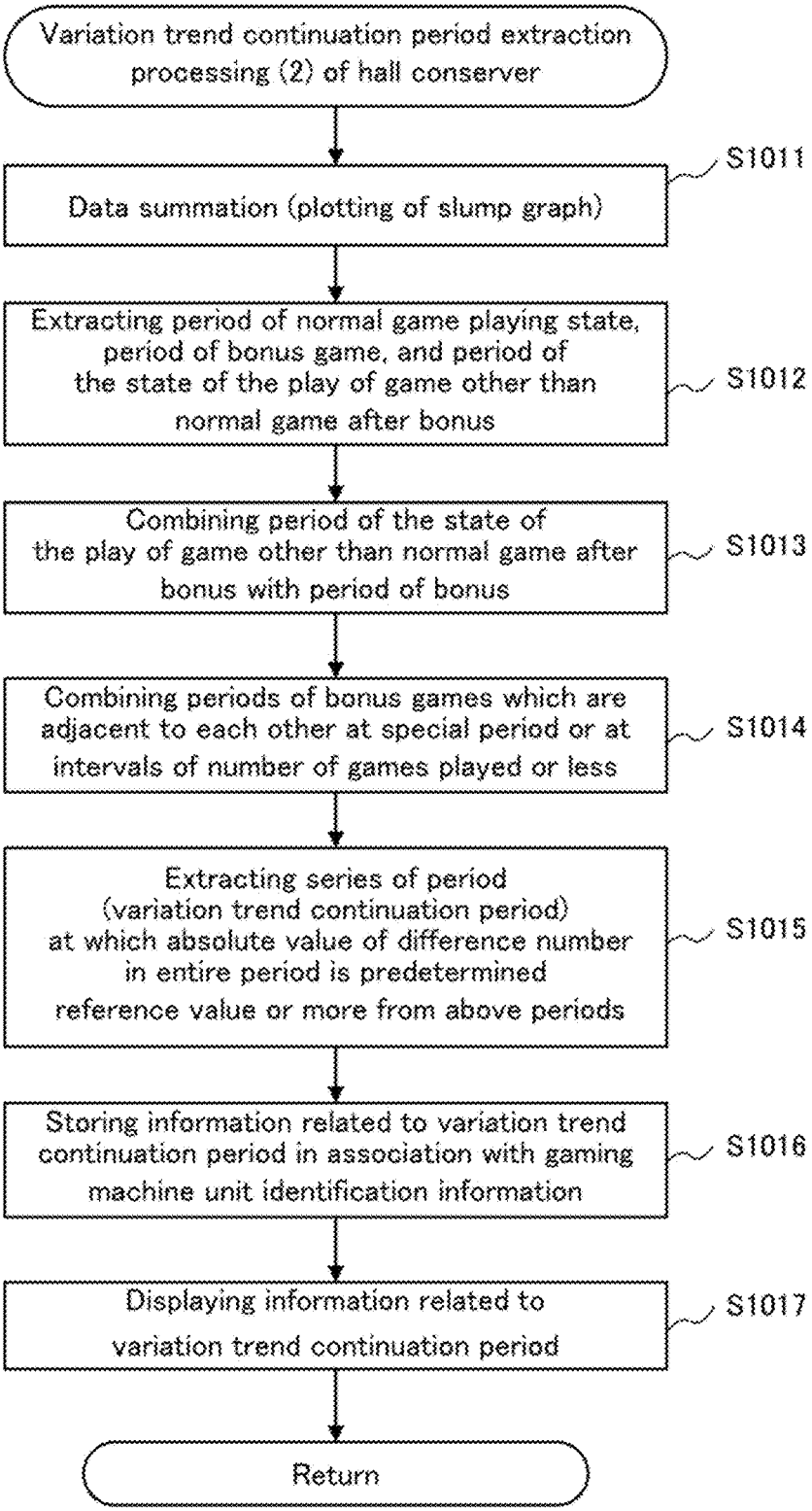
FIG. 66 is a flowchart showing variation trend continuation period extraction processing (2) executed in the hall conserver shown in FIG. 21.

FIG. 66 is a flowchart showing variable trend continuation period extraction processing (2) executed in the hall conserver shown in FIG. 21.

Figure 67A:
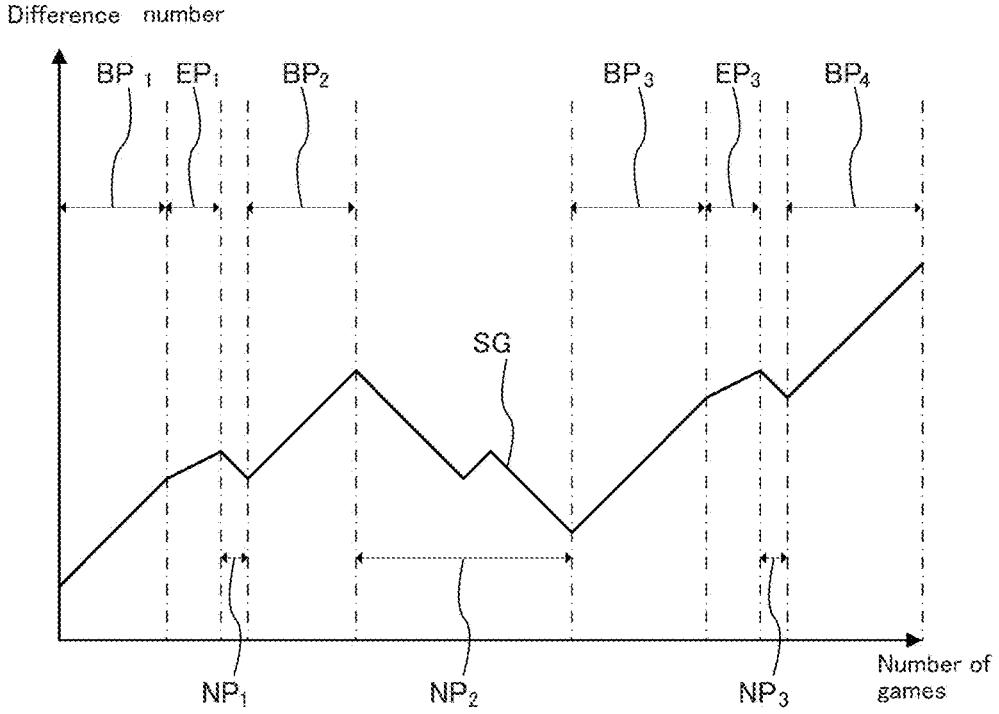
FIG. 67A is a slump graph when extracting a period of normal game playing status, a bonus game period, and a period obtained by combining the bonus game period and a game playing status which is different from a normal game playing status subsequent to the bonus game period.
Figure 67B:
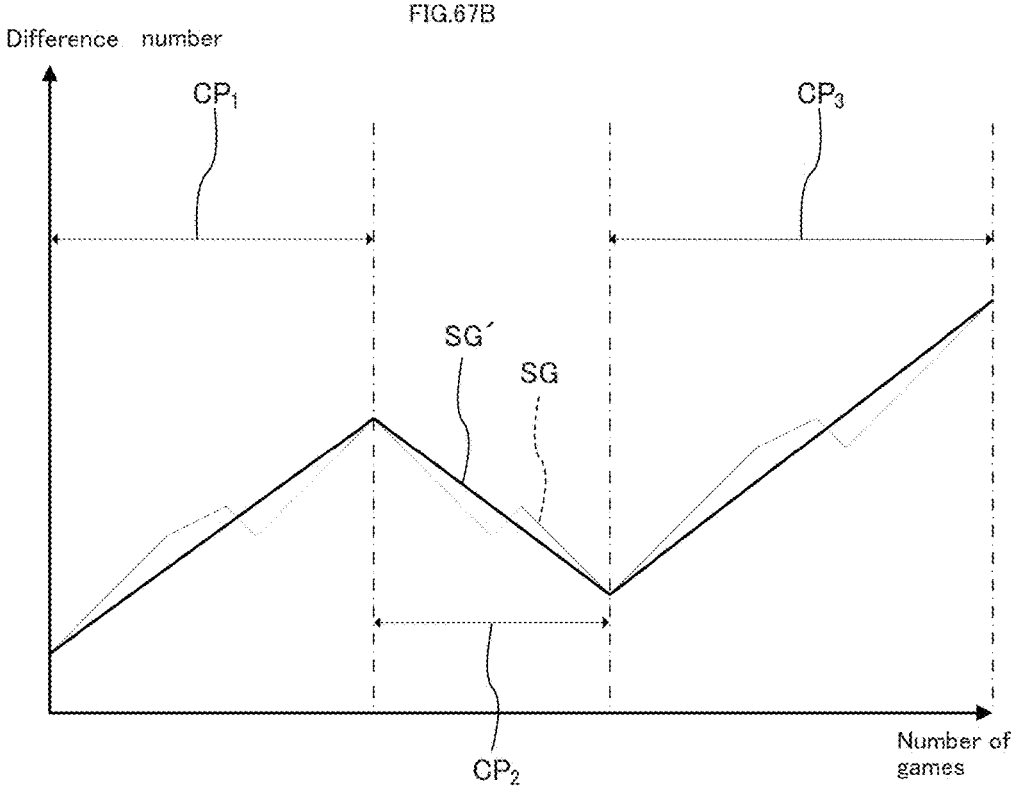
FIG. 67B is a slump graph when a variation trend continuation period is extracted from the slump graph shown in FIG. 67A.

FIG. 67A is a slump graph when extracting a period of normal game playing state, a period of bonus game, and a period obtained by combining the bonus game and a game playing state which is different from the normal game plating state subsequent to the bonus game; and FIG. 67B is a slump graph when a variation rend continuation period is extracted from the slump graph shown in FIG. 67A. When the processing shown in FIG. 66 the control portion 62 functions as an analysis means.

First, the control portion 62 of the hall conserver 60 sums data as to one gaming machine unit 1, based on the data described in the game playing status database 66 (refer to FIG. 34 (*b*)) (step S1011). Since this processing is the same as the processing in step S1001 shown in FIG. 64, a description thereof is omitted.

Next, the control portion 62 of the hall conserver 60 extracts a period of normal game playing state, a period of bonus game, and a period of the play of a game other than normal game after bonus, from the slump graph SG (step S1012). The period of normal game playing state is equivalent to a series of period in which decrease trend of difference number is continuous. The period of bonus game is equivalent to a series of period in which increase tend of difference number is continuous. The state of the play of a game other than normal game after bonus is equivalent to a series of period in which increase trend of difference number is continuous.

For example, if the period of normal game playing state, the period of bonus game, and the period of the play of a game other than normal game after bonus are extracted as a series of period from the slump graph SG shown in FIG. 65 (*a*), the extracted period is as shown in FIG. 67 (*a*). In FIG. 67 (*a*), $NP_1$ to $NP_3$ is the period of normal game playing state; $BP_1$ to $BP_4$ each are the period of bonus game, and $EP_1$ and $EP_3$ each are the period of the state of the play of a game other than normal game after bonus. While the normal game playing state $NP_2$ is not a series of period in which either one of increase trend and decrease trend of difference number is continuous in the slump graph SG, this is caused by the fact that the period employed to compute difference number in the slump graph SG is relatively short. In examples shown in FIG. 66 and FIG. 67, the period of normal game playing state, the period of bonus game, and the period obtained by combining bonus game and a game playing state which is different from a normal game state subsequent to the bonus game are employed to compute difference number, and thus, the normal game playing state $NP_2$ is a series of period in which decrease trend of difference number is continuous.

Next, the control portion 62 of the hall conserver 60 combines the period of the state of the play of a game other than normal game after bonus with the period of bonus game (step S1013). In the slump graph SG shown in FIG. 67 (*a*), from among a series of period $BP_1$ to $BP_4$, $EP_1$, $EP_3$, and $NP_1$ to $NP_3$ extracted from step S1013, the state of the play of a game other than normal game after bonus $EP_1$ and $EP_3$ is combined with bonus games $BP_1$ and $BP_3$ that occur previously.

Next, the control portion 62 of the hall conserver 60 combines the periods of bonus game which are adjacent to each other at special period or at intervals of the number of games played or less (step S1014).

In the slump graph SG shown in FIG. 67 (*a*), the period $BP_1+EP_1$ of bonus game and the period $NP_2$ of bonus game are adjacent to each other while the normal game playing state $NP_1$ is sandwiched. In addition, the period $NP_2$ of bonus game and the period $BP_3$ and $EP_3$ of bonus game are adjacent to each other while the normal game playing state $NP_2$ is sandwiched. Further, the period $BP_3+EP_3$ of bonus game and the $BP_4$ of bonus game are adjacent to each other while the normal game playing state $NP_3$ is sandwiched. Among the normal game playing states $NP_1$ to $NP_3$, a special period or a period corresponding to that of the number of games played are normal game playing states $NP_1$ and $NP_3$. Therefore, the control portion 62 combines the period $BP_1+EP_1$ of bonus game, the normal game playing state $NP_1$, and the period $NP_2$ of bonus game with each other. In addition, the control portion 62 combines the period $BP_3+EP_3$ of bonus game, the normal game playing state $NP_3$, and the period $BP_4$ of bonus game with each other.

By means of the processing leading up to step S1014, the slump graph SG is divided into a period of $BP_1+EP_1+NP_1+NP_2$ of bonus game, the period $NP_2$ of normal game playing state, and a period $BP_3+EP_3+NP_3+BP_4$ of bonus game.

Next, among from the periods obtained in the processing leading up to the step S1014, the control portion 62 of the hall conserver 60 extracts from a period obtained in the processing leading up to step S 1014, a series of period (variable trend continuation period CP) in which an absolute value of difference number in the entire period is a predetermined reference number or more (step S1015). For example, all the periods obtained by means of the processing leading up to step S1014, i.e., $BP_1+EP_1+NP_1+NP_2$ and $NP_2$, $BP_3+EP_3+NP_3+BP_4$, reach a predetermined reference value, and therefore, they are extracted as variable trend continuation periods $CP_1$ to $CP_3$ as in a slump graph SG' shown in FIG. 67 (*b*). When the processing operations of steps S1011 to S1015 are executed, the control portion 62 functions as a variation trend continuation period extraction means.

Subsequently, the control portion 62 of the hall conserver 60 stores the information related variable trend continuation period, extracted by means of step S1015, in a hard disk 65, in association with the gaming machine unit identification information (step S1016). The information relates to variable trend continuation period is not limited in particular, and for example, can include length of variable trend continuation period (time and/or number of games), difference number in variation trend continuation period, and generation time and completion time of variation trend continuation period or the like. In addition, in a case where the variation trend continuation period of a period of bonus game, information related to period included in variation trend continuation period (such as the presence or absence of the state of the play of a game other than normal game after bonus) and the presence or absence of normal game playing state or the like) may be further stored as information related to variation trend continuation period.

Next, the control portion 62 of the hall conserver 60 performs display of information related to variable trend continuation period, based on the information related to variable trend continuation period, stored in the hard disk 65 (step S1017). Afterwards, this routine is completed.

The processing operations as shown in FIG. 64 to FIG. 67 are performed as to each gaming machine unit 1, thereby making it possible to analyze characteristics by device type and characteristics by settings or the like, for example. Next, data actually acquired by means of the abovementioned game playing information integration network system INS will be described with reference to FIG. 68 to FIG. 79.

Figure 68:
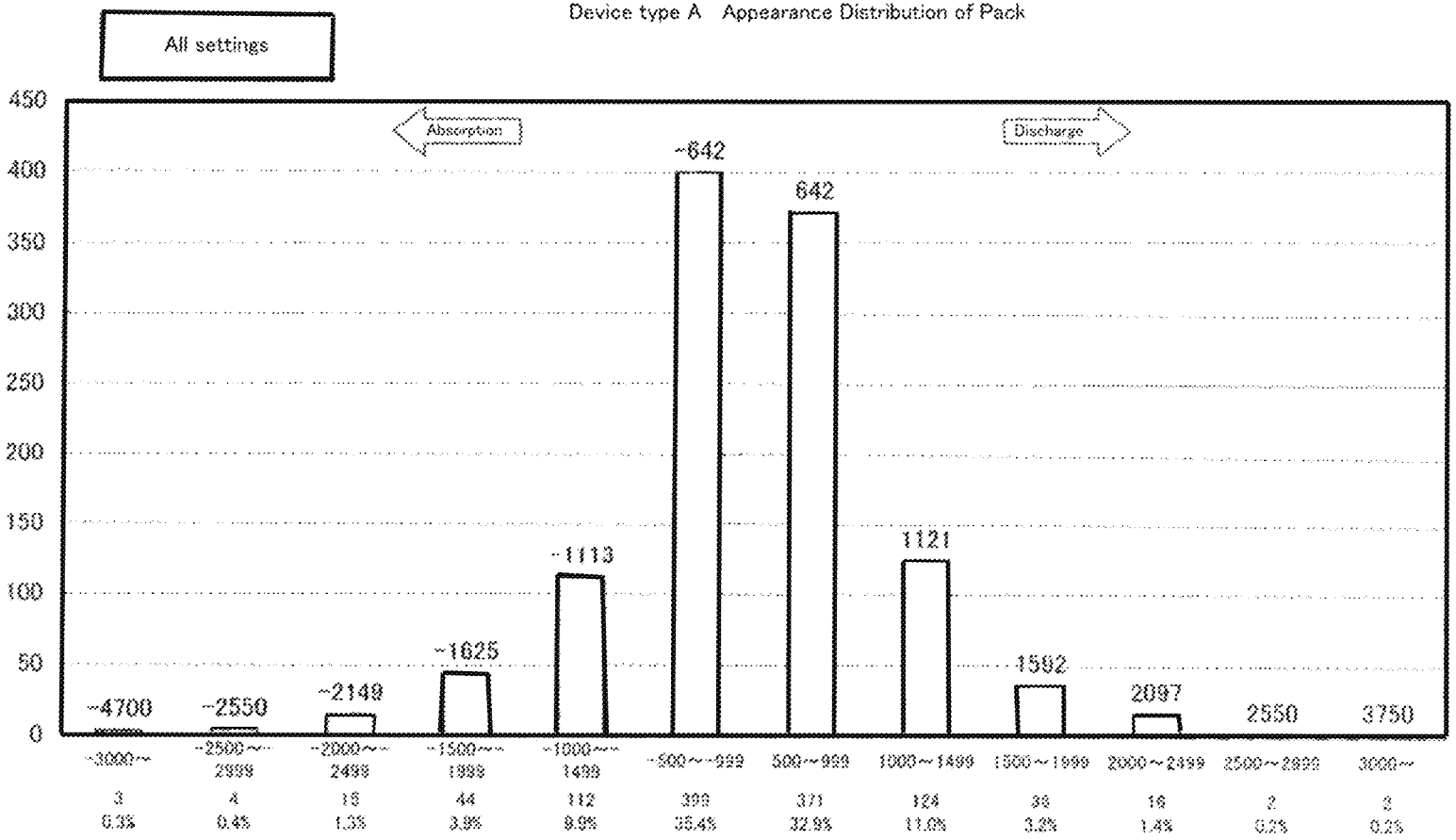
FIG. 68 is a graph depicting appearance distribution of variation trend continuation period (so called "pack") in gaming machines of device type A (all of settings 1 to 6).
Figure 69:
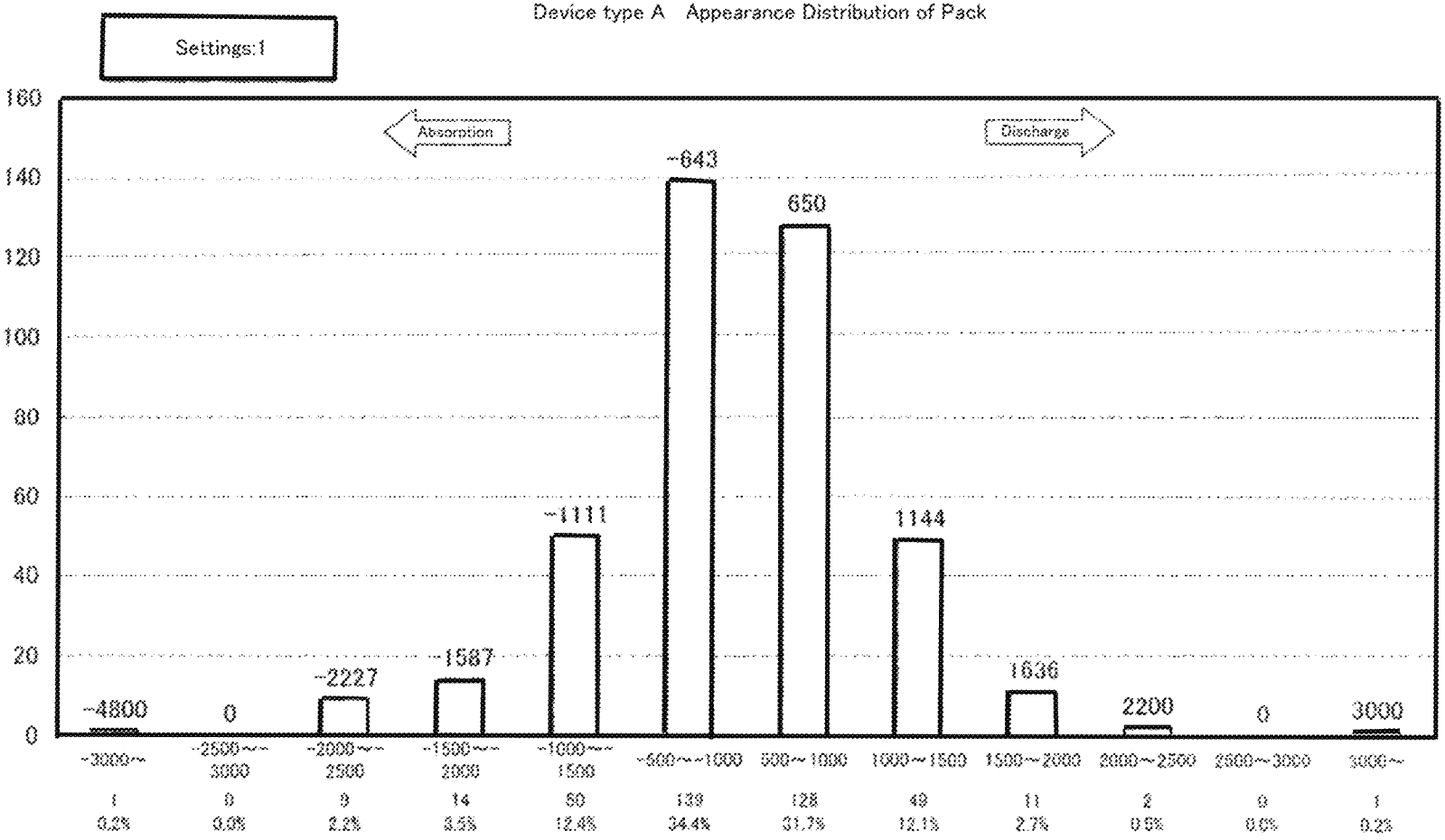
FIG. 69 is a graph depicting appearance distribution of variation trend continuation period in gaming machines of device type A (setting 1).
Figure 70:
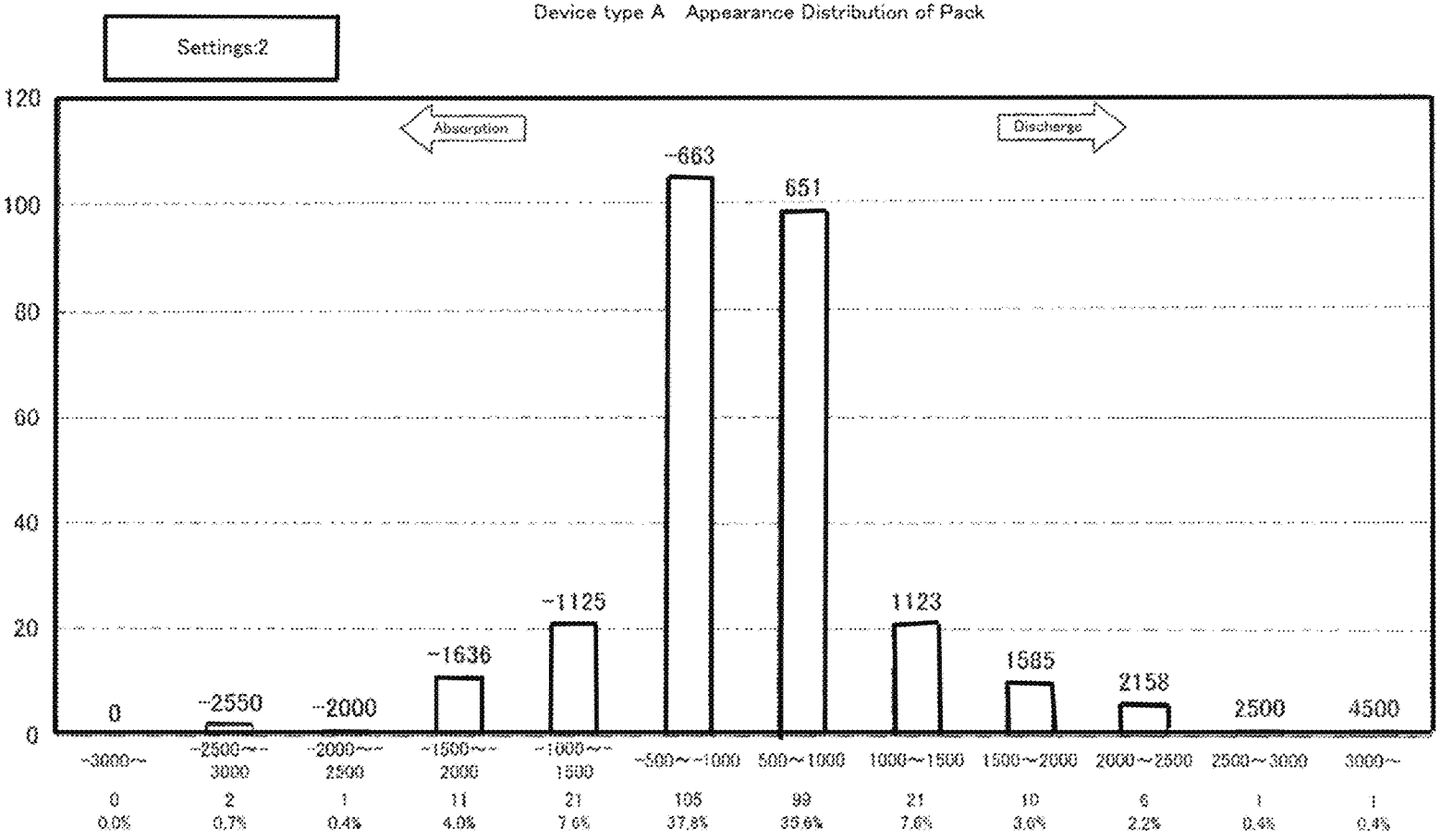
FIG. 70 is a graph depicting appearance distribution of variation trend continuation period in gaming machines of device type A (setting 2).
Figure 71:
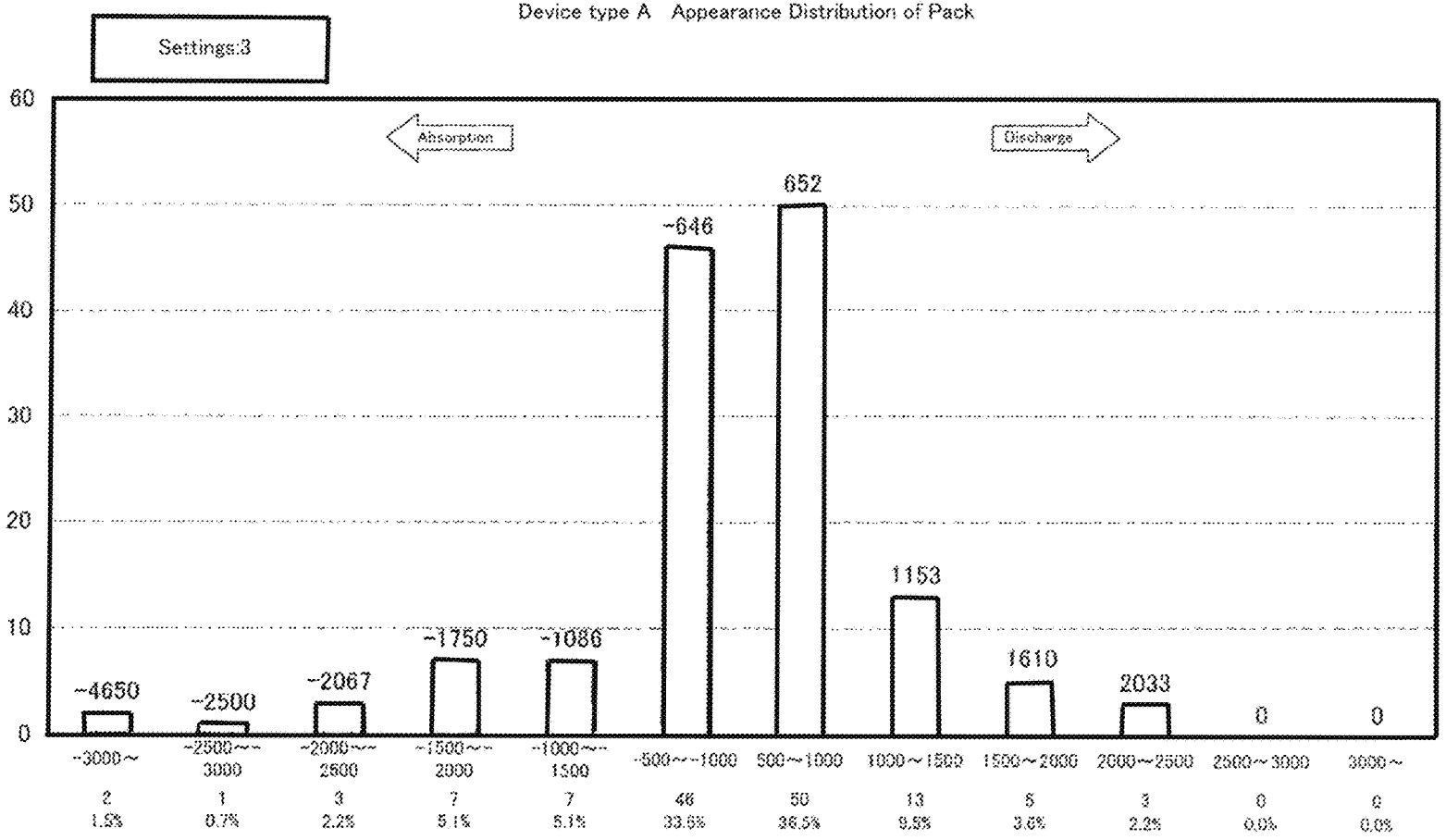
FIG. 71 is a graph depicting appearance distribution of variation trend continuation period in gaming machines of device type A (setting 3).
Figure 72:
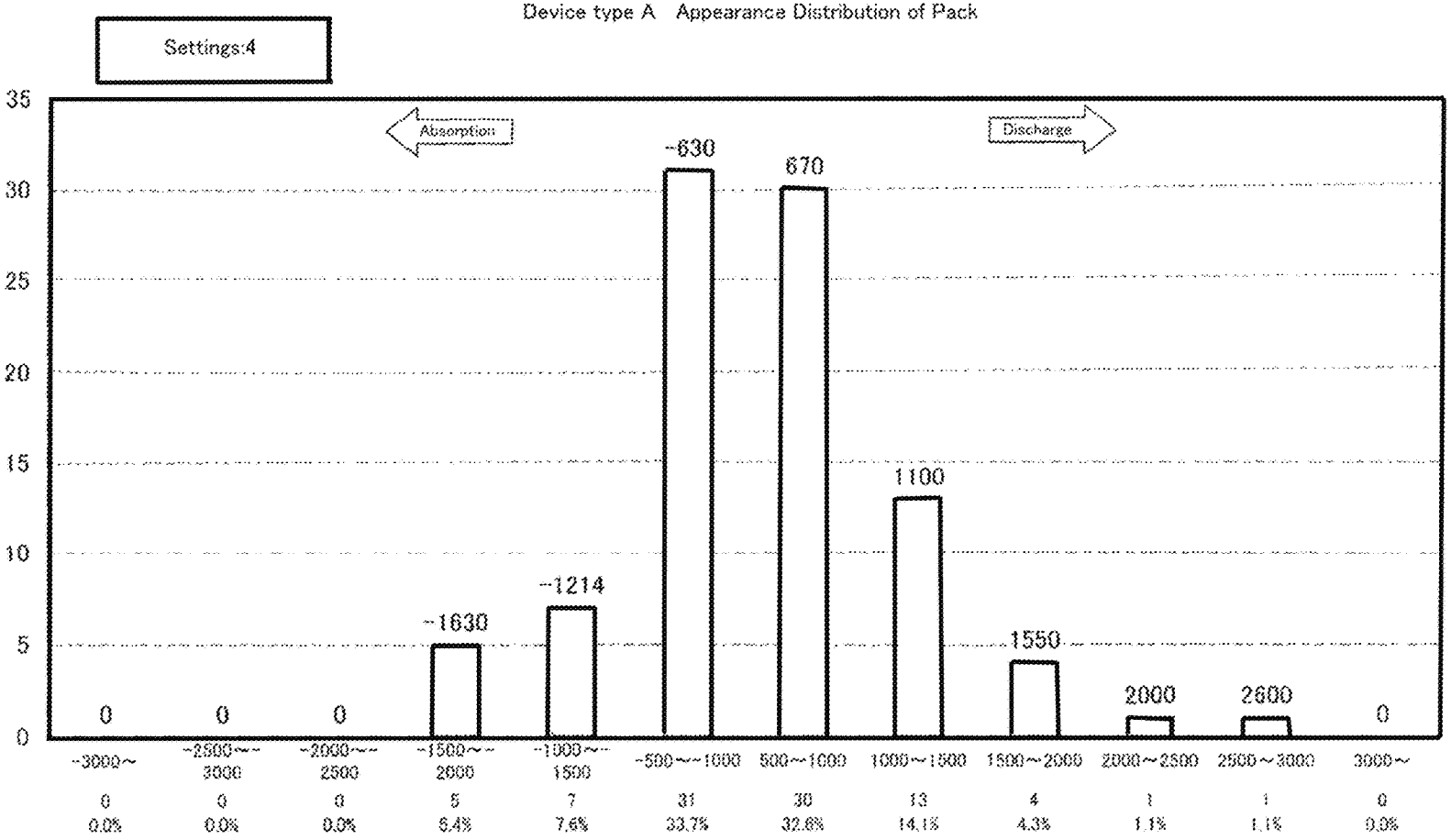
FIG. 72 is a graph depicting appearance distribution of variation trend continuation period in gaming machines of device type A (setting 4).
Figure 73:
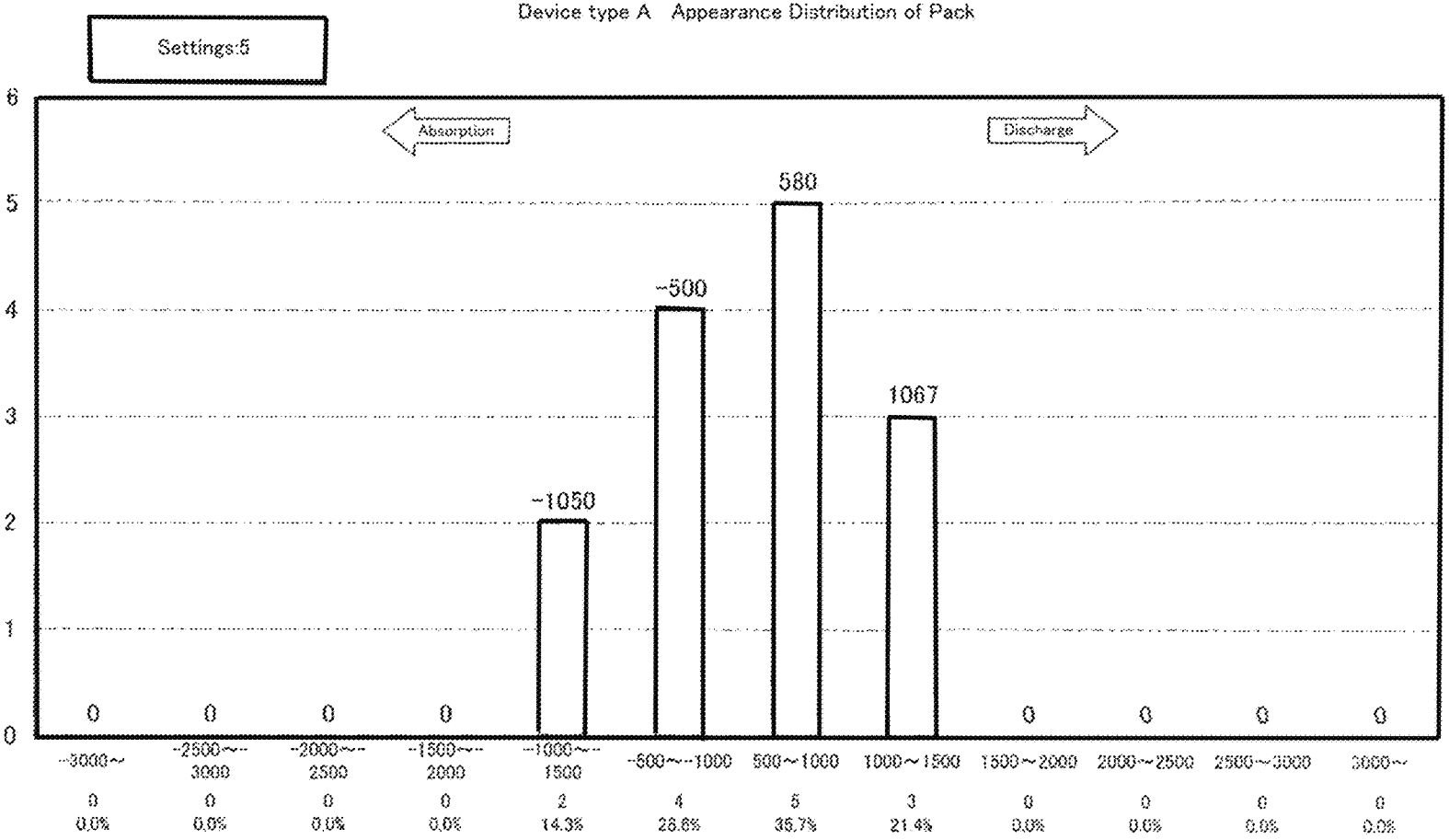
FIG. 73 is a graph depicting appearance distribution of variation trend continuation period in gaming machines of device type A (setting 5).
Figure 74:
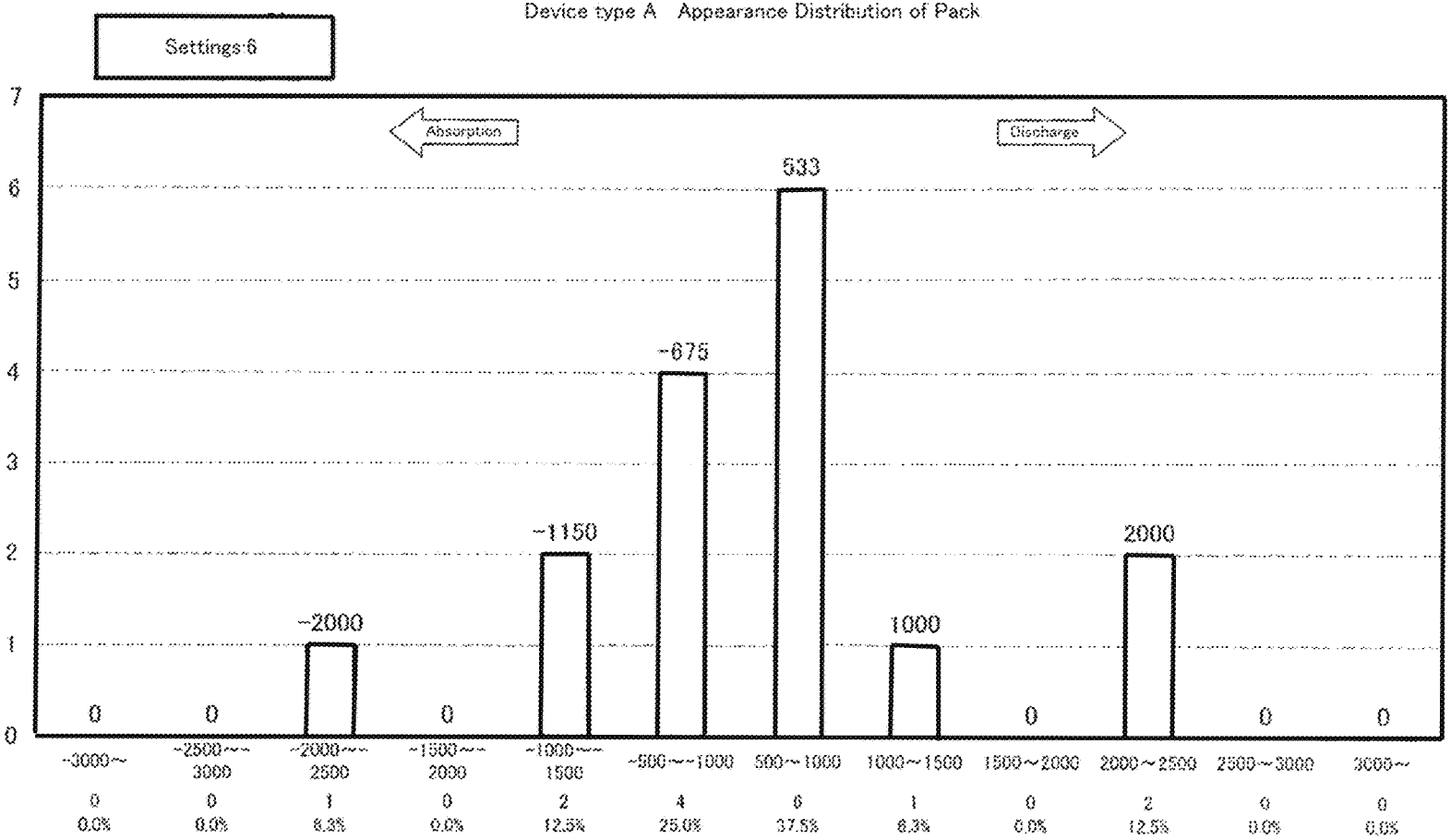
FIG. 74 is a graph depicting appearance distribution of variation trend continuation period in gaming machines of device type A (setting 6).

FIG. 68 is a graph depicting appearance distribution of variation trend continuation period (so called "pack") in gaming machines of device type A (all of settings 1 to 6). FIG. 69 is a graph depicting appearance distribution of variation trend continuation period in gaming machines of device type A (setting 1). FIG. 70 is a graph depicting appearance distribution of variation trend continuation period in gaming machines of device type A (setting 2). FIG. 71 is a graph depicting appearance distribution of variation trend continuation period in gaming machines of device type A (setting 3). FIG. 72 is a graph depicting appearance distribution of variation trend continuation period in gaming machines of device type A (setting 4). FIG. 73 is a graph depicting appearance distribution of variation trend continuation period in gaming machines of device type A (setting 5). FIG. 74 is a graph depicting appearance distribution of variation trend continuation period in gaming machines of device type A (setting 6).

As shown in FIG. 68, if all items of data of settings 1 to 6 are summed as to device type A, distribution of variation trend continuation period between absorption (in a case where difference number is minus) and discharge (in a case where difference number is plus) is substantially identical, and a pack of which difference number is 500 to 999 is the greatest.

The distribution in the graph shown in FIG. 68 is a summation of data in the graphs depicted in FIG. 69 to FIG. 74. As shown in FIG. 69 to FIG. 74, the settings are different from each other in distribution of variable trend continuation period. Specifically, as the setting increases, the number of variation trend continuation period of discharge increases.

Figure 75:
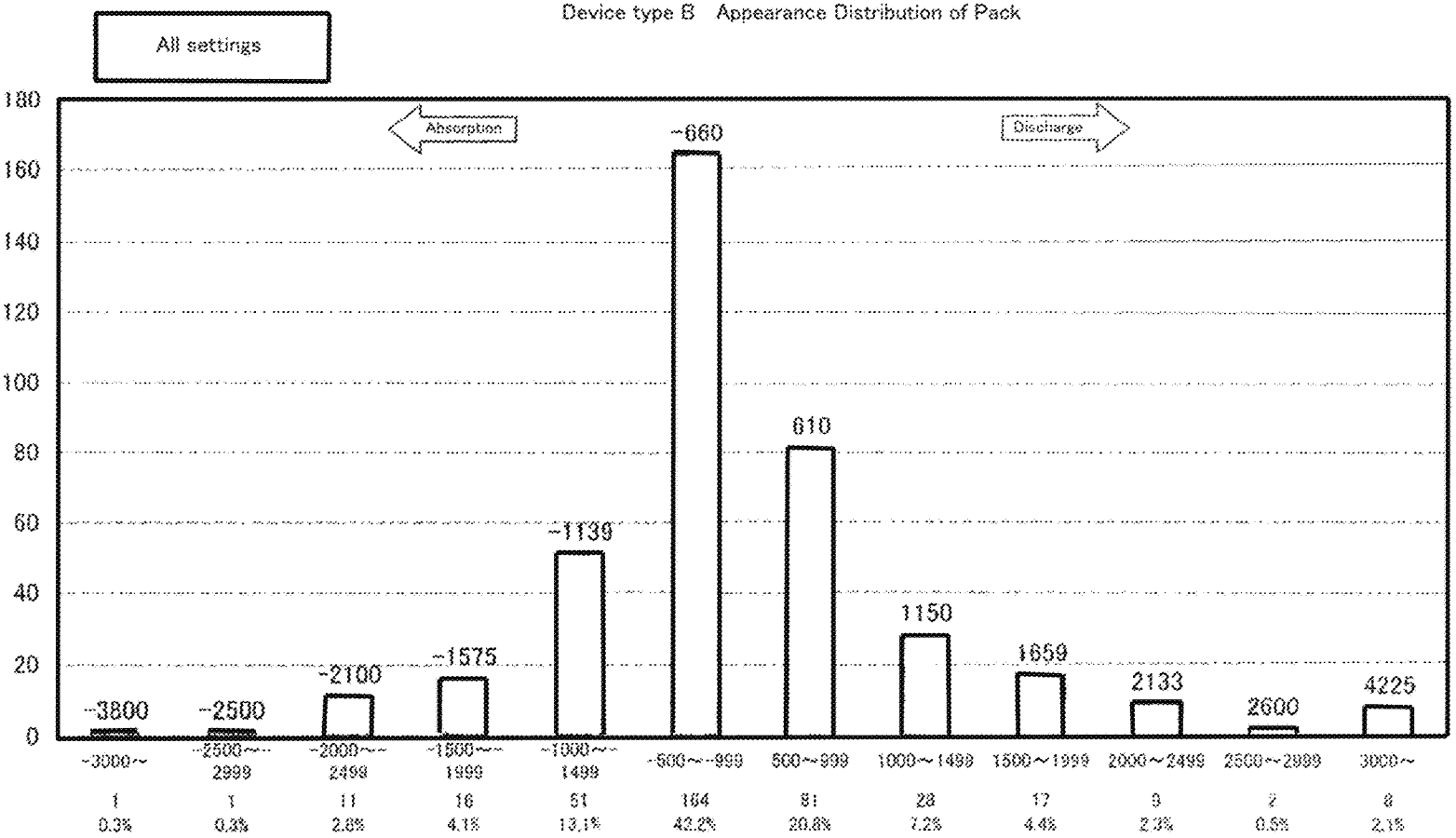
FIG. 75 is a graph depicting appearance distribution of variation trend continuation period in gaming machines of device type B (all of settings 1 to 6).
Figure 76:
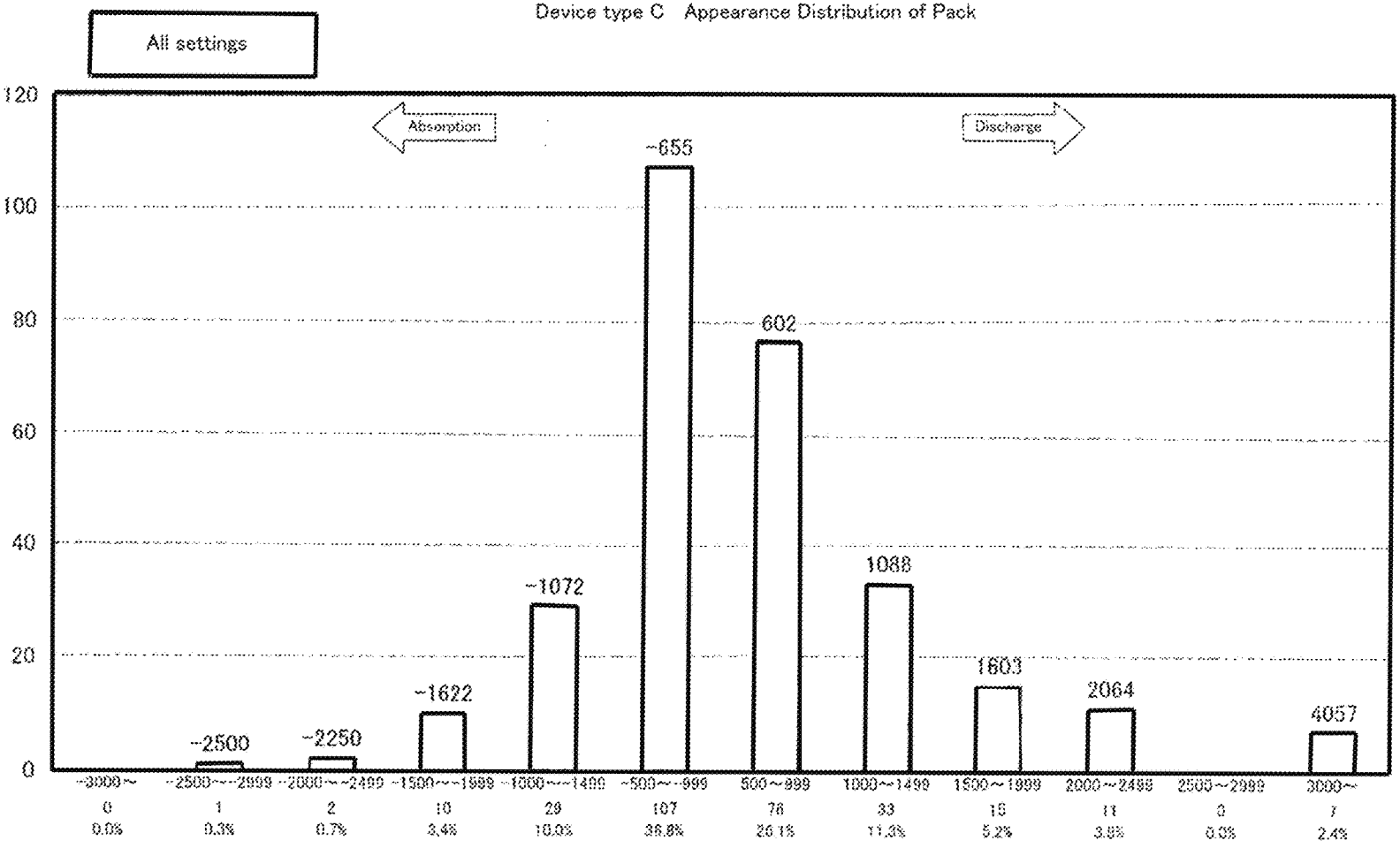
FIG. 76 is a graph depicting appearance distribution of variation trend continuation period in gaming machines of device type C (all of settings 1 to 6).
Figure 77:
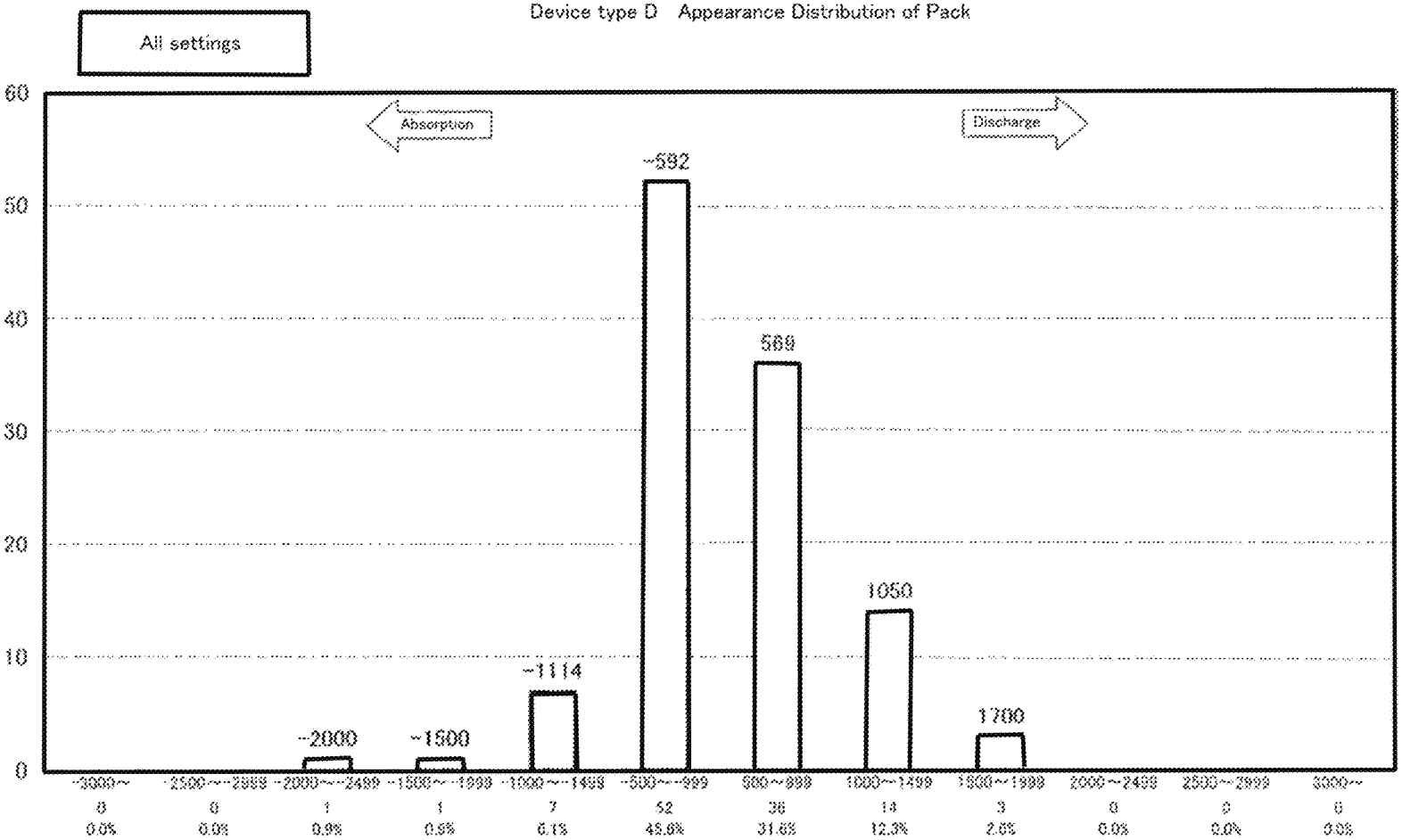
FIG. 77 is a graph depicting appearance distribution of variation trend continuation period in gaming machines of device type D (all of settings 1 to 6).
Figure 78:
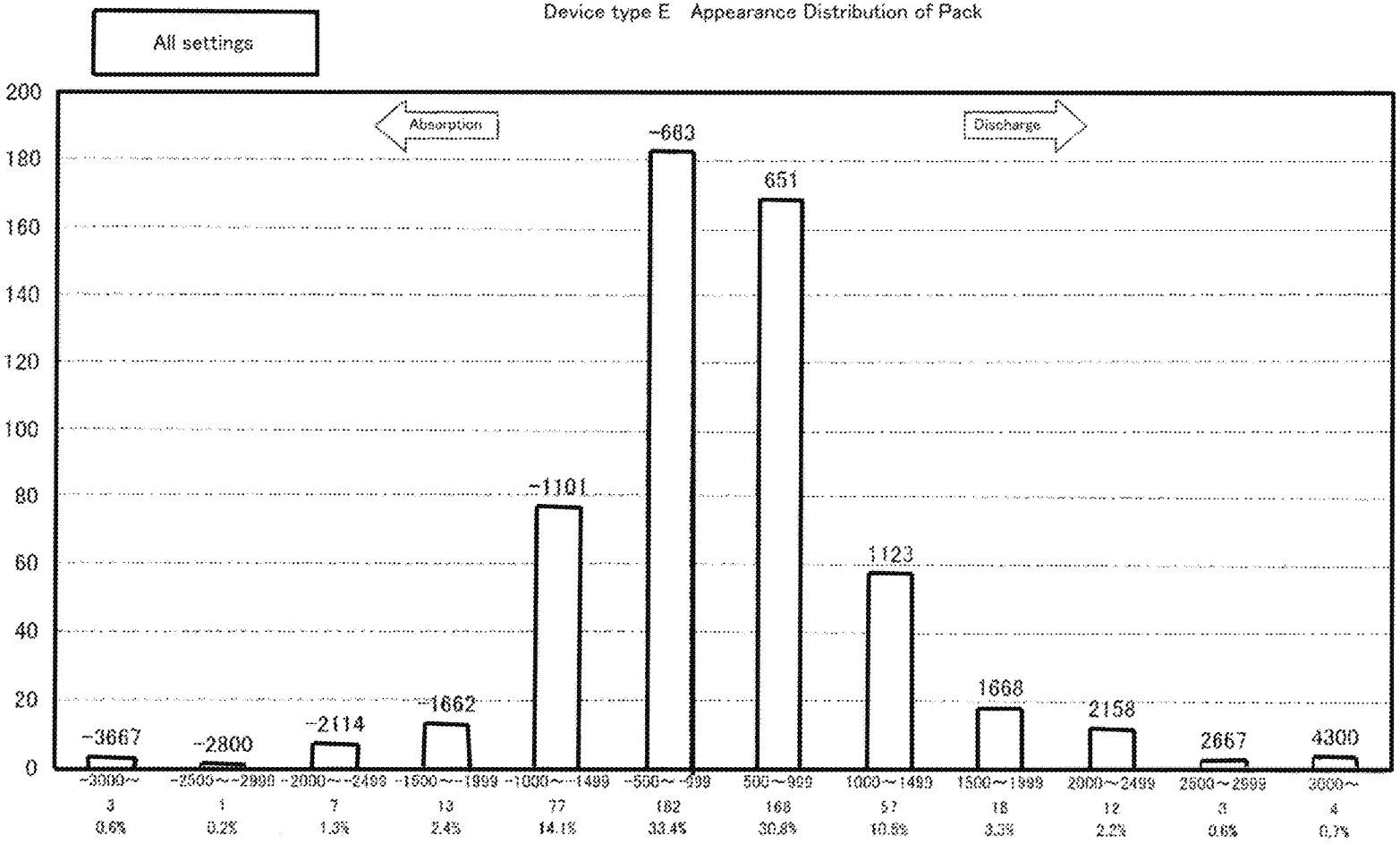
FIG. 78 is a graph depicting appearance distribution of variation trend continuation period in gaming machines of device type E (all of settings 1 to 6).
Figure 79:
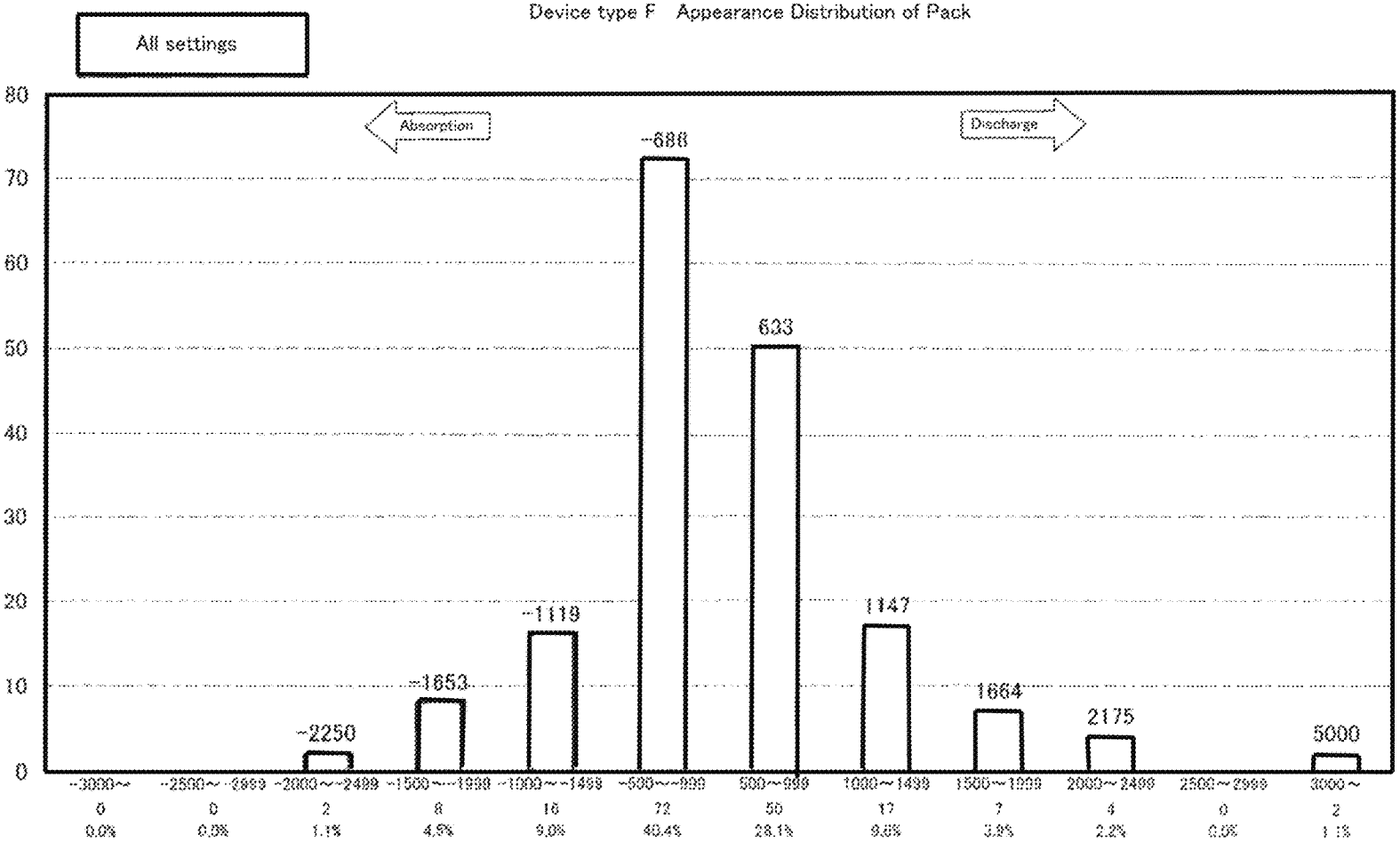
FIG. 79 is a graph depicting appearance distribution of variation trend continuation period in gaming machines of device type F (all of settings 1 to 6).

FIG. 75 is a graph depicting appearance distribution of variation trend continuation period in gaming machines of device type B (all of settings 1 to 6). FIG. 76 is a graph depicting appearance distribution of variation trend continuation period in gaming machines of device type C (all of settings 1 to 6). FIG. 77 is a graph depicting appearance distribution of variation trend continuation period in gaming machines of device type D (all of settings 1 to 6). FIG. 78 is a graph depicting appearance distribution of variation trend continuation period in gaming machines of device type E (all of settings 1 to 6). FIG. 79 is a graph depicting appearance distribution of variation trend continuation period in gaming machines of device type F (all of settings 1 to 6).

In comparison of the graphs shown in FIG. 68 and FIG. 75 to FIG. 79, characteristics of the respective device types A to F obtained from actually measured values can be grasped. Specifically, for example, the following characteristics can be grasped.

Device type B has many more variation trend continuation periods of absorption than device type A.

Device type C has many more variation trend continuation periods of discharge of which difference number is 3,000 or more.

In device type D, there hardly takes place variation trend continuation period of which difference number is great.

In device type E, there likely takes place variation trend continuation period of which difference number is great.

In device type F, there hardly takes place variation trend continuation period for absorption of which difference number is great, whereas there likely takes place variation trend continuation period for absorption of which difference number is small. In addition, there can also occur variation trend continuation period for discharge of which difference number is great.

Therefore, according to the game playing information integration system IS, the characteristics of device types as described above can be qualitatively and quantitatively grasped by analyzing the variation trend continuation period. Therefore, in gaming facility, for example, in a case where gaming machines of device type is popular, it is possible to install a device type of which characteristics are similar to those of device type F when new device type is installed in the future.

While the variation trend continuation period has been described so far, analysis of the characteristics of gaming machines in the present invention is not limited to extraction of variation trend continuation period, and for example, can include analysis of variation pattern, for example.

(Analysis of Variation Pattern)

Figure 80:
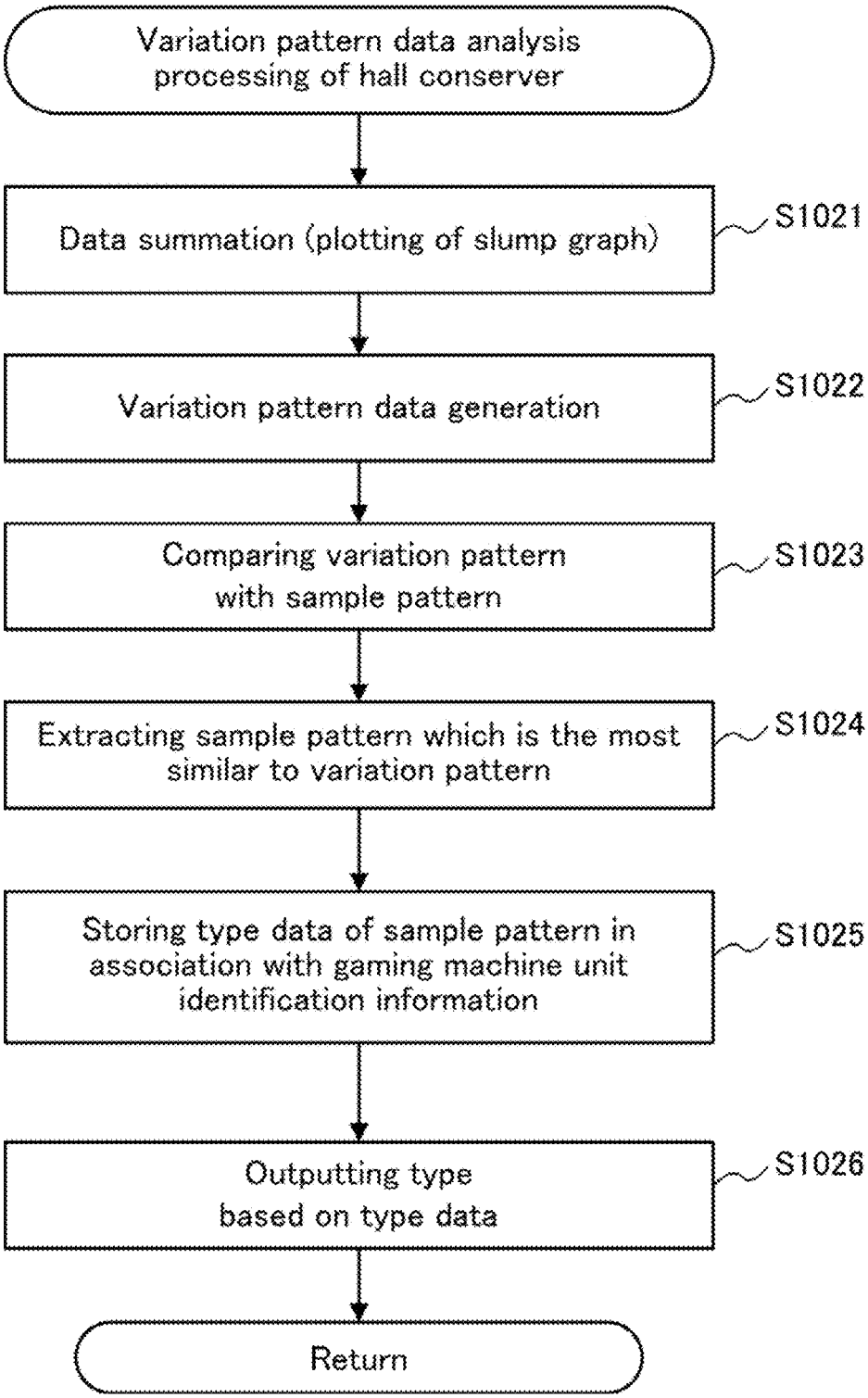
FIG. 80 is a flowchart showing variation pattern data analysis processing executed in the hall conserver shown in FIG. 1.

FIG. 80 is a flowchart showing variation pattern data analysis processing executed in the hall conserver shown in FIG. 21.

Figure 81A:
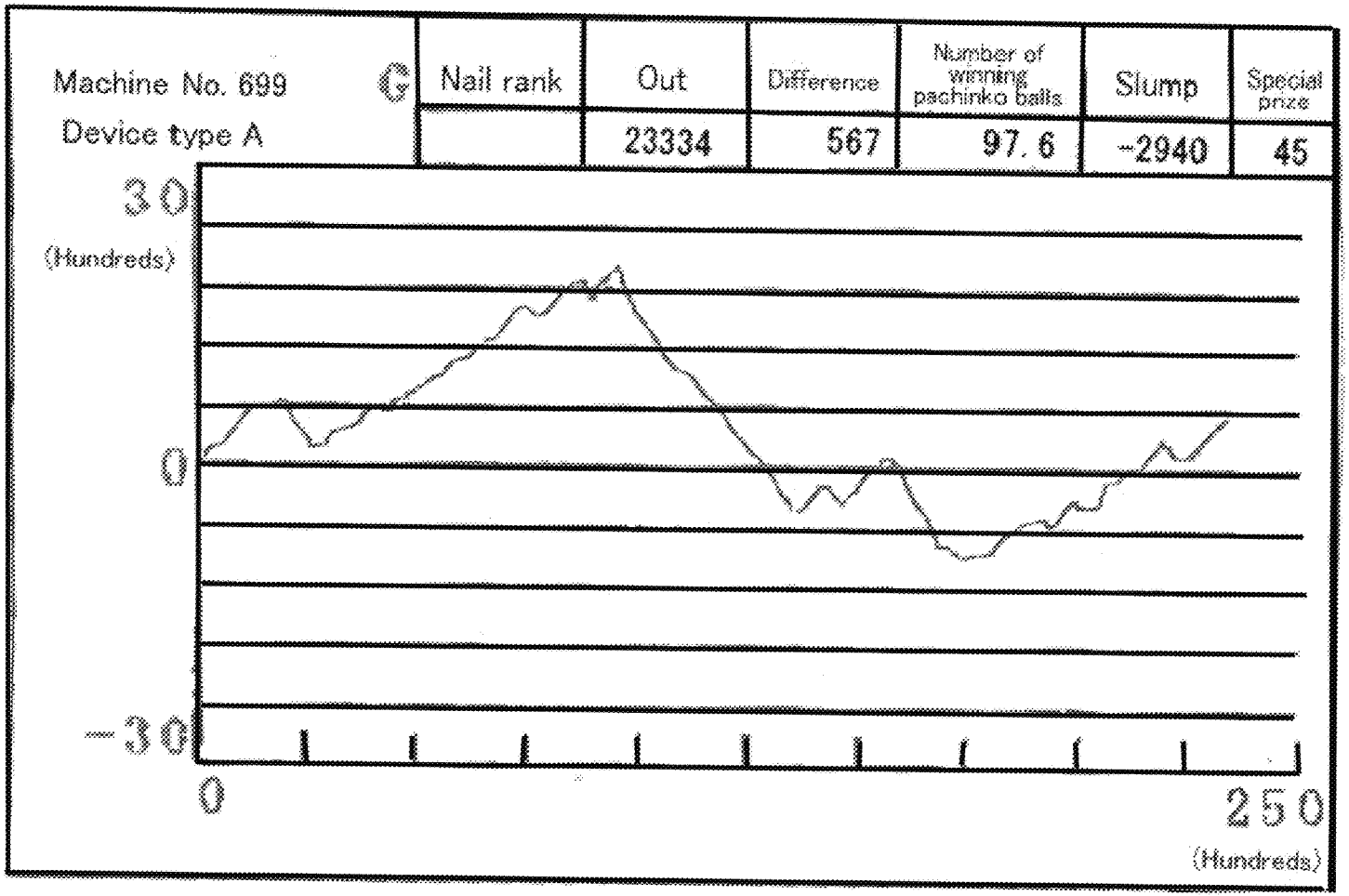
FIGS. 81A and 81B are slump graphs in gaming machines, respectively.
Figure 81B:
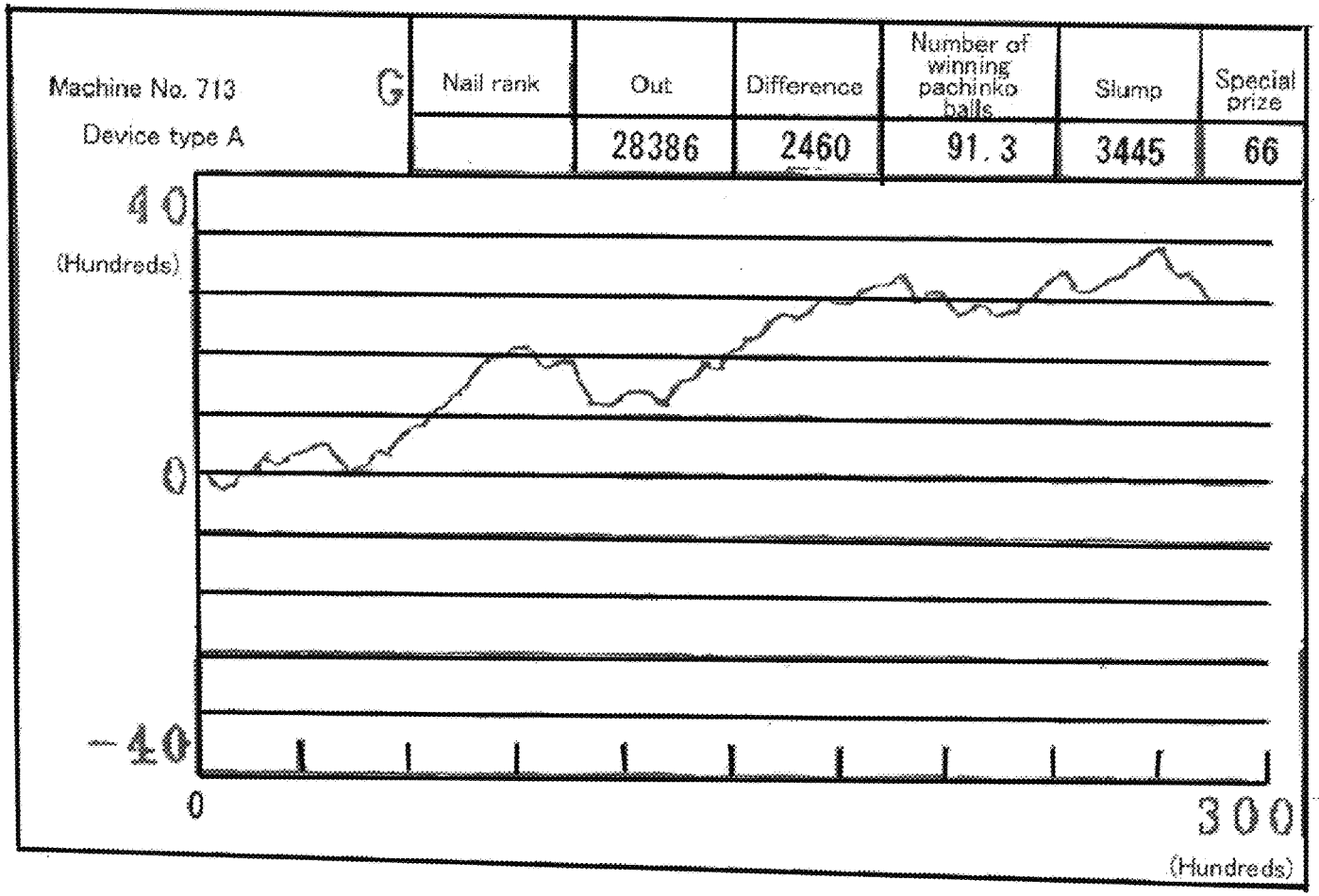
Figure 82:
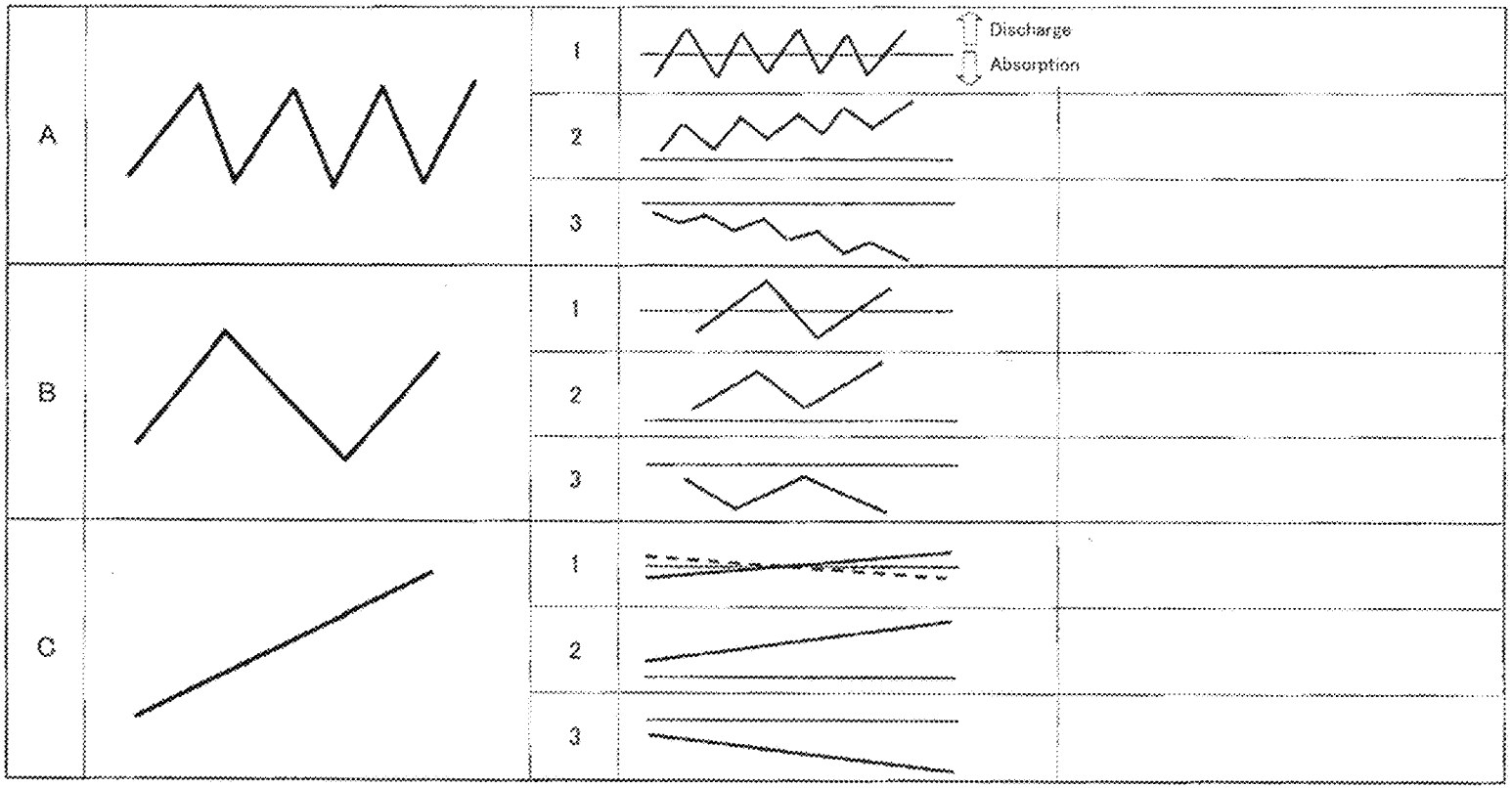
FIG. 82 is a table showing a slump graph waveform type.

FIGS. 81A and 81B are slump graphs in gaming machines, respectively. FIG. 82 is a table showing slump graph waveform types.

First, the control portion 62 of the hall conserver 60 sums data as to one gaming machine unit 1, based on the data stored in the game playing status database 66 (refer to FIG. 34 (*b*) (step S1021). The processing is equivalent to step S1001 of the processing shown in FIG. 64. As shown in FIGS. 81A and 81B, in a slump graph a vertical axis indicates difference number, and a horizontal axis indicates the number of game. Such a slump graph itself is conventionally publicly known.

Next, the control portion 62 generates variation pattern data, based on the slump graph obtained by means of step S1021 (step S1022). The variation pattern data is data for comparing sample data to be described later. That is, the slump graph obtained by means of step S1021 entails a problem such as no limitation of length (period) provided, for example, and however, in this situation it is difficult to compare with sample data. Therefore, in step S1022, a plurality of variation pattern data which is capable of being compared with sample data is generated from one slump data. At this time, the control portion 62 functions as a pattern data generation means.

Next, the control portion 62 compares the variation pattern data generated in step S1022 with the sample data stored in advance in the hard disk 65 (step S1023).

The sample data stored in advance in the hard disk 65 can include data shown in FIG. 82, for example. The sample data shown in FIG. 82 indicates waveforms of a slump graph in a predetermined period of time, and as shown in FIG. 82, the waveforms of 9 types indicate different classes of waveforms which are different from each other. In the table shown in FIG. 82, waveform types are classified into three types of class A, class b, and class C. Class A is a waveform pattern in which difference number varies slightly in a stepwise manner. Class B is a waveform pattern in which difference number varies so that a comparatively large wave is drawn. Class C is a linear waveform pattern.

Specifically, period or the number of games is set for waveform pattern in each waveform type. In class A, there are comparatively changes of variation trend in the period or the number of games. In class B, there are comparatively less changes of variation trend in the period or the number of games. In class C, there is no change of variation trend in the period or the number of games, and the trend is continuous. The term "change of variation trend" used here designates switch between increase trend and decrease trend. It is to be noted that the term does not designate a change to an extent of trend in the same trend.

Classes A to C are further classified into the following three categories, and are entirely classified into nine categories.

Class 1 indicates no variation state (including a case in which no change entirely takes place while increase trend and decrease trend repeated).

Class 2 indicates increase trend (including a case in which an increase entirely takes place while increase trend and decrease tread are repeated).

Class 3 indicates decrease trend (including a case in which a decrease entirely takes place while increase trend and decrease trend are repeated).

In the game playing information integration system IS, the abovementioned variation patterns are employed as sample patterns, and evaluation of actual variation pattern is performed. The sample patterns are stored as sample data in the hard disk 65 of the hall conserver 60 in the game playing information integration system IS, for example. The names of classes A to C and 1 to 3 are classes, and class data indicating classes is also stored in the hard disk 65 in association with the sample data.

In addition, in step S1023, comparison between variation pattern and sample pattern is performed focusing on, for example, which of no change (class 1), increase trend (class 2), and decrease trend (class 3) the entire variation trend falls under, or alternatively, which of none (class C), 1 to 4 times (class B), and 5 times or more (class A) the number of times of repetition between increase tend and decrease trend falls under.

Next, the control portion 62 performs extraction of a sample pattern which is the most similar to a variation pattern (step S1024). In the present invention, a plurality of variation patterns are generated from one slump graph SG and comparison between each variation pattern and sample pattern is performed. Therefore, in step S1024, a plurality of sample patterns are extracted from one slump graph SG At this time, the control portion 62 functions as a sample data extraction means.

Next, the control portion 62 stores class data of sample pattern in association with the gaming machine unit identification information (step S1025). As described above, a plurality of sample patterns are extracted, and thus, a plurality of class data are associated with gaming machine unit identification information. For example, class data associated with the gaming machine unit identification information and its related number such as 10 items for class A1 or 5 items for class A2 are stored. Herein, variation pattern data as actually measured data may be stored as sample data in the hard disk 65.

Next, the control portion 62 performs output of class, based on the class data stored in the hard disk 65 (step S1026). At this time, the control portion 62 functions as a class output means. Afterwards, this routine is completed.

The processing shown in FIG. 80 is performed as to each gaming machine unit 1, making it possible to analyze characteristics by device type and characteristics by settings or the like, for example. Next, data actually acquired by means of the game playing information integration network system INS with the use of the abovementioned sample data will be described with reference to FIG. 83.

Figure 83:
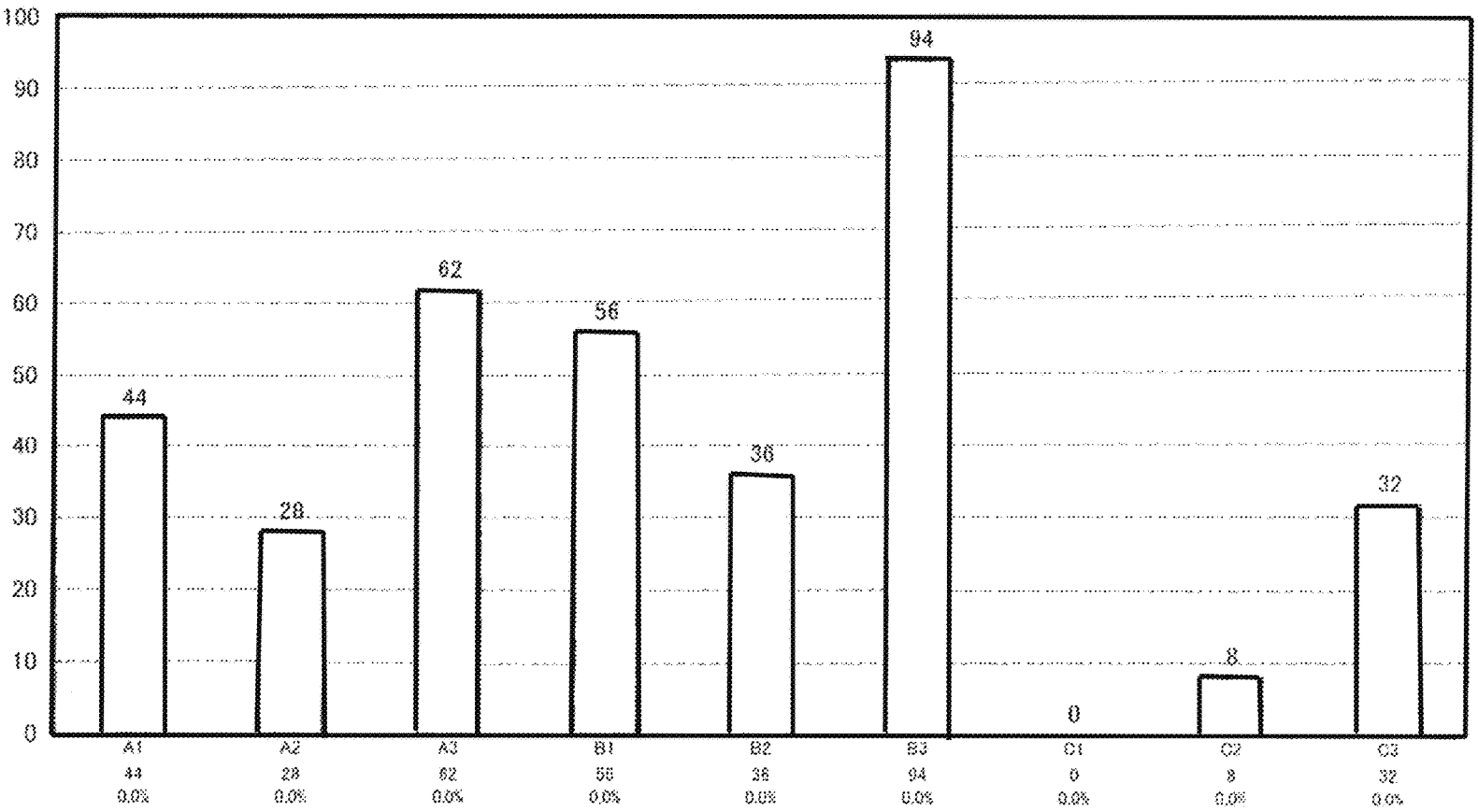
FIG. 83 is a graph depicting analysis by waveform type in gaming machines of device type A.

FIG. 83 is a graph depicting analysis by waveform type in gaming machine of device type A.

According to the graph shown in FIG. 83, in device type A, there are comparatively many cases in which variation pattern falls under class B3 (waveform indicating that an entire decrease takes place while increase trend and decrease trend are repeated so that a comparatively large wave is drawn). In addition, in device type A, class C1 (waveform with no linear variation) does not occur. Further, in device type A, decrease trend is more frequent than increase trend.

In this manner, according to the game playing information integration system IS, the abovementioned characteristics of device type can be qualitatively and quantitatively grasped by analyzing variation pattern of waveform. Therefore, in gaming facility, for example, in a case where gaming machines of device type F are popular, when new device type is introduced in the future, it is possible to introduce device type of which characteristics are similar to those of device type F.

While the embodiment described a case of analyzing variation pattern of waveform, it is to be noted that in the present invention variation pattern is not limited to variation pattern of waveform, and for example, can include appearance pattern of variation trend continuation period or the like. In addition, parameters for quantitatively evaluating appearance pattern of variation trend continuation period can include difference number in variation trend continuation period, appearance number of times of variation trend continuation period in predetermined period of time or in the number of games, and appearance intervals of variation trend continuation period or the like, for example.

(Analysis of Gaming Facility)

Next, in a gaming machine in which the game playing information integration system IS is introduced, there is shown a result obtained by analyzing the gaming facility itself.

FIG. 84 is a table showing data related to the number of players and winning rate or the like in shop α.

As shown in FIG. 84, according to the game playing information integration system IS, a variety of data including the number of players or winning rate can be smoothly and precisely obtained.

It is to be noted that weather and ambient temperature or the like may be manually input by a manager in gaming facility or may be automatically input via the internet or the like.

Figure 85:
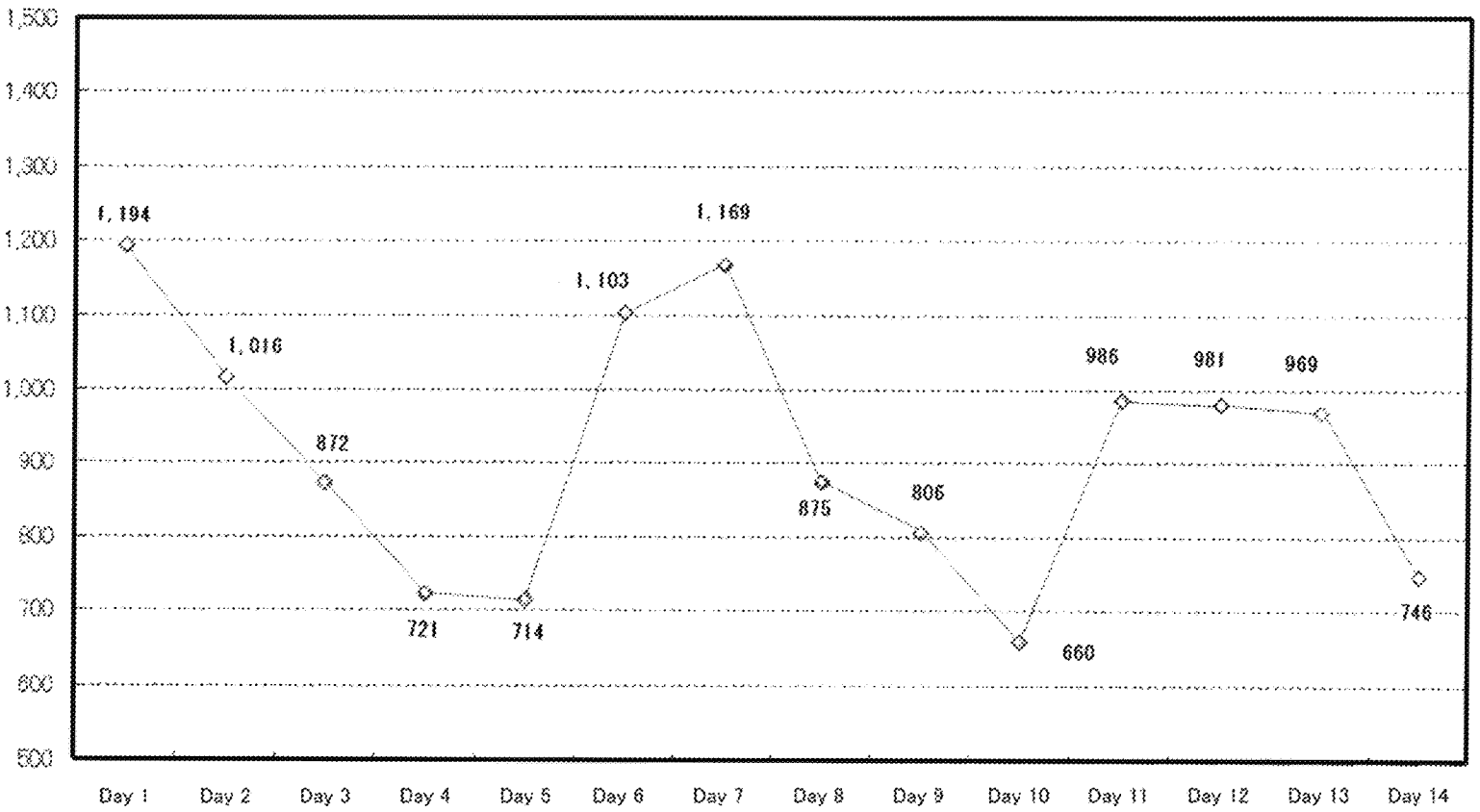
FIG. 85 is a graph depicting data related to an average exchange number of medals in shop α.
Figure 86:
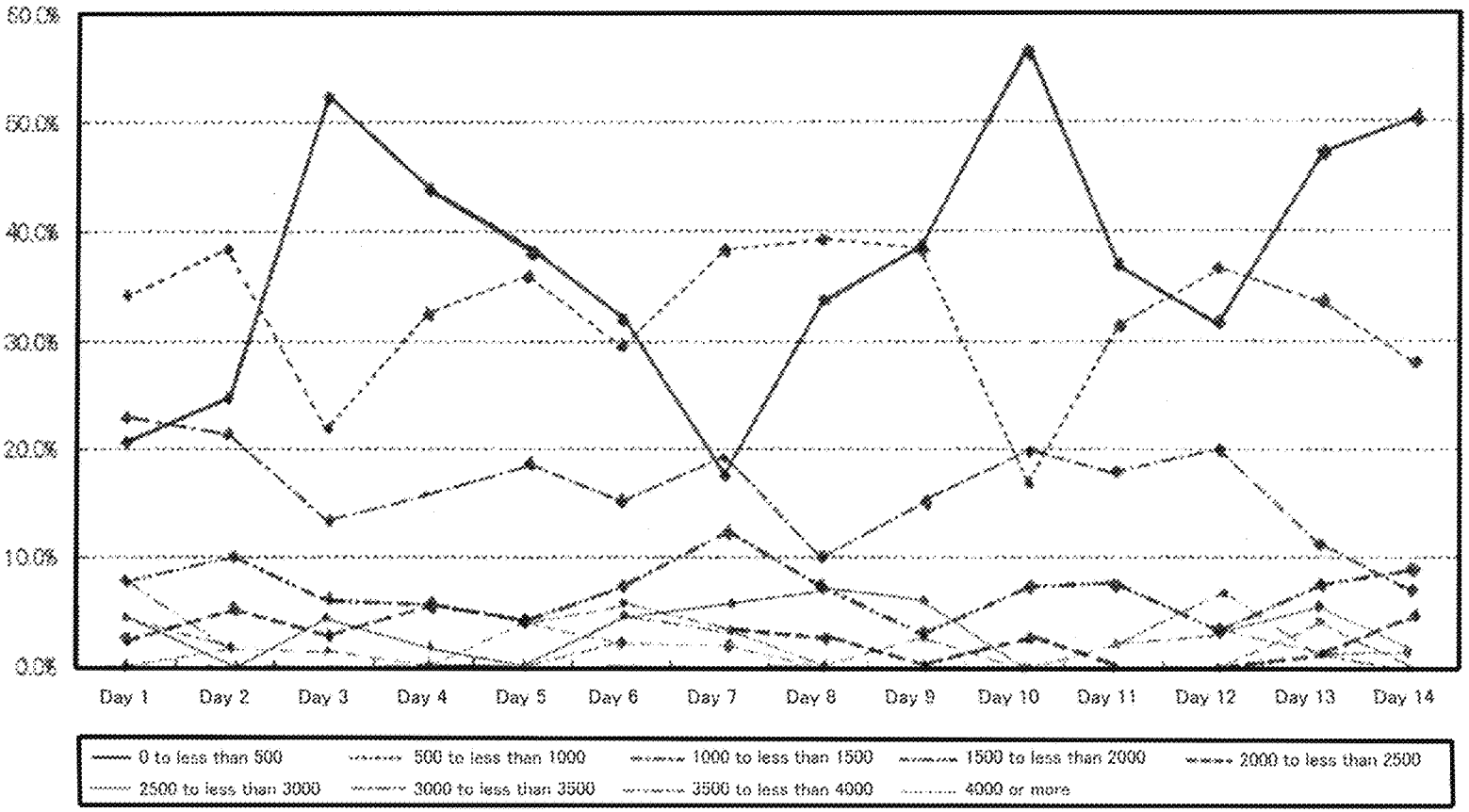
FIG. 86 is a graph depicting metal exchange number distribution by elapse of day in shop α.

In the game playing information integration system IS, the data shown in FIG. 84 can be automatically acquired or generated, and the data can be processed and summed as shown in FIG. 85 and FIG. 86, for example.

FIG. 85 is a graph depicting data related to average number of exchange medals in shop α. This graph shows the average number of exchange metals per player.

FIG. 86 is a graph depicting a state of exchange number of medals by elapsed number of days in shop α. This graph shows average number of exchange medals per player by predetermined range by dividing players in predetermined range in accordance with the number of exchange medals.

Figure 87:
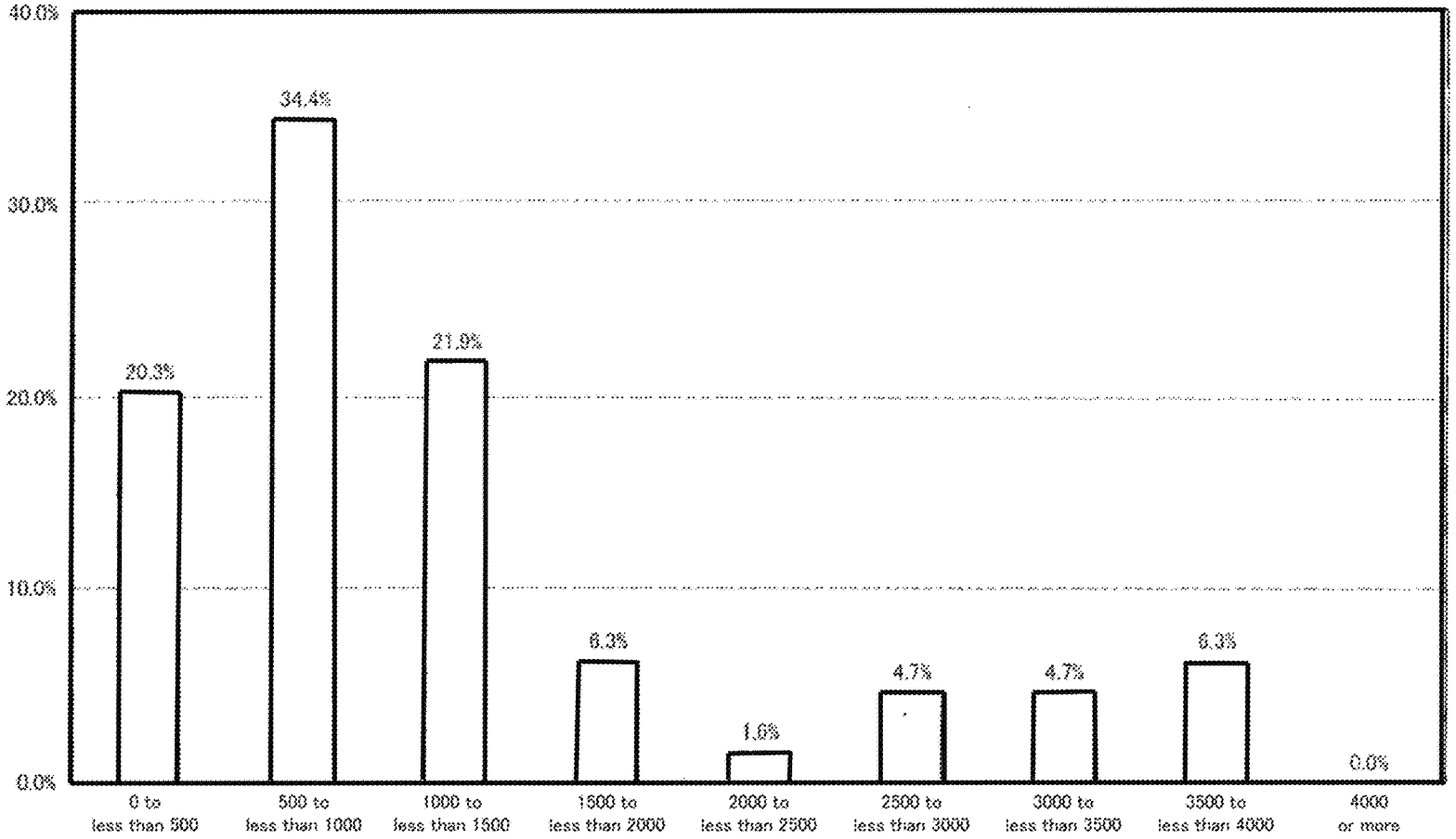
FIG. 87 is a graph depicting medal exchange number distribution by day (first day) in shop α.
Figure 88:
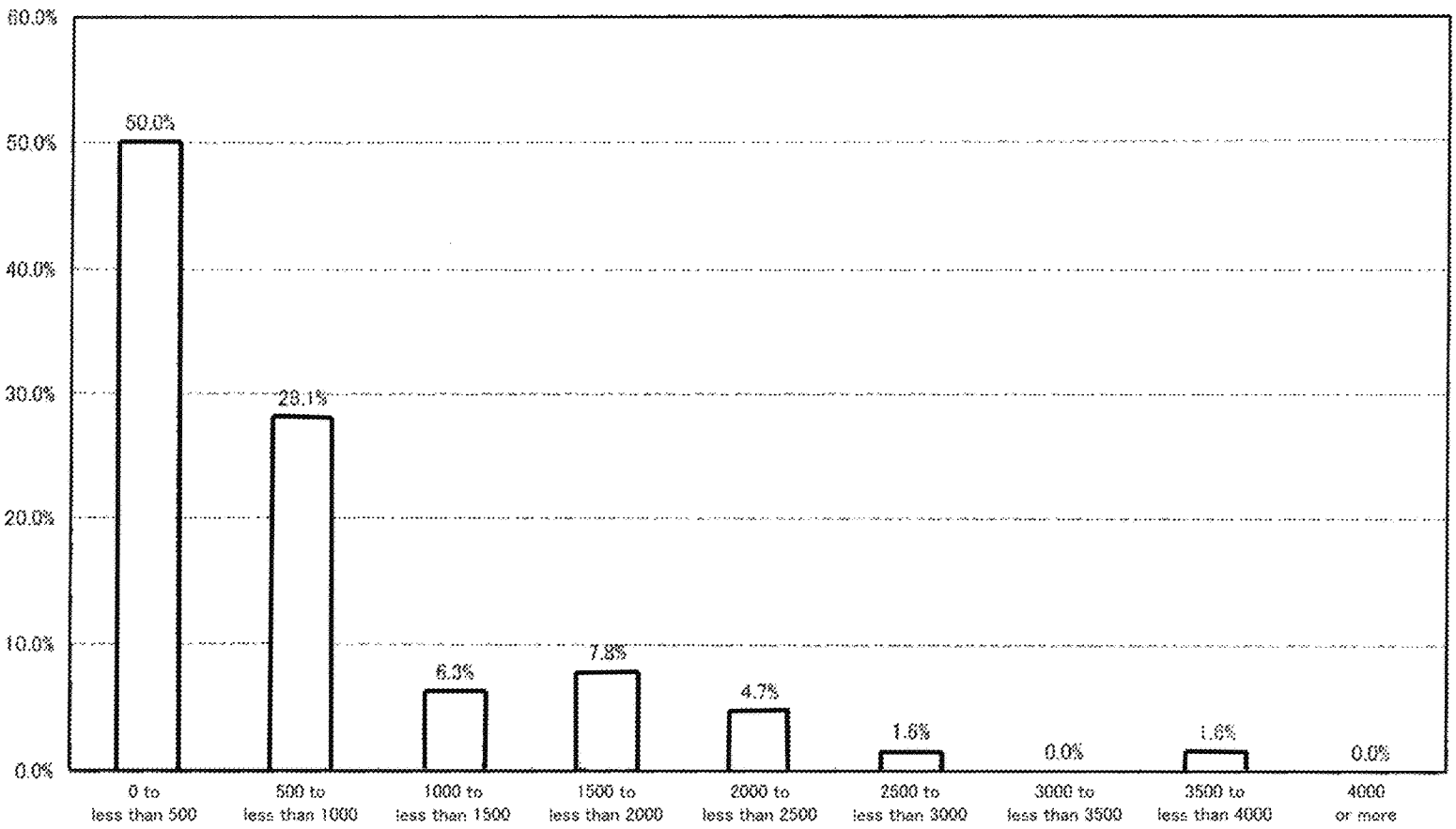
FIG. 88 is a graph depicting medal exchange number distribution by day (last day) in shop α.

FIG. 87 is a graph depicting distribution of the number of exchange metals by day (first day) in shop α. FIG. 88 is a graph depicting distribution of the number of exchange medals by day (last day) in shop α.

In the present specification, the first day designates date when acquisition of data is started by means of the game playing information integration system IS, and device type A is installed as new device type that day. In addition, the last day designates 14 days after starting acquisition of data.

As is evident from comparison between FIG. 87 and FIG. 88, the number of exchanges per player is greater in first day than in last day. According to the game playing information integration system IS, such trend can be quantitatively grasped.

Figure 89:
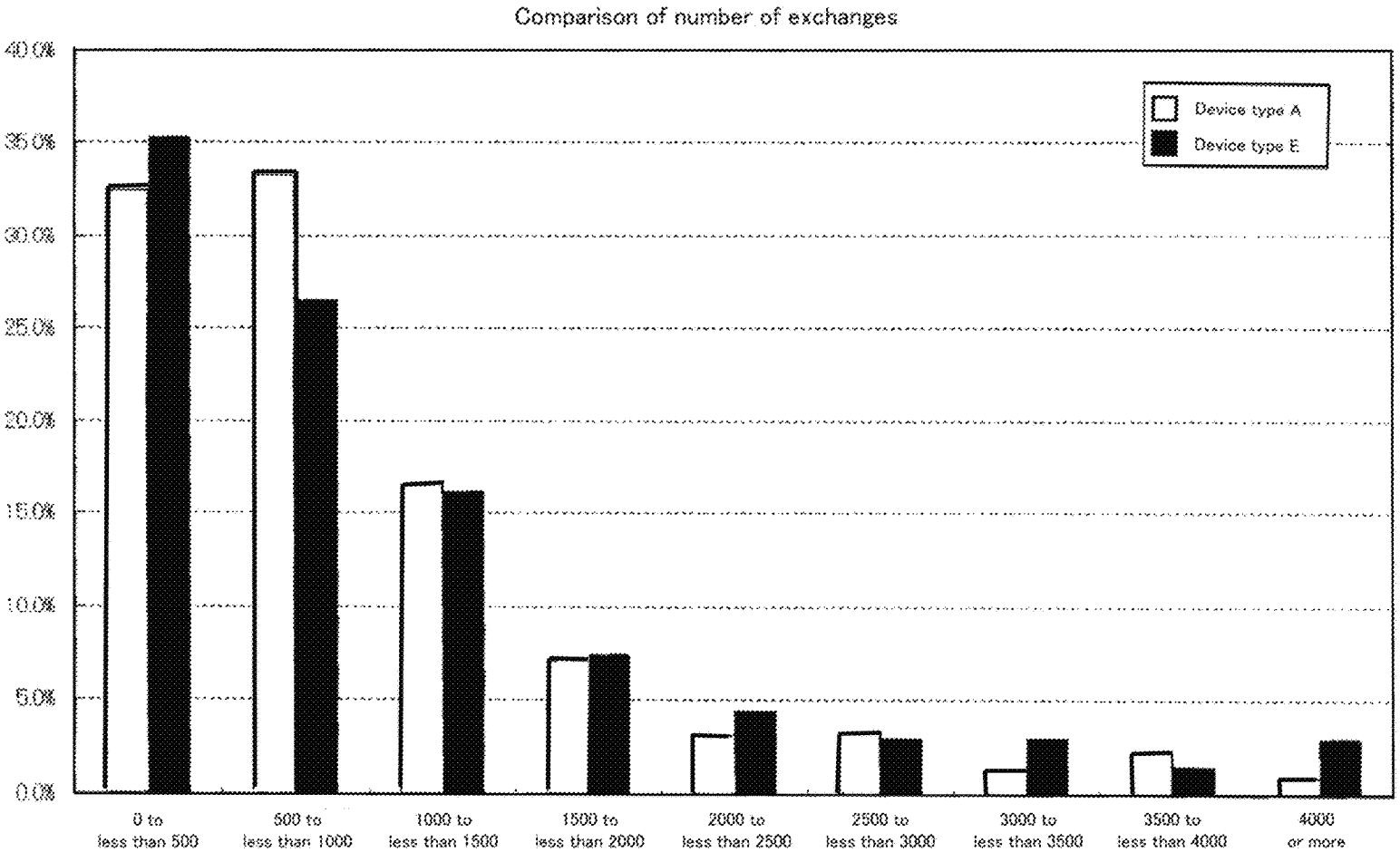
FIG. 89 is a graph depicting a comparison result of exchange medal number by device type in shop α.

FIG. 89 is a graph depicting rate of the number of exchange medals by device type in shop α.

In this manner, according to the game playing information integration system IS, it is possible to sum rate of the number of exchange medals per player by device type.

Figure 90:
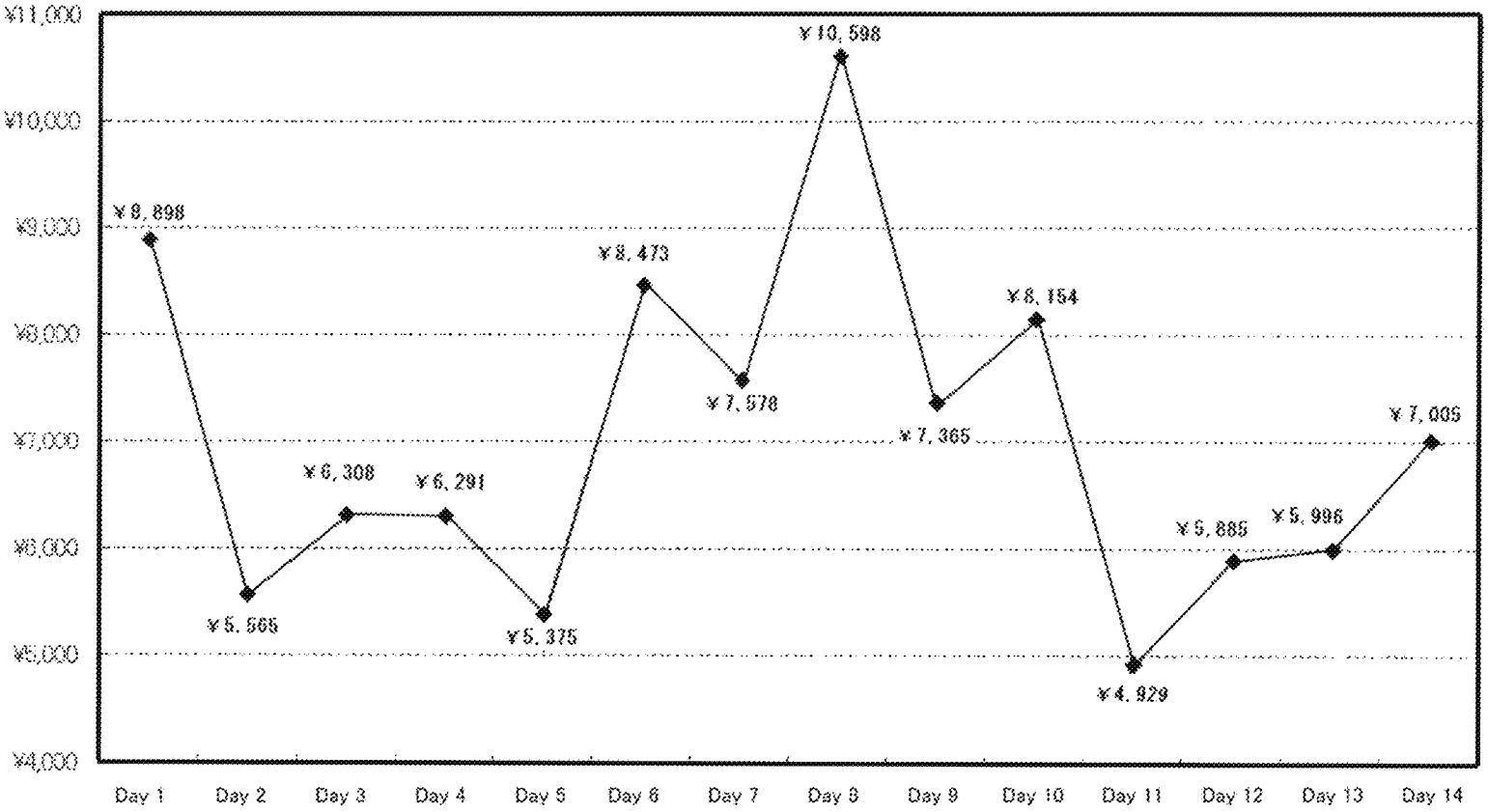
FIG. 90 is a graph depicting a state of player use amount of money by elapse of day in shop α.

FIG. 90 is a graph depicting a status of player use amount of money by elapsed day in shop α. This graph shows average use amount of money per player.

Figure 91:
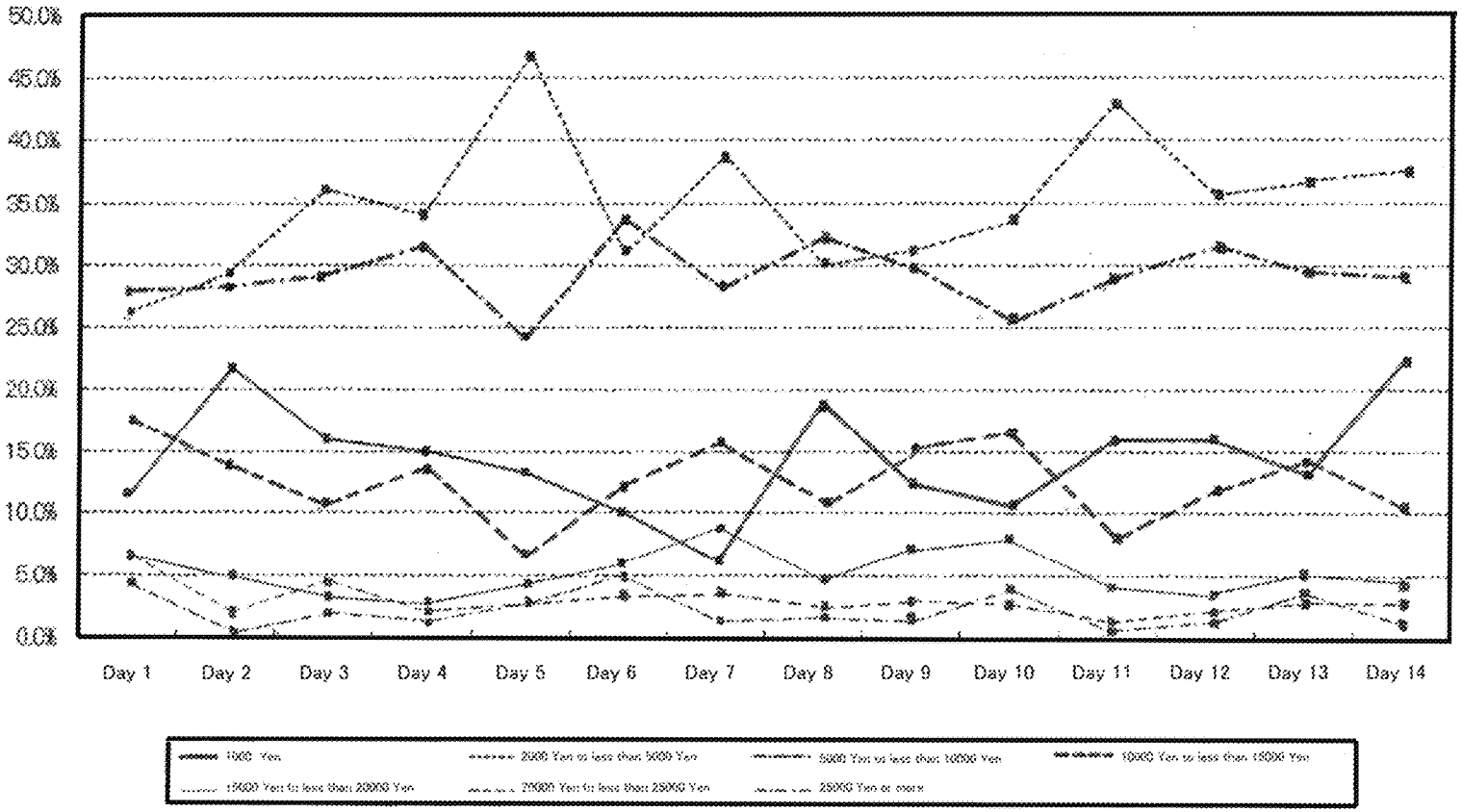
FIG. 91 is a graph depicting a rate of use amount of money by elapse of day in shop α.

FIG. 91 is a graph depicting rate of use amount of money by elapsed day in shop α. This graph shows average use amount of money per player by predetermined range by dividing players in predetermined range in accordance with use amount of money.

Figure 92:
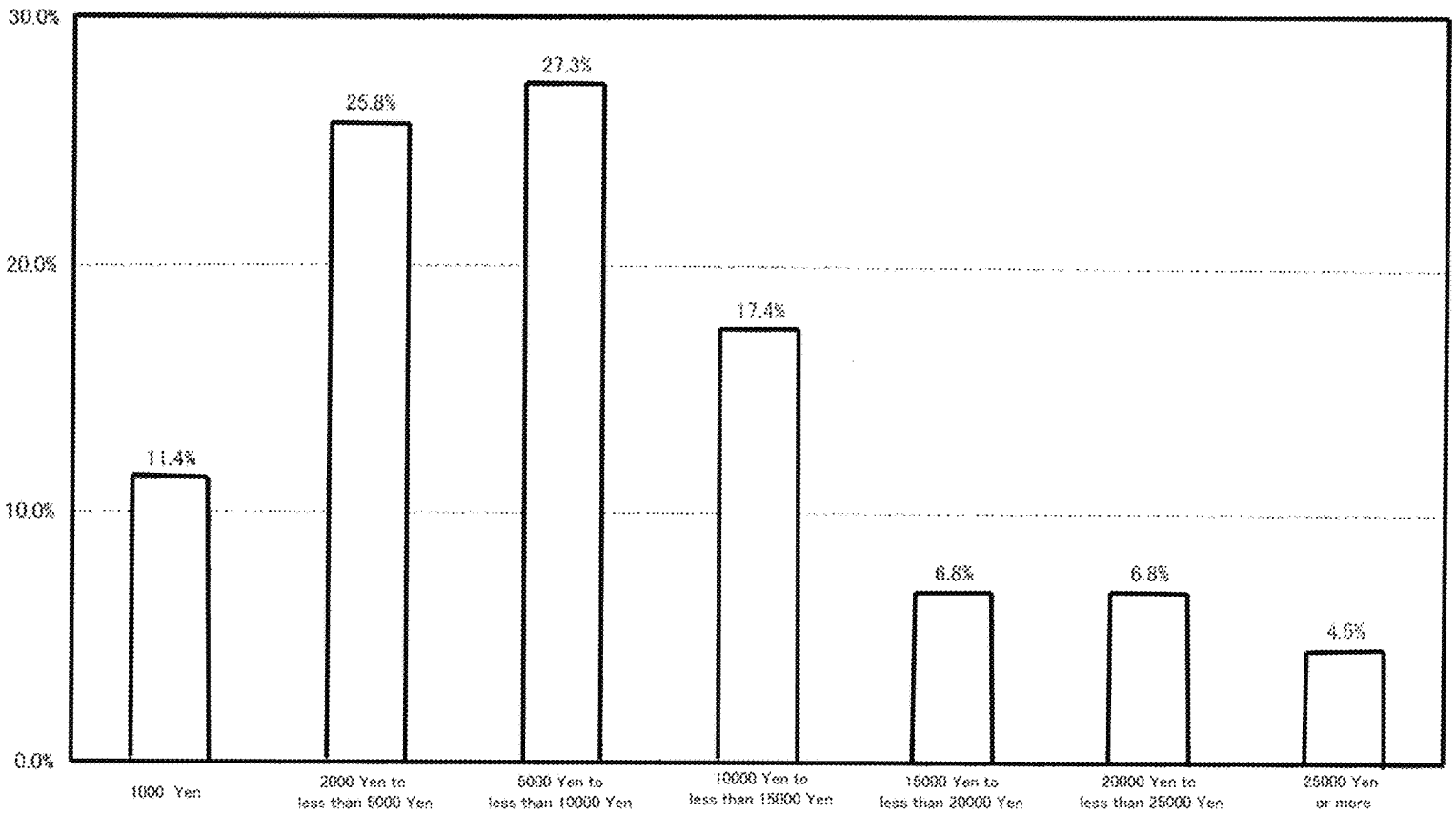
FIG. 92 is a graph depicting a player use amount of money by day (first day) in shop α.
Figure 93:
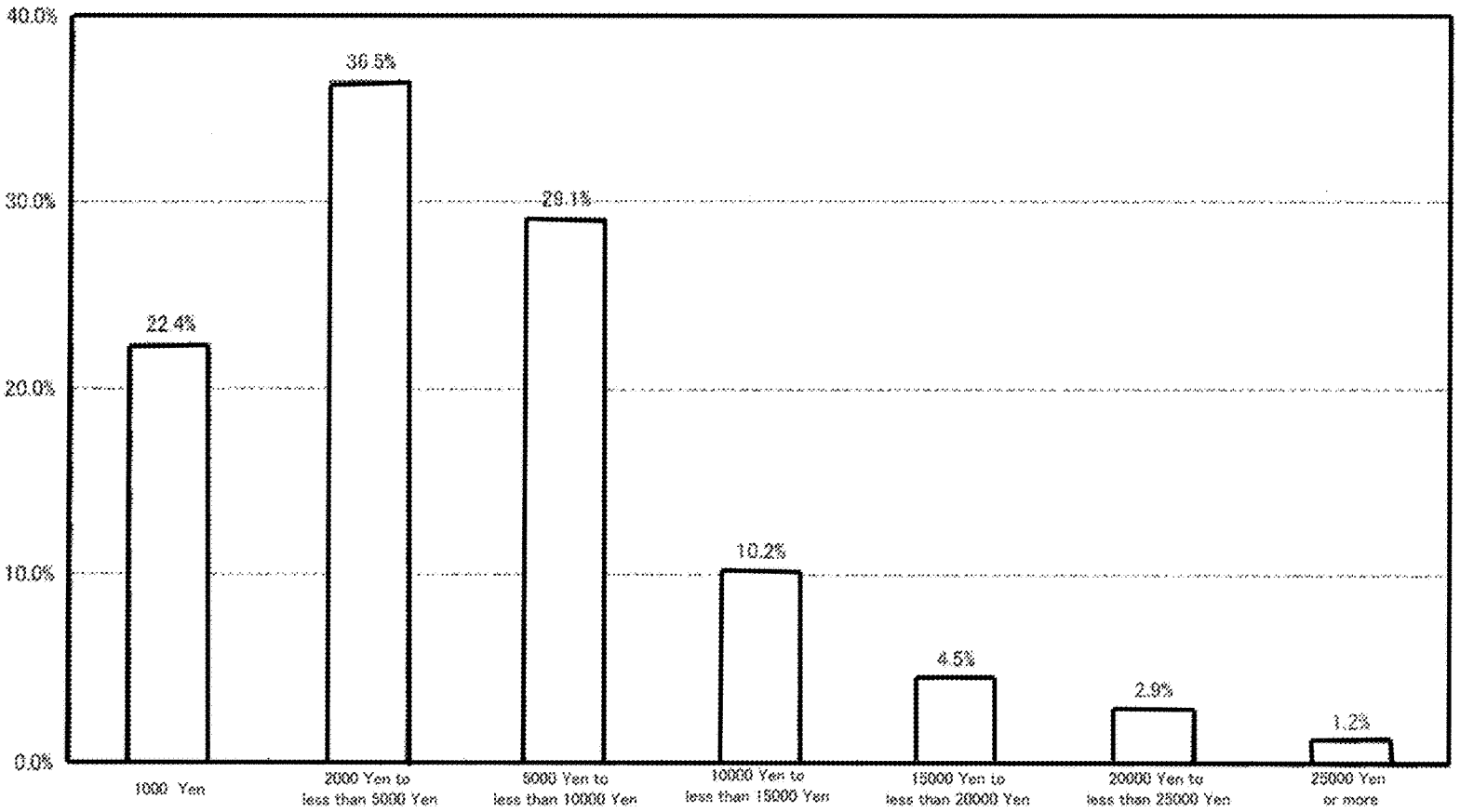
FIG. 93 is a graph depicting a player use amount of money by day (last day) in shop α.
Figure 98A:
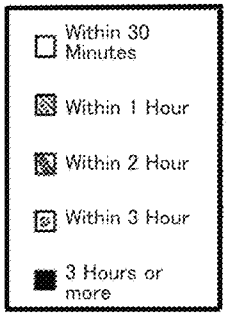
FIGS. 98A, 98B, 98C, and 98D are pie graphs showing ages of players by day (first to fourth days), respectively.
Figure 98B:
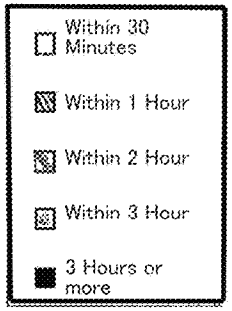
Figure 98C:
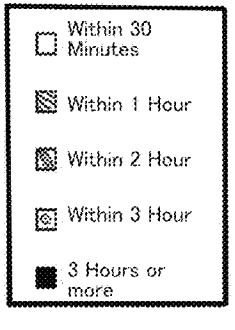
Figure 98D:
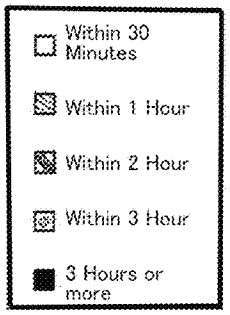
Figure 99A:
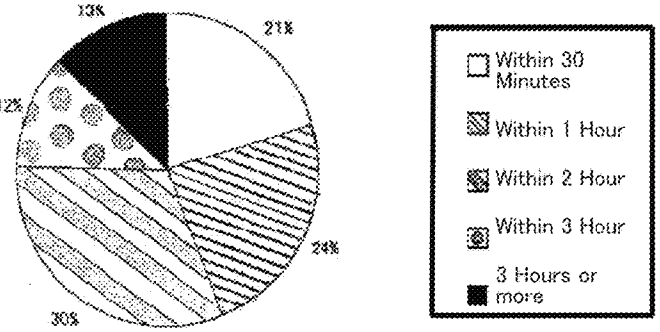
Figure 99B:
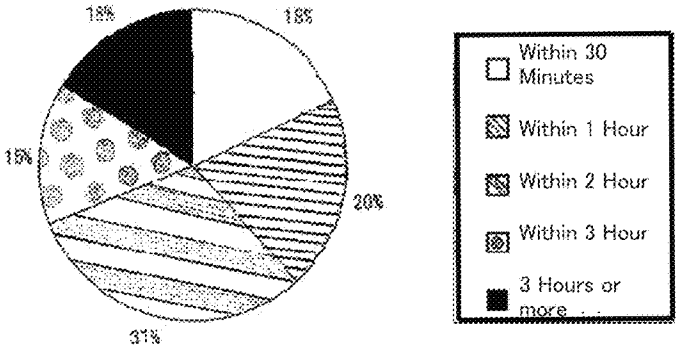
Figure 99C:
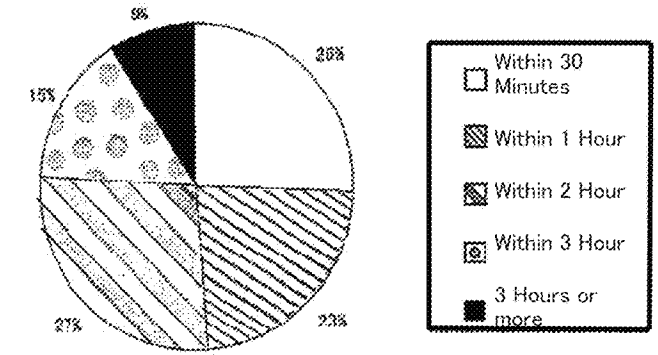
Figure 99D:
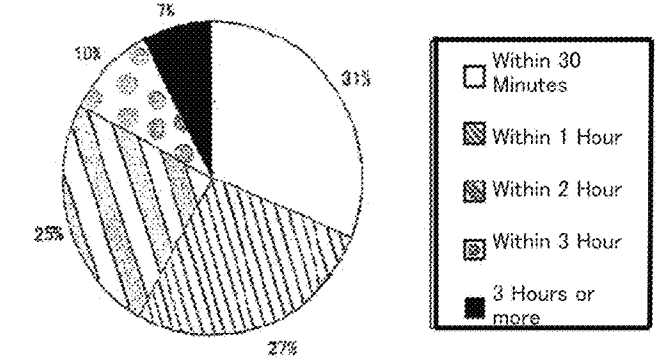
Figure 102A:
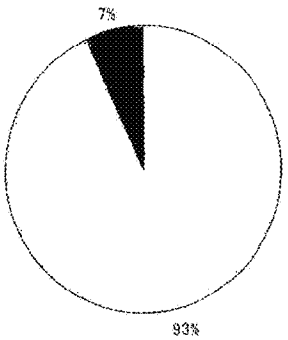
FIGS. 102A, 102B, 102C, and 102D are pie graphs showing sexes of players by day (first to fourth days), respectively.
Figure 102B:
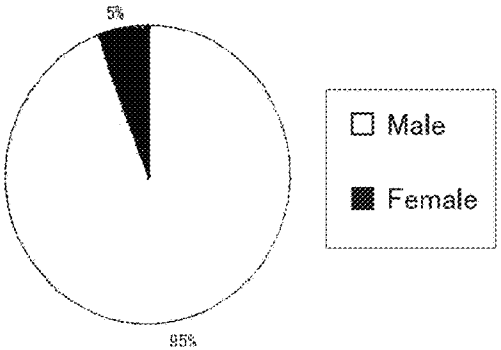
Figure 102C:
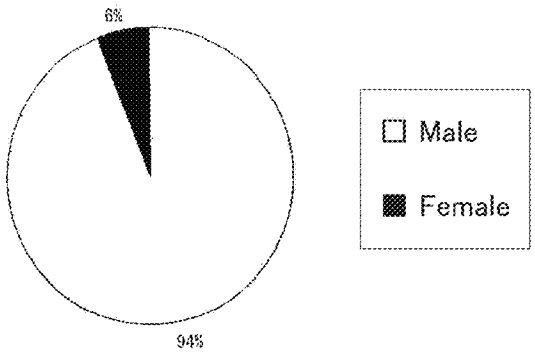
Figure 102D:
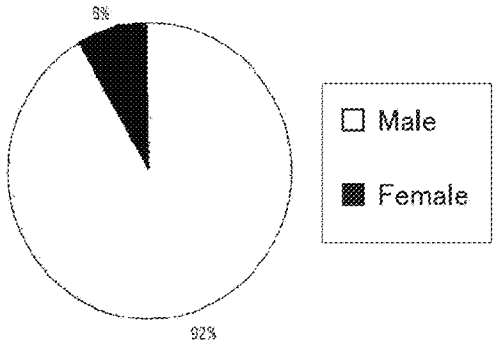
Figure 103A:
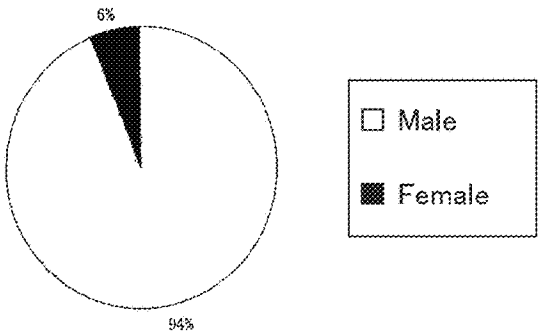
FIGS. 103A, 103B, 103C, and 103D are pie graphs showing sexes of players by day (fifth to eighth days), respectively.
Figure 103B:
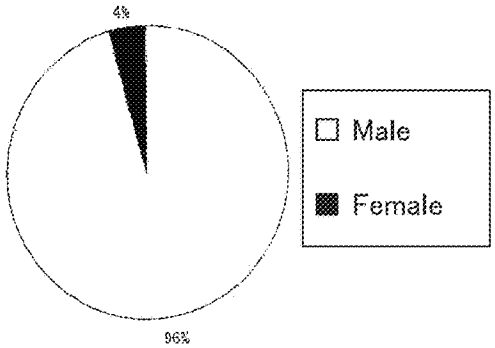
Figure 103C:
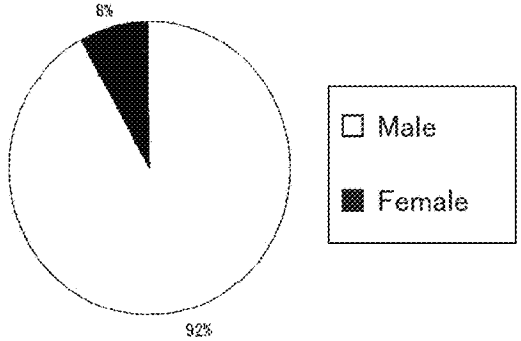
Figure 103D:
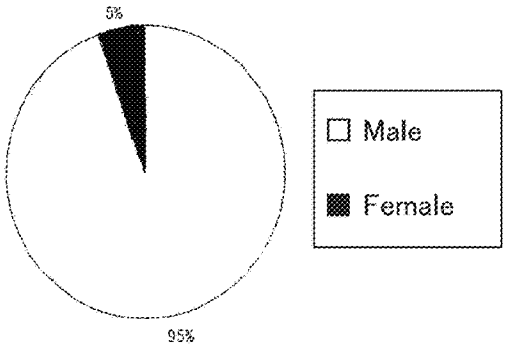
Figure 104A:
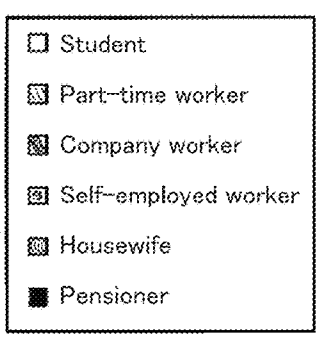
FIGS. 104A, 104B, 104C, and 104D are pie graphs showing attributes of players by day (first to fourth days), respectively.
Figure 104B:
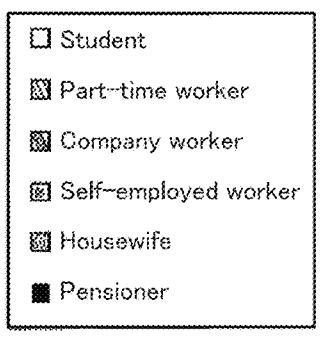
Figure 104C:
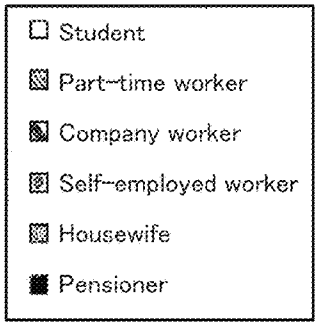
Figure 104D:
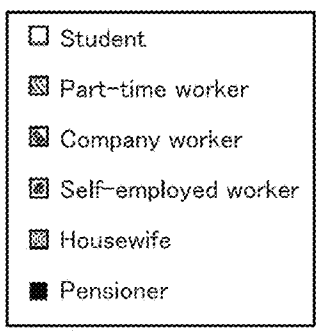

FIG. 92 is a graph depicting player use amount of money by day (first day) in shop α. FIG. 93 is a graph depicting player use amount of money by day (last day) in shop α.

As is evident from comparison between FIG. 92 and FIG. 93, the use amount of money per player is greater in first day than in last day. According to the game playing information system IS, such trend can be quantitatively grasped.

According to the game playing information system IS in shop α, as shown in FIG. 84 to FIG. 93, multi-angled analysis as to shop α is possible. In the present invention, the game playing information integration system IS is applied to a plurality of other shops, each game playing information integration system IS is connected via network, whereby the game playing information integration network system INS can be constructed.

FIG. 94 is a table showing data related to the number of players and winning rate or the like in shop β. FIG. 95 is a table showing data related to the number of players and winning rate or the like in shop γ. FIG. 96 is a table showing data related to the number of players and winning rate or the like in shop δ. FIG. 97 is a table showing data related to the number of players and winning rate or the like in shop ϵ.

Shop β is positioned in shopping street near university. Shop γ is positioned on road side. Shop δ is positioned in building in busy street near station. Shop ϵ is positioned in residential street.

According to the present invention, the game playing information integration system IS of each of shops α to ϵ is connected via network, and the game playing information integration network system INS is constructed, thereby enabling quantitative and objective data comparison between gaming facilities of which local area attributes are different from each other.

(Analysis of Player)

In the game playing information integration system IS, reception time data, player identification information, and the gaming machine unit identification information are stored in association with data output from a gaming machine unit 1. Therefore, customer category data is stored in association with the game playing identification information, thereby making it possible to perform data analysis by game playing time of player, data analysis by player's age, data analysis by player's sex, and analysis by attribute (customer category) or the like, for example.

FIGS. 98A, 98B, 98C, and 98D are pie graphs depicting game playing time per player by day (the first to fourth days), respectively. FIGS. 99A, 99B, 99C, and 99D are pie graphs showing game playing time per player by day (the fifth to eighth days), respectively.

FIGS. 100A, 100B, 100C, and 100D are pie graphs depicting player's age by day (the first to fourth days), respectively. FIGS. 101A, 101B, 101C, and 101D are pie graphs showing player's age by day (the fifth to eighth days), respectively.

FIGS. 102A, 102B, 102C, and 102D are pie graphs depicting player's sex by day (the first to fourth days), respectively. FIGS. 103A, 103B, 103C, and 103D are pie graphs showing player's sex by day (the fifth to eighth days), respectively.

FIGS. 104A, 104B, 104C, and 104D are pie graphs depicting player's attribute by day (the first to fourth days), respectively. FIGS. 105A, 105B, 105C, and 105D are pie graphs showing player's attribute by day (the fifth to eighth days), respectively.

As shown in FIG. 98A to FIG. 105D, according to the game playing information integration system IS, trends of players visiting gaming playing facility can be quantitatively and objectively grasped.

By means of quantitative and objecting grasping of data, if the gaming facility can quantitatively and objectively grasp that 10 players of which customer category is thought to have strong gambling mind, for example, visit the gaming facility at a peak time of one day with the use of data, the gaming facility can perform shop management of which loss is restrained to its required minimum, for example, by introducing 10 gaming machine of device type which is high in appearance probability of variation trend continuation period with its great difference number.

While the manager in gaming facility generally grasps trend or fashion of the business field, information grasped as to one's own gaming facility is not data statistically analyzed in a multi-angled manner. Therefore, for example, the manager is forced to rely on one-sided, qualitative or intuitive information when determining whether or not to require introduction of new device type, introduction number of new device types, timing of withdrawal of gaming machine, adjustment of number of gaming machines by device type, and setting of distribution of settings or the like. In such a situation, grasping of the flow or fashion of the entire business field may function negatively. For example, in a case where gaming machines are introduced which are very popular in the business field of gaming machine, and are evaluated as such excellent machines ruling the times, a gaming facility entailing slugging rise of sales will desire to recover sales by introduction of a large number of new device types. However, depending on a local area attribute (condition of location) of players who visit shop, the number of vacancies may increase by introducing a large amount of device types which are generally referred to as excellent machines. The present invention aims to sum and/or provide quantitative and objective data in order to eliminate such possibility to its required maximum.

(Determination of Identity of Player)

As described above, quantitative and objective data summing and/or provision can be performed by performing analysis of player, some players do not desire that their own information is known to gaming facility. The players who do not desire that their own information is known to gaming facility may not perform member registration, and such players often do not use or own their member cards. In such a situation, in an attempt is made to perform identification of player by means of only player's own card, precise data cannot be occasionally acquired in the strict sense. The present invention aims to identify that at least a player is changed in order to prevent an occurrence of such circumstance.

Figure 106:
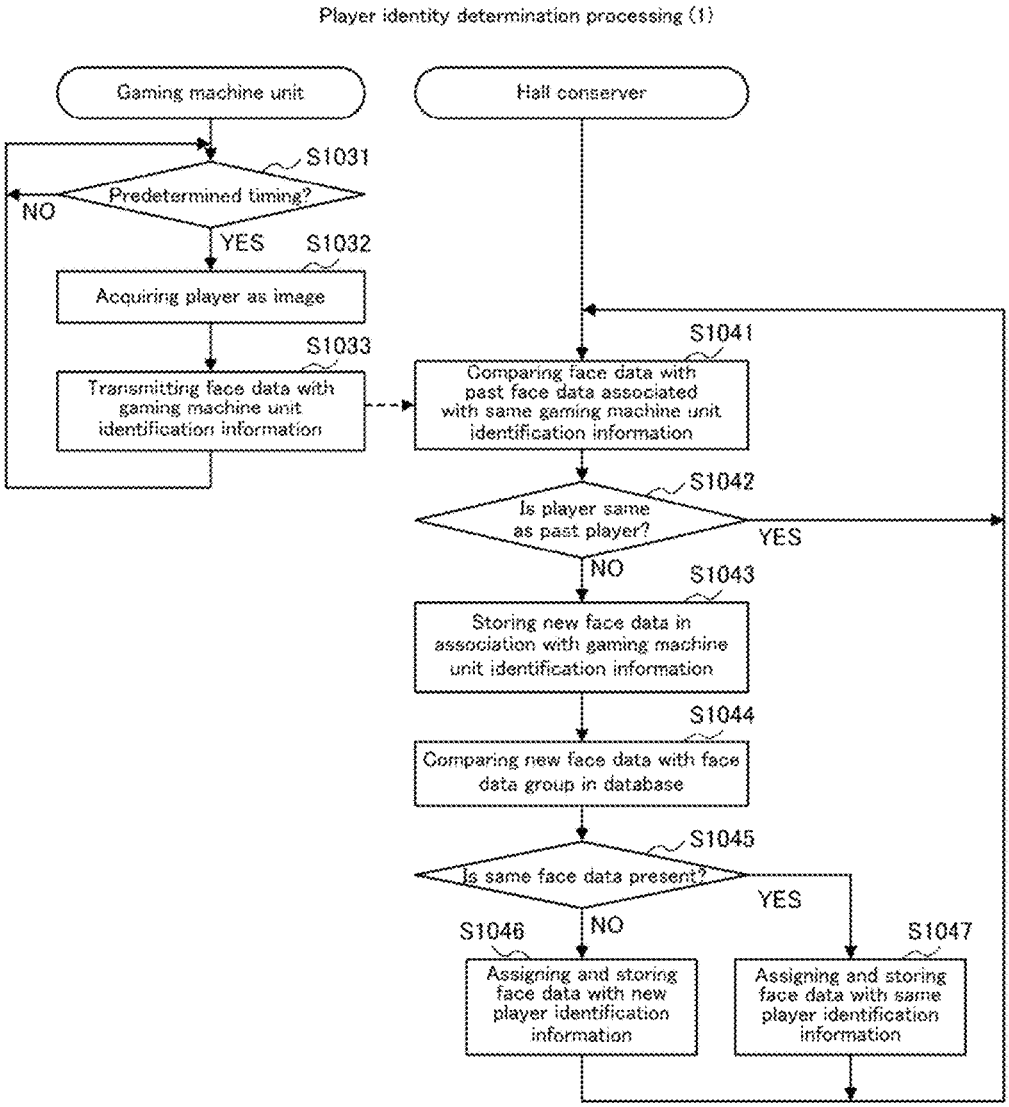
FIG. 106 is a flowchart showing player identity determination processing (1) executed by a gaming machine unit and the hall conserver shown in FIG. 21.

FIG. 106 is a flowchart showing player identity determination processing (1) executed by means of the gaming machine unit 1 and the hall conserver 60, shown in FIG. 21.

Herein, a CCD camera (not shown) as an image acquisition means is connected to a control portion 11 of a pachinko gaming machine 10, and the CCD camera is capable of perform data communication with the control portion 11 in a bidirectional manner, and is constituted so as to operate by means of an instruction from the control portion 11. Hereinafter, a case in which the gaming machine unit 1 includes the pachinko gaming machine 10 will be described, and however, the present invention is not limited to this example, and for example, can include a pachinko game playing machine and a slot machine or the like. The CCD camera as an image acquisition means functions as a player identification information reading means.

First, the control portion 11 (subsidiary control portion 11*b*) of the pachinko gaming machine 10 determines whether or not predetermined timing is reached (step S1031). The predetermined timing can include: timing every time predetermined period of time (for example, 10 minutes) elapses; and timing when event in the play of game (such as winning prize or occurrence of bonus game) takes place or the like.

In a case where no predetermined timing is reached, the routine reverts to step S1031, or alternatively, in a case where predetermined timing is reached, the control portion 11 controls the CCD camera to acquire a player as an image (step S1032).

Next, the control portion 11 transmits face data obtained by means of the step S1032 together with the gaming machine unit identification information to the hall conserver 60 (step S1033), and the routine is reverted to step S1031.

It is to be noted that in a case where the pachinko gaming machine 10 determines whether or not face data is included in the data obtained by means of step S1032 and then the face data is not included therein, no transmission may be performed. In addition, in a case where before performing the processing of step S1032, whether or not a player's face exists within the field of view of the CCD camera is determined from acquired data in a standby state of the CCD camera, and in a case whether the player's face does not exist, no image acquisition may be performed.

On the other hand, the control portion 62 of the hall conserver 60 compares the face data received from the gaming machine unit 1 with the past face data stored in association with the same items of gaming machine unit identification information, in the hard disk 65 (step S1041). As such a face data comparison technique, a conventional publicly known technique can be employed.

Next, based on a result of comparison in step S1041, the control portion 62 determines whether or not a player is the same (step S1042). In a case where the player is the same, it means that the player continuously plays game. In this case, the routine is reverted to step S1041. When the processing operations of step S1041 and S1042 is executed, the control portion 62 functions as a player identify determination means.

On the other hand, in a case where the player is not the same in step S1042, the control portion 62 stores new face data received from the gaming machine unit 1, in association with the gaming machine unit identification information (step S1043). In this manner, the game playing information integration system IS recognizes that the player playing game at the gaming machine unit 1 is a player associated with new face data.

Next, the control portion 62 compares the new device data with a face data group in the database of the hard disk 65 (step S1044). As to the face data comparison technique as well, a conventional publicly known technique can be employed.

Next, based on a result of comparison in step S1044, the control portion 62 determines whether or not face data associated with a player, which is the same as new face data, exists in the database in the hard disk 65 (step S1045).

In a case where it is determined that the face data associated with a same player does not exist in the hard disk 65 in step S1045, the control portion 62 stores new player identification information assigned to that face data, in the database in the hard disk 65 (step S1046). In this manner, the playing identification information is imparted to the player associated with the face data received in step S1041. Afterwards, the routine is shifted to step S1041.

In a case where it is determined that face data associated with a same player is present in the hard disk 65 in step S1045, the control portion 62 adds to that face data, player identification information which is the same as player identification information assigned to face data associated with the same player, and stores the resultant information in the database in the hard disk 65 (step S1047). In this manner, samples of the face data received in step S1041 are assigned. Afterwards, the routine is shifted to step S1041.

As described above, in the processing shown in FIG. 106, a face (face data) of a player is handled like player identification information by adding the player identification information to the face data, whereby even if a player does not perform member registration, start and completion of the play of game can be grasped.

Figure 107:
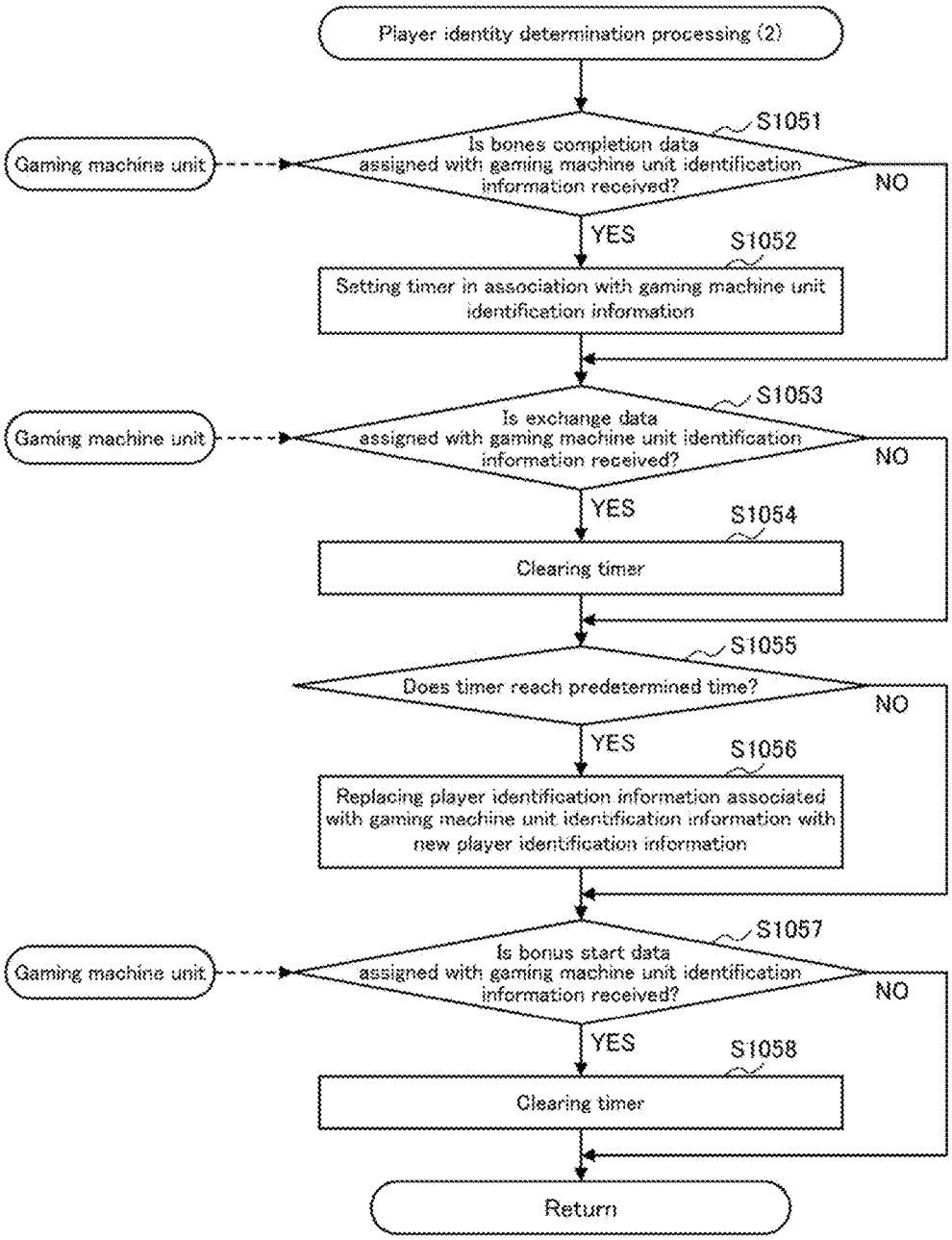
FIG. 107 is a flowchart showing player identity determination processing (2) executed in the hall conserver shown in FIG. 21.

The player identity determination processing in the present invention is not limited to the example shown in FIG. 106, and for example, may be the processing shown in FIG. 107. FIG. 107 is a flowchart showing player identity determination processing (2) executed in the hall conserver 60 shown in FIG. 21.

First, the control portion 62 of the hall conserver 60 determines whether or not bonus completion data to which the gaming machine unit identification information is assigned is received from a gaming machine unit 1 (step S1051). The bonus complete data is data output from the gaming machine unit 1 (pachinko gaming machine 10) together with the gaming machine unit identification information of the gaming machine unit 1 at the time of completion of bonus game or at the time of completion of the playing state of a game other than normal game playing state after bonus. After bonus game completion data has been output, a normal game playing state is started in the gaming machine unit 1.

In a case where it is determined that the bonus completion data is received in step 1051, the control portion 62 sets a timer in association with the gaming machine unit identification information in memory 64 (step S1052). This timer is counted up in accordance with a clock or the like of a CPU 63.

In a case where it is determined that the bonus completion game is not received in step S1051 or in the case where the processing of step S1052 is executed, it is determined whether or not exchange data to which the gaming machine unit identification information is assigned is received from the gaming machine unit 1 (step S1053). The exchange data is data output together with the gaming machine unit identification information of the gaming machine unit 1 when exchange of gaming media is performed from the gaming machine unit 1 (gaming medium lending device 20). In a case where exchange of gaming media is performed, it is predicted that the play of game is continued.

In a case where it is determined that exchange data is received in step S1053, the control portion 62 clears a timer set to memory 64 (step S1054). In a case where it is determined that exchange data is not received in step S1053 or in a case where the processing of step S1054 is executed, the control portion 62 determines whether or not the timer of the memory 64 reaches predetermined time (step S1055).

In a case where the timer reaches the predetermined time, in the gaming machine unit 1 exchange of gaming media is not performed, a normal game plating state continues over a predetermined period of time, and thus, there is a high possibility that the player completes the play of game. Therefore, the control portion 62 replaces player identification information associated with gaming machine unit identification information, with new player identification information (step S1056).

In a case where it is determined that the timer does not reach the predetermined time in step S1055 or in the case where the processing of step S1056 is executed, the control portion 62 determines whether or not bonus start data to which the gaming machine unit identification information is assigned is received from the gaming machine unit 1 (step S1057). The bonus start data is data output together with the gaming machine unit identification information of the gaming machine unit 1 at the time of start of bonus game from the gaming machine unit 1 (pachinko gaming machine 10).

In a case where it is determined that the bonus start data s received in step S1057, it means that a normal game playing state completes, and thus, the control portion 62 clears the timer of memory 64 (step S1058). In a case where it is determined that the bonus start data is not received in step S1057 or in a case whether the processing of step S1058 is executed the routine is completed.

As described above, in the processing shown in FIG. 107, in a case where exchange of gaming media is not performed over a predetermined period of time in a normal game playing state, it is determined that a player changes. The present invention can employ the processing shown in FIG. 108 in addition with the processing shown in FIG. 107.

Figure 108:
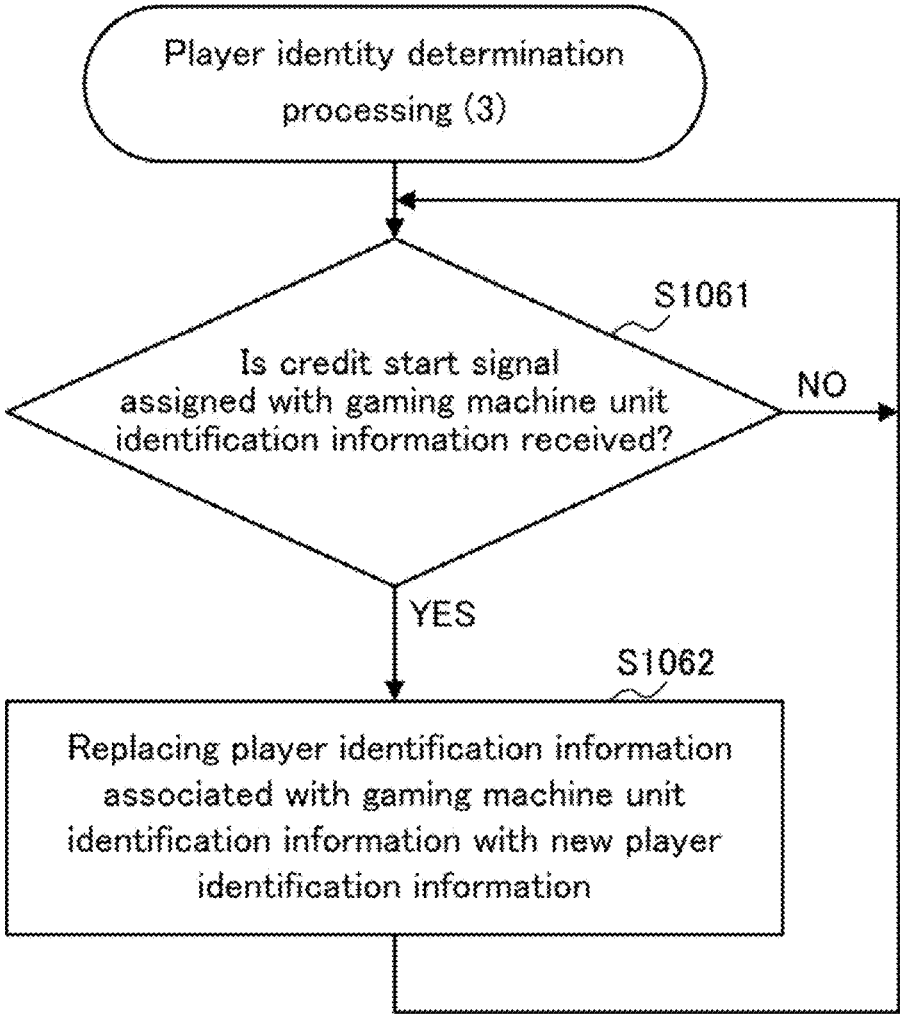
FIG. 108 is a flowchart showing player identity determination processing (3) executed in the hall conserver shown in FIG. 21.

FIG. 108 is a flowchart showing player identity determination processing (3) executed in the hall conserver 60 shown in FIG. 1. In the case of performing the processing shown in FIG. 108, the gaming machine unit 1 included in the game playing information integration system IS includes a pachinko/slot gaming machine (not shown) in place of the pachinko gaming machine 10.

In the processing shown in FIG. 108, first, the control portion 62 determines whether or not a credit start signal to which the gaming machine unit identification information is assigned is received from the gaming machine unit 1 (step S1061). The credit start signal is a signal output when crediting is started in the gaming machine unit 1 (pachinko/slot gaming machine). In general, when a player plays game at the pachinko/slot gaming machine, the player enters coin into the pachinko/slot gaming machine to make credit, and then, continues the play of game by appropriately resupplying coins so as not to be 0 credits; and therefore, in a case where the credit increases from 0, it is possible to determine that the play of game is started.

In a case where it is determined that no credit start signal is received in step S1061, the routine is reverted to step S1061. On the other hand, in a case it is determined that the credit start signal is received in step S1061, the control portion 62 replaces player identification information associated with gaming machine unit identification information, with new player identification information (step S1062), and then, the routine is completed.

While the embodiment described a case in which a gaming machine unit 1 includes a pachinko gaming machine 10, a gaming medium lending device 20, and an individual counting device 30, the present invention is not limited to this example. The gaming machine unit may include a pachinko/slot gaming machine and a medal lending machine. In addition, the gaming machine unit may be a gaming machine.

FIGS. 109 to 121 show an example indicating a state that data obtained by the game playing information integration system shown in FIGS. 1 to 20 below is outputted from the servers or gaming machine units to external portions via cable or wireless communication lines, and the outputted data is displayed on a display screen. For example, it is an explanatory view showing display screen data generated based on the data obtained from the block of the analysis processing as analysis processing means shown in FIG. 1, and the data being displayed on the display screens of personal computers installed in the gaming facility and cellular phones connected via the internet and other communication lines (not shown).

FIGS. 109 to 121 (excluding FIGS. 113, 115A, 115B, 115C, 115D, 116, 118A, 118B, 118C, and 118D) show four types of tabs: "home" "real time analytics" "past analytics" "prediction analytics". Outputted data shown below can be displayed as an image by selecting the four tabs with a pointer. This displayed image can be visually confirmed by the manager operator of the gaming facility in a state which allows visual confirmation of the state of the gaming facility. Therefore, the management and business states of the gaming facility can be grasped by even a manager or an operator with little experience who is not able to grasp the state of the gaming facility correctly from numerical value and the like.

The outputted data is provided from the game playing information integration system stated below.

This is, the game playing information integration system has a plurality of gaming machine units, and servers connected in communication with the gaming machine units as its basic components.

The game playing information integration system is provided with game initiation or completion data output means which outputs a game initiation or completion data for cumulatively monitoring the number of times of games executed by the server for each game by the execution of the game by the execution of games in the gaming machine unit.

The server is provided with data storage means which stores a communication interface for communicating with the gaming machine unit, the game initiation or completion data outputted by the game initiation or completion data output means, and receipt time data indicating the time of receipt of the data in association with each other, and stores in advance map layout display image data of the gaming facility, location information of the gaming machine units displayed in the map layout display image, and when data is received from the gaming machine unit, lookup data with identification information for each gaming machine unit included in the data, analysis processing means which performs analysis of data received from the gaming machine unit and stored in the data storage means, and output means which generates image data depending on the results analyzed by this analysis means and outputs the data to an external portion.

The analysis processing means generates the cumulative value the game initiation or completion data for each gaming machine unit based on data stored in the data storage means. The output means executes a processing for outputting the image of the mark corresponding to the location information of each gaming machine unit of the outputted map layout display image as an image data which is varied depending on the cumulative value. For example, the slot machine is indicated by the symbol □ in FIG. 109, and with reference to table data having color data which is changed at every unit time unit associated therewith, the color within the symbol □ is changed depending on the operational state calculated in real time.

Figure 109:
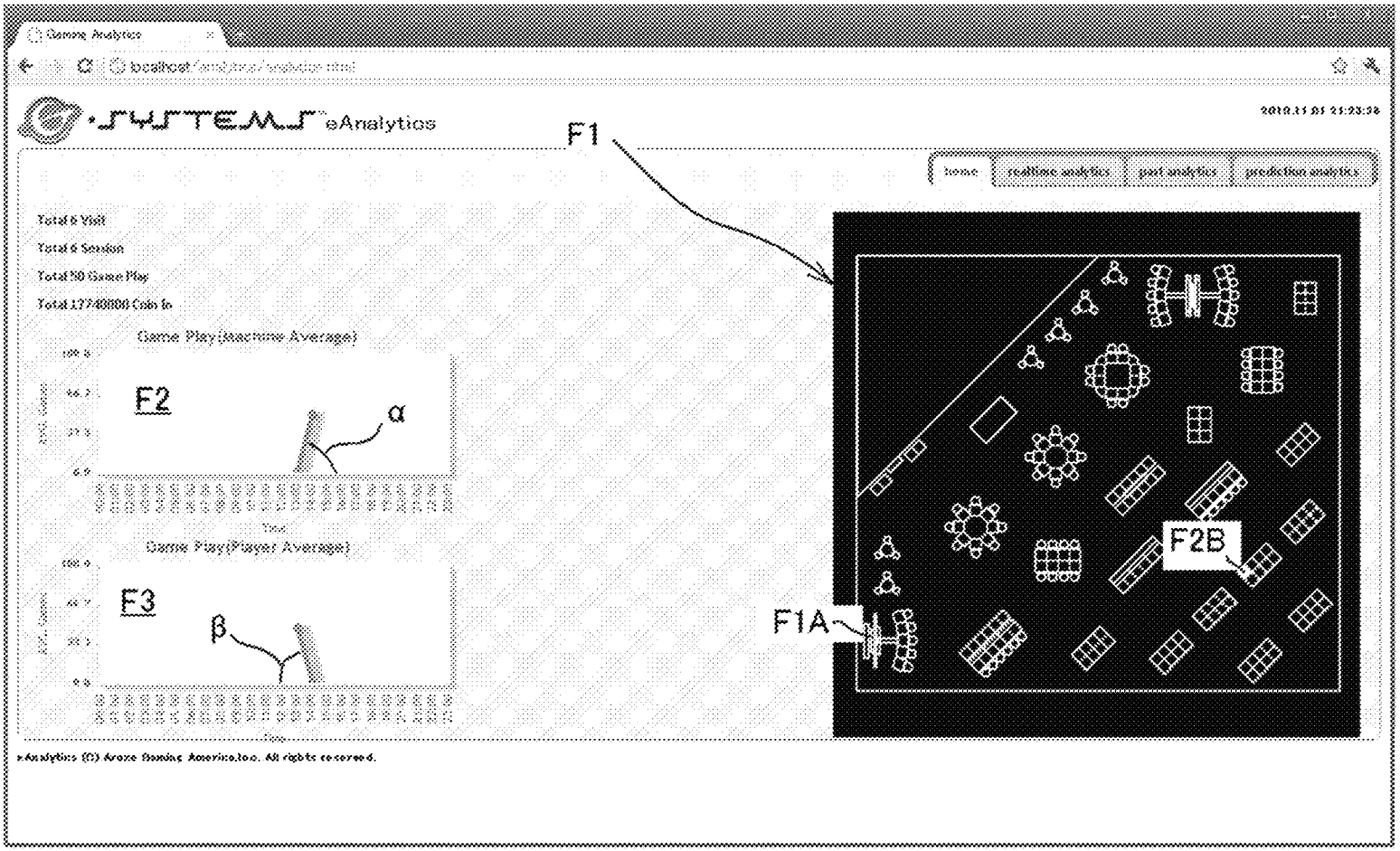
FIG. 109 is an explanatory view indicated on display screens of personal computers which produce display screen data based on the data obtained from the analysis processing as the analysis processing means of FIG. 1 and are installed in the gaming facility (not shown) and of cellular phones connected via the internet and the like. This explanatory view is a view indicated when "home" is selected among "home", "real time analytics", "past analytics", and "prediction analytics" indicated on the display screen.

FIG. 109 shows the state that the cumulative value of such game initiation or completion data for the gaming machine units is generated, and the output means executes a processing of outputting an image of the location information of each gaming machine unit in the outputted map layout indication image as an image data changed depending on the cumulative value.

Specifically, the area surrounded by a white frame of reference numeral F1 indicates the installation area of the gaming machine units indicating the entire gaming facility, and reference numeral F2 represents a line graph of the operability of the game units of the entire gaming facility by time unit. In addition, reference numeral F3 indicates the rate of game execution by time unit of a player visiting the gaming facility. In order to reflect the operability and rate of execution by time unit on the image data, communication for transmitting information is performed once every few seconds between the game unit and server. In this case, the amount of information transmitted is minimized by transmitting only the difference of information from the information transmitted previously to the server, along with the identification information of the game unit only.

In addition, the communication time may be so constituted to be set individually for each game unit to perform the game. In such a case, the set time can be set to be shorter than the shortest game playing time when the game is executed in each game unit, whereby the risk of erroneously summing the gaming information across two games as the gaming information for one game can be decreased.

It should be noted that, in this embodiment, the gaming machine unit corresponds to a slot machine and a gaming machine, and the gaming machine includes devices for executing games which uses Baccarat, cards, or dices.

In the installation area F1 of the gaming machine units slot machines and gaming machines other than slot machines are indicated, and are indicated by using mark images having similar shapes recognized when seeing from the information gaming machines including slot machines installed in the gaming facility. For example, reference numeral F1A is a gaming machine unit for executing a roulette game and a card game. Reference numeral F2B is a mark indicating a single slot machine, and eight slot machines are disposed in a single slot machine disposition mount.

The operability of the overall gaming machine units can be checked with F2, while the colors of the mark image displayed on the map layout display image of the gaming facility of F1 are made different so that by different colors for game units with high operability and those with low operability. This allows the manager and the operator who visually check the display screen to grasp the operational state of the entire gaming facility in the graph of F2, and also grasp the operational states of the respective game units while visually checking the colors of the mark images of the game units. For example, in FIG. 141, when the slot machine as the game unit corresponding only to the mark of reference numeral F2B is operated, the color of the portion of the mark (□) only changes to a that different from those of the marks of other gaming units.

In addition, changes in the state can be grasped while visually checking the angle α of the increase trend of F2 and the angle μ of the decrease trend of F3.

The game playing information integration system of this embodiment has a display screen which displays an image data generated by changing the image of the location information of the gaming machine units depending on the cumulative value in the map layout display image outputted by the above-described output means, and displays the installation area F1 of the above-described game unit on this display screen.

In addition, the game playing integration system of this embodiment grasps the number of all players from the player identification information transmitted from the gaming machine units by the analysis means, generates an average rate of game execution of the players by time unit, generates the operabilities of all game units by time unit, and generates a graph image data from the rates of game execution and operabilities by the output means and outputs the data to an external portion, whereby the graphs of F2 and F3 mentioned above are displayed on the display screen.

Figure 110:
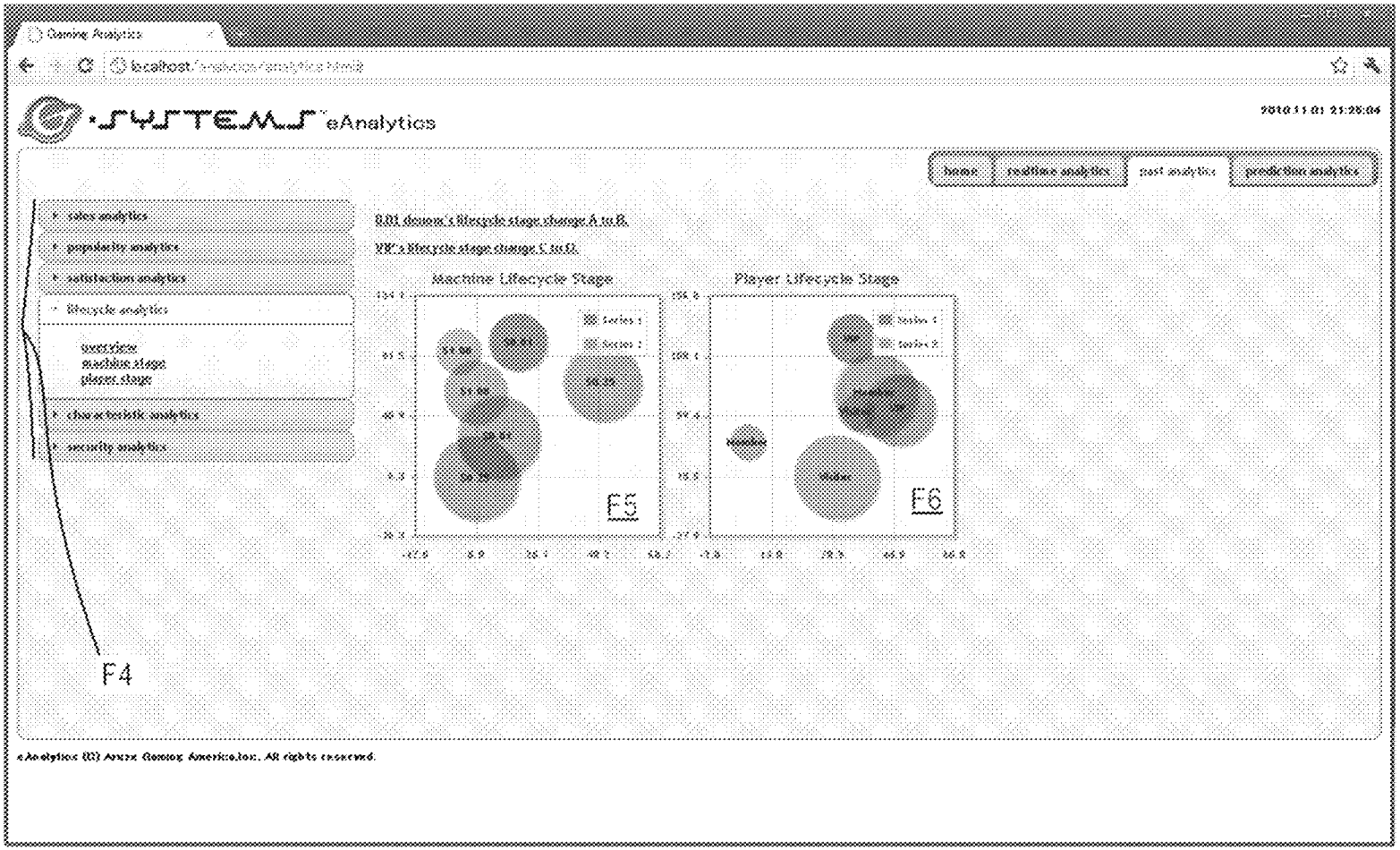
FIG. 110 is an explanatory view indicated on display screens of personal computers which produce display screen data based on the data obtained from the analysis processing as the analysis processing means of FIG. 1 and are installed in the gaming facility (not shown) and of cellular phones connected via the internet and the like. This explanatory view is a view indicated when "past analytics" is selected among "home", "real time analytics", "past analytics", and "prediction analytics" indicated on the display screen.

While FIG. 109 is a display screen displayed when "home" is selected, FIG. 110 is displayed when "past analytics" is selected among "home", "real time analytics", "past analytics", and "prediction analytics".

At reference numeral F4 to the left in the layout of FIG. 110, six menus are indicated: "sales analytic", "popularity analytics", "satisfaction analytics", "lifecycle analytics", "characteristic analytics", and "security analytics", and which allow display of a display image in the selected analytic form by selecting any one of them. The menu indicated here is "life cycle analytics".

F5 is a figure corresponding to FIG. 14 described later, in which players are grouped and indicated by denomination (unit game playing value). The types of the denominations are three: "$0.01", "$1.00", and "$0.25", which are further indicated in different colors of circles depending on the type of the gaming machines. In the figure, no difference is found as the indication is in monochrome, but one of indications of the same denomination is a circle of Series1 type gaming machine, while the other is a circle of Series2 gaming machine. Any circle of gaming machine is not excluded from being a slot machine. In F5, the groups of circles disposed more upper right can be determined to have higher degree of satisfaction.

In addition, F6 is a figure corresponding to FIG. 12 described later. Based on the game playing information obtained from the game units along with the player identification information, a graph is generated by the vertical axis indicating the visit frequency of player, and the horizontal axis indicating the consumed amount of money by a player. In addition, the groups "VIP" "MEMBER", and "VISITOR" determined in advance on the game playing information integration system side for each of the two series are indicated as single groups, respectively.

F5 and F6 the area of a group indicated by a circle indicates the numbers of applicable game units and players.

Figure 111:
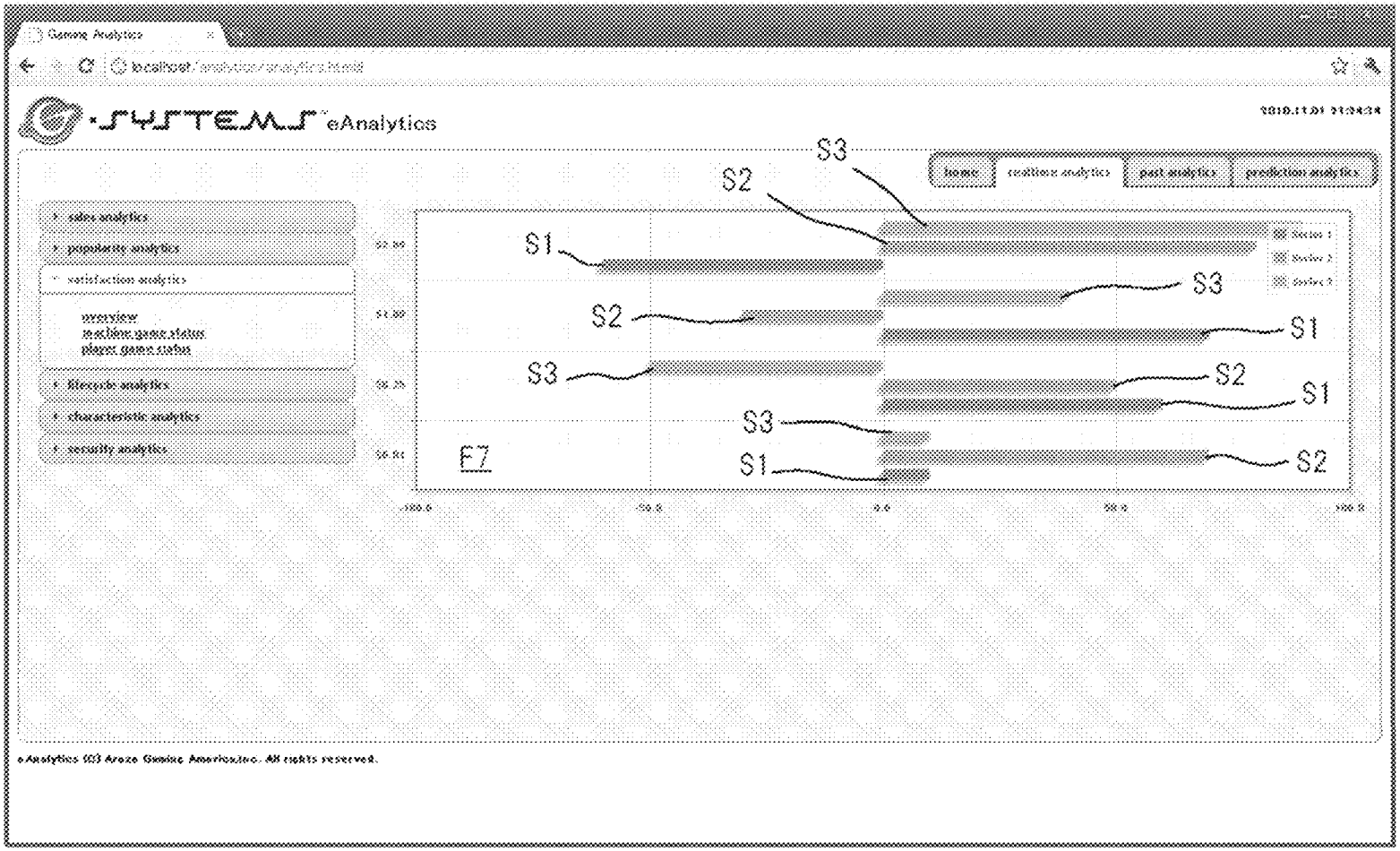
FIG. 111 is an explanatory view indicated on display screens of personal computers which produce display screen data based on the data obtained from the analysis processing as the analysis processing means of FIG. 1 and are installed in the gaming facility (not shown) and of cellular phones connected via the internet and the like. this explanatory view is a view indicated when "real time analytics" is selected among "home", "real time analytics", "past analytics", and "prediction analytics" indicated on the display screen.

FIG. 109 is a display screen displayed when "home" is selected, while this FIG. 111 is a figure displayed when "real time analytics" is selected among "home", "real time analytics", "past analytics", and "prediction analytics".

At F7 of FIG. 111, six menus are displayed on the left side of the layout. These six menus are: "sales analytic" "popularity analytics" "satisfaction analytics" "lifecycle analytics" "characteristic analytics", and "security analytics". FIG. 111 show a state that "satisfaction analytics", among these, is displayed.

In addition, the bar graph at F7 has denominations shown on the vertical axis, and is indicated in three series. No difference in display is found between the three series as the figure is in monochrome, but reference numeral S1 indicates series1; reference numeral S2 indicates series2; and reference numeral S3 indicates series3.

Figure 112:
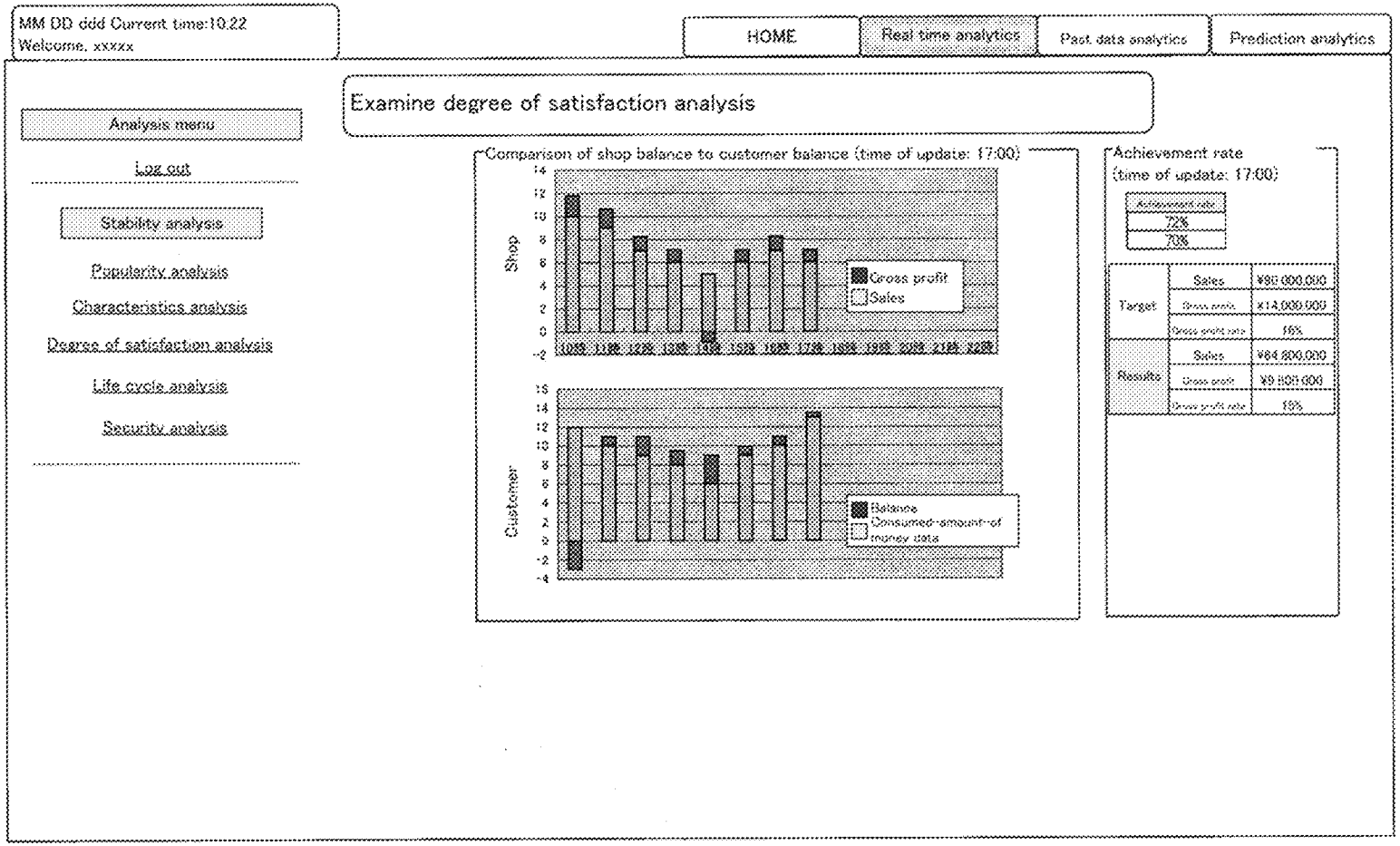
FIG. 112 is a view indicated when "real time analytics" is selected as in FIG. 111.

FIG. 112 is a figure displayed when "real time analytics" is selected as FIG. 111. This FIG. 112 is a figure which shows "sales analytic" (stability analytics), among "sales analytic" "popularity analytics" "satisfaction analytics" "lifecycle analytics" "characteristic analytics" "security analytics".

Figure 113:
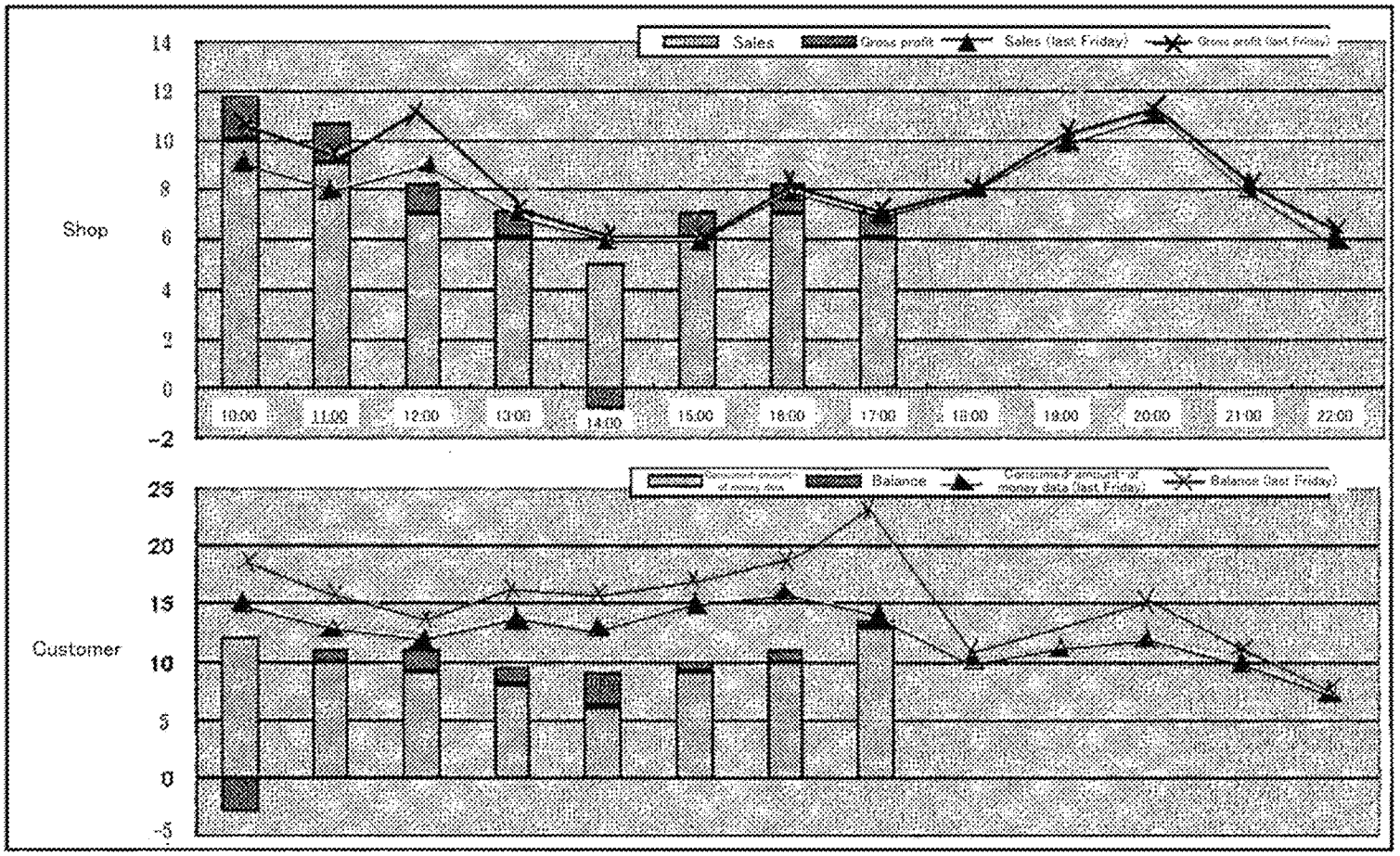
FIG. 113 shows a graph of the results of comparison between today and yesterday.

FIG. 113 shows a graph of the results of comparison between today and yesterday. The feature in this graph lies in that today's results and yesterday's results, which are in the past, are indicated by a bar graph and a line graph, respectively and the comparison between today and yesterday is indicated by graphs in the different forms. By indicating in different graph forms the results from the present and the past to be compared in such a manner, discrimination of the graphs of the present and the past displayed on the display screen can be improved.

Data are summed in such a manner that the results in the shop correspond to the sales and gross profit, while the results of the customer as the player correspond to the consumed amount of money and balance.

Figure 114:
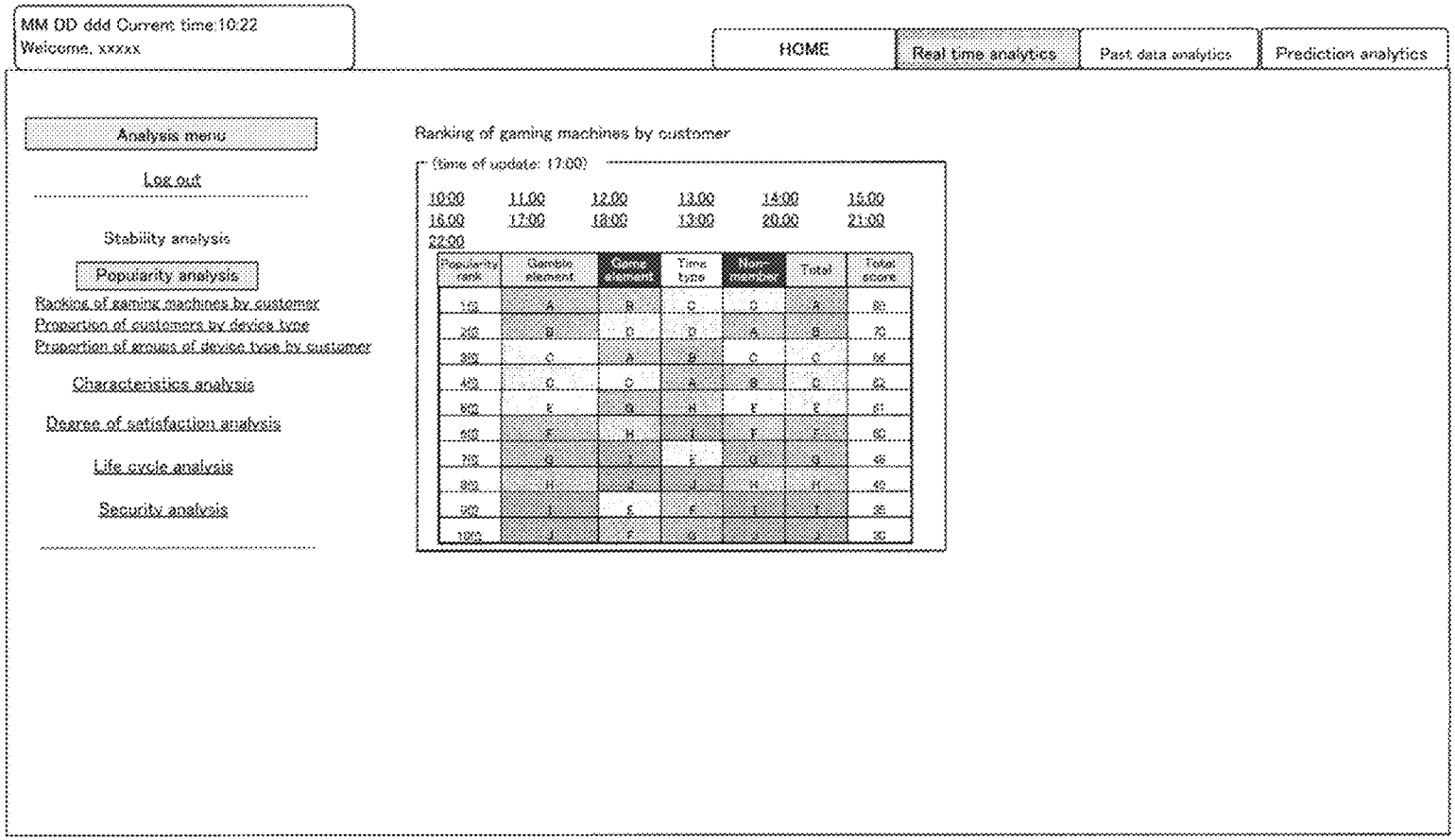
FIG. 114 is a view indicated when "real time analytics" is selected as in FIG. 111.

FIG. 114 is a figure displayed when "real time analytics" is selected as FIG. 111. This FIG. 114 is a figure which indicates "popularity analytics" (popularity analysis), among "sales analytic" "popularity analytics" "satisfaction analytics" "lifecycle analytics" "characteristic analytics" "security analytics".

The popularity analysis, as displayed on the left side of the layout of the display screen, is programed to switch display by designating "ranking of gaming machines by customer", "proportion of customers by device type", and "proportion of customers by device type group" with a pointer (not shown). FIG. 114 shows the state that "ranking of gaming machines by customer" is displayed. Image data of tables linking to the times of updates are generated and stored in a storage area (not shown) so that the ranking of gaming machines by customer can be displayed at the times of update 10 o'clock, 11 o'clock, 12 o'clock, 13 o'clock, 14 o'clock, 15 o'clock, 16 o'clock, 17 o'clock, 18 o'clock, 19 o'clock, 20 o'clock, 21 o'clock, and 22 o'clock. FIG. 114 shows the image data of the table of the ranking of gaming machines by customer updated at 17 o'clock.

Figure 115A:
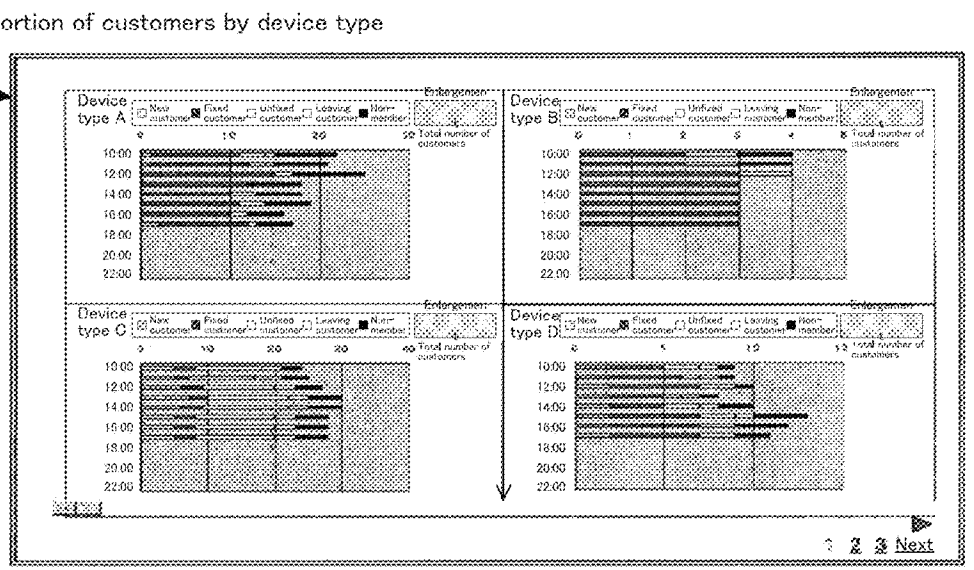
FIGS. 115A, 115B, and 115C are views indicated when "real time analytics" is selected as in FIG. 111.
Figure 115B:
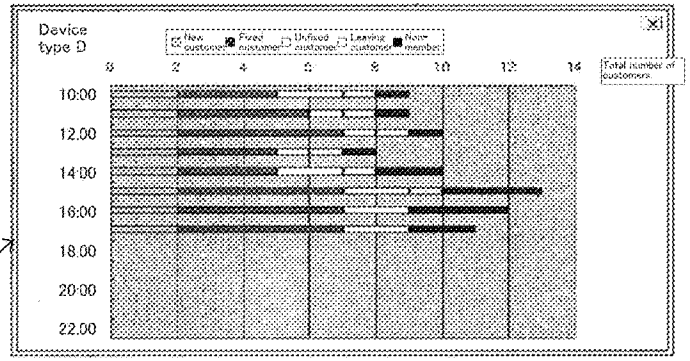
Figure 115C:
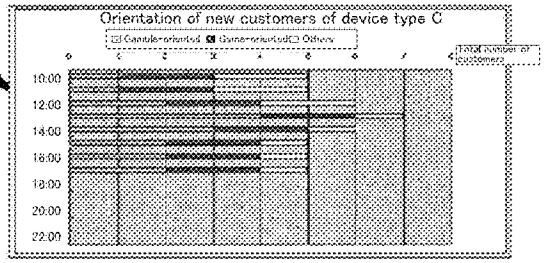

FIG. 115A shows the case where "ranking of gaming machines by customer" is selected among the three options: "ranking of gaming machines by customer", "proportion of customers by device type", and "proportion of customers by device type group" of FIG. 114. In addition, FIG. 115B shows, in a state that the image data as F10 is displayed, a state that display of device type D is selected by designating the enlarge button of device type D with a pointer, among the enlarge buttons on an upper right portion device type A, device type B, device type C, and device type D. The image data of the table of F9 is displayed on the display screen at this time. FIG. 115C show a table F11 which indicates the orientation of new customers of device type C (for example, "gambling elements" involving pursuing large sums by winning big or losing big; "gaming elements" involving pursuing fun of the game itself rather than winning or losing; and "others" involving pursuing beautiful appearance, preference of characters and other factors).

Figure 116:
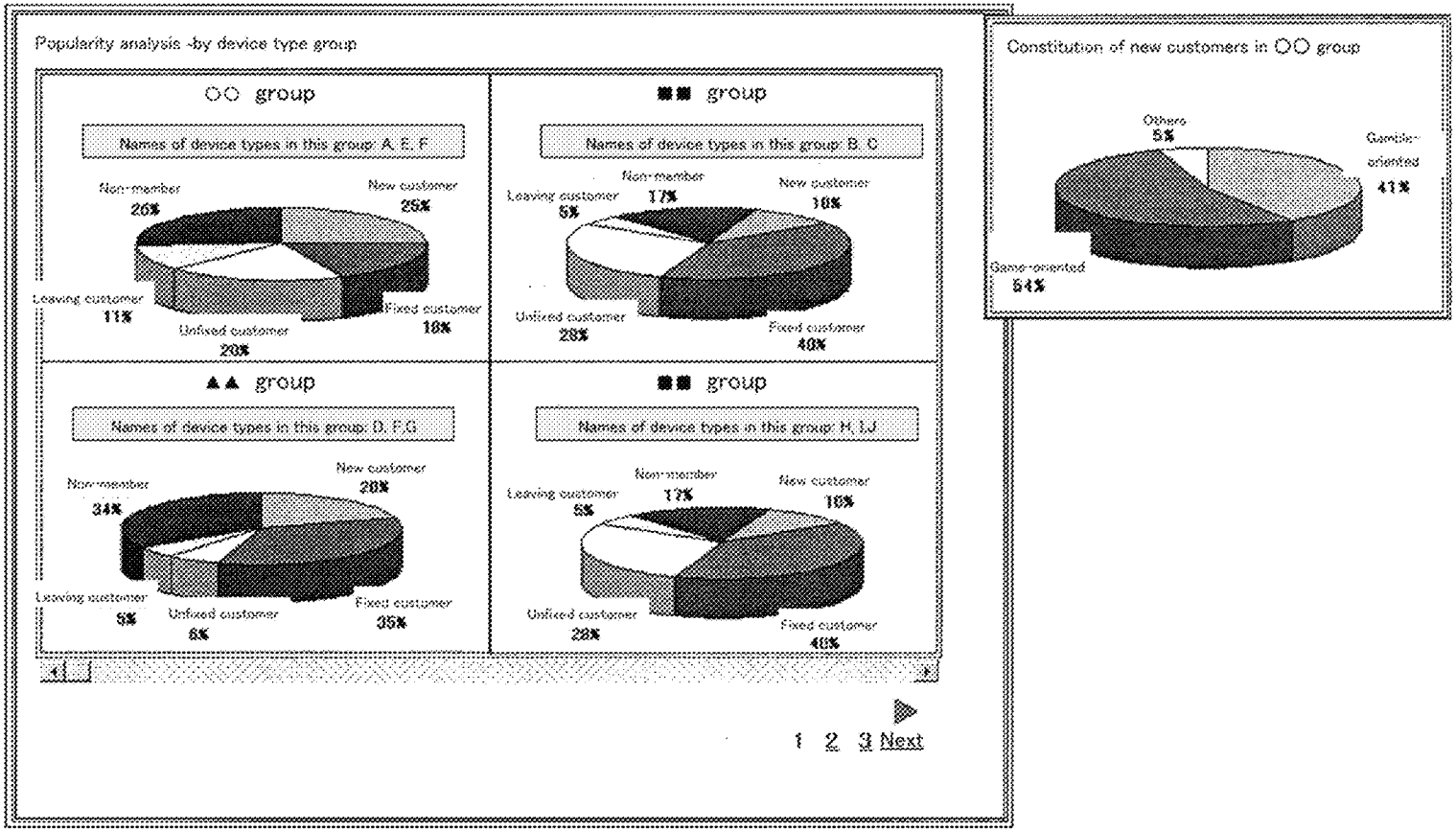
FIG. 116 is a view indicated when "real time analytics" is selected as in FIG. 111.

FIG. 116 is a figure displayed when "real time analytics" is selected as FIG. 111. It also shows the case where "proportion of customers by device type" is selected, among the three options: "ranking of gaming machines by customer", "proportion of customers by device type", and "proportion of customers by device type group" of FIG. 114 displayed after designating the popularity analysis. Described in more detail, device types A to J are grouped by their characteristics, and the proportions of customers in the respective groups is displayed on the display screen in the image of a pie graph.

Figure 117:
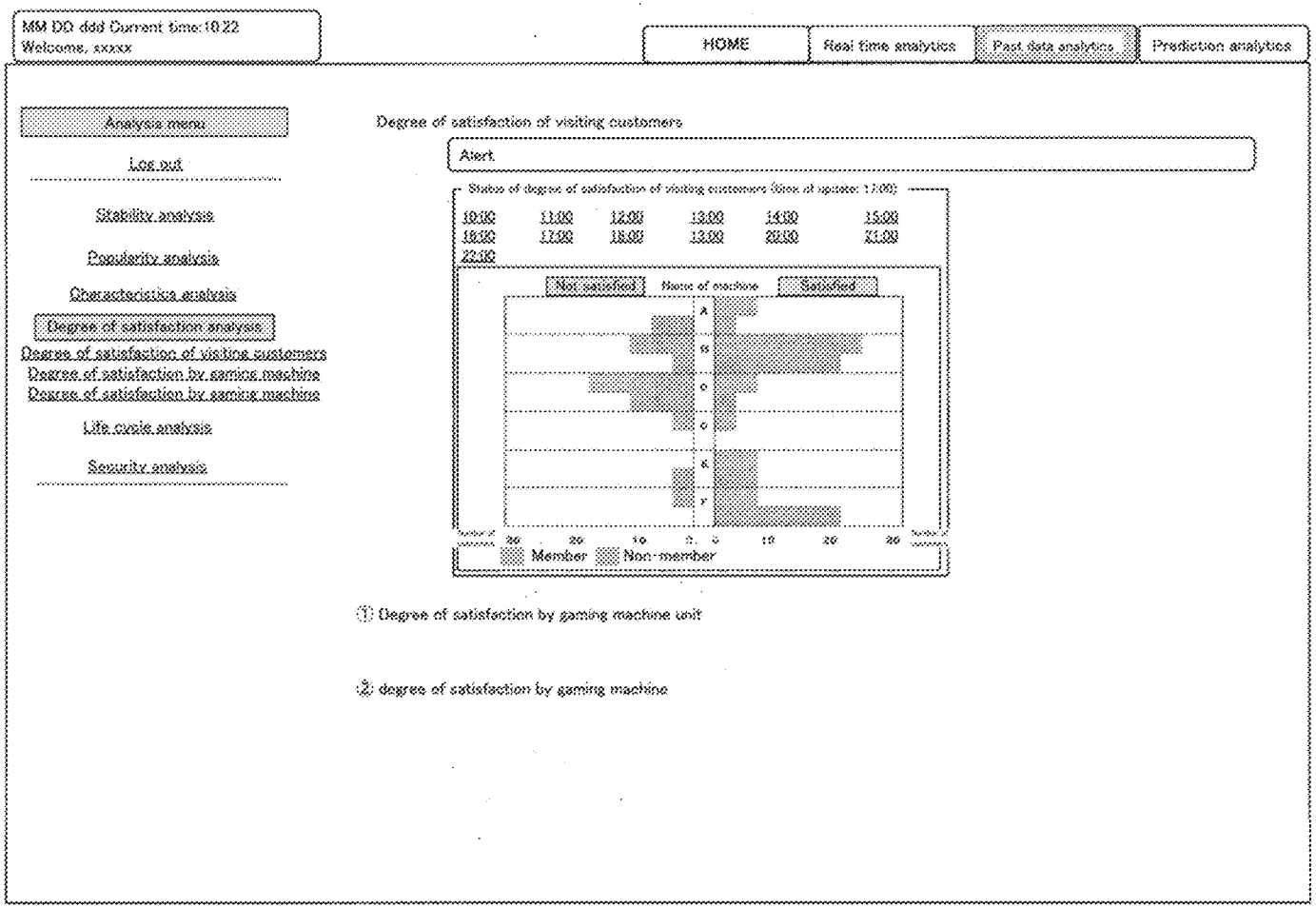
FIG. 117 is an explanatory view indicated on display screens of personal computers which produce display screen data based on the data obtained from the analysis processing as the analysis processing means of FIG. 1 and are installed in the gaming facility (not shown) and of cellular phones connected via the internet and the like. This explanatory view is a view indicated when "past analytics" is selected among "home", "real time analytics", "past analytics", and "prediction analytics" indicated on the display screen.

FIG. 117 is an explanatory view showing display screen data generated based on the data obtained from the analysis processing as analysis processing means shown in FIG. 1, and the data being displayed on the display screens of personal computers installed in the gaming facility and cellular phones connected via the internet and the like (not shown). This explanatory view is a figure displayed when "past analytics" is selected among "home", "real time analytics", and "past analytics" "prediction analytics" displayed on the display screen.

In addition, FIG. 117 shows a screen when, after "past analytics" is selected, "stability analytics", "popularity analysis", "satisfaction analytics", "life cycle analysis", and "security analytics" in the analytics menus are displayed, "satisfaction analytics" in these options is designated, and further "degree of satisfaction of visitors" is selected the options among "degree of satisfaction of visiting customers", "gaming apparatus the degree of satisfaction", and "degree of satisfaction of gaming machine". FIG. 117 indicates the degree of satisfaction by the non-member and member for each gaming apparatus (device type of machine) as a game unit in a bar graph. FIG. 117 displays the degree of satisfaction updated at 17 o'clock. The degrees of satisfaction of visiting customers at the times of update at 10 o'clock, 11 o'clock, 12 o'clock, 13 o'clock, 14 o'clock, 15 o'clock, 16 o'clock, 18 o'clock, 19 o'clock, 20 o'clock, 21 o'clock, and 22 o'clock can be displayed.

Figure 118A:
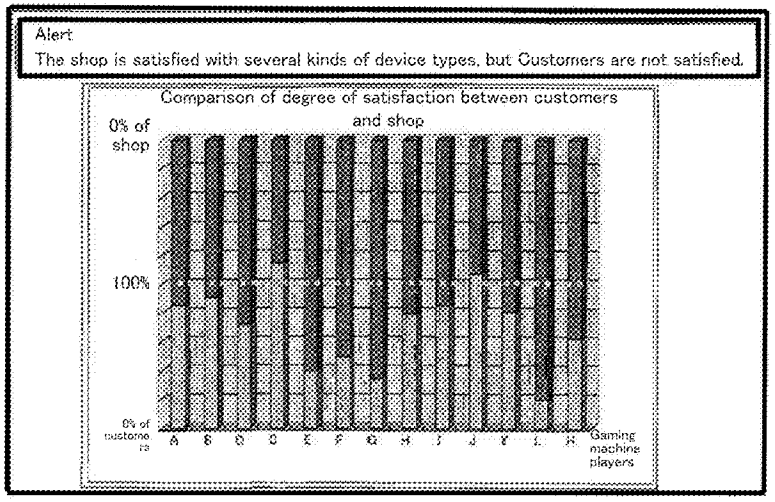
FIG. 118A shows "degree of satisfaction of gaming apparatus"
Figure 118B:
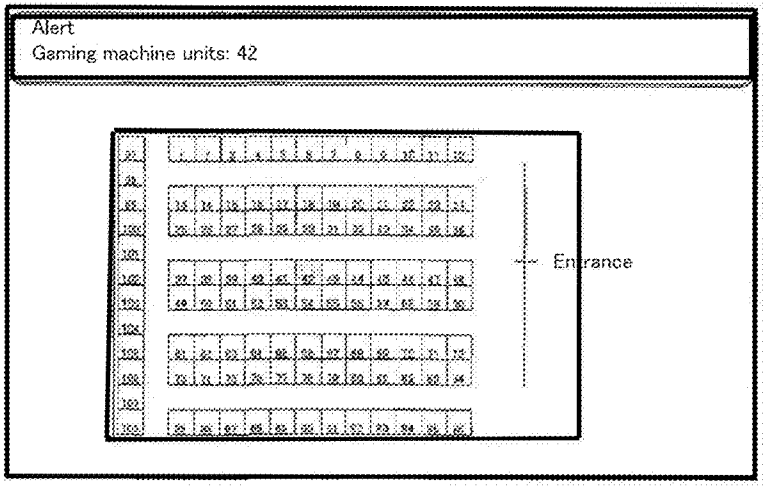
FIG. 118B shows "degree of satisfaction of gaming machine".

As for FIGS. 118A and B, while FIG. 117 shows a screen displayed when "the degree of satisfaction of visitors" is selected, FIG. 118A shows "the degree of satisfaction of gaming apparatus", and FIG. 118B shows "the degree of satisfaction of gaming machine". The degree of satisfaction of gaming apparatus of FIG. 118A is the proportion of the degrees of satisfaction of the shop and the customers for each device type of the gaming machine included in the game unit, and is indicated in the form of a bar graph in the figure. In the degree of satisfaction by gaming machine of FIG. 118B, as shown in the figure, a mark for each gaming machine is indicated on the layout of the gaming facility, and marks are indicated in varied modes for different degrees of satisfaction for each of the gaming machines.

Figure 119:
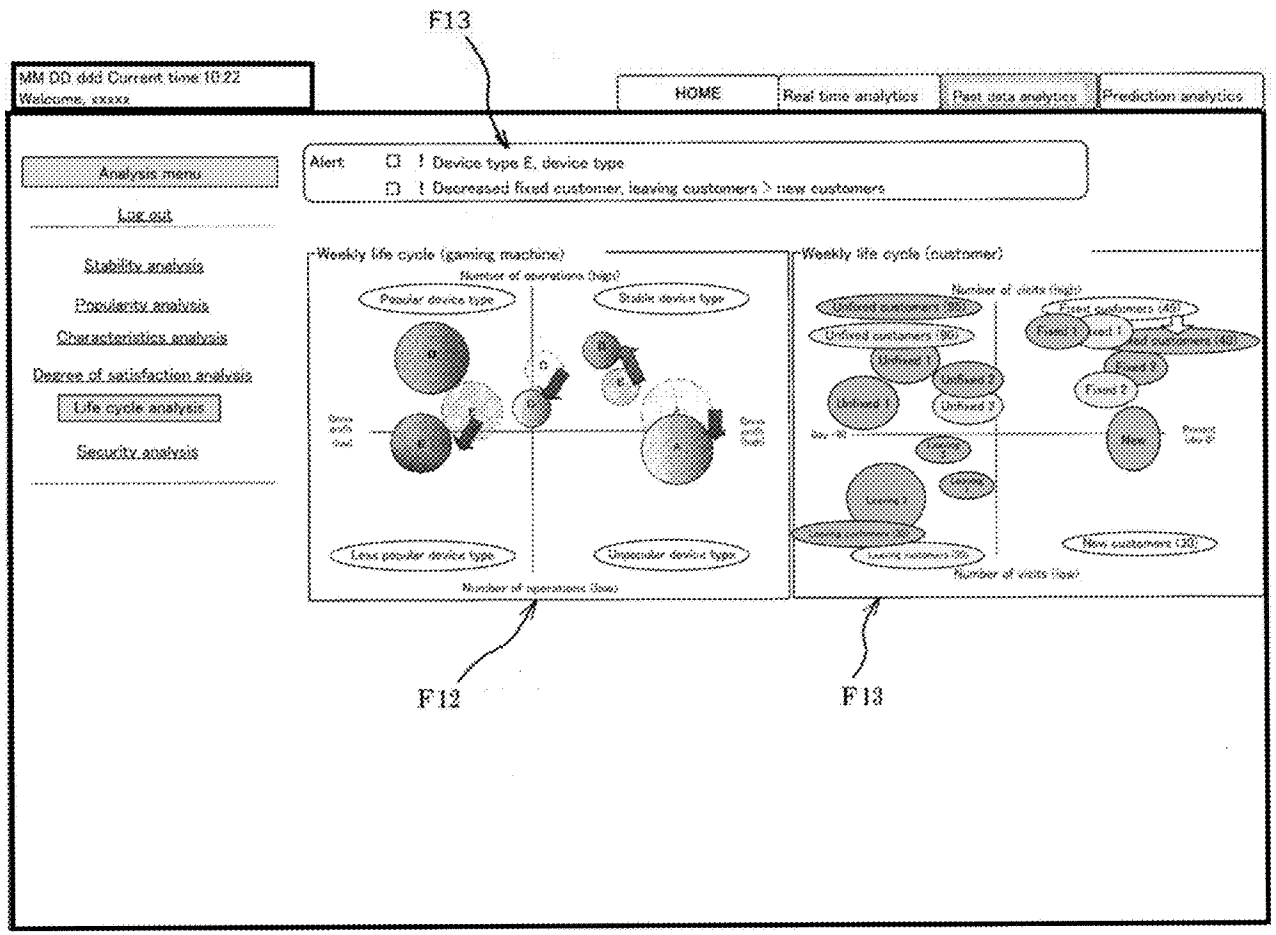
FIG. 119 is a view indicated when "past analytics" is selected as in FIG. 117.

FIG. 119 is a figure displayed when "past analytics" is selected as FIG. 117. In addition, in the case of FIG. 117, "stability analytics", "popularity analysis", "satisfaction analytics", "life cycle analysis", and "security analytics" in the analytics menus are displayed, and "satisfaction analytics" is designated in these options, but FIG. 119 shows the case where "life cycle analysis" is selected. The image of the table of F12 corresponds to FIG. 14 described later, while the image of the table of F13 corresponds to FIG. 12 described later.

Figure 120:
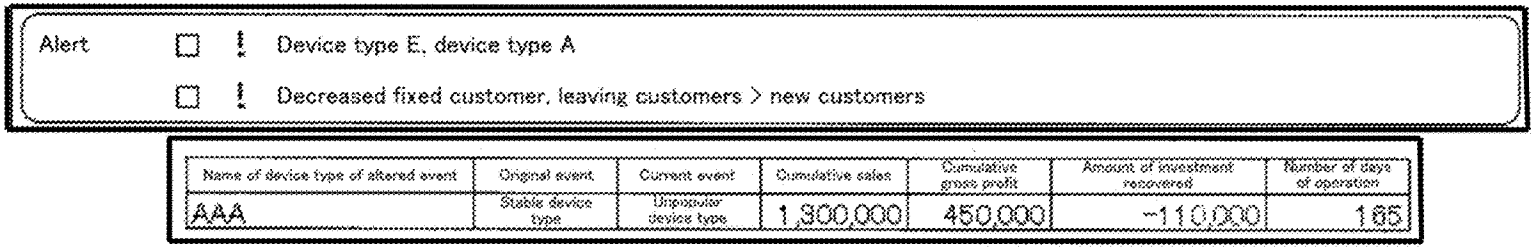

FIG. 120 is a figure which shows a display image displayed by designating the portion of "device type E device type A" of an alert indication portion of F13 of FIG. 119 with a pointer. When the portion of "device type E device type A" of the alert indication portion of the display screen which has been displayed in FIG. 119 is designated with the pointer, the details of the alert is displayed as in FIG. 120.

FIG. 121 is an explanatory view showing display screen data generated based on the data obtained from the analysis processing as analysis processing means shown in FIG. 1, and the data being displayed on the display screens of personal computers installed in the gaming facility and cellular phones connected via the internet and the like (not shown). This explanatory view is a figure displayed when "prediction analytics" is selected among "home", "real time analytics", and "past analytics", and "prediction analytics" displayed on the display screen. Predicted information in the future is displayed on this display screen. The displayed graph is so constituted that, depending on whether the user is authorized to see the graph identified by the ID and password inputted before opening the display screen, the controller of the server determines whether or not to indicate a designation button image of the graph to be displayed.

FIGS. 109 to 121 show explanation relating to the display screens outputted in the game playing information integration system of the present invention. In the present invention, visually unskilled managers or operators can make business judgment more accurately and easily by devising the forms of display of these display screens. More specifically, in a conventional manner, business judgments have been made based on the experience in the past while looking at a plurality of tables and the like represented by numerical values, but information can be indicated not by numerical values but by visual indication so that denominations can be changed in real time as described above. Such methods of changing the denominations of the game in real time allow easily changes of denominations in these days that game programs for the game units are changeable by downloading in most gaming facilities. Conversely, it can be thus said that the orientation of visitors, past data, and real-time information whether there are many high rollers have increased the possibility of performing controls to suitably change game programs executed on all gaming machine unit in the gaming facility and increase the operational state.

While the embodiments of the present invention have been described hereinbefore, these embodiments are merely exemplified as specific examples, and do not limit the present invention in particular, and specific features of means or the like can be appropriately changed in design. In addition, the advantageous effects described in the embodiments of the present invention are merely enumerated as the most preferred advantageous effects derived from the present invention, and the advantageous effects according to the present invention are not limited to those described in the embodiments of the present invention.

In addition, in the foregoing detailed description, characterizing portions have been mainly set forth so as to understand the present invention more easily. The present invention is not limited to the embodiments set forth in the foregoing detailed description, and can be applied to other embodiments, and its applicable scope is various. Further, the terms and expressions used in the present specification are intended to appropriately describe the present invention, and is not intended to limit the interpretation of the present invention. In addition, in view of the concept of the invention described in the present specification, it would have been obvious to one skilled in the art to conceive other features, systems, and methods or the like included in the concept of the present invention. Therefore, recitations of the claims must be regarded to be inclusive of equivalent features from deviating from the scope of technical idea of the present invention. Furthermore, an object of Abstract is for patent office and its related general public organizations or engineers or the like belonging to the technical field, which are familiar with patent, legal terms or terminologies to be able to readily determine the technical contents of the present application and its essence in simplified search. Accordingly, the Abstract is not intended to limit the scope of the invention to be evaluated by the recitations of the claims. Moreover, it is desired that object(s) of the present invention and advantageous effect(s) specific to the present invention be construed in full consideration of the already disclosed literature or the like in order to fully understand them.

The foregoing detailed description includes processing executed by computer. The above statements and expressions are set forth for one skilled in the art to understand them most effectively. In the present specification, each of the steps employed to derive a result is to be understood as processing free of self-contradiction. In addition, in each of the steps, an electric or magnetic signal is transmitted and received, recorded, and so on. In the processing in each of the steps, such a signal is expressed by way of bit, value, symbol, character, term, and numeral or the like, it should be kept in mind that these expressions are employed for the sake of clarity. In addition, while the processing in each of the steps may be described in expression common to human act, the processing described in the present specification is executed by means of a variety of devices in principle. Further, other features required to perform each of the steps would have been self-evident from the foregoing description.

INDUSTRIAL APPLICABILITY

A game playing information integration system which outputs the operation state of game units installed in a gaming facility, the proportions of visitors by type, and the trends of the greatest common preferences of visitors seen from the proportion and other information so that such information can be grasped in real time, and provides useful information for appropriately managing the operation and management of the gaming facility while achieving greater harmony of players and the gaming facility (shop) can be provided.

EXPLANATION OF REFERENCE NUMERALS

IS Game playing information integration system
1 Gaming machine unit
10 Pachinko gaming machine
20 Gaming medium lending device
30 Individual counting device
40 Employee management server
41 Portable terminal device
50, 2050 IC card servers
60, 2060 Hall conservers
70, 2070 Member management servers
80 POS server
90 Number lamp display server
91 Game information by gaming machine display device (display)
1001 Gaming machine

The invention claimed is:

1. A game-playing-information-integration system comprising:

a plurality of gaming machine units; and a server connected to enable communication with each of the gaming machine units, wherein each of the gaming machine units comprises:

a player identifier which ascertains player identification information and which outputs the read player identification information; and a game execution data output device which outputs to the server predetermined data by the execution of game, wherein the gaming machine unit identification information is individually assigned to each of the gaming machine units, wherein the server comprises:

a data storage device which stores the player identification information, the predetermined data outputted by the game execution data output device, and reception time data indicating reception time of the predetermined data in association with each other;

an analysis processor which analyzes data received from the gaming machine unit and stored in the data storage device; and an output device which produces image data depending on the results analyzed by the analysis processor and outputs the data to an external portion, and wherein, based on data stored in the data storage device, the analysis processor produces data relating to at least the values (x) and (y), as follows:

(x) a cumulative value of the predetermined data of each player at the gaming machine unit, and (y) a cumulative value of cumulative number of visitors by the type of players classified into player identification information of each player at the gaming machine unit, and wherein the output device executes by the analysis processor, based on the values (x) and (y), a process of editing a map layout indication image showing a state that the gaming machine units are disposed in the gaming facility to change based on a cumulative value of the predetermined data, outputting the edited map layout information to indicate, and a process of generating and outputting a graph image based on the cumulative value of the number of visitors by the type of players classified in the player identification information in advance.

2. The game-playing-information-integration system according to claim 1, wherein a processing of producing and outputting a graph image based on the cumulative value (x) obtained by the analysis processor is executed.

* * * * *